US009115710B2

(12) United States Patent
McNichol et al.

(10) Patent No.: US 9,115,710 B2
(45) Date of Patent: Aug. 25, 2015

(54) COAXIAL PUMPING APPARATUS WITH INTERNAL POWER FLUID COLUMN

(71) Applicant: Hydro Pacific Pumps Inc., Surrey (CA)

(72) Inventors: Richard F. McNichol, Surrey (CA); Alexandre Eroujenets, Pitt Meadows (CA); Norm Fisher, Courtenay (CA); Lucas van den Berg, Vancouver (CA); Gordon Bryce, White Rock (CA)

(73) Assignee: Richard F. McNichol, Surrey (CA)

( * ) Notice: Subject to any disclaimer, the term of this patent is extended or adjusted under 35 U.S.C. 154(b) by 147 days.

(21) Appl. No.: 13/837,326

(22) Filed: Mar. 15, 2013

(65) Prior Publication Data

US 2013/0287597 A1 Oct. 31, 2013

Related U.S. Application Data

(63) Continuation-in-part of application No. 12/023,016, filed on Jan. 30, 2008, now Pat. No. 8,454,325, which is a continuation-in-part of application No. 13/169,243, filed on Jun. 27, 2011, now Pat. No. 8,535,017, which is a continuation of application No. 10/587,903, filed as application No. PCT/CA2005/000096 on Jan. 27, 2005, now Pat. No. 7,967,578, which is a continuation-in-part of application No. 10/765,979, filed on Jan. 29, 2004, now abandoned.

(60) Provisional application No. 60/898,377, filed on Jan. 30, 2007.

(51) Int. Cl.
*F04B 47/08* (2006.01)

(52) U.S. Cl.
CPC ..... *F04B 47/08* (2013.01)

(58) Field of Classification Search
CPC ..... F04B 47/00; F04B 47/06; F04B 47/08
USPC ..... 417/374, 399, 401
See application file for complete search history.

(56) References Cited

U.S. PATENT DOCUMENTS

| | | | |
|---|---|---|---|
| 1,532,231 | A | 4/1925 | Corey |
| 1,907,948 | A | 5/1933 | Gage |
| 1,981,288 | A | 11/1934 | Evans |
| 2,014,613 | A | 9/1935 | Ceverha |

(Continued)

FOREIGN PATENT DOCUMENTS

| | | |
|---|---|---|
| AU | 2005207990 | 8/2005 |
| AU | 2011201523 | 4/2011 |

(Continued)

OTHER PUBLICATIONS

Office Action issued on Jan. 21, 2014 for Canadian Patent Application No. 2,676,847.

(Continued)

*Primary Examiner* — Charles Freay
*Assistant Examiner* — Philip Stimpert
(74) *Attorney, Agent, or Firm* — Knobbe Martens Olson & Bear, LLP

(57) ABSTRACT

The present application relates generally to pumps, and more particularly to piston type pumps having increased energy efficiency, systems incorporating such piston type pumps, and methods of operating piston type pumps.

16 Claims, 42 Drawing Sheets

(56) References Cited

U.S. PATENT DOCUMENTS

| | | | | |
|---|---|---|---|---|
| 2,174,114 | A | 9/1939 | Will | |
| 2,342,855 | A | 2/1944 | Green | |
| 2,376,538 | A | 5/1945 | Hardey | |
| 2,490,118 | A | 12/1949 | Dickinson | |
| 2,817,298 | A | 12/1957 | Bloudoff | |
| 2,942,552 | A | 6/1960 | Wayt | |
| 2,949,857 | A | 8/1960 | Coberly | |
| 3,135,210 | A | 6/1964 | English | |
| 4,026,661 | A * | 5/1977 | Roeder | 417/53 |
| 4,219,311 | A | 8/1980 | Simon | |
| 4,421,463 | A | 12/1983 | Lee | |
| 4,462,763 | A | 7/1984 | MacLeod | |
| 4,473,340 | A | 9/1984 | Walsworth | |
| 4,551,075 | A | 11/1985 | Canalizo | |
| 4,778,355 | A | 10/1988 | Holland | |
| 5,145,332 | A * | 9/1992 | Bohon | 417/390 |
| 5,188,517 | A | 2/1993 | Koster | |
| 5,337,565 | A | 8/1994 | Meixner | |
| 1,616,744 | A | 8/1997 | Warren | |
| 5,785,500 | A | 7/1998 | Leniek | |
| 5,984,642 | A | 11/1999 | Danielsson | |
| 6,193,476 | B1 | 2/2001 | Sweeney | |
| 7,967,578 | B2 | 6/2011 | McNichol | |
| 2003/0037544 | A1 * | 2/2003 | Armstrong | 60/413 |
| 2005/0169776 | A1 | 8/2005 | McNichol | |
| 2005/0249613 | A1 * | 11/2005 | Jordan et al. | 417/390 |
| 2006/0000616 | A1 | 1/2006 | Crawford | |
| 2007/0172364 | A1 | 7/2007 | McNichol | |
| 2008/0219869 | A1 | 9/2008 | Fisher et al. | |
| 2011/0255997 | A1 | 10/2011 | McNichol | |

FOREIGN PATENT DOCUMENTS

| | | |
|---|---|---|
| CA | 1041371 | 10/1978 |
| CA | 1057121 | 6/1979 |
| CA | 1198315 | 12/1985 |
| CA | 2299486 | 6/2004 |
| CA | 2554856 | 12/2009 |
| EP | 17140310 | 12/2009 |
| FR | 2 545 886 | 11/1984 |
| GB | 631 521 | 11/1949 |
| HK | 1098186 | 5/2010 |
| MX | PA06008420 | 10/2010 |
| RU | 2362050 | 7/2009 |
| WO | WO 84/01002 | 3/1984 |
| WO | WO 2005/073555 | 8/2005 |
| WO | WO 2008/092266 | 7/2008 |

OTHER PUBLICATIONS

Supplementary European Search Report for EP 05706422.2 dated Mar. 15, 2007.
PCT International Search Report and the Written Opinion in PCT/CA2008/000206 issued Apr. 30, 2008.
PCT International Preliminary Report on Patentability in PCT/CA2008/000206 issued Aug. 4, 2009.
PCT Written Opinion in PCT/CA2005/000096 issued May 19, 2005.
PCT International Search Report in PCT/CA2005/000096 issued Mar. 16, 2005.
PCT IPRP in PCT/CA2005/000096 issued Nov. 28, 2005.
Notice of Intention to Grant dated Jun. 24, 2009 in European patent application No. 05706422.2.
Applicant's Response to Official Action dated Nov. 29, 2007 in European patent application No. 05706422.2.
Official Action dated May 21, 2007 in European patent application No. 05706422.2.
Notice of Allowance dated Jul. 9, 2009 in Canadian patent application No. 2554856.
Applicant's Response to Official Action dated Feb. 6, 2009 in Canadian patent application No. 2554856.
Official Action dated Aug. 6, 2008 in Canadian patent application No. 2554856.
Notice of Acceptance dated Jan. 15, 2009 and English translation in Russian patent application No. 2006130682.
Notice of Allowance dated Aug. 31, 2010 in Mexican patent application No. PA/a/2006/008420.
Applicant's Response to Official Action dated Aug. 13, 2010 in Mexican patent application No. PA/a/2006/008420.
Official Action dated Mar. 30, 2010 in Mexican patent application No. PA/a/2006/008420.
Applicant's Response to Official Action dated Dec. 17, 2009 in Mexican patent application No. PA/a/2006/008420.
Official Action dated Oct. 8, 2009 in Mexican patent application No. PA/a/2006/008420.
Applicant's Response to Official Action dated Sep. 9, 2009 in Mexican patent application No. PA/a/2006/008420.
Official Action dated Jul. 16, 2009 in Mexican patent application No. PA/a/2006/008420.
Applicant's Response to Official Action dated Apr. 1, 2009 in Mexican patent application No. PA/a/2006/008420.
Official Action dated Jan. 29, 2009 in Mexican patent application No. PA/a/2006/008420.
Office Action dated Oct. 2, 2009 in Australian patent application No. 2005207990.
Office Action dated Oct. 5, 2010 and English translation in Japanese patent application No. 2006-549817.

* cited by examiner

COAXIAL PUMPING APPARATUS WITH INTERNAL POWER FLUID COLUMN

INCORPORATION BY REFERENCE TO RELATED APPLICATIONS

Any and all priority claims identified in the Application Data Sheet, or any correction thereto, are hereby incorporated by reference under 37 CFR 1.57. This application is a continuation-in-part of U.S. application Ser. No. 12/023,016, filed Jan. 30, 2008, which claims the benefit under 35 U.S.C. §119(e) of U.S. provisional application Ser. No. 60/898,377, filed Jan. 30, 2007. This application is a continuation-in-part of U.S. application Ser. No. 13/169,243, filed Jun. 27, 2011, which is a continuation of U.S. patent application Ser. No. 10/587,903, filed Jul. 28, 2006, which is the National Stage of PCT International Application of PCT/CA05/00096, filed on Jan. 27, 2005, which is a continuation-in-part of U.S. patent application Ser. No. 10/765,979, filed on Jan. 29, 2004. The disclosures of the above-referenced applications are hereby expressly incorporated by reference in their entirety and are hereby expressly made a portion of this application.

FIELD OF THE INVENTION

The present application relates generally to pumps, and more particularly to piston type pumps having increased energy efficiency, systems incorporating such piston type pumps, and methods of operating piston type pumps.

BACKGROUND OF THE INVENTION

It has been estimated that approximately 85% of the total cost of operating a conventional pump is attributable to energy consumption. Pumping systems account for nearly 20% of the world's electrical energy demand and range from 25% to 50% of the energy required by industrial plant operations.

Similarly, maintenance costs account for approximately 10% of the total cost of operating a conventional pump.

Pumping liquids against substantial hydraulic heads is a problem encountered in pumping out mines, deep wells, and similar applications such as pumping water back up, over a hydro dam during low energy usage periods, for subsequent recovery during high energy usage periods, and for run-of-the-river hydro power applications utilizing the potential energy of water in a standing column.

Several earlier patents attempt to provide devices which utilize a piston type pump where energy is recovered from a column of liquid acting downwardly on the piston, as the piston moves downwardly, to assist in subsequently raising the piston with a volume of liquid to be pumped upwardly. An example of such an earlier patent is U.S. Pat. No. 6,193,476 to Sweeney. However such earlier devices have not been efficient enough to justify commercial usage. In the Sweeney patent, for example, the efficiency of the apparatus is significantly reduced due to the upper piston 38 having the same cross-sectional area as lower piston 43. Thus the pressure of liquid acting upwardly on the lower piston 43 inhibits downward movement of the upper piston 38 under the weight of the liquid in the cylinder above.

SUMMARY OF THE INVENTION

It is an object to the invention to provide an improved pumping apparatus capable of pumping liquids against significant hydraulic heads, such as encountered in deep wells or in pumping out mines, without requiring pumps with high output heads.

It is a further object of the invention to provide an improved piston type pumping apparatus with provision for energy recovery or energy conservation, having significantly improved efficiency compared with prior art devices.

It is still further object of the invention to provide an improved piston type pumping apparatus which is simple and rugged in construction, and efficient to operate and install.

BRIEF DESCRIPTION OF THE DRAWINGS

Features of the present disclosure will become more fully apparent from the following description and appended claims, taken in conjunction with the accompanying drawings. It will be understood these drawings depict only certain embodiments in accordance with the disclosure and, therefore, are not to be considered limiting of its scope; the disclosure will be described with additional specificity and detail through use of the accompanying drawings. An apparatus, system or method according to some of the described embodiments can have several aspects, no single one of which necessarily is solely responsible for the desirable attributes of the apparatus, system or method. After considering this discussion, and particularly after reading the section entitled "Detailed Description of the Preferred Embodiment" one will understand how illustrated features serve to explain certain principles of the present disclosure.

DETAILED DESCRIPTION OF THE PREFERRED EMBODIMENT

Figure 1:
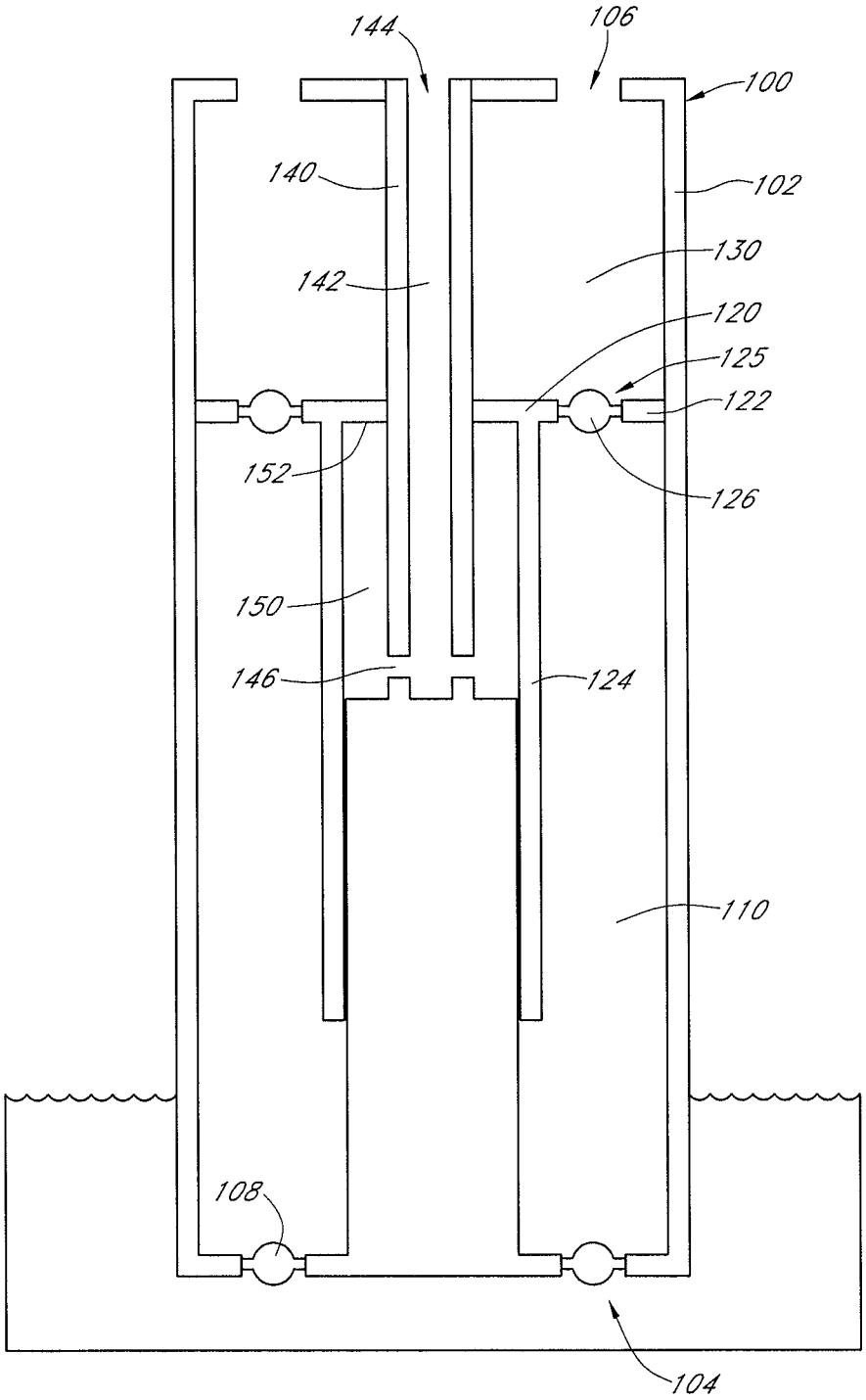
FIG. 1 provides a cross-sectional view of a vertically oriented pump including a pump housing, an inlet near the bottom of the pump, and an outlet near the top of the pump.

In the following detailed description, only certain exemplary embodiments have been shown and described, simply by way of illustration. As those skilled in the art would realize, the described embodiments may be modified in various different ways, all without departing from the spirit or scope of the present disclosure. Accordingly, the drawings and description are to be regarded as illustrative in nature and not restrictive. In addition, when an element is referred to as being "on" another element, it can be directly on the another element or be indirectly on the another element with one or more intervening elements interposed therebetween. Also, when an element is referred to as being "connected to" another element, it can be directly connected to the another element or be indirectly connected to the another element with one or more intervening elements interposed therebetween. Hereinafter, embodiments of the disclosure will be described with reference to the attached drawings. If there is no particular definition or mention, terms that indicate directions used to describe the disclosure are based on the state shown in the drawings. Further, the same reference numerals indicate the same members in the embodiments.

FIG. 1 illustrates an embodiment of a pumping apparatus of a preferred embodiment. The vertically oriented pump 100 preferably includes a pump housing 102, at least one inlet 104 near the bottom of the pump 100, and at least one outlet 106 near the top of the pump 100. The pump inlet 104 includes a valve 108. The valve 108 is preferably a one-way valve, allowing fluid to flow through the inlet 104 into a transfer chamber 110 inside the pump 100, but not in the reverse direction. More preferably, the inlet valve 108 is a self-actuating valve, such that it requires no electronic or manual control, but rather opens and closes solely by the force of the fluid moving therethrough and/or by pressure changes in the transfer chamber 110. In such embodiments, any suitable type of one-way valve can be utilized, including check valves and the like.

Check valves are valves that permit fluid to flow in only one direction. Ball check valves contain a ball that sits freely above a seat, which has only one opening therethrough. The ball has a diameter that is larger than the diameter of the opening. When the pressure behind the seat exceeds the pressure above the ball, liquid is allowed to flow through the valve; however, once the pressure above the ball exceeds the pressure below the seat, the ball returns to rest in the seat, forming a seal that prevents backflow. The ball can also be connected to a spring or other alignment device. Such alignment devices are useful if the pump operates in a non-vertical orientation. In some embodiments, the ball can be replaced by another shape, such as a cone.

Swing check valves can also be utilized. Swing check valves use a hinged disc that swings open with the flow. Any other suitable type of check valve, including dual flap check valves and lift check valves, can also be utilized. Numerous other types of valves can be utilized, including reed valves, diaphragm valves. The valves can optionally be electronically controlled. Using standard computer process control techniques, such as those known in the art, the opening and closing of each valve can be automated. In such embodiments, two-way valves can advantageously be utilized.

Any suitable number of inlets and outlets can be employed, for example, 1, 2, 3, 4, 5, or more inlets, and 1, 2, 3, 4, 5, or more outlets. Preferably three (3) inlets and three (3) outlets are employed.

The pump can be of any suitable size. The preferred size can be selected based upon various factors such as the amount of liquid to be pumped, the type of liquid, and other factors. For example, the pump housing can have a diameter of 1, 3, 6, 12, 24, or 36 inches or more. In a preferred embodiment, the pump housing 102 has an outer diameter of about 3.5 inches. In another preferred embodiment, the pump housing 102 has an outer diameter of about 1.5 inches.

The pump 100 also includes a transfer piston 120, which is reciprocatingly mounted therein. The transfer piston 120 typically includes a piston portion 122 and a rod portion 124. The piston portion 122 includes a channel 125 and a valve 126, which is referred to herein as the "transfer piston valve." Preferably, the transfer piston valve 126 is a one-way valve, allowing fluid to flow from the transfer chamber 110 into a product cylinder 130, but not in the reverse direction from the product cylinder 130 to the transfer chamber 110.

The pump 100 also includes a vertically oriented power fluid column 140, which defines a power fluid tube 142. The power fluid column can be oriented in any suitable manner, and is not limited to a vertical orientation. For example, the power fluid column can be horizontal, or at any angle displaced from the vertical. In addition, the pump 100 can operate at any angle, including vertical, horizontal, or any angle therebetween. The power fluid tube comprises an inlet 144 such that power fluid can be provided to and/or removed from the power fluid tube 142.

The power fluid column 140 further includes at least one passageway 146. In preferred embodiments, the power fluid column includes 1, 2, 3, 4, 5, 6 or more passageways. This passageway 146 allows power fluid to flow freely between the power fluid tube 142 and a power fluid chamber 150. Preferably, the passageway 146 is located near the bottom of the power fluid tube 142.

In the embodiment illustrated in FIG. 1, the power fluid chamber 150 is defined by the exterior surface of the power fluid column 140 and the transfer piston 120. The power fluid chamber 150 has a top 152, also referred to herein as the "inner surface area." In the embodiment illustrated in FIG. 1, the inner surface area 152 is a portion of the bottom of the piston portion 122 of the transfer piston 120. The inner surface area 152 is the surface area upon which the power fluid acts. The passageway 146 through which the power fluid enters the power fluid chamber 150 is located below the inner surface area 152.

To enclose the power fluid chamber 150, the rod portion 124 of the transfer piston 130 extends coaxially about the power fluid column 140. The shape of the power fluid column 140 and the transfer piston 120 are chosen such that they form a slideable seal both at the top and the bottom of the power fluid chamber 150. For example, in the embodiment illustrated in FIG. 1, the power fluid column 140 increases in diameter to form a slidingly sealable engagement with the rod portion 124 of the transfer piston 120 at the bottom of the power fluid chamber 150, thereby ensuring a secure power fluid chamber 150. The spacing between components, such as between the power fluid column 140 and the rod portion 124, is typically determined by the seal utilized. The type of seal utilized is determined by the operating conditions (i.e. pressure and temperature) and the fluids utilized. In a preferred embodiment, a standard o-ring seal is utilized. In high temperature applications, a ring such as those used in automobile pistons can be utilized.

FIG. 1 is a simplified drawing of a pump of one preferred embodiment. Seals and other conventional elements are omitted from the drawing for purposes of illustration. Numerous modifications can be made to the embodiment illustrated in FIG. 1. As just one example, the piston portion 122 of the transfer piston 120 can alternatively be located at the bottom of the rod portion 124, rather than adjacent the top as illustrated in FIG. 1. In addition, the rod 124 and piston portions 122 can vary in shape and thickness. For example, the thickness of the piston portion 122 can be selected based on the pressure applied.

The operation of the pump illustrated in FIG. 1 is described in connection with pumping of oil from an oil well. However, the pumps of preferred embodiments are also suitable for pumping other liquids as well (e.g., ground water, subterranean liquids, brackish water, sea water, waste water, cooling water, gas, coolants, and the like).

The operating cycle of the pump 100 can be divided into two separate stages, referred to as the "production stroke" or "power stroke" and the "recovery stroke." During the production stroke, water is supplied under pressure through the power fluid inlet 144. This forces water down the power fluid tube 142, through the passageway 146, and into the power fluid chamber 150. The water acts on the inner surface area 152 to lift the transfer piston 120. As the transfer piston 120 lifts against the weight of the oil in the product cylinder 130, the transfer piston valve 126 closes. As the transfer piston 120 is lifted, the oil in the product cylinder 130 is forced out through the pump outlet 106. This oil can then be recovered by suitable means or apparatus, such as known in the art. For example, the outlet 106 can be connected to a pipe, which directs the oil to a desired location. Sometimes, the oil can be delivered to the wellhead, where the oil can be directed to separation and/or storage facilities. Storage facilities, when employed, can be either above ground or below ground. Where crude oil is recovered, the oil can be transferred to a refinery or refineries by pipeline, ship, barge, truck, or railroad. Where natural gas is recovered, the gas is typically transported to processing facilities by pipeline. Gas processing facilities are typically located nearby so impurities such as sulfur can be removed when possible. In cold climate applications, the oil can be transferred via heated lines.

As the transfer piston 120 is rising with the transfer piston valve 126 closed as described above, a vacuum, partial vacuum, or low pressure volume is created in the transfer chamber 110. The decrease in pressure in the transfer chamber 110 causes the inlet valve 108 to open and oil from the well is drawn into the transfer chamber 110 through the pump inlet 104.

The transfer piston 120 rises until the top of the transfer piston 120 contacts the top of the pump or, alternatively, until the force generated by the power fluid and acting on the inner surface area 152 equals the force generated by the weight of the oil in the product cylinder 130 plus the weight of the transfer piston 120. As the transfer piston 120 reaches the highest point (similar to top dead center for a piston in an engine), the product cylinder 130 is at its smallest volume and the transfer chamber 110 is at its largest volume. The inlet valve 108 is open, but the transfer piston valve 126 is closed.

As the transfer piston 120 reaches its highest point, the pressure of the power fluid is reduced until the downward force, provided by gravity acting on the weight of the oil in the product cylinder 130, the weight of the oil in the product pipeline above the pump, and the weight of the transfer piston, is greater than the upward force provided by the power fluid acting on the inner surface area. This causes the transfer piston 120 to fall, and initiates the recovery stroke. In some embodiments, the pressure of the power fluid can be reduced such that the power fluid chamber serves as a vacuum or partial vacuum, providing an additional force to lower the transfer piston 120. In some embodiments, the fluid in the product cylinder can be pumped to a higher elevation or into a pressure vessel to supply additional energy for the recovery stroke.

As the transfer piston 120 lowers, the pressure inside the transfer chamber 110 increases. The increase in pressure causes the inlet valve 108 to close, thereby sealing the pump inlet 104. Alternatively, sensors can be employed and the valves controlled electronically. As the pressure inside the transfer chamber 110 continues to increase due to the lowering transfer piston 120, the transfer piston valve 126 opens, thereby allowing oil located within the transfer chamber 110 to flow into the product cylinder 130. The transfer piston 120 continues to lower until the rod portion 124 of the transfer piston 120 contacts the bottom of the pump 100, or alternatively until the force generated by the power fluid equals the force generated by the weight of the oil and the weight of the transfer piston. Thereafter, power fluid is introduced under pressure, acting on the inner surface area 152 and initiating the production stroke.

The operation of the pump is maintained by providing an oscillating or periodic pressure to the power fluid. The power fluid can be any suitable fluid. In one embodiment, the power fluid is water; however, numerous other power fluids can be utilized, including but not limited to sea water, waste water from oil recovery processes, and product fluid (i.e. oil if the pump is being used in oil recovery processes). In other embodiments, the power fluid can be gas or steam. Thus, the term "fluid," as used herein, is not restricted to liquids, but is intended to have a broad meaning, including gases and vapors. In one embodiment, the power fluid is air. In another embodiment, the power fluid is steam.

The appropriate power fluid for a particular application can be based on a variety of factors, including cost and availability, corrosiveness, viscosity, density, and operating conditions. For example, the power fluid can be the same fluid as the product fluid. This allows the product fluid and the power fluid to have the same density, thereby simplifying the forces acting on the transfer piston. Alternatively, a more dense power fluid can be utilized. Utilizing a power fluid that is more dense than the product fluid allows the pump to operate with either (a) the power fluid supplied at a lower pressure, or (b) a smaller inner surface area. For example, in some embodiments, brine or mercury can be utilized. Preferably, a low-viscosity power fluid is utilized, as use of a high viscosity power fluid may cause pressure loss due to friction between the power fluid and the power fluid column.

In some embodiments, such as where the pump is utilized in high temperature applications, a power fluid such as motor oil can be utilized. Similarly, various oils and liquids with low freezing points can be utilized in cold environments.

The pump can be operated by one power source, or a number of pumps can be operated by the same power source. For example, in some applications such as construction, mine dewatering, or other commercial and industrial applications, several pumps can be operated by the same power source. In addition, several pumps can be operated using an air system, such as in a manufacturing facility.

The pump 100 and its components can be any suitable shape. The use of the terms column, chamber, tube, rod, and the like are not intended to limit the shape of the components. Rather, these terms are used solely to aid in describing particular embodiments. For example, with reference to FIG. 1, the pump housing 102 and power fluid column 140 can both be substantially cylindrical in shape. Thus, the piston portion 122 of the transfer piston 120 seals the annular gap between these two cylinders. However, the pumps of preferred embodiments are not limited to this configuration; the pump housing 102 can be any shape, and the power fluid column 140 can be any shape. For example, besides being formed in a circular shape, the pump components can also be square, rectangular, triangular, or elliptical.

The pump housing 102 and the pump components, such as the power fluid column 140 and the transfer piston 120, can be constructed of any suitable material. For example, in preferred embodiments, these components can be constructed of 304 or 316 stainless steel. In some embodiments, such as when the pump is in contact with highly corrosive materials, a 400 series stainless steel can be used. One of skill in the art will appreciate that selection of the pump materials depends on a variety of factors, including strength, corrosion resistance, and cost. In high temperature applications, pump components can preferably be constructed of ceramic, carbon fiber, or other heat resistant materials.

Referring still to FIG. 1, the upper surface of the transfer piston 120 defines an area $A_1$. This upper surface can be planar, but can also be concave, convex, or linearly sloping. The surface area $A_1$ supports the weight of the fluid in the product cylinder 130 and any standing column of fluid above the pump. That is, the fluid in the product cylinder 130 and in any vertical pump outlet pipes creates a downward force on the transfer piston 120. This downward force is equal to the mass of the product fluid multiplied by gravity, or alternatively, it is equal to the pressure of the product fluid in the product cylinder 130 multiplied by the surface area $A_1$. Gravity acting on the weight of the transfer piston 120 also creates a downwards force.

The bottom surface of the transfer piston 120 exposed to the fluid in the transfer chamber 110 also defines an area, $A_2$. $A_2$ is the surface area upon which the fluid in the transfer chamber acts. During the recovery stroke, the fluid in the transfer chamber 110 exerts an upwards force on the transfer piston equal to the pressure inside the transfer chamber 110 multiplied by the surface area $A_2$ upon which it acts. For the embodiment illustrated in FIG. 1, the difference between $A_1$ and $A_2$ represents the inner surface area, $A_3$, the area upon which the pressure fluid acts.

Therefore, if:

$P_1$=Pressure of product fluid in the product chamber 130

$A_1$=Area upon which fluid in the product chamber 130 acts $P_2$=Pressure of fluid in the transfer chamber 110

$A_2$=Area upon which fluid in the transfer chamber 110 acts $P_{pf}$=Pressure of power fluid in the power fluid chamber 150

$A_3=(A_1-A_2)$=Pressure upon which power fluid acts ("inner surface area")

T=Weight of the transfer piston

And ignoring any forces caused due to friction between the components and seals inside the pump, then:

$$\text{Force}_{down}=P_1A_1+T$$

$$\text{Force}_{up}=P_2A_2+P_{pf}A_3$$

Accordingly, changes to the values for $A_1$ and $A_2$ influence the amount of pressure required for the power fluid to lift the piston during the power stroke. The work required to lift the piston is determined by multiplying the force exerted by the power fluid by the distance the piston travels. Therefore, if S represents the distance the piston travels from its lowest position to its highest position, then the work ($W_{in}$) necessary to lift the piston is:

$$W_{in}=P_{pf}A_3S$$

Accordingly, the amount of work required is also impacted by the ratio of $A_1$:$A_3$, as is the pump's efficiency. In a preferred embodiment, the ratio of $A_1$:$A_3$ is from about 1.25 to about 4.

Figure 2:
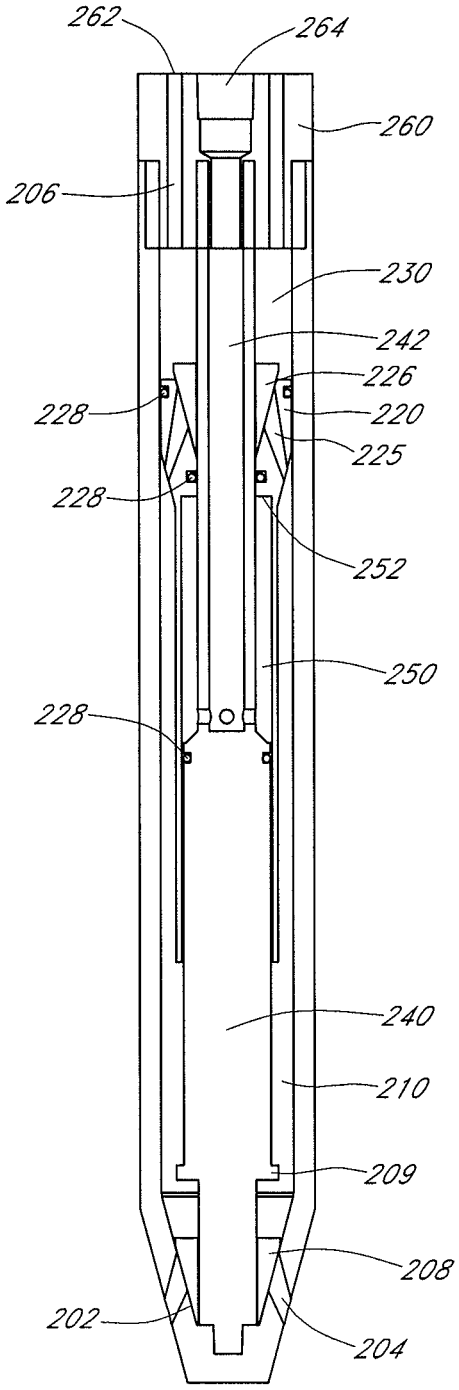
FIG. 2 provides a cross-sectional view of a pump having a tapered pump inlet.

FIG. 2 illustrates another embodiment of a pump. The pump is, in many respects, similar to the embodiment described above in connection with FIG. 1. As shown in FIG. 2, the pump inlet 204 is not located on the bottom of the pump 100, as illustrated in FIG. 1. The inlet 204 can be located at any point below the transfer piston valve 226. In a preferred embodiment, the inlet 204 is not located on the bottom of the pump housing 202, because when the pump is placed down a well, the bottom of the pump can rest on the ground beneath the fluid being pumped. Pump inlets on the bottom of the pump often become plugged. As illustrated in FIG. 2, the pump inlet 204 can be tapered such that the narrowest portion of the inlet is at the exterior of the pump housing 202. In a preferred embodiment, the inlet has a one-eighth inch external opening, and has an inwardly enlarging taper. This tapering of the inlet 204 prevents suspended particles from becoming lodged within the pump.

The embodiment illustrated in FIG. 2 provides one example of a one-way valve system that can be utilized. The inlet 204 comprises a hole or passageway, as illustrated. A conical check valve member 208 is located near the bottom of the power fluid column 240. As the pressure inside the transfer chamber 210 decreases, the check valve opens, allowing fluid to flow through the inlet 204 into the transfer chamber 210. The conical valve member 208 can rise up freely, or it can rise until it reaches a stop 209, as illustrated in FIG. 2. The valve member 208 can also be slideably coupled to the power fluid column 240.

As illustrated, the pump 200 is in the recovery stroke. The increased pressure inside the transfer chamber 210 has caused the inlet valve member 208 to lower. As illustrated, the valve member 208 has lowered and formed a sealing engagement with the interior surface of the pump housing 202 (often referred to as the valve "seat"), thereby preventing fluid from flowing out of the transfer chamber 210 through the inlet holes 204.

The embodiment illustrated in FIG. 2 also utilizes a conical check valve as the transfer piston valve 226. Any suitable type of one-way valve can be used, and any combination of valve types can be used for the pump inlet valve 208 and the transfer piston valve 226. As previously described, automated valves and two-way valves can also be utilized with appropriate controls. As described previously in connection with pump inlet valve 208, the conical portion of the transfer piston valve 226 can be slideably coupled to the power fluid column 240. The amount of travel the conical portion of the piston valve 226 has can be limited by a stop (not shown). In a preferred embodiment, the valves 208, 226 are spring loaded. In other embodiments, the valves can be guided by other mechanisms, or, alternatively, free of constraints.

In the embodiment illustrated in FIG. 2, the transfer piston 220 comprises a channel 225. The transfer piston channel 225 can also be tapered to prevent solid particles from being lodged therein. Any number of piston channels and valves can be utilized. For example, the transfer piston can include 1, 2, 3, 4, 5, or 6 or more channels and/or valves.

As illustrated, the pumping apparatus 200 is in the recovery stroke. The pressure inside the transfer chamber 210 is greater than the pressure inside the product cylinder 230, and the transfer piston valve 226 is open, allowing fluid to flow from the transfer chamber 210 into the product cylinder 230.

The embodiment illustrated in FIG. 2 employs a preferred method for sealing the transfer piston 220. Sealing mechanisms 228 are used to prevent fluid communication between the transfer chamber 210 and the product cylinder 230, and between the transfer piston 220 and the power fluid column 240 to ensure a secure power fluid chamber 250. Methods of creating and maintaining a seal are well known in the art, and any such suitable method of forming a seal can be utilized with the pumps provided herein. For example, rings formed of polyurethane or polytetrafluoroethylene (PTFE) can be used.

The embodiment illustrated in FIG. 2 further utilizes a top cap 260. The top cap 260 serves as a mechanism 264 for connecting the source of the power fluid to the power fluid tube 242. Any suitable connection mechanism, including those connection mechanisms as known in the art, can be employed. The top cap 260 also provides a mechanism 262 for connecting the pump outlet 206 to a recovery unit (not shown). For example, the top cap 260 can include threads to which a pump can be connected, or a seat to which a flanged pipe can be connected.

Figure 3:
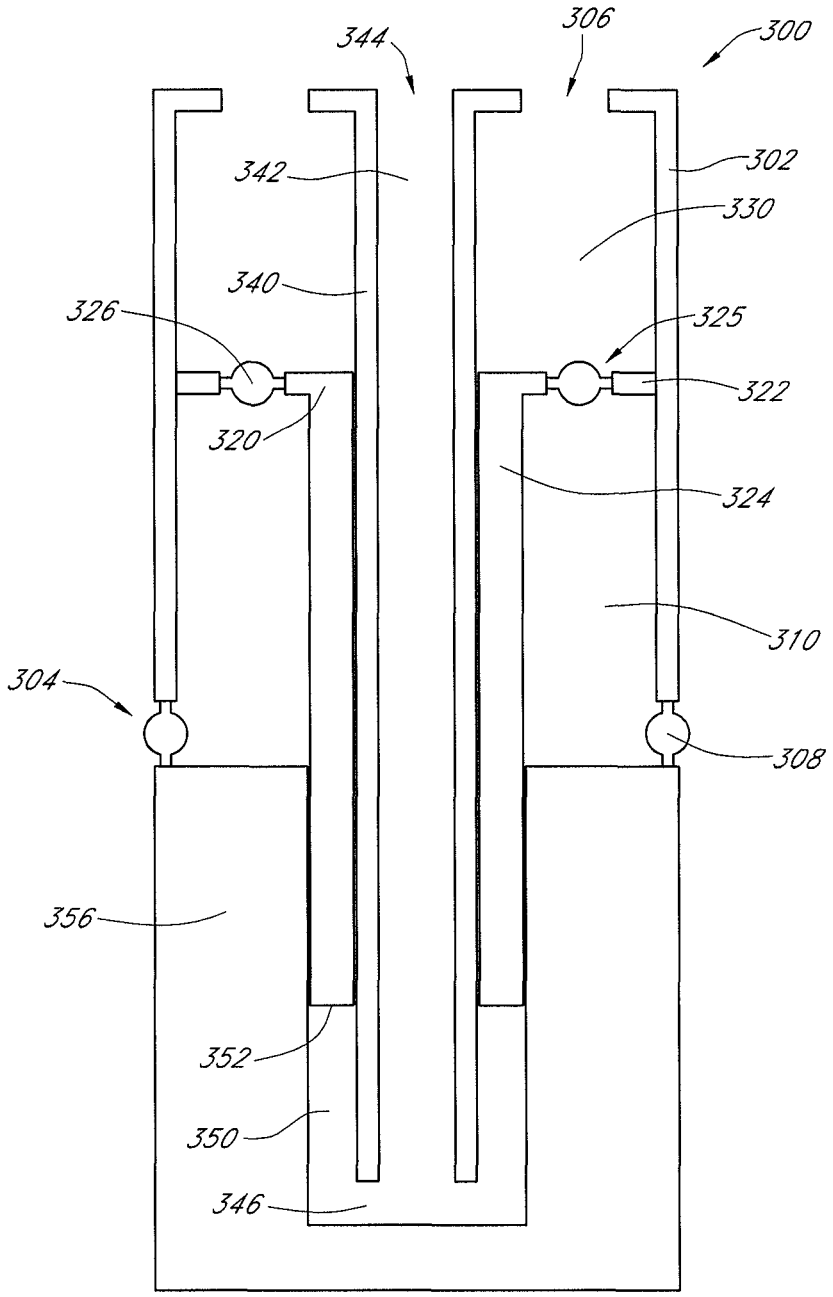
FIG. 3 provides a cross-sectional view of a pump wherein the power fluid acts on the bottom of the rod portion of the transfer piston.

FIG. 3 illustrates another embodiment of a pumping apparatus. The embodiment illustrated in FIG. 3 is similar in many respects to the embodiments illustrated in FIG. 1 and FIG. 2. However, the embodiment in FIG. 3 utilizes the bottom of the rod portion 324 of the transfer piston 320 as the inner surface area 352 upon which the power fluid acts. Accordingly, the power fluid chamber 350 is enclosed not only by the rod portion 324 of the transfer piston 320 and the power fluid column 340, but also by a third component, referred to herein as the power fluid containment portion 356. This containment portion 356, which provides an outer wall for the power fluid chamber 350, can be formed by increasing the thickness of the pump housing 302 below the inlet 304, as illustrated in FIG. 3. However, numerous other configurations and/or mechanisms can alternatively enclose the power fluid chamber. As an example, if the pump 300 has a 3 inch diameter, and the power fluid column 340 and power fluid chamber 350 have a combined diameter of 1.5 inches, then the pump housing 302 below the inlet 304 can be 1.5 inches thick. However, if the embodiment illustrated in FIG. 1 is utilized, and the transfer chamber occupies an additional 1 inch of the diameter, then the pump housing 302 can be only 0.5 inches thick.

The transfer piston 320, which is reciprocatingly mounted about the power fluid column 340, forms a slideable and sealing engagement with both the power fluid column 340 and the power fluid containment portion 356. The pump inlet 304, as illustrated in the embodiment in FIG. 3, is located above the power fluid containment portion 356 and the upper surface of the power fluid containment portion 356 serves as the base for the transfer chamber 310. However, the inlet 304 can alternatively extend through the power fluid containment portion 356.

Figure 4A:
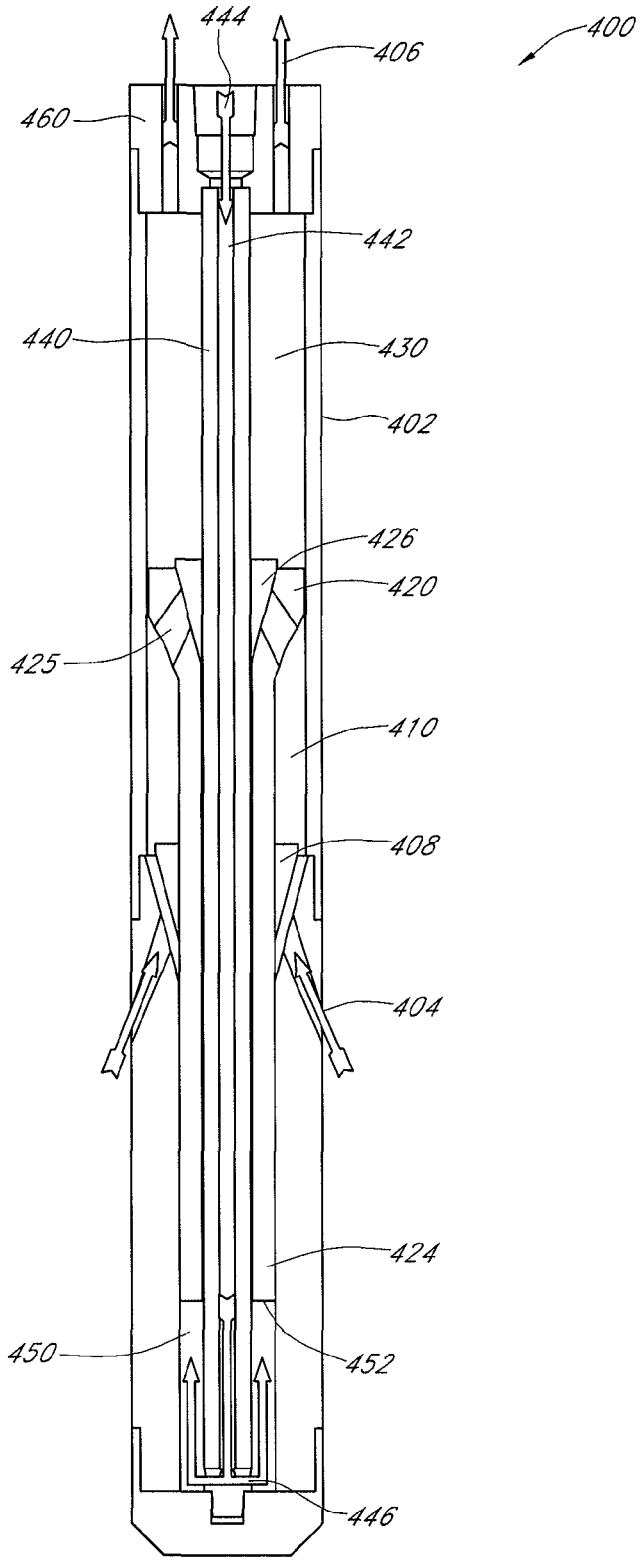
FIG. 4A provides a cross-sectional view of a pump during the production stroke.
Figure 4B:
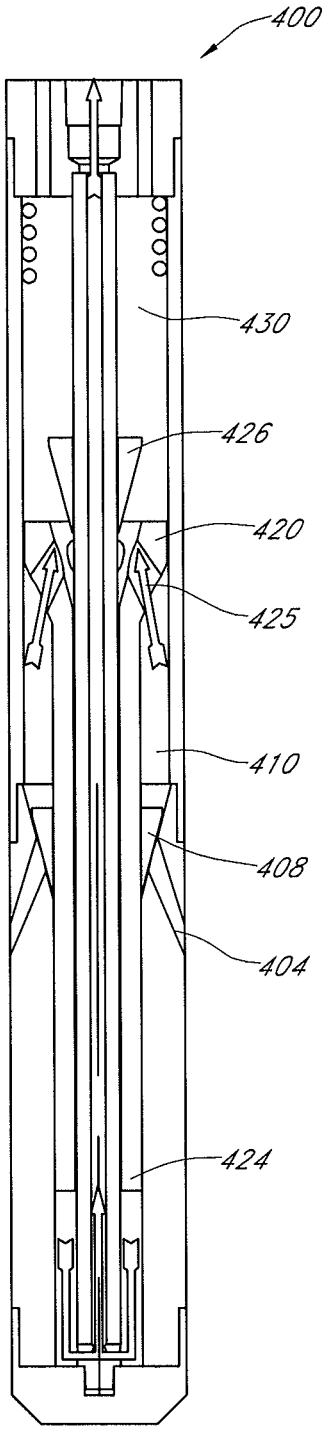
FIG. 4B provides a cross-sectional view of a pump during the recovery stroke.

FIG. 4A and FIG. 4B illustrate another embodiment of the pumping apparatus. In many ways, the embodiment illustrated in FIG. 4A and FIG. 4B is similar to the embodiment discussed above in connection with FIG. 3. FIG. 4A and FIG. 4B illustrate using conical check valves for both the inlet valve 408 and the transfer piston valve 426.

The embodiments illustrated in FIG. 3, FIG. 4A, and FIG. 4B operate in manner similar to those illustrated in FIG. 1 and FIG. 2. The operation of the pumps of embodiments illustrated in FIG. 4A and FIG. 4B is as follows. Pump dimensions and characteristics described herein are provided to aid in the description only, and are not meant to limit the scope of the application.

FIG. 4A represents one embodiment of a pump during the production stroke. The pump 400 can have any outer diameter, including 1, 1.5, 2, 3, 4, 6, 12, or 24 inches or more. The pump 400 can be any height. In a preferred embodiment, the outer diameter of the pump housing 402 is about 1.5 inches, and the power fluid column 440 is about 0.5 inches in diameter. The pump 400, measured from the bottom of the pump to the top of the top cap 460, is about 19 inches in height. The center of the inlet hole 404 is about 8 inches from the bottom of the pump. When the transfer piston 420 is at its lowest position, the height of the transfer chamber 410 is about 0.7 inches. The pump is placed in a well at a depth of about 1000 feet and both the product fluid and the power fluid are water.

The fluid in the product cylinder 430, and the standing column of water above the pump, exerts a pressure $P_1$ on the transfer piston 420. The downward force acting on the transfer piston 420 is equal to this pressure multiplied by the surface area of the piston upon which it acts, $A_1$. Gravity acting on the weight of the transfer piston 420 also creates a downwards force; however, because the piston of this embodiment is only about 1 to about 2 pounds, its effect may be negligible. The resistance R caused by the friction of the seals also exerts a downward force as the piston 420 is raised.

The force lifting the transfer piston 420 is equal to the power fluid pressure, $P_{pf}$, multiplied by the surface area upon which it acts, $A_3$. To lift the transfer piston, the force supplied by the power fluid must be greater than the downward force previously discussed. Therefore, the net force on the piston is given by:

$$F_{net}=F_{up}-F_{down}=P_{pf}A3-P_1A_1-R$$

Although the resistance of the seals can be considered it is ignored here to describe this embodiment. In some embodiments, the ratio of $A_1$ to $A_3$ is between about 1.25 and about 4. In a preferred embodiment, the ratio of $A_1$:$A_3$ is about 2:1. Therefore, $$F\text{net}=P_{pf}A_3-P_12A_3$$

In order for this net force to be positive, the pressure of the power fluid $P_{pf}$ must be at least twice as great as the pressure of the standing column, $P_1$. Since the pump is placed at a depth of about 1000 ft, $P_1$ is approximately 445 psi (pounds per square inch). The power fluid is supplied at least double this pressure, or 890 psi. Because the force exerted by the power fluid is proportional to its density, it can be seen that if a power fluid is utilized that is twice as dense as the water being pumped, the power fluid only needs to be supplied at 445 psi to raise the piston.

When power fluid is supplied at this pressure, the power fluid acts against the inner surface area 452, thereby causing the transfer piston 420 to rise. As the transfer piston 420 lifts against the weight of the fluid in the product chamber 430, the transfer piston valve 426 closes, thereby sealing the transfer piston channel 425. As the transfer piston 420 rises, the fluid in the product chamber 430 is forced out of the pump through the pump outlet 406.

As the transfer piston 420 rises with the transfer piston valve 426 closed, the pressure in the transfer chamber 410 decreases. The pressure drop inside the transfer chamber 410 causes the inlet valve 408 to open, thereby allowing fluid from the source to be drawn through the pump inlet 404 into the transfer chamber 410. As described previously, the inlet holes can be tapered to prevent debris from becoming lodged therein. As illustrated, the inlet valve 408 can be guided by, or alternatively slideably coupled to, the rod portion 424 of the transfer piston 420. The transfer piston 420 rises until the top of the transfer piston 420 reaches a predetermined stopping point, such as when the transfer piston hits the top cap 460, or alternatively until the force generated by the power fluid equals the force generated by the weight of the product fluid and the weight of the transfer piston 420. For the embodiment described above, the top of the piston stroke can be set by decreasing the pressure of the power fluid below 890 psi. When the transfer piston is at the top of its stroke, the transfer chamber is about 6.7 inches in height, resulting in a stroke length of about 6 inches.

Once the transfer piston 420 reaches its highest point, the recovery stroke begins. As illustrated in FIG. 4B, during the recovery stroke the pressure of the power fluid is reduced until the weight of the fluid in the product chamber 430 plus the weight of the transfer piston 420 is greater than the force provided by the power fluid and the fluid in the transfer chamber 410. This causes the transfer piston 420 to fall, thereby increasing the pressure of the trapped fluid in the transfer chamber 410. The increased pressure inside the transfer chamber 410 causes the inlet valve 408 to close and seal the pump inlet 404. As the pressure continues to increase inside the transfer chamber 410, it causes the transfer piston valve 426 to open, and fluid is forced from the transfer chamber 410 to the product chamber 430 via the transfer piston channel 425. Like the pump inlet holes, the transfer piston channel 425 can be tapered to prevent debris from becoming lodged therein. In some embodiments, the transfer piston channel 425 had a diameter that is larger than the diameter of the pump inlet holes, thereby allowing any particles that enter the inlet 404 to pass through the pump 400. The transfer piston 420 continues to fall until the bottom of the rod portion 424 of the transfer piston 420 contacts the bottom of the pumping apparatus, or alternatively until the upwards force generated by the power fluid and the fluid in the transfer chamber 410 equals the downwards force generated by both the weight of the fluid in the product chamber 430 and the weight of the transfer piston 420.

The speed at which the pump operates can be varied as desired. The time required for one "stroke," which is defined as the transfer piston 420 moving from its lowest position, through its highest position and returning to its lowest position, can be set by the operator. For the embodiment described above, wherein the outer diameter of the pump is about 1.5 inches, a preferred speed is about 6 strokes per minute, which provides a displaced volume of about three barrels per day. However, any range of speeds can be utilized depending upon the application. For example, in some embodiments, only one stroke per minute can be preferable. In other applications, speeds of 20 strokes per minute or more can be preferable. The volume of product fluid pumped is determined by the speed of the pump and the length of the stroke. Any suitable stroke length can be utilized, including 6, 12, 24, or 36 inches or more.

The operating cycle of the pump 400 is maintained by providing an oscillating pressure to the power fluid. This oscillating pressure can be provided by any suitable method, including a number of methods known in the art. Among such methods are those described below and those disclosed in United States Patent Publication No. 2005-0169776-A1, the contents of which are incorporated herein by reference in its entirety.

Figure 5A:
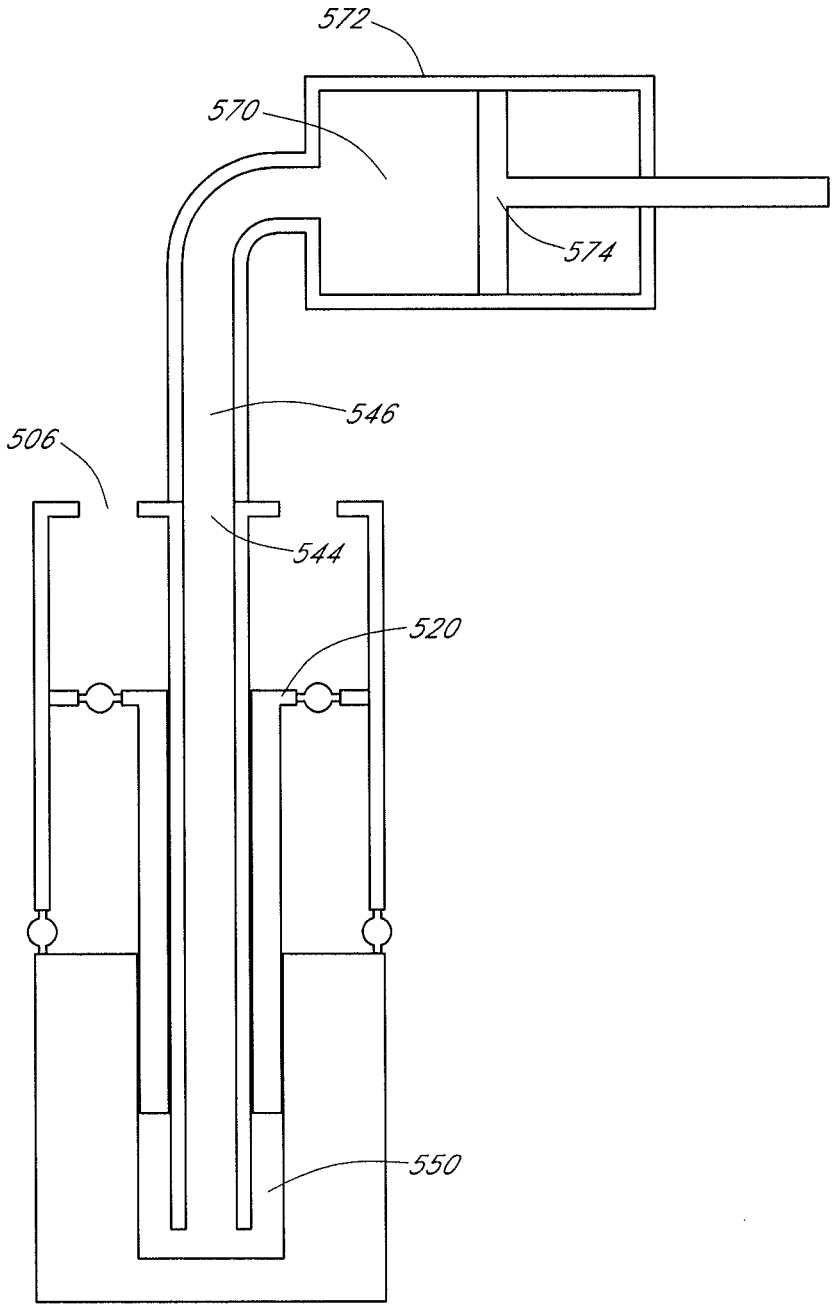
FIG. 5A provides a cross-sectional view of a pump wherein an oscillating pressure is provided by a piston and cylinder system.

For example, as illustrated in FIG. 5A, the oscillating pressure can be provided by a piston and cylinder system, wherein the piston is moved by a motor or engine with a crank mechanism, or a pneumatic or hydraulic device. These systems can be controlled manually, by an electronic timer, by a programmable logic controller ("PLC"), by computer, or by a pendulum. As illustrated in FIG. 5A, a conduit 546 delivers power fluid to the power fluid inlet 544 from a power fluid source 570. The power fluid source 570 comprises a cylinder 572 and a power fluid piston 574. During the power stroke, the power fluid piston 574 moves to the left, forcing power fluid from the power fluid cylinder 572, through the conduit 546, to the power fluid inlet 544. This increases the power fluid pressure inside the power fluid chamber 550, thereby lifting the transfer piston 520. During the recovery stroke, the power fluid piston 574 moves to the right. Power fluid is forced out of the power fluid chamber 550, and the transfer piston 520 lowers.

Figure 5B:
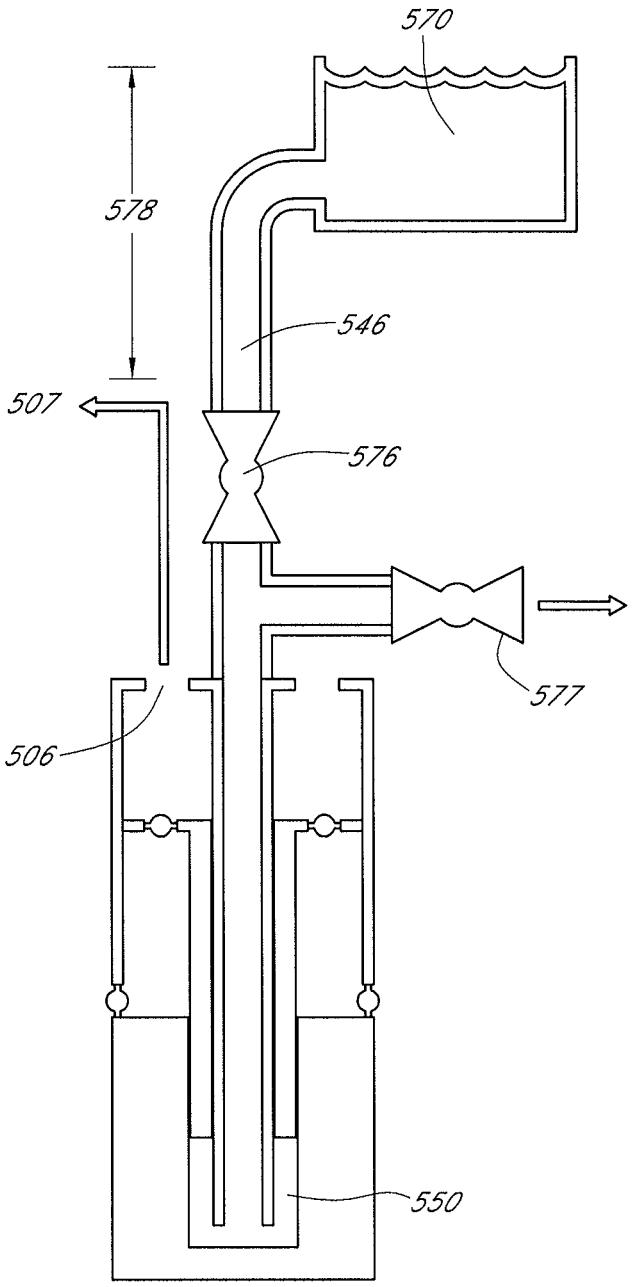
FIG. 5B provides a cross-sectional view of a pump wherein an oscillating pressure is provided by alternating the conduit valve and power release valve.

In some applications, the power fluid in the conduit 546 alone can provide substantial pressure to the power fluid chamber 550. As illustrated in FIG. 5B, the power source can be a fluid source stored at an elevation that is higher than that where the product fluid is recovered 507. The difference in elevation 578 provides a natural source of pressure. During the power stroke, a valve 576 in the conduit is opened, allowing power fluid to flow from the power fluid source 570, through the conduit 546, and into the power fluid chamber 550. The difference in elevation 578 alone can cause the transfer piston 520 to rise and pump fluid out of the pump outlet 506 at the recovery elevation 507.

During the recovery stroke, the conduit valve 576, which is located at an elevation that is lower than the recovery elevation 507, is closed and a power fluid release valve 577 is opened. The power fluid release valve 577 is at an elevation that is lower than the elevation of the conduit valve 576. The power fluid release valve 577 is at an elevation lower than the product fluid recovery elevation 507, and the pressure in the pump outlet line forces the transfer piston 520 down and power fluid drains from the power fluid release valve 577.

Accordingly, in the embodiment illustrated in FIG. 5B, the oscillating pressure is provided by alternating the conduit valve 576 and power fluid release valve 577. The differences in elevation can be selected depending on the relative densities of the power fluid and the product fluid.

In some embodiments, the pumping apparatus comprises a power fluid column internal to the product fluid. Such a design is advantageous because the power fluid can be supplied at a greater pressure without compromising the structural integrity of the column containing the power fluid. For example, if a pump is 3 inches in diameter, and if the power fluid column is external to the product fluid column, then the diameter of the power fluid column is 3 inches. Since the force (F) exerted by the power fluid on the wall of the power fluid column is determined by multiplying the pressure (P) of the power fluid by the surface area of the column, and the surface area of a cylinder is determined by multiplying the cylinder's circumference by its height, then the force on an externally placed power fluid column is:

$$F_{external}=\pi(\text{diameter})(\text{Pressure})(\text{height})=3P\pi(\text{height})$$

Assuming the same 3 inch diameter pump uses a 1 inch diameter internal power fluid column, the force on the power fluid column is:

$$F_{internal}=\pi(\text{diameter})(\text{pressure})(\text{height})=1P\pi(\text{height})$$

Assuming the height of the column is the same for each pump, the internally placed power fluid column exerts only one third of the force on the pump material when compared to the externally placed power fluid column. For a pump constructed with a material capable of sustaining a maximum force, the power fluid can be supplied at 3 times the pressure if the power fluid column is internal rather than external.

Similarly, the hoop stress for a thin walled cylinder is equal to the pressure inside the cylinder multiplied by the radius of the cylinder, divided by the wall thickness. Accordingly, as the radius increases, the hoop stress increases linearly. In applications that require the power fluid to be supplied at significant pressures, such as when pumping fluid from very deep wells, it is preferable to have an internal power fluid column. For example, for a water well at a depth of 10,000 feet, the power fluid can be supplied at a pressure of about 10,000 psi.

Below, Tables 1 through 20 include data compiled from the pumps of the present disclosure. In reference to the pipes of FIG. 5A and FIG. 5B, the data shows that the greater the diameter the conduit 546 the greater the (volume) required in the cylinder 572. The greater cylinder volume is required to compensate for the greater amount of fluid compression loss in the conduit 546. This fluid compression loss is linearly proportional to the volume of the fluid in the conduit 546 for any given drive pressure. Table 1 gives the bulk modulus value of typical hydraulic water-based fluids and volume of fluid within different conduit pipes for depths up to 4000 feet. Tables 2 through 10 illustrate the volumes of compression fluid losses for typical hydraulic water-based fluids for given conduits (546) at different depths. Table 2 illustrates the volume of fluid losses for a drive pressure of 500 psi. Table 3 illustrates the volume of fluid losses for a drive pressure of 750 psi, etc. These volumes of water-based hydraulic fluid losses must be compensated by a corresponding increase in volume of the drive cylinder (572). Table 11 gives the bulk modulus value of typical hydraulic oil-based fluids and volume of fluid within different conduit pipes for depths up to 4000 feet. Tables 12 through 20 illustrate the volumes of compression fluid losses for typical hydraulic oil-based fluids for given conduits (546) at different depths. Table 12 illustrates the volume of fluid losses for a drive pressure of 500 psi. Table 13 illustrates the volume of fluid losses for a drive pressure of 750 psi, etc. These volumes of oil-based hydraulic fluid losses must be compensated by a corresponding increase in volume of the drive cylinder (572).

TABLE 1

DATA for water
Bulk Modulus = (psi) 300000

| PIPE SIZE/SCHEDULE | OD (in) | OD AREA (in^2) | ID (in) | ID AREA (in^2) | WALL THCK (in) | VOL. @ DEPTH 500 (in^3) | VOL. @ DEPTH 750 (in^3) | VOL. @ DEPTH 1000 (in^3) | VOL. @ DEPTH 1250 (in^3) | VOL. @ DEPTH 1500 (in^3) |
|---|---|---|---|---|---|---|---|---|---|---|
| ⅛" SCH 40 | 0.405 | 0.129 | 0.269 | 0.057 | 0.068 | 340.8 | 511.2 | 681.6 | 852.1 | 1022.5 |
| ¼" SCH 40 | 0.540 | 0.229 | 0.364 | 0.104 | 0.088 | 624.1 | 936.1 | 1248.1 | 1560.1 | 1872.2 |
| ⅜" SCH 40 | 0.675 | 0.358 | 0.493 | 0.191 | 0.091 | 1144.8 | 1717.1 | 2289.5 | 2861.9 | 3434.3 |

TABLE 1-continued

DATA for water
Bulk Modulus = (psi) 300000

| | | | | | | | | | | |
|---|---|---|---|---|---|---|---|---|---|---|
| ½" SCH 40 | 0.840 | 0.554 | 0.622 | 0.304 | 0.109 | 1822.2 | 2733.3 | 3644.4 | 4555.6 | 5466.7 |
| ¾" SCH 40 | 1.050 | 0.865 | 0.824 | 0.533 | 0.113 | 3198.0 | 4797.0 | 6396.0 | 7994.9 | 9593.9 |
| 1" SCH 40 | 1.315 | 1.357 | 1.049 | 0.864 | 0.133 | 5182.9 | 7774.3 | 10365.8 | 12957.2 | 15548.7 |
| 1¼" SCH 40 | 1.660 | 2.163 | 1.380 | 1.495 | 0.140 | 8969.7 | 13454.6 | 17939.4 | 22424.3 | 26909.2 |
| 1½" SCH 40 | 1.900 | 2.834 | 1.610 | 2.035 | 0.145 | 12208.8 | 18313.2 | 24417.6 | 30522.0 | 36626.4 |
| ⅛" SCH 80 | 0.405 | 0.129 | 0.215 | 0.036 | 0.095 | 217.7 | 326.6 | 435.4 | 544.3 | 653.2 |
| ¼" SCH 80 | 0.540 | 0.229 | 0.302 | 0.072 | 0.119 | 429.6 | 644.4 | 859.1 | 1073.9 | 1288.7 |
| ⅜" SCH 80 | 0.675 | 0.358 | 0.423 | 0.140 | 0.126 | 842.8 | 1264.1 | 1685.5 | 2106.9 | 2528.3 |
| ½" SCH 80 | 0.840 | 0.554 | 0.546 | 0.234 | 0.147 | 1404.1 | 2106.2 | 2808.3 | 3510.3 | 4212.4 |
| ¾" SCH 80 | 1.050 | 0.865 | 0.742 | 0.432 | 0.154 | 2593.2 | 3889.7 | 5186.3 | 6482.9 | 7779.5 |
| 1" SCH 80 | 1.315 | 1.357 | 0.957 | 0.719 | 0.179 | 4313.6 | 6470.5 | 8627.3 | 10784.1 | 12940.9 |
| 1¼" SCH 80 | 1.660 | 2.163 | 1.278 | 1.282 | 0.191 | 7692.8 | 11539.2 | 15385.5 | 19231.9 | 23078.3 |
| 1½" SCH 80 | 1.900 | 2.834 | 1.500 | 1.766 | 0.200 | 10597.5 | 15896.3 | 21195.0 | 26493.8 | 31792.5 |
| ½" SCH 160 | 0.840 | 0.554 | 0.464 | 0.169 | 0.188 | 1014.0 | 1521.1 | 2028.1 | 2535.1 | 3042.1 |
| ¾" SCH 160 | 1.050 | 0.865 | 0.612 | 0.294 | 0.219 | 1764.1 | 2646.2 | 3528.2 | 4410.3 | 5292.3 |
| 1" SCH 160 | 1.315 | 1.357 | 0.815 | 0.521 | 0.250 | 3128.5 | 4692.7 | 6257.0 | 7821.2 | 9385.5 |
| 1¼" SCH 160 | 1.660 | 2.163 | 1.160 | 1.056 | 0.250 | 6337.8 | 9506.7 | 12675.6 | 15844.4 | 19013.3 |
| 1½" SCH 160 | 1.900 | 2.834 | 1.338 | 1.405 | 0.281 | 8432.0 | 12648.1 | 16864.1 | 21080.1 | 25296.1 |

| PIPE SIZE/SCHEDULE | OD (in) | OD AREA (in^2) | ID (in) | ID AREA (in^2) | WALL THCK (in) | VOL. @ DEPTH 1750 (in^3) | VOL. @ DEPTH 2000 (in^3) | VOL. @ DEPTH 2250 (in^3) | VOL. @ DEPTH 2500 (in^3) | VOL. @ DEPTH 2750 (in^3) |
|---|---|---|---|---|---|---|---|---|---|---|
| ⅛" SCH 40 | 0.405 | 0.129 | 0.269 | 0.057 | 0.068 | 1192.9 | 1363.3 | 1533.7 | 1704.1 | 1874.5 |
| ¼" SCH 40 | 0.540 | 0.229 | 0.364 | 0.104 | 0.088 | 2184.2 | 2496.2 | 2808.3 | 3120.3 | 3432.3 |
| ⅜" SCH 40 | 0.675 | 0.358 | 0.493 | 0.191 | 0.091 | 4006.7 | 4579.0 | 5151.4 | 5723.8 | 6296.2 |
| ½" SCH 40 | 0.840 | 0.554 | 0.622 | 0.304 | 0.109 | 6377.8 | 7288.9 | 8200.0 | 9111.1 | 10022.2 |
| ¾" SCH 40 | 1.050 | 0.865 | 0.824 | 0.533 | 0.113 | 11192.9 | 12791.9 | 14390.9 | 15989.9 | 17588.9 |
| 1" SCH 40 | 1.315 | 1.357 | 1.049 | 0.864 | 0.133 | 18140.1 | 20731.6 | 23323.0 | 25914.4 | 28505.9 |
| 1¼" SCH 40 | 1.660 | 2.163 | 1.380 | 1.495 | 0.140 | 31394.0 | 35878.9 | 40363.8 | 44848.6 | 49333.5 |
| 1½" SCH 40 | 1.900 | 2.834 | 1.610 | 2.035 | 0.145 | 42730.8 | 48835.2 | 54939.6 | 61044.0 | 67148.4 |
| ⅛" SCH 80 | 0.405 | 0.129 | 0.215 | 0.036 | 0.095 | 762.0 | 870.9 | 979.7 | 1088.6 | 1197.5 |
| ¼" SCH 80 | 0.540 | 0.229 | 0.302 | 0.072 | 0.119 | 1503.5 | 1718.3 | 1933.1 | 2147.9 | 2362.6 |
| ⅜" SCH 80 | 0.675 | 0.358 | 0.423 | 0.140 | 0.126 | 2949.6 | 3371.0 | 3792.4 | 4213.8 | 4635.2 |
| ½" SCH 80 | 0.840 | 0.554 | 0.546 | 0.234 | 0.147 | 4914.4 | 5616.5 | 6318.6 | 7020.6 | 7722.7 |
| ¾" SCH 80 | 1.050 | 0.865 | 0.742 | 0.432 | 0.154 | 9076.0 | 10372.6 | 11669.2 | 12965.8 | 14262.4 |
| 1" SCH 80 | 1.315 | 1.357 | 0.957 | 0.719 | 0.179 | 15097.8 | 17254.6 | 19411.4 | 21568.2 | 23725.1 |
| 1¼" SCH 80 | 1.660 | 2.163 | 1.278 | 1.282 | 0.191 | 26924.7 | 30771.1 | 34617.5 | 38463.8 | 42310.2 |
| 1½" SCH 80 | 1.900 | 2.834 | 1.500 | 1.766 | 0.200 | 37091.3 | 42390.0 | 47688.8 | 52987.5 | 58286.3 |
| ½" SCH 160 | 0.840 | 0.554 | 0.464 | 0.169 | 0.188 | 3549.2 | 4056.2 | 4563.2 | 5070.2 | 5577.2 |
| ¾" SCH 160 | 1.050 | 0.865 | 0.612 | 0.294 | 0.219 | 6174.4 | 7056.4 | 7938.5 | 8820.5 | 9702.6 |
| 1" SCH 160 | 1.315 | 1.357 | 0.815 | 0.521 | 0.250 | 10949.7 | 12514.0 | 14078.2 | 15642.5 | 17206.7 |
| 1¼" SCH 160 | 1.660 | 2.163 | 1.160 | 1.056 | 0.250 | 22182.2 | 25351.1 | 28520.0 | 31688.9 | 34857.8 |
| 1½" SCH 160 | 1.900 | 2.834 | 1.338 | 1.405 | 0.281 | 29512.2 | 33728.2 | 37944.2 | 42160.2 | 46376.3 |

| PIPE SIZE/SCHEDULE | OD (in) | OD AREA (in^2) | ID (in) | ID AREA (in^2) | WALL THCK (in) | VOL. @ DEPTH 3000 (in^3) | VOL. @ DEPTH 3250 (in^3) | VOL. @ DEPTH 3500 (in^3) | VOL. @ DEPTH 3750 (in^3) | VOL. @ DEPTH 4000 (in^3) |
|---|---|---|---|---|---|---|---|---|---|---|
| ⅛" SCH 40 | 0.405 | 0.129 | 0.269 | 0.057 | 0.068 | 2044.9 | 2215.3 | 2385.7 | 2556.2 | 2726.6 |
| ¼" SCH 40 | 0.540 | 0.229 | 0.364 | 0.104 | 0.088 | 3744.3 | 4056.4 | 4368.4 | 4680.4 | 4992.4 |
| ⅜" SCH 40 | 0.675 | 0.358 | 0.493 | 0.191 | 0.091 | 6868.6 | 7440.9 | 8013.3 | 8585.7 | 9158.1 |
| ½" SCH 40 | 0.840 | 0.554 | 0.622 | 0.304 | 0.109 | 10933.3 | 11844.5 | 12755.6 | 13666.7 | 14577.8 |
| ¾" SCH 40 | 1.050 | 0.865 | 0.824 | 0.533 | 0.113 | 19187.9 | 20786.9 | 22385.8 | 23984.8 | 25583.8 |
| 1" SCH 40 | 1.315 | 1.357 | 1.049 | 0.864 | 0.133 | 31097.3 | 33688.8 | 36280.2 | 38871.7 | 41463.1 |
| 1¼" SCH 40 | 1.660 | 2.163 | 1.380 | 1.495 | 0.140 | 53818.3 | 58303.2 | 62788.1 | 67272.9 | 71757.8 |
| 1½" SCH 40 | 1.900 | 2.834 | 1.610 | 2.035 | 0.145 | 73252.7 | 79357.1 | 85461.5 | 91565.9 | 97670.3 |
| ⅛" SCH 80 | 0.405 | 0.129 | 0.215 | 0.036 | 0.095 | 1306.3 | 1415.2 | 1524.0 | 1632.9 | 1741.8 |
| ¼" SCH 80 | 0.540 | 0.229 | 0.302 | 0.072 | 0.119 | 2577.4 | 2792.2 | 3007.0 | 3221.8 | 3436.6 |
| ⅜" SCH 80 | 0.675 | 0.358 | 0.423 | 0.140 | 0.126 | 5056.5 | 5477.9 | 5899.3 | 6320.7 | 6742.0 |
| ½" SCH 80 | 0.840 | 0.554 | 0.546 | 0.234 | 0.147 | 8424.8 | 9126.8 | 9828.9 | 10530.9 | 11233.0 |
| ¾" SCH 80 | 1.050 | 0.865 | 0.742 | 0.432 | 0.154 | 15558.9 | 16855.5 | 18152.1 | 19448.7 | 20745.3 |
| 1" SCH 80 | 1.315 | 1.357 | 0.957 | 0.719 | 0.179 | 25881.9 | 28038.7 | 30195.5 | 32352.4 | 34509.2 |
| 1¼" SCH 80 | 1.660 | 2.163 | 1.278 | 1.282 | 0.191 | 46156.6 | 50003.0 | 53849.4 | 57695.8 | 61542.1 |
| 1½" SCH 80 | 1.900 | 2.834 | 1.500 | 1.766 | 0.200 | 63585.0 | 68883.8 | 74182.5 | 79481.3 | 84780.0 |
| ½" SCH 160 | 0.840 | 0.554 | 0.464 | 0.169 | 0.188 | 6084.3 | 6591.3 | 7098.3 | 7605.3 | 8112.4 |
| ¾" SCH 160 | 1.050 | 0.865 | 0.612 | 0.294 | 0.219 | 10584.6 | 11466.7 | 12348.7 | 13230.8 | 14112.8 |
| 1" SCH 160 | 1.315 | 1.357 | 0.815 | 0.521 | 0.250 | 18771.0 | 20335.2 | 21899.5 | 23463.7 | 25028.0 |
| 1¼" SCH 160 | 1.660 | 2.163 | 1.160 | 1.056 | 0.250 | 38026.7 | 41195.5 | 44364.4 | 47533.3 | 50702.2 |
| 1½" SCH 160 | 1.900 | 2.834 | 1.338 | 1.405 | 0.281 | 50592.3 | 54808.3 | 59024.3 | 63240.4 | 67456.4 |

TABLE 2

| Drive Delta-P = (psi) 500 | | | | | | | | |
|---|---|---|---|---|---|---|---|---|
| PIPE SIZE/SCHEDULE | DRIVE VOLUME LOSS @ 500' (in^3) | DRIVE VOLUME LOSS @ 750' (in^3) | DRIVE VOLUME LOSS @ 1000' (in^3) | DRIVE VOLUME LOSS @ 1250' (in^3) | DRIVE VOLUME LOSS @ 1500' (in^3) | DRIVE VOLUME LOSS @ 1750' (in^3) | DRIVE VOLUME LOSS @ 2000' (in^3) | DRIVE VOLUME LOSS @ 2250' (in^3) |
| ⅛" SCH 40 | 0.6 | 0.9 | 1.1 | 1.4 | 1.7 | 2.0 | 2.3 | 2.6 |
| ¼" SCH 40 | 1.0 | 1.6 | 2.1 | 2.6 | 3.1 | 3.6 | 4.2 | 4.7 |
| ⅜" SCH 40 | 1.9 | 2.9 | 3.8 | 4.8 | 5.7 | 6.7 | 7.6 | 8.6 |
| ½" SCH 40 | 3.0 | 4.6 | 6.1 | 7.6 | 9.1 | 10.6 | 12.1 | 13.7 |
| ¾" SCH 40 | 5.3 | 8.0 | 10.7 | 13.3 | 16.0 | 18.7 | 21.3 | 24.0 |
| 1" SCH 40 | 8.6 | 13.0 | 17.3 | 21.6 | 25.9 | 30.2 | 34.6 | 38.9 |
| 1¼" SCH 40 | 14.9 | 22.4 | 29.9 | 37.4 | 44.8 | 52.3 | 59.8 | 67.3 |
| 1½" SCH 40 | 20.3 | 30.5 | 40.7 | 50.9 | 61.0 | 71.2 | 81.4 | 91.6 |
| ⅛" SCH 80 | 0.4 | 0.5 | 0.7 | 0.9 | 1.1 | 1.3 | 1.5 | 1.6 |
| ¼" SCH 80 | 0.7 | 1.1 | 1.4 | 1.8 | 2.1 | 2.5 | 2.9 | 3.2 |
| ⅜" SCH 80 | 1.4 | 2.1 | 2.8 | 3.5 | 4.2 | 4.9 | 5.6 | 6.3 |
| ½" SCH 80 | 2.3 | 3.5 | 4.7 | 5.9 | 7.0 | 8.2 | 9.4 | 10.5 |
| ¾" SCH 80 | 4.3 | 6.5 | 8.6 | 10.8 | 13.0 | 15.1 | 17.3 | 19.4 |
| 1" SCH 80 | 7.2 | 10.8 | 14.4 | 18.0 | 21.6 | 25.2 | 28.8 | 32.4 |
| 1¼" SCH 80 | 12.8 | 19.2 | 25.6 | 32.1 | 38.5 | 44.9 | 51.3 | 57.7 |
| 1½" SCH 80 | 17.7 | 26.5 | 35.3 | 44.2 | 53.0 | 61.8 | 70.7 | 79.5 |
| ½" SCH 160 | 1.7 | 2.5 | 3.4 | 4.2 | 5.1 | 5.9 | 6.8 | 7.6 |
| ¾" SCH 160 | 2.9 | 4.4 | 5.9 | 7.4 | 8.8 | 10.3 | 11.8 | 13.2 |
| 1" SCH 160 | 5.2 | 7.8 | 10.4 | 13.0 | 15.6 | 18.2 | 20.9 | 23.5 |
| 1¼" SCH 160 | 10.6 | 15.8 | 21.1 | 26.4 | 31.7 | 37.0 | 42.3 | 47.5 |
| 1½" SCH 160 | 14.1 | 21.1 | 28.1 | 35.1 | 42.2 | 49.2 | 56.2 | 63.2 |

| PIPE SIZE/SCHEDULE | DRIVE VOLUME LOSS @ 2500' (in^3) | DRIVE VOLUME LOSS @ 2750' (in^3) | DRIVE VOLUME LOSS @ 3000' (in^3) | DRIVE VOLUME LOSS @ 3250' (in^3) | DRIVE VOLUME LOSS @ 3500' (in^3) | DRIVE VOLUME LOSS @ 3750' (in^3) | DRIVE VOLUME LOSS @ 4000' (in^3) |
|---|---|---|---|---|---|---|---|
| ⅛" SCH 40 | 2.8 | 3.1 | 3.4 | 3.7 | 4.0 | 4.3 | 4.5 |
| ¼" SCH 40 | 5.2 | 5.7 | 6.2 | 6.8 | 7.3 | 7.8 | 8.3 |
| ⅜" SCH 40 | 9.5 | 10.5 | 11.4 | 12.4 | 13.4 | 14.3 | 15.3 |
| ½" SCH 40 | 15.2 | 16.7 | 18.2 | 19.7 | 21.3 | 22.8 | 24.3 |
| ¾" SCH 40 | 26.6 | 29.3 | 32.0 | 34.6 | 37.3 | 40.0 | 42.6 |
| 1" SCH 40 | 43.2 | 47.5 | 51.8 | 56.1 | 60.5 | 64.8 | 69.1 |
| 1¼" SCH 40 | 74.7 | 82.2 | 89.7 | 97.2 | 104.6 | 112.1 | 119.6 |
| 1½" SCH 40 | 101.7 | 111.9 | 122.1 | 132.3 | 142.4 | 152.6 | 162.8 |
| ⅛" SCH 80 | 1.8 | 2.0 | 2.2 | 2.4 | 2.5 | 2.7 | 2.9 |
| ¼" SCH 80 | 3.6 | 3.9 | 4.3 | 4.7 | 5.0 | 5.4 | 5.7 |
| ⅜" SCH 80 | 7.0 | 7.7 | 8.4 | 9.1 | 9.8 | 10.5 | 11.2 |
| ½" SCH 80 | 11.7 | 12.9 | 14.0 | 15.2 | 16.4 | 17.6 | 18.7 |
| ¾" SCH 80 | 21.6 | 23.8 | 25.9 | 28.1 | 30.3 | 32.4 | 34.6 |
| 1" SCH 80 | 35.9 | 39.5 | 43.1 | 46.7 | 50.3 | 53.9 | 57.5 |
| 1¼" SCH 80 | 64.1 | 70.5 | 76.9 | 83.3 | 89.7 | 96.2 | 102.6 |
| 1½" SCH 80 | 88.3 | 97.1 | 106.0 | 114.8 | 123.6 | 132.5 | 141.3 |
| ½" SCH 160 | 8.5 | 9.3 | 10.1 | 11.0 | 11.8 | 12.7 | 13.5 |
| ¾" SCH 160 | 14.7 | 16.2 | 17.6 | 19.1 | 20.6 | 22.1 | 23.5 |
| 1" SCH 160 | 26.1 | 28.7 | 31.3 | 33.9 | 36.5 | 39.1 | 41.7 |
| 1¼" SCH 160 | 52.8 | 58.1 | 63.4 | 68.7 | 73.9 | 79.2 | 84.5 |
| 1½" SCH 160 | 70.3 | 77.3 | 84.3 | 91.3 | 98.4 | 105.4 | 112.4 |

TABLE 3

| Drive Delta-P = (psi) 750 | | | | | | | | |
|---|---|---|---|---|---|---|---|---|
| PIPE SIZE/SCHEDULE | DRIVE VOLUME LOSS @ 500' (in^3) | DRIVE VOLUME LOSS @ 750' (in^3) | DRIVE VOLUME LOSS @ 1000' (in^3) | DRIVE VOLUME LOSS @ 1250' (in^3) | DRIVE VOLUME LOSS @ 1500' (in^3) | DRIVE VOLUME LOSS @ 1750' (in^3) | DRIVE VOLUME LOSS @ 2000' (in^3) | DRIVE VOLUME LOSS @ 2250' (in^3) |
| ⅛" SCH 40 | 0.9 | 1.3 | 1.7 | 2.1 | 2.6 | 3.0 | 3.4 | 3.8 |
| ¼" SCH 40 | 1.6 | 2.3 | 3.1 | 3.9 | 4.7 | 5.5 | 6.2 | 7.0 |
| ⅜" SCH 40 | 2.9 | 4.3 | 5.7 | 7.2 | 8.6 | 10.0 | 11.4 | 12.9 |
| ½" SCH 40 | 4.6 | 6.8 | 9.1 | 11.4 | 13.7 | 15.9 | 18.2 | 20.5 |
| ¾" SCH 40 | 8.0 | 12.0 | 16.0 | 20.0 | 24.0 | 28.0 | 32.0 | 36.0 |
| 1" SCH 40 | 13.0 | 19.4 | 25.9 | 32.4 | 38.9 | 45.4 | 51.8 | 58.3 |
| 1¼" SCH 40 | 22.4 | 33.6 | 44.8 | 56.1 | 67.3 | 78.5 | 89.7 | 100.9 |
| 1½" SCH 40 | 30.5 | 45.8 | 61.0 | 76.3 | 91.6 | 106.8 | 122.1 | 137.3 |
| ⅛" SCH 80 | 0.5 | 0.8 | 1.1 | 1.4 | 1.6 | 1.9 | 2.2 | 2.4 |

TABLE 3-continued

| Drive Delta-P = (psi) 750 | | | | | | | | |
|---|---|---|---|---|---|---|---|---|
| ¼" SCH 80 | 1.1 | 1.6 | 2.1 | 2.7 | 3.2 | 3.8 | 4.3 | 4.8 |
| ⅜" SCH 80 | 2.1 | 3.2 | 4.2 | 5.3 | 6.3 | 7.4 | 8.4 | 9.5 |
| ½" SCH 80 | 3.5 | 5.3 | 7.0 | 8.8 | 10.5 | 12.3 | 14.0 | 15.8 |
| ¾" SCH 80 | 6.5 | 9.7 | 13.0 | 16.2 | 19.4 | 22.7 | 25.9 | 29.2 |
| 1" SCH 80 | 10.8 | 16.2 | 21.6 | 27.0 | 32.4 | 37.7 | 43.1 | 48.5 |
| 1¼" SCH 80 | 19.2 | 28.8 | 38.5 | 48.1 | 57.7 | 67.3 | 76.9 | 86.5 |
| 1½" SCH 80 | 26.5 | 39.7 | 53.0 | 66.2 | 79.5 | 92.7 | 106.0 | 119.2 |
| ½" SCH 160 | 2.5 | 3.8 | 5.1 | 6.3 | 7.6 | 8.9 | 10.1 | 11.4 |
| ¾" SCH 160 | 4.4 | 6.6 | 8.8 | 11.0 | 13.2 | 15.4 | 17.6 | 19.8 |
| 1" SCH 160 | 7.8 | 11.7 | 15.6 | 19.6 | 23.5 | 27.4 | 31.3 | 35.2 |
| 1¼" SCH 160 | 15.8 | 23.8 | 31.7 | 39.6 | 47.5 | 55.5 | 63.4 | 71.3 |
| 1½" SCH 160 | 21.1 | 31.6 | 42.2 | 52.7 | 63.2 | 73.8 | 84.3 | 94.9 |

| PIPE SIZE/SCHEDULE | DRIVE VOLUME LOSS @ 2500' (in^3) | DRIVE VOLUME LOSS @ 2750' (in^3) | DRIVE VOLUME LOSS @ 3000' (in^3) | DRIVE VOLUME LOSS @ 3250' (in^3) | DRIVE VOLUME LOSS @ 3500' (in^3) | DRIVE VOLUME LOSS @ 3750' (in^3) | DRIVE VOLUME LOSS @ 4000' (in^3) |
|---|---|---|---|---|---|---|---|
| ⅛" SCH 40 | 4.3 | 4.7 | 5.1 | 5.5 | 6.0 | 6.4 | 6.8 |
| ¼" SCH 40 | 7.8 | 8.6 | 9.4 | 10.1 | 10.9 | 11.7 | 12.5 |
| ⅜" SCH 40 | 14.3 | 15.7 | 17.2 | 18.6 | 20.0 | 21.5 | 22.9 |
| ½" SCH 40 | 22.8 | 25.1 | 27.3 | 29.6 | 31.9 | 34.2 | 36.4 |
| ¾" SCH 40 | 40.0 | 44.0 | 48.0 | 52.0 | 56.0 | 60.0 | 64.0 |
| 1" SCH 40 | 64.8 | 71.3 | 77.7 | 84.2 | 90.7 | 97.2 | 103.7 |
| 1¼" SCH 40 | 112.1 | 123.3 | 134.5 | 145.8 | 157.0 | 168.2 | 179.4 |
| 1½" SCH 40 | 152.6 | 167.9 | 183.1 | 198.4 | 213.7 | 228.9 | 244.2 |
| ⅛" SCH 80 | 2.7 | 3.0 | 3.3 | 3.5 | 3.8 | 4.1 | 4.4 |
| ¼" SCH 80 | 5.4 | 5.9 | 6.4 | 7.0 | 7.5 | 8.1 | 8.6 |
| ⅜" SCH 80 | 10.5 | 11.6 | 12.6 | 13.7 | 14.7 | 15.8 | 16.9 |
| ½" SCH 80 | 17.6 | 19.3 | 21.1 | 22.8 | 24.6 | 26.3 | 28.1 |
| ¾" SCH 80 | 32.4 | 35.7 | 38.9 | 42.1 | 45.4 | 48.6 | 51.9 |
| 1" SCH 80 | 53.9 | 59.3 | 64.7 | 70.1 | 75.5 | 80.9 | 86.3 |
| 1¼" SCH 80 | 96.2 | 105.8 | 115.4 | 125.0 | 134.6 | 144.2 | 153.9 |
| 1½" SCH 80 | 132.5 | 145.7 | 159.0 | 172.2 | 185.5 | 198.7 | 212.0 |
| ½" SCH 160 | 12.7 | 13.9 | 15.2 | 16.5 | 17.7 | 19.0 | 20.3 |
| ¾" SCH 160 | 22.1 | 24.3 | 26.5 | 28.7 | 30.9 | 33.1 | 35.3 |
| 1" SCH 160 | 39.1 | 43.0 | 46.9 | 50.8 | 54.7 | 58.7 | 62.6 |
| 1¼" SCH 160 | 79.2 | 87.1 | 95.1 | 103.0 | 110.9 | 118.8 | 126.8 |
| 1½" SCH 160 | 105.4 | 115.9 | 126.5 | 137.0 | 147.6 | 158.1 | 168.6 |

TABLE 4

| Drive Delta-P = (psi) 1000 | | | | | | | |
|---|---|---|---|---|---|---|---|
| PIPE SIZE/SCHEDULE | DRIVE VOLUME LOSS @ 500' (in^3) | DRIVE VOLUME LOSS @ 750' (in^3) | DRIVE VOLUME LOSS @ 1000' (in^3) | DRIVE VOLUME LOSS @ 1250' (in^3) | DRIVE VOLUME LOSS @ 1500' (in^3) | DRIVE VOLUME LOSS @ 1750' (in^3) | DRIVE VOLUME LOSS @ 2000' (in^3) |
| ⅛" SCH 40 | 1.1 | 1.7 | 2.3 | 2.8 | 3.4 | 4.0 | 4.5 |
| ¼" SCH 40 | 2.1 | 3.1 | 4.2 | 5.2 | 6.2 | 7.3 | 8.3 |
| ⅜" SCH 40 | 3.8 | 5.7 | 7.6 | 9.5 | 11.4 | 13.4 | 15.3 |
| ½" SCH 40 | 6.1 | 9.1 | 12.1 | 15.2 | 18.2 | 21.3 | 24.3 |
| ¾" SCH 40 | 10.7 | 16.0 | 21.3 | 26.6 | 32.0 | 37.3 | 42.6 |
| 1" SCH 40 | 17.3 | 25.9 | 34.6 | 43.2 | 51.8 | 60.5 | 69.1 |
| 1¼" SCH 40 | 29.9 | 44.8 | 59.8 | 74.7 | 89.7 | 104.6 | 119.6 |
| 1½" SCH 40 | 40.7 | 61.0 | 81.4 | 101.7 | 122.1 | 142.4 | 162.8 |
| ⅛" SCH 80 | 0.7 | 1.1 | 1.5 | 1.8 | 2.2 | 2.5 | 2.9 |
| ¼" SCH 80 | 1.4 | 2.1 | 2.9 | 3.6 | 4.3 | 5.0 | 5.7 |
| ⅜" SCH 80 | 2.8 | 4.2 | 5.6 | 7.0 | 8.4 | 9.8 | 11.2 |
| ½" SCH 80 | 4.7 | 7.0 | 9.4 | 11.7 | 14.0 | 16.4 | 18.7 |
| ¾" SCH 80 | 8.6 | 13.0 | 17.3 | 21.6 | 25.9 | 30.3 | 34.6 |
| 1" SCH 80 | 14.4 | 21.6 | 28.8 | 35.9 | 43.1 | 50.3 | 57.5 |
| 1¼" SCH 80 | 25.6 | 38.5 | 51.3 | 64.1 | 76.9 | 89.7 | 102.6 |
| 1½" SCH 80 | 35.3 | 53.0 | 70.7 | 88.3 | 106.0 | 123.6 | 141.3 |
| ½" SCH 160 | 3.4 | 5.1 | 6.8 | 8.5 | 10.1 | 11.8 | 13.5 |
| ¾" SCH 160 | 5.9 | 8.8 | 11.8 | 14.7 | 17.6 | 20.6 | 23.5 |
| 1" SCH 160 | 10.4 | 15.6 | 20.9 | 26.1 | 31.3 | 36.5 | 41.7 |
| 1¼" SCH 160 | 21.1 | 31.7 | 42.3 | 52.8 | 63.4 | 73.9 | 84.5 |
| 1½" SCH 160 | 28.1 | 42.2 | 56.2 | 70.3 | 84.3 | 98.4 | 112.4 |

TABLE 4-continued

| Drive Delta-P = (psi) 1000 | | | | | | | | |
|---|---|---|---|---|---|---|---|---|
| PIPE SIZE/SCHEDULE | DRIVE VOLUME LOSS @ 2250' (in^3) | DRIVE VOLUME LOSS @ 2500' (in^3) | DRIVE VOLUME LOSS @ 2750' (in^3) | DRIVE VOLUME LOSS @ 3000' (in^3) | DRIVE VOLUME LOSS @ 3250' (in^3) | DRIVE VOLUME LOSS @ 3500' (in^3) | DRIVE VOLUME LOSS @ 3750' (in^3) | DRIVE VOLUME LOSS @ 4000' (in^3) |
| ⅛" SCH 40 | 5.1 | 5.7 | 6.2 | 6.8 | 7.4 | 8.0 | 8.5 | 9.1 |
| ¼" SCH 40 | 9.4 | 10.4 | 11.4 | 12.5 | 13.5 | 14.6 | 15.6 | 16.6 |
| ⅜" SCH 40 | 17.2 | 19.1 | 21.0 | 22.9 | 24.8 | 26.7 | 28.6 | 30.5 |
| ½" SCH 40 | 27.3 | 30.4 | 33.4 | 36.4 | 39.5 | 42.5 | 45.6 | 48.6 |
| ¾" SCH 40 | 48.0 | 53.3 | 58.6 | 64.0 | 69.3 | 74.6 | 79.9 | 85.3 |
| 1" SCH 40 | 77.7 | 86.4 | 95.0 | 103.7 | 112.3 | 120.9 | 129.6 | 138.2 |
| 1¼" SCH 40 | 134.5 | 149.5 | 164.4 | 179.4 | 194.3 | 209.3 | 224.2 | 239.2 |
| 1½" SCH 40 | 183.1 | 203.5 | 223.8 | 244.2 | 264.5 | 284.9 | 305.2 | 325.6 |
| ⅛" SCH 80 | 3.3 | 3.6 | 4.0 | 4.4 | 4.7 | 5.1 | 5.4 | 5.8 |
| ¼" SCH 80 | 6.4 | 7.2 | 7.9 | 8.6 | 9.3 | 10.0 | 10.7 | 11.5 |
| ⅜" SCH 80 | 12.6 | 14.0 | 15.5 | 16.9 | 18.3 | 19.7 | 21.1 | 22.5 |
| ½" SCH 80 | 21.1 | 23.4 | 25.7 | 28.1 | 30.4 | 32.8 | 35.1 | 37.4 |
| ¾" SCH 80 | 38.9 | 43.2 | 47.5 | 51.9 | 56.2 | 60.5 | 64.8 | 69.2 |
| 1" SCH 80 | 64.7 | 71.9 | 79.1 | 86.3 | 93.5 | 100.7 | 107.8 | 115.0 |
| 1¼" SCH 80 | 115.4 | 128.2 | 141.0 | 153.9 | 166.7 | 179.5 | 192.3 | 205.1 |
| 1½" SCH 80 | 159.0 | 176.6 | 194.3 | 212.0 | 229.6 | 247.3 | 264.9 | 282.6 |
| ½" SCH 160 | 15.2 | 16.9 | 18.6 | 20.3 | 22.0 | 23.7 | 25.4 | 27.0 |
| ¾" SCH 160 | 26.5 | 29.4 | 32.3 | 35.3 | 38.2 | 41.2 | 44.1 | 47.0 |
| 1" SCH 160 | 46.9 | 52.1 | 57.4 | 62.6 | 67.8 | 73.0 | 78.2 | 83.4 |
| 1¼" SCH 160 | 95.1 | 105.6 | 116.2 | 126.8 | 137.3 | 147.9 | 158.4 | 169.0 |
| 1½" SCH 160 | 126.5 | 140.5 | 154.6 | 168.6 | 182.7 | 196.7 | 210.8 | 224.9 |

TABLE 5

| Drive Delta-P = (psi) 1250 | | | | | | | |
|---|---|---|---|---|---|---|---|
| PIPE SIZE/SCHEDULE | DRIVE VOLUME LOSS @ 500' (in^3) | DRIVE VOLUME LOSS @ 750' (in^3) | DRIVE VOLUME LOSS @ 1000' (in^3) | DRIVE VOLUME LOSS @ 1250' (in^3) | DRIVE VOLUME LOSS @ 1500' (in^3) | DRIVE VOLUME LOSS @ 1750' (in^3) | DRIVE VOLUME LOSS @ 2000' (in^3) |
| ⅛" SCH 40 | 1.4 | 2.1 | 2.8 | 3.6 | 4.3 | 5.0 | 5.7 |
| ¼" SCH 40 | 2.6 | 3.9 | 5.2 | 6.5 | 7.8 | 9.1 | 10.4 |
| ⅜" SCH 40 | 4.8 | 7.2 | 9.5 | 11.9 | 14.3 | 16.7 | 19.1 |
| ½" SCH 40 | 7.6 | 11.4 | 15.2 | 19.0 | 22.8 | 26.6 | 30.4 |
| ¾" SCH 40 | 13.3 | 20.0 | 26.6 | 33.3 | 40.0 | 46.6 | 53.3 |
| 1" SCH 40 | 21.6 | 32.4 | 43.2 | 54.0 | 64.8 | 75.6 | 86.4 |
| 1¼" SCH 40 | 37.4 | 56.1 | 74.7 | 93.4 | 112.1 | 130.8 | 149.5 |
| 1½" SCH 40 | 50.9 | 76.3 | 101.7 | 127.2 | 152.6 | 178.0 | 203.5 |
| ⅛" SCH 80 | 0.9 | 1.4 | 1.8 | 2.3 | 2.7 | 3.2 | 3.6 |
| ¼" SCH 80 | 1.8 | 2.7 | 3.6 | 4.5 | 5.4 | 6.3 | 7.2 |
| ⅜" SCH 80 | 3.5 | 5.3 | 7.0 | 8.8 | 10.5 | 12.3 | 14.0 |
| ½" SCH 80 | 5.9 | 8.8 | 11.7 | 14.6 | 17.6 | 20.5 | 23.4 |
| ¾" SCH 80 | 10.8 | 16.2 | 21.6 | 27.0 | 32.4 | 37.8 | 43.2 |
| 1" SCH 80 | 18.0 | 27.0 | 35.9 | 44.9 | 53.9 | 62.9 | 71.9 |
| 1¼" SCH 80 | 32.1 | 48.1 | 64.1 | 80.1 | 96.2 | 112.2 | 128.2 |
| 1½" SCH 80 | 44.2 | 66.2 | 88.3 | 110.4 | 132.5 | 154.5 | 176.6 |
| ½" SCH 160 | 4.2 | 6.3 | 8.5 | 10.6 | 12.7 | 14.8 | 16.9 |
| ¾" SCH 160 | 7.4 | 11.0 | 14.7 | 18.4 | 22.1 | 25.7 | 29.4 |
| 1" SCH 160 | 13.0 | 19.6 | 26.1 | 32.6 | 39.1 | 45.6 | 52.1 |
| 1¼" SCH 160 | 26.4 | 39.6 | 52.8 | 66.0 | 79.2 | 92.4 | 105.6 |
| 1½" SCH 160 | 35.1 | 52.7 | 70.3 | 87.8 | 105.4 | 123.0 | 140.5 |

| PIPE SIZE/SCHEDULE | DRIVE VOLUME LOSS @ 2250' (in^3) | DRIVE VOLUME LOSS @ 2500' (in^3) | DRIVE VOLUME LOSS @ 2750' (in^3) | DRIVE VOLUME LOSS @ 3000' (in^3) | DRIVE VOLUME LOSS @ 3250' (in^3) | DRIVE VOLUME LOSS @ 3500' (in^3) | DRIVE VOLUME LOSS @ 3750' (in^3) | DRIVE VOLUME LOSS @ 4000' (in^3) |
|---|---|---|---|---|---|---|---|---|
| ⅛" SCH 40 | 6.4 | 7.1 | 7.8 | 8.5 | 9.2 | 9.9 | 10.7 | 11.4 |
| ¼" SCH 40 | 11.7 | 13.0 | 14.3 | 15.6 | 16.9 | 18.2 | 19.5 | 20.8 |
| ⅜" SCH 40 | 21.5 | 23.8 | 26.2 | 28.6 | 31.0 | 33.4 | 35.8 | 38.2 |
| ½" SCH 40 | 34.2 | 38.0 | 41.8 | 45.6 | 49.4 | 53.1 | 56.9 | 60.7 |
| ¾" SCH 40 | 60.0 | 66.6 | 73.3 | 79.9 | 86.6 | 93.3 | 99.9 | 106.6 |
| 1" SCH 40 | 97.2 | 108.0 | 118.8 | 129.6 | 140.4 | 151.2 | 162.0 | 172.8 |
| 1¼" SCH 40 | 168.2 | 186.9 | 205.6 | 224.2 | 242.9 | 261.6 | 280.3 | 299.0 |
| 1½" SCH 40 | 228.9 | 254.3 | 279.8 | 305.2 | 330.7 | 356.1 | 381.5 | 407.0 |
| ⅛" SCH 80 | 4.1 | 4.5 | 5.0 | 5.4 | 5.9 | 6.4 | 6.8 | 7.3 |

TABLE 5-continued

| Drive Delta-P = (psi) 1250 | | | | | | | | |
|---|---|---|---|---|---|---|---|---|
| ¼" SCH 80 | 8.1 | 8.9 | 9.8 | 10.7 | 11.6 | 12.5 | 13.4 | 14.3 |
| ⅜" SCH 80 | 15.8 | 17.6 | 19.3 | 21.1 | 22.8 | 24.6 | 26.3 | 28.1 |
| ½" SCH 80 | 26.3 | 29.3 | 32.2 | 35.1 | 38.0 | 41.0 | 43.9 | 46.8 |
| ¾" SCH 80 | 48.6 | 54.0 | 59.4 | 64.8 | 70.2 | 75.6 | 81.0 | 86.4 |
| 1" SCH 80 | 80.9 | 89.9 | 98.9 | 107.8 | 116.8 | 125.8 | 134.8 | 143.8 |
| 1¼" SCH 80 | 144.2 | 160.3 | 176.3 | 192.3 | 208.3 | 224.4 | 240.4 | 256.4 |
| 1½" SCH 80 | 198.7 | 220.8 | 242.9 | 264.9 | 287.0 | 309.1 | 331.2 | 353.3 |
| ½" SCH 160 | 19.0 | 21.1 | 23.2 | 25.4 | 27.5 | 29.6 | 31.7 | 33.8 |
| ¾" SCH 160 | 33.1 | 36.8 | 40.4 | 44.1 | 47.8 | 51.5 | 55.1 | 58.8 |
| 1" SCH 160 | 58.7 | 65.2 | 71.7 | 78.2 | 84.7 | 91.2 | 97.8 | 104.3 |
| 1¼" SCH 160 | 118.8 | 132.0 | 145.2 | 158.4 | 171.6 | 184.9 | 198.1 | 211.3 |
| 1½" SCH 160 | 158.1 | 175.7 | 193.2 | 210.8 | 228.4 | 245.9 | 263.5 | 281.1 |

TABLE 6

| Drive Delta-P = (psi) 1500 | | | | | | | |
|---|---|---|---|---|---|---|---|
| PIPE SIZE/SCHEDULE | DRIVE VOLUME LOSS @ 500' (in^3) | DRIVE VOLUME LOSS @ 750' (in^3) | DRIVE VOLUME LOSS @ 1000' (in^3) | DRIVE VOLUME LOSS @ 1250' (in^3) | DRIVE VOLUME LOSS @ 1500' (in^3) | DRIVE VOLUME LOSS @ 1750' (in^3) | DRIVE VOLUME LOSS @ 2000' (in^3) |
| ⅛" SCH 40 | 1.7 | 2.6 | 3.4 | 4.3 | 5.1 | 6.0 | 6.8 |
| ¼" SCH 40 | 3.1 | 4.7 | 6.2 | 7.8 | 9.4 | 10.9 | 12.5 |
| ⅜" SCH 40 | 5.7 | 8.6 | 11.4 | 14.3 | 17.2 | 20.0 | 22.9 |
| ½" SCH 40 | 9.1 | 13.7 | 18.2 | 22.8 | 27.3 | 31.9 | 36.4 |
| ¾" SCH 40 | 16.0 | 24.0 | 32.0 | 40.0 | 48.0 | 56.0 | 64.0 |
| 1" SCH 40 | 25.9 | 38.9 | 51.8 | 64.8 | 77.7 | 90.7 | 103.7 |
| 1¼" SCH 40 | 44.8 | 67.3 | 89.7 | 112.1 | 134.5 | 157.0 | 179.4 |
| 1½" SCH 40 | 61.0 | 91.6 | 122.1 | 152.6 | 183.1 | 213.7 | 244.2 |
| ⅛" SCH 80 | 1.1 | 1.6 | 2.2 | 2.7 | 3.3 | 3.8 | 4.4 |
| ¼" SCH 80 | 2.1 | 3.2 | 4.3 | 5.4 | 6.4 | 7.5 | 8.6 |
| ⅜" SCH 80 | 4.2 | 6.3 | 8.4 | 10.5 | 12.6 | 14.7 | 16.9 |
| ½" SCH 80 | 7.0 | 10.5 | 14.0 | 17.6 | 21.1 | 24.6 | 28.1 |
| ¾" SCH 80 | 13.0 | 19.4 | 25.9 | 32.4 | 38.9 | 45.4 | 51.9 |
| 1" SCH 80 | 21.6 | 32.4 | 43.1 | 53.9 | 64.7 | 75.5 | 86.3 |
| 1¼" SCH 80 | 38.5 | 57.7 | 76.9 | 96.2 | 115.4 | 134.6 | 153.9 |
| 1½" SCH 80 | 53.0 | 79.5 | 106.0 | 132.5 | 159.0 | 185.5 | 212.0 |
| ½" SCH 160 | 5.1 | 7.6 | 10.1 | 12.7 | 15.2 | 17.7 | 20.3 |
| ¾" SCH 160 | 8.8 | 13.2 | 17.6 | 22.1 | 26.5 | 30.9 | 35.3 |
| 1" SCH 160 | 15.6 | 23.5 | 31.3 | 39.1 | 46.9 | 54.7 | 62.6 |
| 1¼" SCH 160 | 31.7 | 47.5 | 63.4 | 79.2 | 95.1 | 110.9 | 126.8 |
| 1½" SCH 160 | 42.2 | 63.2 | 84.3 | 105.4 | 126.5 | 147.6 | 168.6 |

| PIPE SIZE/SCHEDULE | DRIVE VOLUME LOSS @ 2250' (in^3) | DRIVE VOLUME LOSS @ 2500' (in^3) | DRIVE VOLUME LOSS @ 2750' (in^3) | DRIVE VOLUME LOSS @ 3000' (in^3) | DRIVE VOLUME LOSS @ 3250' (in^3) | DRIVE VOLUME LOSS @ 3500' (in^3) | DRIVE VOLUME LOSS @ 3750' (in^3) | DRIVE VOLUME LOSS @ 4000' (in^3) |
|---|---|---|---|---|---|---|---|---|
| ⅛" SCH 40 | 7.7 | 8.5 | 9.4 | 10.2 | 11.1 | 11.9 | 12.8 | 13.6 |
| ¼" SCH 40 | 14.0 | 15.6 | 17.2 | 18.7 | 20.3 | 21.8 | 23.4 | 25.0 |
| ⅜" SCH 40 | 25.8 | 28.6 | 31.5 | 34.3 | 37.2 | 40.1 | 42.9 | 45.8 |
| ½" SCH 40 | 41.0 | 45.6 | 50.1 | 54.7 | 59.2 | 63.8 | 68.3 | 72.9 |
| ¾" SCH 40 | 72.0 | 79.9 | 87.9 | 95.9 | 103.9 | 111.9 | 119.9 | 127.9 |
| 1" SCH 40 | 116.6 | 129.6 | 142.5 | 155.5 | 168.4 | 181.4 | 194.4 | 207.3 |
| 1¼" SCH 40 | 201.8 | 224.2 | 246.7 | 269.1 | 291.5 | 313.9 | 336.4 | 358.8 |
| 1½" SCH 40 | 274.7 | 305.2 | 335.7 | 366.3 | 396.8 | 427.3 | 457.8 | 488.4 |
| ⅛" SCH 80 | 4.9 | 5.4 | 6.0 | 6.5 | 7.1 | 7.6 | 8.2 | 8.7 |
| ¼" SCH 80 | 9.7 | 10.7 | 11.8 | 12.9 | 14.0 | 15.0 | 16.1 | 17.2 |
| ⅜" SCH 80 | 19.0 | 21.1 | 23.2 | 25.3 | 27.4 | 29.5 | 31.6 | 33.7 |
| ½" SCH 80 | 31.6 | 35.1 | 38.6 | 42.1 | 45.6 | 49.1 | 52.7 | 56.2 |
| ¾" SCH 80 | 58.3 | 64.8 | 71.3 | 77.8 | 84.3 | 90.8 | 97.2 | 103.7 |
| 1" SCH 80 | 97.1 | 107.8 | 118.6 | 129.4 | 140.2 | 151.0 | 161.8 | 172.5 |
| 1¼" SCH 80 | 173.1 | 192.3 | 211.6 | 230.8 | 250.0 | 269.2 | 288.5 | 307.7 |
| 1½" SCH 80 | 238.4 | 264.9 | 291.4 | 317.9 | 344.4 | 370.9 | 397.4 | 423.9 |
| ½" SCH 160 | 22.8 | 25.4 | 27.9 | 30.4 | 33.0 | 35.5 | 38.0 | 40.6 |
| ¾" SCH 160 | 39.7 | 44.1 | 48.5 | 52.9 | 57.3 | 61.7 | 66.2 | 70.6 |
| 1" SCH 160 | 70.4 | 78.2 | 86.0 | 93.9 | 101.7 | 109.5 | 117.3 | 125.1 |
| 1¼" SCH 160 | 142.6 | 158.4 | 174.3 | 190.1 | 206.0 | 221.8 | 237.7 | 253.5 |
| 1½" SCH 160 | 189.7 | 210.8 | 231.9 | 253.0 | 274.0 | 295.1 | 316.2 | 337.3 |

TABLE 7

Drive Delta-P = (psi) 1750

| PIPE SIZE/SCHEDULE | DRIVE VOLUME LOSS @ 500' (in^3) | DRIVE VOLUME LOSS @ 750' (in^3) | DRIVE VOLUME LOSS @ 1000' (in^3) | DRIVE VOLUME LOSS @ 1250' (in^3) | DRIVE VOLUME LOSS @ 1500' (in^3) | DRIVE VOLUME LOSS @ 1750' (in^3) | DRIVE VOLUME LOSS @ 2000' (in^3) |
|---|---|---|---|---|---|---|---|
| ⅛" SCH 40 | 2.0 | 3.0 | 4.0 | 5.0 | 6.0 | 7.0 | 8.0 |
| ¼" SCH 40 | 3.6 | 5.5 | 7.3 | 9.1 | 10.9 | 12.7 | 14.6 |
| ⅜" SCH 40 | 6.7 | 10.0 | 13.4 | 16.7 | 20.0 | 23.4 | 26.7 |
| ½" SCH 40 | 10.6 | 15.9 | 21.3 | 26.6 | 31.9 | 37.2 | 42.5 |
| ¾" SCH 40 | 18.7 | 28.0 | 37.3 | 46.6 | 56.0 | 65.3 | 74.6 |
| 1" SCH 40 | 30.2 | 45.4 | 60.5 | 75.6 | 90.7 | 105.8 | 120.9 |
| 1¼" SCH 40 | 52.3 | 78.5 | 104.6 | 130.8 | 157.0 | 183.1 | 209.3 |
| 1½" SCH 40 | 71.2 | 106.8 | 142.4 | 178.0 | 213.7 | 249.3 | 284.9 |
| ⅛" SCH 80 | 1.3 | 1.9 | 2.5 | 3.2 | 3.8 | 4.4 | 5.1 |
| ¼" SCH 80 | 2.5 | 3.8 | 5.0 | 6.3 | 7.5 | 8.8 | 10.0 |
| ⅜" SCH 80 | 4.9 | 7.4 | 9.8 | 12.3 | 14.7 | 17.2 | 19.7 |
| ½" SCH 80 | 8.2 | 12.3 | 16.4 | 20.5 | 24.6 | 28.7 | 32.8 |
| ¾" SCH 80 | 15.1 | 22.7 | 30.3 | 37.8 | 45.4 | 52.9 | 60.5 |
| 1" SCH 80 | 25.2 | 37.7 | 50.3 | 62.9 | 75.5 | 88.1 | 100.7 |
| 1¼" SCH 80 | 44.9 | 67.3 | 89.7 | 112.2 | 134.6 | 157.1 | 179.5 |
| 1½" SCH 80 | 61.8 | 92.7 | 123.6 | 154.5 | 185.5 | 216.4 | 247.3 |
| ½" SCH 160 | 5.9 | 8.9 | 11.8 | 14.8 | 17.7 | 20.7 | 23.7 |
| ¾" SCH 160 | 10.3 | 15.4 | 20.6 | 25.7 | 30.9 | 36.0 | 41.2 |
| 1" SCH 160 | 18.2 | 27.4 | 36.5 | 45.6 | 54.7 | 63.9 | 73.0 |
| 1¼" SCH 160 | 37.0 | 55.5 | 73.9 | 92.4 | 110.9 | 129.4 | 147.9 |
| 1½" SCH 160 | 49.2 | 73.8 | 98.4 | 123.0 | 147.6 | 172.2 | 196.7 |

| PIPE SIZE/SCHEDULE | DRIVE VOLUME LOSS @ 2250' (in^3) | DRIVE VOLUME LOSS @ 2500' (in^3) | DRIVE VOLUME LOSS @ 2750' (in^3) | DRIVE VOLUME LOSS @ 3000' (in^3) | DRIVE VOLUME LOSS @ 3250' (in^3) | DRIVE VOLUME LOSS @ 3500' (in^3) | DRIVE VOLUME LOSS @ 3750' (in^3) | DRIVE VOLUME LOSS @ 4000' (in^3) |
|---|---|---|---|---|---|---|---|---|
| ⅛" SCH 40 | 8.9 | 9.9 | 10.9 | 11.9 | 12.9 | 13.9 | 14.9 | 15.9 |
| ¼" SCH 40 | 16.4 | 18.2 | 20.0 | 21.8 | 23.7 | 25.5 | 27.3 | 29.1 |
| ⅜" SCH 40 | 30.0 | 33.4 | 36.7 | 40.1 | 43.4 | 46.7 | 50.1 | 53.4 |
| ½" SCH 40 | 47.8 | 53.1 | 58.5 | 63.8 | 69.1 | 74.4 | 79.7 | 85.0 |
| ¾" SCH 40 | 83.9 | 93.3 | 102.6 | 111.9 | 121.3 | 130.6 | 139.9 | 149.2 |
| 1" SCH 40 | 136.1 | 151.2 | 166.3 | 181.4 | 196.5 | 211.6 | 226.8 | 241.9 |
| 1¼" SCH 40 | 235.5 | 261.6 | 287.8 | 313.9 | 340.1 | 366.3 | 392.4 | 418.6 |
| 1½" SCH 40 | 320.5 | 356.1 | 391.7 | 427.3 | 462.9 | 498.5 | 534.1 | 569.7 |
| ⅛" SCH 80 | 5.7 | 6.4 | 7.0 | 7.6 | 8.3 | 8.9 | 9.5 | 10.2 |
| ¼" SCH 80 | 11.3 | 12.5 | 13.8 | 15.0 | 16.3 | 17.5 | 18.8 | 20.0 |
| ⅜" SCH 80 | 22.1 | 24.6 | 27.0 | 29.5 | 32.0 | 34.4 | 36.9 | 39.3 |
| ½" SCH 80 | 36.9 | 41.0 | 45.0 | 49.1 | 53.2 | 57.3 | 61.4 | 65.5 |
| ¾" SCH 80 | 68.1 | 75.6 | 83.2 | 90.8 | 98.3 | 105.9 | 113.5 | 121.0 |
| 1" SCH 80 | 113.2 | 125.8 | 138.4 | 151.0 | 163.6 | 176.1 | 188.7 | 201.3 |
| 1¼" SCH 80 | 201.9 | 224.4 | 246.8 | 269.2 | 291.7 | 314.1 | 336.6 | 359.0 |
| 1½" SCH 80 | 278.2 | 309.1 | 340.0 | 370.9 | 401.8 | 432.7 | 463.6 | 494.6 |
| ½" SCH 160 | 26.6 | 29.6 | 32.5 | 35.5 | 38.4 | 41.4 | 44.4 | 47.3 |
| ¾" SCH 160 | 46.3 | 51.5 | 56.6 | 61.7 | 66.9 | 72.0 | 77.2 | 82.3 |
| 1" SCH 160 | 82.1 | 91.2 | 100.4 | 109.5 | 118.6 | 127.7 | 136.9 | 146.0 |
| 1¼" SCH 160 | 166.4 | 184.9 | 203.3 | 221.8 | 240.3 | 258.8 | 277.3 | 295.8 |
| 1½" SCH 160 | 221.3 | 245.9 | 270.5 | 295.1 | 319.7 | 344.3 | 368.9 | 393.5 |

TABLE 8

Drive Delta-P = (psi) 2000

| PIPE SIZE/SCHEDULE | DRIVE VOLUME LOSS @ 500' (in^3) | DRIVE VOLUME LOSS @ 750' (in^3) | DRIVE VOLUME LOSS @ 1000' (in^3) | DRIVE VOLUME LOSS @ 1250' (in^3) | DRIVE VOLUME LOSS @ 1500' (in^3) | DRIVE VOLUME LOSS @ 1750' (in^3) | DRIVE VOLUME LOSS @ 2000' (in^3) |
|---|---|---|---|---|---|---|---|
| ⅛" SCH 40 | 2.3 | 3.4 | 4.5 | 5.7 | 6.8 | 8.0 | 9.1 |
| ¼" SCH 40 | 4.2 | 6.2 | 8.3 | 10.4 | 12.5 | 14.6 | 16.6 |
| ⅜" SCH 40 | 7.6 | 11.4 | 15.3 | 19.1 | 22.9 | 26.7 | 30.5 |
| ½" SCH 40 | 12.1 | 18.2 | 24.3 | 30.4 | 36.4 | 42.5 | 48.6 |
| ¾" SCH 40 | 21.3 | 32.0 | 42.6 | 53.3 | 64.0 | 74.6 | 85.3 |
| 1" SCH 40 | 34.6 | 51.8 | 69.1 | 86.4 | 103.7 | 120.9 | 138.2 |
| 1¼" SCH 40 | 59.8 | 89.7 | 119.6 | 149.5 | 179.4 | 209.3 | 239.2 |
| 1½" SCH 40 | 81.4 | 122.1 | 162.8 | 203.5 | 244.2 | 284.9 | 325.6 |
| ⅛" SCH 80 | 1.5 | 2.2 | 2.9 | 3.6 | 4.4 | 5.1 | 5.8 |

TABLE 8-continued

| Drive Delta-P = (psi) 2000 | | | | | | | |
|---|---|---|---|---|---|---|---|
| ¼" SCH 80 | 2.9 | 4.3 | 5.7 | 7.2 | 8.6 | 10.0 | 11.5 |
| ⅜" SCH 80 | 5.6 | 8.4 | 11.2 | 14.0 | 16.9 | 19.7 | 22.5 |
| ½" SCH 80 | 9.4 | 14.0 | 18.7 | 23.4 | 28.1 | 32.8 | 37.4 |
| ¾" SCH 80 | 17.3 | 25.9 | 34.6 | 43.2 | 51.9 | 60.5 | 69.2 |
| 1" SCH 80 | 28.8 | 43.1 | 57.5 | 71.9 | 86.3 | 100.7 | 115.0 |
| 1¼" SCH 80 | 51.3 | 76.9 | 102.6 | 128.2 | 153.9 | 179.5 | 205.1 |
| 1½" SCH 80 | 70.7 | 106.0 | 141.3 | 176.6 | 212.0 | 247.3 | 282.6 |
| ½" SCH 160 | 6.8 | 10.1 | 13.5 | 16.9 | 20.3 | 23.7 | 27.0 |
| ¾" SCH 160 | 11.8 | 17.6 | 23.5 | 29.4 | 35.3 | 41.2 | 47.0 |
| 1" SCH 160 | 20.9 | 31.3 | 41.7 | 52.1 | 62.6 | 73.0 | 83.4 |
| 1¼" SCH 160 | 42.3 | 63.4 | 84.5 | 105.6 | 126.8 | 147.9 | 169.0 |
| 1½" SCH 160 | 56.2 | 84.3 | 112.4 | 140.5 | 168.6 | 196.7 | 224.9 |

| PIPE SIZE/SCHEDULE | DRIVE VOLUME LOSS @ 2250' (in^3) | DRIVE VOLUME LOSS @ 2500' (in^3) | DRIVE VOLUME LOSS @ 2750' (in^3) | DRIVE VOLUME LOSS @ 3000' (in^3) | DRIVE VOLUME LOSS @ 3250' (in^3) | DRIVE VOLUME LOSS @ 3500' (in^3) | DRIVE VOLUME LOSS @ 3750' (in^3) | DRIVE VOLUME LOSS @ 4000' (in^3) |
|---|---|---|---|---|---|---|---|---|
| ⅛" SCH 40 | 10.2 | 11.4 | 12.5 | 13.6 | 14.8 | 15.9 | 17.0 | 18.2 |
| ¼" SCH 40 | 18.7 | 20.8 | 22.9 | 25.0 | 27.0 | 29.1 | 31.2 | 33.3 |
| ⅜" SCH 40 | 34.3 | 38.2 | 42.0 | 45.8 | 49.6 | 53.4 | 57.2 | 61.1 |
| ½" SCH 40 | 54.7 | 60.7 | 66.8 | 72.9 | 79.0 | 85.0 | 91.1 | 97.2 |
| ¾" SCH 40 | 95.9 | 106.6 | 117.3 | 127.9 | 138.6 | 149.2 | 159.9 | 170.6 |
| 1" SCH 40 | 155.5 | 172.8 | 190.0 | 207.3 | 224.6 | 241.9 | 259.1 | 276.4 |
| 1¼" SCH 40 | 269.1 | 299.0 | 328.9 | 358.8 | 388.7 | 418.6 | 448.5 | 478.4 |
| 1½" SCH 40 | 366.3 | 407.0 | 447.7 | 488.4 | 529.0 | 569.7 | 610.4 | 651.1 |
| ⅛" SCH 80 | 6.5 | 7.3 | 8.0 | 8.7 | 9.4 | 10.2 | 10.9 | 11.6 |
| ¼" SCH 80 | 12.9 | 14.3 | 15.8 | 17.2 | 18.6 | 20.0 | 21.5 | 22.9 |
| ⅜" SCH 80 | 25.3 | 28.1 | 30.9 | 33.7 | 36.5 | 39.3 | 42.1 | 44.9 |
| ½" SCH 80 | 42.1 | 46.8 | 51.5 | 56.2 | 60.8 | 65.5 | 70.2 | 74.9 |
| ¾" SCH 80 | 77.8 | 86.4 | 95.1 | 103.7 | 112.4 | 121.0 | 129.7 | 138.3 |
| 1" SCH 80 | 129.4 | 143.8 | 158.2 | 172.5 | 186.9 | 201.3 | 215.7 | 230.1 |
| 1¼" SCH 80 | 230.8 | 256.4 | 282.1 | 307.7 | 333.4 | 359.0 | 384.6 | 410.3 |
| 1½" SCH 80 | 317.9 | 353.3 | 388.6 | 423.9 | 459.2 | 494.6 | 529.9 | 565.2 |
| ½" SCH 160 | 30.4 | 33.8 | 37.2 | 40.6 | 43.9 | 47.3 | 50.7 | 54.1 |
| ¾" SCH 160 | 52.9 | 58.8 | 64.7 | 70.6 | 76.4 | 82.3 | 88.2 | 94.1 |
| 1" SCH 160 | 93.9 | 104.3 | 114.7 | 125.1 | 135.6 | 146.0 | 156.4 | 166.9 |
| 1¼" SCH 160 | 190.1 | 211.3 | 232.4 | 253.5 | 274.6 | 295.8 | 316.9 | 338.0 |
| 1½" SCH 160 | 253.0 | 281.1 | 309.2 | 337.3 | 365.4 | 393.5 | 421.6 | 449.7 |

TABLE 9

| Drive Delta-P = (psi) 2250 | | | | | | | |
|---|---|---|---|---|---|---|---|
| PIPE SIZE/SCHEDULE | DRIVE VOLUME LOSS @ 500' (in^3) | DRIVE VOLUME LOSS @ 750' (in^3) | DRIVE VOLUME LOSS @ 1000' (in^3) | DRIVE VOLUME LOSS @ 1250' (in^3) | DRIVE VOLUME LOSS @ 1500' (in^3) | DRIVE VOLUME LOSS @ 1750' (in^3) | DRIVE VOLUME LOSS @ 2000' (in^3) |
| ⅛" SCH 40 | 2.6 | 3.8 | 5.1 | 6.4 | 7.7 | 8.9 | 10.2 |
| ¼" SCH 40 | 4.7 | 7.0 | 9.4 | 11.7 | 14.0 | 16.4 | 18.7 |
| ⅜" SCH 40 | 8.6 | 12.9 | 17.2 | 21.5 | 25.8 | 30.0 | 34.3 |
| ½" SCH 40 | 13.7 | 20.5 | 27.3 | 34.2 | 41.0 | 47.8 | 54.7 |
| ¾" SCH 40 | 24.0 | 36.0 | 48.0 | 60.0 | 72.0 | 83.9 | 95.9 |
| 1" SCH 40 | 38.9 | 58.3 | 77.7 | 97.2 | 116.6 | 136.1 | 155.5 |
| 1¼" SCH 40 | 67.3 | 100.9 | 134.5 | 168.2 | 201.8 | 235.5 | 269.1 |
| 1½" SCH 40 | 91.6 | 137.3 | 183.1 | 228.9 | 274.7 | 320.5 | 366.3 |
| ⅛" SCH 80 | 1.6 | 2.4 | 3.3 | 4.1 | 4.9 | 5.7 | 6.5 |
| ¼" SCH 80 | 3.2 | 4.8 | 6.4 | 8.1 | 9.7 | 11.3 | 12.9 |
| ⅜" SCH 80 | 6.3 | 9.5 | 12.6 | 15.8 | 19.0 | 22.1 | 25.3 |
| ½" SCH 80 | 10.5 | 15.8 | 21.1 | 26.3 | 31.6 | 36.9 | 42.1 |
| ¾" SCH 80 | 19.4 | 29.2 | 38.9 | 48.6 | 58.3 | 68.1 | 77.8 |
| 1" SCH 80 | 32.4 | 48.5 | 64.7 | 80.9 | 97.1 | 113.2 | 129.4 |
| 1¼" SCH 80 | 57.7 | 86.5 | 115.4 | 144.2 | 173.1 | 201.9 | 230.8 |
| 1½" SCH 80 | 79.5 | 119.2 | 159.0 | 198.7 | 238.4 | 278.2 | 317.9 |
| ½" SCH 160 | 7.6 | 11.4 | 15.2 | 19.0 | 22.8 | 26.6 | 30.4 |
| ¾" SCH 160 | 13.2 | 19.8 | 26.5 | 33.1 | 39.7 | 46.3 | 52.9 |
| 1" SCH 160 | 23.5 | 35.2 | 46.9 | 58.7 | 70.4 | 82.1 | 93.9 |
| 1¼" SCH 160 | 47.5 | 71.3 | 95.1 | 118.8 | 142.6 | 166.4 | 190.1 |
| 1½" SCH 160 | 63.2 | 94.9 | 126.5 | 158.1 | 189.7 | 221.3 | 253.0 |

TABLE 9-continued

| Drive Delta-P = (psi) 2250 | | | | | | | | |
|---|---|---|---|---|---|---|---|---|
| PIPE SIZE/SCHEDULE | DRIVE VOLUME LOSS @ 2250' (in^3) | DRIVE VOLUME LOSS @ 2500' (in^3) | DRIVE VOLUME LOSS @ 2750' (in^3) | DRIVE VOLUME LOSS @ 3000' (in^3) | DRIVE VOLUME LOSS @ 3250' (in^3) | DRIVE VOLUME LOSS @ 3500' (in^3) | DRIVE VOLUME LOSS @ 3750' (in^3) | DRIVE VOLUME LOSS @ 4000' (in^3) |
| ⅛" SCH 40 | 11.5 | 12.8 | 14.1 | 15.3 | 16.6 | 17.9 | 19.2 | 20.4 |
| ¼" SCH 40 | 21.1 | 23.4 | 25.7 | 28.1 | 30.4 | 32.8 | 35.1 | 37.4 |
| ⅜" SCH 40 | 38.6 | 42.9 | 47.2 | 51.5 | 55.8 | 60.1 | 64.4 | 68.7 |
| ½" SCH 40 | 61.5 | 68.3 | 75.2 | 82.0 | 88.8 | 95.7 | 102.5 | 109.3 |
| ¾" SCH 40 | 107.9 | 119.9 | 131.9 | 143.9 | 155.9 | 167.9 | 179.9 | 191.9 |
| 1" SCH 40 | 174.9 | 194.4 | 213.8 | 233.2 | 252.7 | 272.1 | 291.5 | 311.0 |
| 1¼" SCH 40 | 302.7 | 336.4 | 370.0 | 403.6 | 437.3 | 470.9 | 504.5 | 538.2 |
| 1½" SCH 40 | 412.0 | 457.8 | 503.6 | 549.4 | 595.2 | 641.0 | 686.7 | 732.5 |
| ⅛" SCH 80 | 7.3 | 8.2 | 9.0 | 9.8 | 10.6 | 11.4 | 12.2 | 13.1 |
| ¼" SCH 80 | 14.5 | 16.1 | 17.7 | 19.3 | 20.9 | 22.6 | 24.2 | 25.8 |
| ⅜" SCH 80 | 28.4 | 31.6 | 34.8 | 37.9 | 41.1 | 44.2 | 47.4 | 50.6 |
| ½" SCH 80 | 47.4 | 52.7 | 57.9 | 63.2 | 68.5 | 73.7 | 79.0 | 84.2 |
| ¾" SCH 80 | 87.5 | 97.2 | 107.0 | 116.7 | 126.4 | 136.1 | 145.9 | 155.6 |
| 1" SCH 80 | 145.6 | 161.8 | 177.9 | 194.1 | 210.3 | 226.5 | 242.6 | 258.8 |
| 1¼" SCH 80 | 259.6 | 288.5 | 317.3 | 346.2 | 375.0 | 403.9 | 432.7 | 461.6 |
| 1½" SCH 80 | 357.7 | 397.4 | 437.1 | 476.9 | 516.6 | 556.4 | 596.1 | 635.9 |
| ½" SCH 160 | 34.2 | 38.0 | 41.8 | 45.6 | 49.4 | 53.2 | 57.0 | 60.8 |
| ¾" SCH 160 | 59.5 | 66.2 | 72.8 | 79.4 | 86.0 | 92.6 | 99.2 | 105.8 |
| 1" SCH 160 | 105.6 | 117.3 | 129.1 | 140.8 | 152.5 | 164.2 | 176.0 | 187.7 |
| 1¼" SCH 160 | 213.9 | 237.7 | 261.4 | 285.2 | 309.0 | 332.7 | 356.5 | 380.3 |
| 1½" SCH 160 | 284.6 | 316.2 | 347.8 | 379.4 | 411.1 | 442.7 | 474.3 | 505.9 |

TABLE 10

| Drive Delta-P = (psi) 2500 | | | | | | | |
|---|---|---|---|---|---|---|---|
| PIPE SIZE/SCHEDULE | DRIVE VOLUME LOSS @ 500' (in^3) | DRIVE VOLUME LOSS @ 750' (in^3) | DRIVE VOLUME LOSS @ 1000' (in^3) | DRIVE VOLUME LOSS @ 1250' (in^3) | DRIVE VOLUME LOSS @ 1500' (in^3) | DRIVE VOLUME LOSS @ 1750' (in^3) | DRIVE VOLUME LOSS @ 2000' (in^3) |
| ⅛" SCH 40 | 2.8 | 4.3 | 5.7 | 7.1 | 8.5 | 9.9 | 11.4 |
| ¼" SCH 40 | 5.2 | 7.8 | 10.4 | 13.0 | 15.6 | 18.2 | 20.8 |
| ⅜" SCH 40 | 9.5 | 14.3 | 19.1 | 23.8 | 28.6 | 33.4 | 38.2 |
| ½" SCH 40 | 15.2 | 22.8 | 30.4 | 38.0 | 45.6 | 53.1 | 60.7 |
| ¾" SCH 40 | 26.6 | 40.0 | 53.3 | 66.6 | 79.9 | 93.3 | 106.6 |
| 1" SCH 40 | 43.2 | 64.8 | 86.4 | 108.0 | 129.6 | 151.2 | 172.8 |
| 1¼" SCH 40 | 74.7 | 112.1 | 149.5 | 186.9 | 224.2 | 261.6 | 299.0 |
| 1½" SCH 40 | 101.7 | 152.6 | 203.5 | 254.3 | 305.2 | 356.1 | 407.0 |
| ⅛" SCH 80 | 1.8 | 2.7 | 3.6 | 4.5 | 5.4 | 6.4 | 7.3 |
| ¼" SCH 80 | 3.6 | 5.4 | 7.2 | 8.9 | 10.7 | 12.5 | 14.3 |
| ⅜" SCH 80 | 7.0 | 10.5 | 14.0 | 17.6 | 21.1 | 24.6 | 28.1 |
| ½" SCH 80 | 11.7 | 17.6 | 23.4 | 29.3 | 35.1 | 41.0 | 46.8 |
| ¾" SCH 80 | 21.6 | 32.4 | 43.2 | 54.0 | 64.8 | 75.6 | 86.4 |
| 1" SCH 80 | 35.9 | 53.9 | 71.9 | 89.9 | 107.8 | 125.8 | 143.8 |
| 1¼" SCH 80 | 64.1 | 96.2 | 128.2 | 160.3 | 192.3 | 224.4 | 256.4 |
| 1½" SCH 80 | 88.3 | 132.5 | 176.6 | 220.8 | 264.9 | 309.1 | 353.3 |
| ½" SCH 160 | 8.5 | 12.7 | 16.9 | 21.1 | 25.4 | 29.6 | 33.8 |
| ¾" SCH 160 | 14.7 | 22.1 | 29.4 | 36.8 | 44.1 | 51.5 | 58.8 |
| 1" SCH 160 | 26.1 | 39.1 | 52.1 | 65.2 | 78.2 | 91.2 | 104.3 |
| 1¼" SCH 160 | 52.8 | 79.2 | 105.6 | 132.0 | 158.4 | 184.9 | 211.3 |
| 1½" SCH 160 | 70.3 | 105.4 | 140.5 | 175.7 | 210.8 | 245.9 | 281.1 |

| PIPE SIZE/SCHEDULE | DRIVE VOLUME LOSS @ 2250' (in^3) | DRIVE VOLUME LOSS @ 2500' (in^3) | DRIVE VOLUME LOSS @ 2750' (in^3) | DRIVE VOLUME LOSS @ 3000' (in^3) | DRIVE VOLUME LOSS @ 3250' (in^3) | DRIVE VOLUME LOSS @ 3500' (in^3) | DRIVE VOLUME LOSS @ 3750' (in^3) | DRIVE VOLUME LOSS @ 4000' (in^3) |
|---|---|---|---|---|---|---|---|---|
| ⅛" SCH 40 | 12.8 | 14.2 | 15.6 | 17.0 | 18.5 | 19.9 | 21.3 | 22.7 |
| ¼" SCH 40 | 23.4 | 26.0 | 28.6 | 31.2 | 33.8 | 36.4 | 39.0 | 41.6 |
| ⅜" SCH 40 | 42.9 | 47.7 | 52.5 | 57.2 | 62.0 | 66.8 | 71.5 | 76.3 |
| ½" SCH 40 | 68.3 | 75.9 | 83.5 | 91.1 | 98.7 | 106.3 | 113.9 | 121.5 |
| ¾" SCH 40 | 119.9 | 133.2 | 146.6 | 159.9 | 173.2 | 186.5 | 199.9 | 213.2 |
| 1" SCH 40 | 194.4 | 216.0 | 237.5 | 259.1 | 280.7 | 302.3 | 323.9 | 345.5 |
| 1¼" SCH 40 | 336.4 | 373.7 | 411.1 | 448.5 | 485.9 | 523.2 | 560.6 | 598.0 |
| 1½" SCH 40 | 457.8 | 508.7 | 559.6 | 610.4 | 661.3 | 712.2 | 763.0 | 813.9 |
| ⅛" SCH 80 | 8.2 | 9.1 | 10.0 | 10.9 | 11.8 | 12.7 | 13.6 | 14.5 |

TABLE 10-continued

| Drive Delta-P = (psi) 2500 | | | | | | | | |
|---|---|---|---|---|---|---|---|---|
| ¼" SCH 80 | 16.1 | 17.9 | 19.7 | 21.5 | 23.3 | 25.1 | 26.8 | 28.6 |
| ⅜" SCH 80 | 31.6 | 35.1 | 38.6 | 42.1 | 45.6 | 49.2 | 52.7 | 56.2 |
| ½" SCH 80 | 52.7 | 58.5 | 64.4 | 70.2 | 76.1 | 81.9 | 87.8 | 93.6 |
| ¾" SCH 80 | 97.2 | 108.0 | 118.9 | 129.7 | 140.5 | 151.3 | 162.1 | 172.9 |
| 1" SCH 80 | 161.8 | 179.7 | 197.7 | 215.7 | 233.7 | 251.6 | 269.6 | 287.6 |
| 1¼" SCH 80 | 288.5 | 320.5 | 352.6 | 384.6 | 416.7 | 448.7 | 480.8 | 512.9 |
| 1½" SCH 80 | 397.4 | 441.6 | 485.7 | 529.9 | 574.0 | 618.2 | 662.3 | 706.5 |
| ½" SCH 160 | 38.0 | 42.3 | 46.5 | 50.7 | 54.9 | 59.2 | 63.4 | 67.6 |
| ¾" SCH 160 | 66.2 | 73.5 | 80.9 | 88.2 | 95.6 | 102.9 | 110.3 | 117.6 |
| 1" SCH 160 | 117.3 | 130.4 | 143.4 | 156.4 | 169.5 | 182.5 | 195.5 | 208.6 |
| 1¼" SCH 160 | 237.7 | 264.1 | 290.5 | 316.9 | 343.3 | 369.7 | 396.1 | 422.5 |
| 1½" SCH 160 | 316.2 | 351.3 | 386.5 | 421.6 | 456.7 | 491.9 | 527.0 | 562.1 |

TABLE 11

DATA for oil
Bulk Modulus = (psi) 250000

| PIPE SIZE/SCHEDULE | OD (in) | OD AREA (in^2) | ID (in) | ID AREA (in^2) | WALL THCK (in) | VOL. @ DEPTH 500 (in^3) | VOL. @ DEPTH 750 (in^3) | VOL. @ DEPTH 1000 (in^3) | VOL. @ DEPTH 1250 (in^3) |
|---|---|---|---|---|---|---|---|---|---|
| ⅛" SCH 40 | 0.405 | 0.129 | 0.269 | 0.057 | 0.068 | 340.8 | 511.2 | 681.6 | 852.1 |
| ¼" SCH 40 | 0.540 | 0.229 | 0.364 | 0.104 | 0.088 | 624.1 | 936.1 | 1248.1 | 1560.1 |
| ⅜" SCH 40 | 0.675 | 0.358 | 0.493 | 0.191 | 0.091 | 1144.8 | 1717.1 | 2289.5 | 2861.9 |
| ½" SCH 40 | 0.840 | 0.554 | 0.622 | 0.304 | 0.109 | 1822.2 | 2733.3 | 3644.4 | 4555.6 |
| ¾" SCH 40 | 1.050 | 0.865 | 0.824 | 0.533 | 0.113 | 3198.0 | 4797.0 | 6396.0 | 7994.9 |
| 1" SCH 40 | 1.315 | 1.357 | 1.049 | 0.864 | 0.133 | 5182.9 | 7774.3 | 10365.8 | 12957.2 |
| 1¼" SCH 40 | 1.660 | 2.163 | 1.380 | 1.495 | 0.140 | 8969.7 | 13454.6 | 17939.4 | 22424.3 |
| 1½" SCH 40 | 1.900 | 2.834 | 1.610 | 2.035 | 0.145 | 12208.8 | 18313.2 | 24417.6 | 30522.0 |
| ⅛" SCH 80 | 0.405 | 0.129 | 0.215 | 0.036 | 0.095 | 217.7 | 326.6 | 435.4 | 544.3 |
| ¼" SCH 80 | 0.540 | 0.229 | 0.302 | 0.072 | 0.119 | 429.6 | 644.4 | 859.1 | 1073.9 |
| ⅜" SCH 80 | 0.675 | 0.358 | 0.423 | 0.140 | 0.126 | 842.8 | 1264.1 | 1685.5 | 2106.9 |
| ½" SCH 80 | 0.840 | 0.554 | 0.546 | 0.234 | 0.147 | 1404.1 | 2106.2 | 2808.3 | 3510.3 |
| ¾" SCH 80 | 1.050 | 0.865 | 0.742 | 0.432 | 0.154 | 2593.2 | 3889.7 | 5186.3 | 6482.9 |
| 1" SCH 80 | 1.315 | 1.357 | 0.957 | 0.719 | 0.179 | 4313.6 | 6470.5 | 8627.3 | 10784.1 |
| 1¼" SCH 80 | 1.660 | 2.163 | 1.278 | 1.282 | 0.191 | 7692.8 | 11539.2 | 15385.5 | 19231.9 |
| 1½" SCH 80 | 1.900 | 2.834 | 1.500 | 1.766 | 0.200 | 10597.5 | 15896.3 | 21195.0 | 26493.8 |
| ½" SCH 160 | 0.840 | 0.554 | 0.464 | 0.169 | 0.188 | 1014.0 | 1521.1 | 2028.1 | 2535.1 |
| ¾" SCH 160 | 1.050 | 0.865 | 0.612 | 0.294 | 0.219 | 1764.1 | 2646.2 | 3528.2 | 4410.3 |
| 1" SCH 160 | 1.315 | 1.357 | 0.815 | 0.521 | 0.250 | 3128.5 | 4692.7 | 6257.0 | 7821.2 |
| 1¼" SCH 160 | 1.660 | 2.163 | 1.160 | 1.056 | 0.250 | 6337.8 | 9506.7 | 12675.6 | 15844.4 |
| 1½" SCH 160 | 1.900 | 2.834 | 1.338 | 1.405 | 0.281 | 8432.0 | 12648.1 | 16864.1 | 21080.1 |

| PIPE SIZE/SCHEDULE | OD (in) | OD AREA (in^2) | ID (in) | ID AREA (in^2) | WALL THCK (in) | VOL. @ DEPTH 1500 (in^3) | VOL. @ DEPTH 1750 (in^3) | VOL. @ DEPTH 2000 (in^3) | VOL. @ DEPTH 2250 (in^3) |
|---|---|---|---|---|---|---|---|---|---|
| ⅛" SCH 40 | 0.405 | 0.129 | 0.269 | 0.057 | 0.068 | 1022.5 | 1192.9 | 1363.3 | 1533.7 |
| ¼" SCH 40 | 0.540 | 0.229 | 0.364 | 0.104 | 0.088 | 1872.2 | 2184.2 | 2496.2 | 2808.3 |
| ⅜" SCH 40 | 0.675 | 0.358 | 0.493 | 0.191 | 0.091 | 3434.3 | 4006.7 | 4579.0 | 5151.4 |
| ½" SCH 40 | 0.840 | 0.554 | 0.622 | 0.304 | 0.109 | 5466.7 | 6377.8 | 7288.9 | 8200.0 |
| ¾" SCH 40 | 1.050 | 0.865 | 0.824 | 0.533 | 0.113 | 9593.9 | 11192.9 | 12791.9 | 14390.9 |
| 1" SCH 40 | 1.315 | 1.357 | 1.049 | 0.864 | 0.133 | 15548.7 | 18140.1 | 20731.6 | 23323.0 |
| 1¼" SCH 40 | 1.660 | 2.163 | 1.380 | 1.495 | 0.140 | 26909.2 | 31394.0 | 35878.9 | 40363.8 |
| 1½" SCH 40 | 1.900 | 2.834 | 1.610 | 2.035 | 0.145 | 36626.4 | 42730.8 | 48835.2 | 54939.6 |
| ⅛" SCH 80 | 0.405 | 0.129 | 0.215 | 0.036 | 0.095 | 653.2 | 762.0 | 870.9 | 979.7 |
| ¼" SCH 80 | 0.540 | 0.229 | 0.302 | 0.072 | 0.119 | 1288.7 | 1503.5 | 1718.3 | 1933.1 |
| ⅜" SCH 80 | 0.675 | 0.358 | 0.423 | 0.140 | 0.126 | 2528.3 | 2949.6 | 3371.0 | 3792.4 |
| ½" SCH 80 | 0.840 | 0.554 | 0.546 | 0.234 | 0.147 | 4212.4 | 4914.4 | 5616.5 | 6318.6 |
| ¾" SCH 80 | 1.050 | 0.865 | 0.742 | 0.432 | 0.154 | 7779.5 | 9076.0 | 10372.6 | 11669.2 |
| 1" SCH 80 | 1.315 | 1.357 | 0.957 | 0.719 | 0.179 | 12940.9 | 15097.8 | 17254.6 | 19411.4 |
| 1¼" SCH 80 | 1.660 | 2.163 | 1.278 | 1.282 | 0.191 | 23078.3 | 26924.7 | 30771.1 | 34617.5 |
| 1½" SCH 80 | 1.900 | 2.834 | 1.500 | 1.766 | 0.200 | 31792.5 | 37091.3 | 42390.0 | 47688.8 |
| ½" SCH 160 | 0.840 | 0.554 | 0.464 | 0.169 | 0.188 | 3042.1 | 3549.2 | 4056.2 | 4563.2 |
| ¾" SCH 160 | 1.050 | 0.865 | 0.612 | 0.294 | 0.219 | 5292.3 | 6174.4 | 7056.4 | 7938.5 |
| 1" SCH 160 | 1.315 | 1.357 | 0.815 | 0.521 | 0.250 | 9385.5 | 10949.7 | 12514.0 | 14078.2 |
| 1¼" SCH 160 | 1.660 | 2.163 | 1.160 | 1.056 | 0.250 | 19013.3 | 22182.2 | 25351.1 | 28520.0 |
| 1½" SCH 160 | 1.900 | 2.834 | 1.338 | 1.405 | 0.281 | 25296.1 | 29512.2 | 33728.2 | 37944.2 |

TABLE 11-continued

DATA for oil
Bulk Modulus = (psi) 250000

| PIPE SIZE/SCHEDULE | OD (in) | OD AREA (in^2) | ID (in) | ID AREA (in^2) | WALL THCK (in) | VOL. @ DEPTH 2500 (in^3) | VOL. @ DEPTH 2750 (in^3) | VOL. @ DEPTH 3000 (in^3) | VOL. @ DEPTH 3250 (in^3) |
|---|---|---|---|---|---|---|---|---|---|
| ⅛" SCH 40 | 0.405 | 0.129 | 0.269 | 0.057 | 0.068 | 1704.1 | 1874.5 | 2044.9 | 2215.3 |
| ¼" SCH 40 | 0.540 | 0.229 | 0.364 | 0.104 | 0.088 | 3120.3 | 3432.3 | 3744.3 | 4056.4 |
| ⅜" SCH 40 | 0.675 | 0.358 | 0.493 | 0.191 | 0.091 | 5723.8 | 6296.2 | 6868.6 | 7440.9 |
| ½" SCH 40 | 0.840 | 0.554 | 0.622 | 0.304 | 0.109 | 9111.1 | 10022.2 | 10933.3 | 11844.5 |
| ¾" SCH 40 | 1.050 | 0.865 | 0.824 | 0.533 | 0.113 | 15989.9 | 17588.9 | 19187.9 | 20786.9 |
| 1" SCH 40 | 1.315 | 1.357 | 1.049 | 0.864 | 0.133 | 25914.4 | 28505.9 | 31097.3 | 33688.8 |
| 1¼" SCH 40 | 1.660 | 2.163 | 1.380 | 1.495 | 0.140 | 44848.6 | 49333.5 | 53818.3 | 58303.2 |
| 1½" SCH 40 | 1.900 | 2.834 | 1.610 | 2.035 | 0.145 | 61044.0 | 67148.4 | 73252.7 | 79357.1 |
| ⅛" SCH 80 | 0.405 | 0.129 | 0.215 | 0.036 | 0.095 | 1088.6 | 1197.5 | 1306.3 | 1415.2 |
| ¼" SCH 80 | 0.540 | 0.229 | 0.302 | 0.072 | 0.119 | 2147.9 | 2362.6 | 2577.4 | 2792.2 |
| ⅜" SCH 80 | 0.675 | 0.358 | 0.423 | 0.140 | 0.126 | 4213.8 | 4635.2 | 5056.5 | 5477.9 |
| ½" SCH 80 | 0.840 | 0.554 | 0.546 | 0.234 | 0.147 | 7020.6 | 7722.7 | 8424.8 | 9126.8 |
| ¾" SCH 80 | 1.050 | 0.865 | 0.742 | 0.432 | 0.154 | 12965.8 | 14262.4 | 15558.9 | 16855.5 |
| 1" SCH 80 | 1.315 | 1.357 | 0.957 | 0.719 | 0.179 | 21568.2 | 23725.1 | 25881.9 | 28038.7 |
| 1¼" SCH 80 | 1.660 | 2.163 | 1.278 | 1.282 | 0.191 | 38463.8 | 42310.2 | 46156.6 | 50003.0 |
| 1½" SCH 80 | 1.900 | 2.834 | 1.500 | 1.766 | 0.200 | 52987.5 | 58286.3 | 63585.0 | 68883.8 |
| ½" SCH 160 | 0.840 | 0.554 | 0.464 | 0.169 | 0.188 | 5070.2 | 5577.2 | 6084.3 | 6591.3 |
| ¾" SCH 160 | 1.050 | 0.865 | 0.612 | 0.294 | 0.219 | 8820.5 | 9702.6 | 10584.6 | 11466.7 |
| 1" SCH 160 | 1.315 | 1.357 | 0.815 | 0.521 | 0.250 | 15642.5 | 17206.7 | 18771.0 | 20335.2 |
| 1¼" SCH 160 | 1.660 | 2.163 | 1.160 | 1.056 | 0.250 | 31688.9 | 34857.8 | 38026.7 | 41195.5 |
| 1½" SCH 160 | 1.900 | 2.834 | 1.338 | 1.405 | 0.281 | 42160.2 | 46376.3 | 50592.3 | 54808.3 |

| PIPE SIZE/SCHEDULE | OD (in) | OD AREA (in^2) | ID (in) | ID AREA (in^2) | WALL THCK (in) | VOL. @ DEPTH 3500 (in^3) | VOL. @ DEPTH 3750 (in^3) | VOL. @ DEPTH 4000 (in^3) |
|---|---|---|---|---|---|---|---|---|
| ⅛" SCH 40 | 0.405 | 0.129 | 0.269 | 0.057 | 0.068 | 2385.7 | 2556.2 | 2726.6 |
| ¼" SCH 40 | 0.540 | 0.229 | 0.364 | 0.104 | 0.088 | 4368.4 | 4680.4 | 4992.4 |
| ⅜" SCH 40 | 0.675 | 0.358 | 0.493 | 0.191 | 0.091 | 8013.3 | 8585.7 | 9158.1 |
| ½" SCH 40 | 0.840 | 0.554 | 0.622 | 0.304 | 0.109 | 12755.6 | 13666.7 | 14577.8 |
| ¾" SCH 40 | 1.050 | 0.865 | 0.824 | 0.533 | 0.113 | 22385.8 | 23984.8 | 25583.8 |
| 1" SCH 40 | 1.315 | 1.357 | 1.049 | 0.864 | 0.133 | 36280.2 | 38871.7 | 41463.1 |
| 1¼" SCH 40 | 1.660 | 2.163 | 1.380 | 1.495 | 0.140 | 62788.1 | 67272.9 | 71757.8 |
| 1½" SCH 40 | 1.900 | 2.834 | 1.610 | 2.035 | 0.145 | 85461.5 | 91565.9 | 97670.3 |
| ⅛" SCH 80 | 0.405 | 0.129 | 0.215 | 0.036 | 0.095 | 1524.0 | 1632.9 | 1741.8 |
| ¼" SCH 80 | 0.540 | 0.229 | 0.302 | 0.072 | 0.119 | 3007.0 | 3221.8 | 3436.6 |
| ⅜" SCH 80 | 0.675 | 0.358 | 0.423 | 0.140 | 0.126 | 5899.3 | 6320.7 | 6742.0 |
| ½" SCH 80 | 0.840 | 0.554 | 0.546 | 0.234 | 0.147 | 9828.9 | 10530.9 | 11233.0 |
| ¾" SCH 80 | 1.050 | 0.865 | 0.742 | 0.432 | 0.154 | 18152.1 | 19448.7 | 20745.3 |
| 1" SCH 80 | 1.315 | 1.357 | 0.957 | 0.719 | 0.179 | 30195.5 | 32352.4 | 34509.2 |
| 1¼" SCH 80 | 1.660 | 2.163 | 1.278 | 1.282 | 0.191 | 53849.4 | 57695.8 | 61542.1 |
| 1½" SCH 80 | 1.900 | 2.834 | 1.500 | 1.766 | 0.200 | 74182.5 | 79481.3 | 84780.0 |
| ½" SCH 160 | 0.840 | 0.554 | 0.464 | 0.169 | 0.188 | 7098.3 | 7605.3 | 8112.4 |
| ¾" SCH 160 | 1.050 | 0.865 | 0.612 | 0.294 | 0.219 | 12348.7 | 13230.8 | 14112.8 |
| 1" SCH 160 | 1.315 | 1.357 | 0.815 | 0.521 | 0.250 | 21899.5 | 23463.7 | 25028.0 |
| 1¼" SCH 160 | 1.660 | 2.163 | 1.160 | 1.056 | 0.250 | 44364.4 | 47533.3 | 50702.2 |
| 1½" SCH 160 | 1.900 | 2.834 | 1.338 | 1.405 | 0.281 | 59024.3 | 63240.4 | 67456.4 |

TABLE 12

Drive Delta-P = (psi) 500

| PIPE SIZE/SCHEDULE | DRIVE VOLUME LOSS @ 500' (in^3) | DRIVE VOLUME LOSS @ 750' (in^3) | DRIVE VOLUME LOSS @ 1000' (in^3) | DRIVE VOLUME LOSS @ 1250' (in^3) | DRIVE VOLUME LOSS @ 1500' (in^3) | DRIVE VOLUME LOSS @ 1750' (in^3) | DRIVE VOLUME LOSS @ 2000' (in^3) |
|---|---|---|---|---|---|---|---|
| ⅛" SCH 40 | 0.7 | 1.0 | 1.4 | 1.7 | 2.0 | 2.4 | 2.7 |
| ¼" SCH 40 | 1.2 | 1.9 | 2.5 | 3.1 | 3.7 | 4.4 | 5.0 |
| ⅜" SCH 40 | 2.3 | 3.4 | 4.6 | 5.7 | 6.9 | 8.0 | 9.2 |
| ½" SCH 40 | 3.6 | 5.5 | 7.3 | 9.1 | 10.9 | 12.8 | 14.6 |
| ¾" SCH 40 | 6.4 | 9.6 | 12.8 | 16.0 | 19.2 | 22.4 | 25.6 |
| 1" SCH 40 | 10.4 | 15.5 | 20.7 | 25.9 | 31.1 | 36.3 | 41.5 |
| 1¼" SCH 40 | 17.9 | 26.9 | 35.9 | 44.8 | 53.8 | 62.8 | 71.8 |
| 1½" SCH 40 | 24.4 | 36.6 | 48.8 | 61.0 | 73.3 | 85.5 | 97.7 |
| ⅛" SCH 80 | 0.4 | 0.7 | 0.9 | 1.1 | 1.3 | 1.5 | 1.7 |
| ¼" SCH 80 | 0.9 | 1.3 | 1.7 | 2.1 | 2.6 | 3.0 | 3.4 |

TABLE 12-continued

| Drive Delta-P = (psi) 500 | | | | | | | |
|---|---|---|---|---|---|---|---|
| ⅜" SCH 80 | 1.7 | 2.5 | 3.4 | 4.2 | 5.1 | 5.9 | 6.7 |
| ½" SCH 80 | 2.8 | 4.2 | 5.6 | 7.0 | 8.4 | 9.8 | 11.2 |
| ¾" SCH 80 | 5.2 | 7.8 | 10.4 | 13.0 | 15.6 | 18.2 | 20.7 |
| 1" SCH 80 | 8.6 | 12.9 | 17.3 | 21.6 | 25.9 | 30.2 | 34.5 |
| 1¼" SCH 80 | 15.4 | 23.1 | 30.8 | 38.5 | 46.2 | 53.8 | 61.5 |
| 1½" SCH 80 | 21.2 | 31.8 | 42.4 | 53.0 | 63.6 | 74.2 | 84.8 |
| ½" SCH 160 | 2.0 | 3.0 | 4.1 | 5.1 | 6.1 | 7.1 | 8.1 |
| ¾" SCH 160 | 3.5 | 5.3 | 7.1 | 8.8 | 10.6 | 12.3 | 14.1 |
| 1" SCH 160 | 6.3 | 9.4 | 12.5 | 15.6 | 18.8 | 21.9 | 25.0 |
| 1¼" SCH 160 | 12.7 | 19.0 | 25.4 | 31.7 | 38.0 | 44.4 | 50.7 |
| 1½" SCH 160 | 16.9 | 25.3 | 33.7 | 42.2 | 50.6 | 59.0 | 67.5 |

| PIPE SIZE/SCHEDULE | DRIVE VOLUME LOSS @ 2250' (in^3) | DRIVE VOLUME LOSS @ 2500' (in^3) | DRIVE VOLUME LOSS @ 2750' (in^3) | DRIVE VOLUME LOSS @ 3000' (in^3) | DRIVE VOLUME LOSS @ 3250' (in^3) | DRIVE VOLUME LOSS @ 3500' (in^3) | DRIVE VOLUME LOSS @ 3750' (in^3) | DRIVE VOLUME LOSS @ 4000' (in^3) |
|---|---|---|---|---|---|---|---|---|
| ⅛" SCH 40 | 3.1 | 3.4 | 3.7 | 4.1 | 4.4 | 4.8 | 5.1 | 5.5 |
| ¼" SCH 40 | 5.6 | 6.2 | 6.9 | 7.5 | 8.1 | 8.7 | 9.4 | 10.0 |
| ⅜" SCH 40 | 10.3 | 11.4 | 12.6 | 13.7 | 14.9 | 16.0 | 17.2 | 18.3 |
| ½" SCH 40 | 16.4 | 18.2 | 20.0 | 21.9 | 23.7 | 25.5 | 27.3 | 29.2 |
| ¾" SCH 40 | 28.8 | 32.0 | 35.2 | 38.4 | 41.6 | 44.8 | 48.0 | 51.2 |
| 1" SCH 40 | 46.6 | 51.8 | 57.0 | 62.2 | 67.4 | 72.6 | 77.7 | 82.9 |
| 1¼" SCH 40 | 80.7 | 89.7 | 98.7 | 107.6 | 116.6 | 125.6 | 134.5 | 143.5 |
| 1½" SCH 40 | 109.9 | 122.1 | 134.3 | 146.5 | 158.7 | 170.9 | 183.1 | 195.3 |
| ⅛" SCH 80 | 2.0 | 2.2 | 2.4 | 2.6 | 2.8 | 3.0 | 3.3 | 3.5 |
| ¼" SCH 80 | 3.9 | 4.3 | 4.7 | 5.2 | 5.6 | 6.0 | 6.4 | 6.9 |
| ⅜" SCH 80 | 7.6 | 8.4 | 9.3 | 10.1 | 11.0 | 11.8 | 12.6 | 13.5 |
| ½" SCH 80 | 12.6 | 14.0 | 15.4 | 16.8 | 18.3 | 19.7 | 21.1 | 22.5 |
| ¾" SCH 80 | 23.3 | 25.9 | 28.5 | 31.1 | 33.7 | 36.3 | 38.9 | 41.5 |
| 1" SCH 80 | 38.8 | 43.1 | 47.5 | 51.8 | 56.1 | 60.4 | 64.7 | 69.0 |
| 1¼" SCH 80 | 69.2 | 76.9 | 84.6 | 92.3 | 100.0 | 107.7 | 115.4 | 123.1 |
| 1½" SCH 80 | 95.4 | 106.0 | 116.6 | 127.2 | 137.8 | 148.4 | 159.0 | 169.6 |
| ½" SCH 160 | 9.1 | 10.1 | 11.2 | 12.2 | 13.2 | 14.2 | 15.2 | 16.2 |
| ¾" SCH 160 | 15.9 | 17.6 | 19.4 | 21.2 | 22.9 | 24.7 | 26.5 | 28.2 |
| 1" SCH 160 | 28.2 | 31.3 | 34.4 | 37.5 | 40.7 | 43.8 | 46.9 | 50.1 |
| 1¼" SCH 160 | 57.0 | 63.4 | 69.7 | 76.1 | 82.4 | 88.7 | 95.1 | 101.4 |
| 1½" SCH 160 | 75.9 | 84.3 | 92.8 | 101.2 | 109.6 | 118.0 | 126.5 | 134.9 |

TABLE 13

| Drive Delta-P = (psi) 750 | | | | | | | |
|---|---|---|---|---|---|---|---|
| PIPE SIZE/SCHEDULE | DRIVE VOLUME LOSS @ 500' (in^3) | DRIVE VOLUME LOSS @ 750' (in^3) | DRIVE VOLUME LOSS @ 1000' (in^3) | DRIVE VOLUME LOSS @ 1250' (in^3) | DRIVE VOLUME LOSS @ 1500' (in^3) | DRIVE VOLUME LOSS @ 1750' (in^3) | DRIVE VOLUME LOSS @ 2000' (in^3) |
| ⅛" SCH 40 | 1.0 | 1.5 | 2.0 | 2.6 | 3.1 | 3.6 | 4.1 |
| ¼" SCH 40 | 1.9 | 2.8 | 3.7 | 4.7 | 5.6 | 6.6 | 7.5 |
| ⅜" SCH 40 | 3.4 | 5.2 | 6.9 | 8.6 | 10.3 | 12.0 | 13.7 |
| ½" SCH 40 | 5.5 | 8.2 | 10.9 | 13.7 | 16.4 | 19.1 | 21.9 |
| ¾" SCH 40 | 9.6 | 14.4 | 19.2 | 24.0 | 28.8 | 33.6 | 38.4 |
| 1" SCH 40 | 15.5 | 23.3 | 31.1 | 38.9 | 46.6 | 54.4 | 62.2 |
| 1¼" SCH 40 | 26.9 | 40.4 | 53.8 | 67.3 | 80.7 | 94.2 | 107.6 |
| 1½" SCH 40 | 36.6 | 54.9 | 73.3 | 91.6 | 109.9 | 128.2 | 146.5 |
| ⅛" SCH 80 | 0.7 | 1.0 | 1.3 | 1.6 | 2.0 | 2.3 | 2.6 |
| ¼" SCH 80 | 1.3 | 1.9 | 2.6 | 3.2 | 3.9 | 4.5 | 5.2 |
| ⅜" SCH 80 | 2.5 | 3.8 | 5.1 | 6.3 | 7.6 | 8.8 | 10.1 |
| ½" SCH 80 | 4.2 | 6.3 | 8.4 | 10.5 | 12.6 | 14.7 | 16.8 |
| ¾" SCH 80 | 7.8 | 11.7 | 15.6 | 19.4 | 23.3 | 27.2 | 31.1 |
| 1" SCH 80 | 12.9 | 19.4 | 25.9 | 32.4 | 38.8 | 45.3 | 51.8 |
| 1¼" SCH 80 | 23.1 | 34.6 | 46.2 | 57.7 | 69.2 | 80.8 | 92.3 |
| 1½" SCH 80 | 31.8 | 47.7 | 63.6 | 79.5 | 95.4 | 111.3 | 127.2 |
| ½" SCH 160 | 3.0 | 4.6 | 6.1 | 7.6 | 9.1 | 10.6 | 12.2 |
| ¾" SCH 160 | 5.3 | 7.9 | 10.6 | 13.2 | 15.9 | 18.5 | 21.2 |
| 1" SCH 160 | 9.4 | 14.1 | 18.8 | 23.5 | 28.2 | 32.8 | 37.5 |
| 1¼" SCH 160 | 19.0 | 28.5 | 38.0 | 47.5 | 57.0 | 66.5 | 76.1 |
| 1½" SCH 160 | 25.3 | 37.9 | 50.6 | 63.2 | 75.9 | 88.5 | 101.2 |

TABLE 13-continued

| Drive Delta-P = (psi) 750 | | | | | | | | |
|---|---|---|---|---|---|---|---|---|
| PIPE SIZE/SCHEDULE | DRIVE VOLUME LOSS @ 2250' (in^3) | DRIVE VOLUME LOSS @ 2500' (in^3) | DRIVE VOLUME LOSS @ 2750' (in^3) | DRIVE VOLUME LOSS @ 3000' (in^3) | DRIVE VOLUME LOSS @ 3250' (in^3) | DRIVE VOLUME LOSS @ 3500' (in^3) | DRIVE VOLUME LOSS @ 3750' (in^3) | DRIVE VOLUME LOSS @ 4000' (in^3) |
| ⅛" SCH 40 | 4.6 | 5.1 | 5.6 | 6.1 | 6.6 | 7.2 | 7.7 | 8.2 |
| ¼" SCH 40 | 8.4 | 9.4 | 10.3 | 11.2 | 12.2 | 13.1 | 14.0 | 15.0 |
| ⅜" SCH 40 | 15.5 | 17.2 | 18.9 | 20.6 | 22.3 | 24.0 | 25.8 | 27.5 |
| ½" SCH 40 | 24.6 | 27.3 | 30.1 | 32.8 | 35.5 | 38.3 | 41.0 | 43.7 |
| ¾" SCH 40 | 43.2 | 48.0 | 52.8 | 57.6 | 62.4 | 67.2 | 72.0 | 76.8 |
| 1" SCH 40 | 70.0 | 77.7 | 85.5 | 93.3 | 101.1 | 108.8 | 116.6 | 124.4 |
| 1¼" SCH 40 | 121.1 | 134.5 | 148.0 | 161.5 | 174.9 | 188.4 | 201.8 | 215.3 |
| 1½" SCH 40 | 164.8 | 183.1 | 201.4 | 219.8 | 238.1 | 256.4 | 274.7 | 293.0 |
| ⅛" SCH 80 | 2.9 | 3.3 | 3.6 | 3.9 | 4.2 | 4.6 | 4.9 | 5.2 |
| ¼" SCH 80 | 5.8 | 6.4 | 7.1 | 7.7 | 8.4 | 9.0 | 9.7 | 10.3 |
| ⅜" SCH 80 | 11.4 | 12.6 | 13.9 | 15.2 | 16.4 | 17.7 | 19.0 | 20.2 |
| ½" SCH 80 | 19.0 | 21.1 | 23.2 | 25.3 | 27.4 | 29.5 | 31.6 | 33.7 |
| ¾" SCH 80 | 35.0 | 38.9 | 42.8 | 46.7 | 50.6 | 54.5 | 58.3 | 62.2 |
| 1" SCH 80 | 58.2 | 64.7 | 71.2 | 77.6 | 84.1 | 90.6 | 97.1 | 103.5 |
| 1¼" SCH 80 | 103.9 | 115.4 | 126.9 | 138.5 | 150.0 | 161.5 | 173.1 | 184.6 |
| 1½" SCH 80 | 143.1 | 159.0 | 174.9 | 190.8 | 206.7 | 222.5 | 238.4 | 254.3 |
| ½" SCH 160 | 13.7 | 15.2 | 16.7 | 18.3 | 19.8 | 21.3 | 22.8 | 24.3 |
| ¾" SCH 160 | 23.8 | 26.5 | 29.1 | 31.8 | 34.4 | 37.0 | 39.7 | 42.3 |
| 1" SCH 160 | 42.2 | 46.9 | 51.6 | 56.3 | 61.0 | 65.7 | 70.4 | 75.1 |
| 1¼" SCH 160 | 85.6 | 95.1 | 104.6 | 114.1 | 123.6 | 133.1 | 142.6 | 152.1 |
| 1½" SCH 160 | 113.8 | 126.5 | 139.1 | 151.8 | 164.4 | 177.1 | 189.7 | 202.4 |

TABLE 14

| Drive Delta-P = (psi) 1000 | | | | | | | |
|---|---|---|---|---|---|---|---|
| PIPE SIZE/SCHEDULE | DRIVE VOLUME LOSS @ 500' (in^3) | DRIVE VOLUME LOSS @ 750' (in^3) | DRIVE VOLUME LOSS @ 1000' (in^3) | DRIVE VOLUME LOSS @ 1250' (in^3) | DRIVE VOLUME LOSS @ 1500' (in^3) | DRIVE VOLUME LOSS @ 1750' (in^3) | DRIVE VOLUME LOSS @ 2000' (in^3) |
| ⅛" SCH 40 | 1.4 | 2.0 | 2.7 | 3.4 | 4.1 | 4.8 | 5.5 |
| ¼" SCH 40 | 2.5 | 3.7 | 5.0 | 6.2 | 7.5 | 8.7 | 10.0 |
| ⅜" SCH 40 | 4.6 | 6.9 | 9.2 | 11.4 | 13.7 | 16.0 | 18.3 |
| ½" SCH 40 | 7.3 | 10.9 | 14.6 | 18.2 | 21.9 | 25.5 | 29.2 |
| ¾" SCH 40 | 12.8 | 19.2 | 25.6 | 32.0 | 38.4 | 44.8 | 51.2 |
| 1" SCH 40 | 20.7 | 31.1 | 41.5 | 51.8 | 62.2 | 72.6 | 82.9 |
| 1¼" SCH 40 | 35.9 | 53.8 | 71.8 | 89.7 | 107.6 | 125.6 | 143.5 |
| 1½" SCH 40 | 48.8 | 73.3 | 97.7 | 122.1 | 146.5 | 170.9 | 195.3 |
| ⅛" SCH 80 | 0.9 | 1.3 | 1.7 | 2.2 | 2.6 | 3.0 | 3.5 |
| ¼" SCH 80 | 1.7 | 2.6 | 3.4 | 4.3 | 5.2 | 6.0 | 6.9 |
| ⅜" SCH 80 | 3.4 | 5.1 | 6.7 | 8.4 | 10.1 | 11.8 | 13.5 |
| ½" SCH 80 | 5.6 | 8.4 | 11.2 | 14.0 | 16.8 | 19.7 | 22.5 |
| ¾" SCH 80 | 10.4 | 15.6 | 20.7 | 25.9 | 31.1 | 36.3 | 41.5 |
| 1" SCH 80 | 17.3 | 25.9 | 34.5 | 43.1 | 51.8 | 60.4 | 69.0 |
| 1¼" SCH 80 | 30.8 | 46.2 | 61.5 | 76.9 | 92.3 | 107.7 | 123.1 |
| 1½" SCH 80 | 42.4 | 63.6 | 84.8 | 106.0 | 127.2 | 148.4 | 169.6 |
| ½" SCH 160 | 4.1 | 6.1 | 8.1 | 10.1 | 12.2 | 14.2 | 16.2 |
| ¾" SCH 160 | 7.1 | 10.6 | 14.1 | 17.6 | 21.2 | 24.7 | 28.2 |
| 1" SCH 160 | 12.5 | 18.8 | 25.0 | 31.3 | 37.5 | 43.8 | 50.1 |
| 1¼" SCH 160 | 25.4 | 38.0 | 50.7 | 63.4 | 76.1 | 88.7 | 101.4 |
| 1½" SCH 160 | 33.7 | 50.6 | 67.5 | 84.3 | 101.2 | 118.0 | 134.9 |

| PIPE SIZE/SCHEDULE | DRIVE VOLUME LOSS @ 2250' (in^3) | DRIVE VOLUME LOSS @ 2500' (in^3) | DRIVE VOLUME LOSS @ 2750' (in^3) | DRIVE VOLUME LOSS @ 3000' (in^3) | DRIVE VOLUME LOSS @ 3250' (in^3) | DRIVE VOLUME LOSS @ 3500' (in^3) | DRIVE VOLUME LOSS @ 3750' (in^3) | DRIVE VOLUME LOSS @ 4000' (in^3) |
|---|---|---|---|---|---|---|---|---|
| ⅛" SCH 40 | 6.1 | 6.8 | 7.5 | 8.2 | 8.9 | 9.5 | 10.2 | 10.9 |
| ¼" SCH 40 | 11.2 | 12.5 | 13.7 | 15.0 | 16.2 | 17.5 | 18.7 | 20.0 |
| ⅜" SCH 40 | 20.6 | 22.9 | 25.2 | 27.5 | 29.8 | 32.1 | 34.3 | 36.6 |
| ½" SCH 40 | 32.8 | 36.4 | 40.1 | 43.7 | 47.4 | 51.0 | 54.7 | 58.3 |
| ¾" SCH 40 | 57.6 | 64.0 | 70.4 | 76.8 | 83.1 | 89.5 | 95.9 | 102.3 |
| 1" SCH 40 | 93.3 | 103.7 | 114.0 | 124.4 | 134.8 | 145.1 | 155.5 | 165.9 |
| 1¼" SCH 40 | 161.5 | 179.4 | 197.3 | 215.3 | 233.2 | 251.2 | 269.1 | 287.0 |
| 1½" SCH 40 | 219.8 | 244.2 | 268.6 | 293.0 | 317.4 | 341.8 | 366.3 | 390.7 |
| ⅛" SCH 80 | 3.9 | 4.4 | 4.8 | 5.2 | 5.7 | 6.1 | 6.5 | 7.0 |

TABLE 14-continued

| Drive Delta-P = (psi) 1000 | | | | | | | | |
|---|---|---|---|---|---|---|---|---|
| ¼" SCH 80 | 7.7 | 8.6 | 9.5 | 10.3 | 11.2 | 12.0 | 12.9 | 13.7 |
| ⅜" SCH 80 | 15.2 | 16.9 | 18.5 | 20.2 | 21.9 | 23.6 | 25.3 | 27.0 |
| ½" SCH 80 | 25.3 | 28.1 | 30.9 | 33.7 | 36.5 | 39.3 | 42.1 | 44.9 |
| ¾" SCH 80 | 46.7 | 51.9 | 57.0 | 62.2 | 67.4 | 72.6 | 77.8 | 83.0 |
| 1" SCH 80 | 77.6 | 86.3 | 94.9 | 103.5 | 112.2 | 120.8 | 129.4 | 138.0 |
| 1¼" SCH 80 | 138.5 | 153.9 | 169.2 | 184.6 | 200.0 | 215.4 | 230.8 | 246.2 |
| 1½" SCH 80 | 190.8 | 212.0 | 233.1 | 254.3 | 275.5 | 296.7 | 317.9 | 339.1 |
| ½" SCH 160 | 18.3 | 20.3 | 22.3 | 24.3 | 26.4 | 28.4 | 30.4 | 32.4 |
| ¾" SCH 160 | 31.8 | 35.3 | 38.8 | 42.3 | 45.9 | 49.4 | 52.9 | 56.5 |
| 1" SCH 160 | 56.3 | 62.6 | 68.8 | 75.1 | 81.3 | 87.6 | 93.9 | 100.1 |
| 1¼" SCH 160 | 114.1 | 126.8 | 139.4 | 152.1 | 164.8 | 177.5 | 190.1 | 202.8 |
| 1½" SCH 160 | 151.8 | 168.6 | 185.5 | 202.4 | 219.2 | 236.1 | 253.0 | 269.8 |

TABLE 15

| Drive Delta-P = (psi) 1250 | | | | | | | |
|---|---|---|---|---|---|---|---|
| PIPE SIZE/SCHEDULE | DRIVE VOLUME LOSS @ 500' (in^3) | DRIVE VOLUME LOSS @ 750' (in^3) | DRIVE VOLUME LOSS @ 1000' (in^3) | DRIVE VOLUME LOSS @ 1250' (in^3) | DRIVE VOLUME LOSS @ 1500' (in^3) | DRIVE VOLUME LOSS @ 1750' (in^3) | DRIVE VOLUME LOSS @ 2000' (in^3) |
| ⅛" SCH 40 | 1.7 | 2.6 | 3.4 | 4.3 | 5.1 | 6.0 | 6.8 |
| ¼" SCH 40 | 3.1 | 4.7 | 6.2 | 7.8 | 9.4 | 10.9 | 12.5 |
| ⅜" SCH 40 | 5.7 | 8.6 | 11.4 | 14.3 | 17.2 | 20.0 | 22.9 |
| ½" SCH 40 | 9.1 | 13.7 | 18.2 | 22.8 | 27.3 | 31.9 | 36.4 |
| ¾" SCH 40 | 16.0 | 24.0 | 32.0 | 40.0 | 48.0 | 56.0 | 64.0 |
| 1" SCH 40 | 25.9 | 38.9 | 51.8 | 64.8 | 77.7 | 90.7 | 103.7 |
| 1¼" SCH 40 | 44.8 | 67.3 | 89.7 | 112.1 | 134.5 | 157.0 | 179.4 |
| 1½" SCH 40 | 61.0 | 91.6 | 122.1 | 152.6 | 183.1 | 213.7 | 244.2 |
| ⅛" SCH 80 | 1.1 | 1.6 | 2.2 | 2.7 | 3.3 | 3.8 | 4.4 |
| ¼" SCH 80 | 2.1 | 3.2 | 4.3 | 5.4 | 6.4 | 7.5 | 8.6 |
| ⅜" SCH 80 | 4.2 | 6.3 | 8.4 | 10.5 | 12.6 | 14.7 | 16.9 |
| ½" SCH 80 | 7.0 | 10.5 | 14.0 | 17.6 | 21.1 | 24.6 | 28.1 |
| ¾" SCH 80 | 13.0 | 19.4 | 25.9 | 32.4 | 38.9 | 45.4 | 51.9 |
| 1" SCH 80 | 21.6 | 32.4 | 43.1 | 53.9 | 64.7 | 75.5 | 86.3 |
| 1¼" SCH 80 | 38.5 | 57.7 | 76.9 | 96.2 | 115.4 | 134.6 | 153.9 |
| 1½" SCH 80 | 53.0 | 79.5 | 106.0 | 132.5 | 159.0 | 185.5 | 212.0 |
| ½" SCH 160 | 5.1 | 7.6 | 10.1 | 12.7 | 15.2 | 17.7 | 20.3 |
| ¾" SCH 160 | 8.8 | 13.2 | 17.6 | 22.1 | 26.5 | 30.9 | 35.3 |
| 1" SCH 160 | 15.6 | 23.5 | 31.3 | 39.1 | 46.9 | 54.7 | 62.6 |
| 1¼" SCH 160 | 31.7 | 47.5 | 63.4 | 79.2 | 95.1 | 110.9 | 126.8 |
| 1½" SCH 160 | 42.2 | 63.2 | 84.3 | 105.4 | 126.5 | 147.6 | 168.6 |

| PIPE SIZE/SCHEDULE | DRIVE VOLUME LOSS @ 2250' (in^3) | DRIVE VOLUME LOSS @ 2500' (in^3) | DRIVE VOLUME LOSS @ 2750' (in^3) | DRIVE VOLUME LOSS @ 3000' (in^3) | DRIVE VOLUME LOSS @ 3250' (in^3) | DRIVE VOLUME LOSS @ 3500' (in^3) | DRIVE VOLUME LOSS @ 3750' (in^3) | DRIVE VOLUME LOSS @ 4000' (in^3) |
|---|---|---|---|---|---|---|---|---|
| ⅛" SCH 40 | 7.7 | 8.5 | 9.4 | 10.2 | 11.1 | 11.9 | 12.8 | 13.6 |
| ¼" SCH 40 | 14.0 | 15.6 | 17.2 | 18.7 | 20.3 | 21.8 | 23.4 | 25.0 |
| ⅜" SCH 40 | 25.8 | 28.6 | 31.5 | 34.3 | 37.2 | 40.1 | 42.9 | 45.8 |
| ½" SCH 40 | 41.0 | 45.6 | 50.1 | 54.7 | 59.2 | 63.8 | 68.3 | 72.9 |
| ¾" SCH 40 | 72.0 | 79.9 | 87.9 | 95.9 | 103.9 | 111.9 | 119.9 | 127.9 |
| 1" SCH 40 | 116.6 | 129.6 | 142.5 | 155.5 | 168.4 | 181.4 | 194.4 | 207.3 |
| 1¼" SCH 40 | 201.8 | 224.2 | 246.7 | 269.1 | 291.5 | 313.9 | 336.4 | 358.8 |
| 1½" SCH 40 | 274.7 | 305.2 | 335.7 | 366.3 | 396.8 | 427.3 | 457.8 | 488.4 |
| ⅛" SCH 80 | 4.9 | 5.4 | 6.0 | 6.5 | 7.1 | 7.6 | 8.2 | 8.7 |
| ¼" SCH 80 | 9.7 | 10.7 | 11.8 | 12.9 | 14.0 | 15.0 | 16.1 | 17.2 |
| ⅜" SCH 80 | 19.0 | 21.1 | 23.2 | 25.3 | 27.4 | 29.5 | 31.6 | 33.7 |
| ½" SCH 80 | 31.6 | 35.1 | 38.6 | 42.1 | 45.6 | 49.1 | 52.7 | 56.2 |
| ¾" SCH 80 | 58.3 | 64.8 | 71.3 | 77.8 | 84.3 | 90.8 | 97.2 | 103.7 |
| 1" SCH 80 | 97.1 | 107.8 | 118.6 | 129.4 | 140.2 | 151.0 | 161.8 | 172.5 |
| 1¼" SCH 80 | 173.1 | 192.3 | 211.6 | 230.8 | 250.0 | 269.2 | 288.5 | 307.7 |
| 1½" SCH 80 | 238.4 | 264.9 | 291.4 | 317.9 | 344.4 | 370.9 | 397.4 | 423.9 |
| ½" SCH 160 | 22.8 | 25.4 | 27.9 | 30.4 | 33.0 | 35.5 | 38.0 | 40.6 |
| ¾" SCH 160 | 39.7 | 44.1 | 48.5 | 52.9 | 57.3 | 61.7 | 66.2 | 70.6 |
| 1" SCH 160 | 70.4 | 78.2 | 86.0 | 93.9 | 101.7 | 109.5 | 117.3 | 125.1 |
| 1¼" SCH 160 | 142.6 | 158.4 | 174.3 | 190.1 | 206.0 | 221.8 | 237.7 | 253.5 |
| 1½" SCH 160 | 189.7 | 210.8 | 231.9 | 253.0 | 274.0 | 295.1 | 316.2 | 337.3 |

TABLE 16

Drive Delta-P = (psi) 1500

| PIPE SIZE/SCHEDULE | DRIVE VOLUME LOSS @ 500' (in^3) | DRIVE VOLUME LOSS @ 750' (in^3) | DRIVE VOLUME LOSS @ 1000' (in^3) | DRIVE VOLUME LOSS @ 1250' (in^3) | DRIVE VOLUME LOSS @ 1500' (in^3) | DRIVE VOLUME LOSS @ 1750' (in^3) | DRIVE VOLUME LOSS @ 2000' (in^3) |
|---|---|---|---|---|---|---|---|
| ⅛" SCH 40 | 2.0 | 3.1 | 4.1 | 5.1 | 6.1 | 7.2 | 8.2 |
| ¼" SCH 40 | 3.7 | 5.6 | 7.5 | 9.4 | 11.2 | 13.1 | 15.0 |
| ⅜" SCH 40 | 6.9 | 10.3 | 13.7 | 17.2 | 20.6 | 24.0 | 27.5 |
| ½" SCH 40 | 10.9 | 16.4 | 21.9 | 27.3 | 32.8 | 38.3 | 43.7 |
| ¾" SCH 40 | 19.2 | 28.8 | 38.4 | 48.0 | 57.6 | 67.2 | 76.8 |
| 1" SCH 40 | 31.1 | 46.6 | 62.2 | 77.7 | 93.3 | 108.8 | 124.4 |
| 1¼" SCH 40 | 53.8 | 80.7 | 107.6 | 134.5 | 161.5 | 188.4 | 215.3 |
| 1½" SCH 40 | 73.3 | 109.9 | 146.5 | 183.1 | 219.8 | 256.4 | 293.0 |
| ⅛" SCH 80 | 1.3 | 2.0 | 2.6 | 3.3 | 3.9 | 4.6 | 5.2 |
| ¼" SCH 80 | 2.6 | 3.9 | 5.2 | 6.4 | 7.7 | 9.0 | 10.3 |
| ⅜" SCH 80 | 5.1 | 7.6 | 10.1 | 12.6 | 15.2 | 17.7 | 20.2 |
| ½" SCH 80 | 8.4 | 12.6 | 16.8 | 21.1 | 25.3 | 29.5 | 33.7 |
| ¾" SCH 80 | 15.6 | 23.3 | 31.1 | 38.9 | 46.7 | 54.5 | 62.2 |
| 1" SCH 80 | 25.9 | 38.8 | 51.8 | 64.7 | 77.6 | 90.6 | 103.5 |
| 1¼" SCH 80 | 46.2 | 69.2 | 92.3 | 115.4 | 138.5 | 161.5 | 184.6 |
| 1½" SCH 80 | 63.6 | 95.4 | 127.2 | 159.0 | 190.8 | 222.5 | 254.3 |
| ½" SCH 160 | 6.1 | 9.1 | 12.2 | 15.2 | 18.3 | 21.3 | 24.3 |
| ¾" SCH 160 | 10.6 | 15.9 | 21.2 | 26.5 | 31.8 | 37.0 | 42.3 |
| 1" SCH 160 | 18.8 | 28.2 | 37.5 | 46.9 | 56.3 | 65.7 | 75.1 |
| 1¼" SCH 160 | 38.0 | 57.0 | 76.1 | 95.1 | 114.1 | 133.1 | 152.1 |
| 1½" SCH 160 | 50.6 | 75.9 | 101.2 | 126.5 | 151.8 | 177.1 | 202.4 |

| PIPE SIZE/SCHEDULE | DRIVE VOLUME LOSS @ 2250' (in^3) | DRIVE VOLUME LOSS @ 2500' (in^3) | DRIVE VOLUME LOSS @ 2750' (in^3) | DRIVE VOLUME LOSS @ 3000' (in^3) | DRIVE VOLUME LOSS @ 3250' (in^3) | DRIVE VOLUME LOSS @ 3500' (in^3) | DRIVE VOLUME LOSS @ 3750' (in^3) | DRIVE VOLUME LOSS @ 4000' (in^3) |
|---|---|---|---|---|---|---|---|---|
| ⅛" SCH 40 | 9.2 | 10.2 | 11.2 | 12.3 | 13.3 | 14.3 | 15.3 | 16.4 |
| ¼" SCH 40 | 16.8 | 18.7 | 20.6 | 22.5 | 24.3 | 26.2 | 28.1 | 30.0 |
| ⅜" SCH 40 | 30.9 | 34.3 | 37.8 | 41.2 | 44.6 | 48.1 | 51.5 | 54.9 |
| ½" SCH 40 | 49.2 | 54.7 | 60.1 | 65.6 | 71.1 | 76.5 | 82.0 | 87.5 |
| ¾" SCH 40 | 86.3 | 95.9 | 105.5 | 115.1 | 124.7 | 134.3 | 143.9 | 153.5 |
| 1" SCH 40 | 139.9 | 155.5 | 171.0 | 186.6 | 202.1 | 217.7 | 233.2 | 248.8 |
| 1¼" SCH 40 | 242.2 | 269.1 | 296.0 | 322.9 | 349.8 | 376.7 | 403.6 | 430.5 |
| 1½" SCH 40 | 329.6 | 366.3 | 402.9 | 439.5 | 476.1 | 512.8 | 549.4 | 586.0 |
| ⅛" SCH 80 | 5.9 | 6.5 | 7.2 | 7.8 | 8.5 | 9.1 | 9.8 | 10.5 |
| ¼" SCH 80 | 11.6 | 12.9 | 14.2 | 15.5 | 16.8 | 18.0 | 19.3 | 20.6 |
| ⅜" SCH 80 | 22.8 | 25.3 | 27.8 | 30.3 | 32.9 | 35.4 | 37.9 | 40.5 |
| ½" SCH 80 | 37.9 | 42.1 | 46.3 | 50.5 | 54.8 | 59.0 | 63.2 | 67.4 |
| ¾" SCH 80 | 70.0 | 77.8 | 85.6 | 93.4 | 101.1 | 108.9 | 116.7 | 124.5 |
| 1" SCH 80 | 116.5 | 129.4 | 142.4 | 155.3 | 168.2 | 181.2 | 194.1 | 207.1 |
| 1¼" SCH 80 | 207.7 | 230.8 | 253.9 | 276.9 | 300.0 | 323.1 | 346.2 | 369.3 |
| 1½" SCH 80 | 286.1 | 317.9 | 349.7 | 381.5 | 413.3 | 445.1 | 476.9 | 508.7 |
| ½" SCH 160 | 27.4 | 30.4 | 33.5 | 36.5 | 39.5 | 42.6 | 45.6 | 48.7 |
| ¾" SCH 160 | 47.6 | 52.9 | 58.2 | 63.5 | 68.8 | 74.1 | 79.4 | 84.7 |
| 1" SCH 160 | 84.5 | 93.9 | 103.2 | 112.6 | 122.0 | 131.4 | 140.8 | 150.2 |
| 1¼" SCH 160 | 171.1 | 190.1 | 209.1 | 228.2 | 247.2 | 266.2 | 285.2 | 304.2 |
| 1½" SCH 160 | 227.7 | 253.0 | 278.3 | 303.6 | 328.8 | 354.1 | 379.4 | 404.7 |

TABLE 17

Drive Delta-P = (psi) 1750

| PIPE SIZE/SCHEDULE | DRIVE VOLUME LOSS @ 500' (in^3) | DRIVE VOLUME LOSS @ 750' (in^3) | DRIVE VOLUME LOSS @ 1000' (in^3) | DRIVE VOLUME LOSS @ 1250' (in^3) | DRIVE VOLUME LOSS @ 1500' (in^3) | DRIVE VOLUME LOSS @ 1750' (in^3) | DRIVE VOLUME LOSS @ 2000' (in^3) |
|---|---|---|---|---|---|---|---|
| ⅛" SCH 40 | 2.4 | 3.6 | 4.8 | 6.0 | 7.2 | 8.4 | 9.5 |
| ¼" SCH 40 | 4.4 | 6.6 | 8.7 | 10.9 | 13.1 | 15.3 | 17.5 |
| ⅜" SCH 40 | 8.0 | 12.0 | 16.0 | 20.0 | 24.0 | 28.0 | 32.1 |
| ½" SCH 40 | 12.8 | 19.1 | 25.5 | 31.9 | 38.3 | 44.6 | 51.0 |
| ¾" SCH 40 | 22.4 | 33.6 | 44.8 | 56.0 | 67.2 | 78.4 | 89.5 |
| 1" SCH 40 | 36.3 | 54.4 | 72.6 | 90.7 | 108.8 | 127.0 | 145.1 |
| 1¼" SCH 40 | 62.8 | 94.2 | 125.6 | 157.0 | 188.4 | 219.8 | 251.2 |
| 1½" SCH 40 | 85.5 | 128.2 | 170.9 | 213.7 | 256.4 | 299.1 | 341.8 |
| ⅛" SCH 80 | 1.5 | 2.3 | 3.0 | 3.8 | 4.6 | 5.3 | 6.1 |

TABLE 17-continued

| Drive Delta-P = (psi) 1750 | | | | | | | |
|---|---|---|---|---|---|---|---|
| ¼" SCH 80 | 3.0 | 4.5 | 6.0 | 7.5 | 9.0 | 10.5 | 12.0 |
| ⅜" SCH 80 | 5.9 | 8.8 | 11.8 | 14.7 | 17.7 | 20.6 | 23.6 |
| ½" SCH 80 | 9.8 | 14.7 | 19.7 | 24.6 | 29.5 | 34.4 | 39.3 |
| ¾" SCH 80 | 18.2 | 27.2 | 36.3 | 45.4 | 54.5 | 63.5 | 72.6 |
| 1" SCH 80 | 30.2 | 45.3 | 60.4 | 75.5 | 90.6 | 105.7 | 120.8 |
| 1¼" SCH 80 | 53.8 | 80.8 | 107.7 | 134.6 | 161.5 | 188.5 | 215.4 |
| 1½" SCH 80 | 74.2 | 111.3 | 148.4 | 185.5 | 222.5 | 259.6 | 296.7 |
| ½" SCH 160 | 7.1 | 10.6 | 14.2 | 17.7 | 21.3 | 24.8 | 28.4 |
| ¾" SCH 160 | 12.3 | 18.5 | 24.7 | 30.9 | 37.0 | 43.2 | 49.4 |
| 1" SCH 160 | 21.9 | 32.8 | 43.8 | 54.7 | 65.7 | 76.6 | 87.6 |
| 1¼" SCH 160 | 44.4 | 66.5 | 88.7 | 110.9 | 133.1 | 155.3 | 177.5 |
| 1½" SCH 160 | 59.0 | 88.5 | 118.0 | 147.6 | 177.1 | 206.6 | 236.1 |

| PIPE SIZE/SCHEDULE | DRIVE VOLUME LOSS @ 2250' (in^3) | DRIVE VOLUME LOSS @ 2500' (in^3) | DRIVE VOLUME LOSS @ 2750' (in^3) | DRIVE VOLUME LOSS @ 3000' (in^3) | DRIVE VOLUME LOSS @ 3250' (in^3) | DRIVE VOLUME LOSS @ 3500' (in^3) | DRIVE VOLUME LOSS @ 3750' (in^3) | DRIVE VOLUME LOSS @ 4000' (in^3) |
|---|---|---|---|---|---|---|---|---|
| ⅛" SCH 40 | 10.7 | 11.9 | 13.1 | 14.3 | 15.5 | 16.7 | 17.9 | 19.1 |
| ¼" SCH 40 | 19.7 | 21.8 | 24.0 | 26.2 | 28.4 | 30.6 | 32.8 | 34.9 |
| ⅜" SCH 40 | 36.1 | 40.1 | 44.1 | 48.1 | 52.1 | 56.1 | 60.1 | 64.1 |
| ½" SCH 40 | 57.4 | 63.8 | 70.2 | 76.5 | 82.9 | 89.3 | 95.7 | 102.0 |
| ¾" SCH 40 | 100.7 | 111.9 | 123.1 | 134.3 | 145.5 | 156.7 | 167.9 | 179.1 |
| 1" SCH 40 | 163.3 | 181.4 | 199.5 | 217.7 | 235.8 | 254.0 | 272.1 | 290.2 |
| 1¼" SCH 40 | 282.5 | 313.9 | 345.3 | 376.7 | 408.1 | 439.5 | 470.9 | 502.3 |
| 1½" SCH 40 | 384.6 | 427.3 | 470.0 | 512.8 | 555.5 | 598.2 | 641.0 | 683.7 |
| ⅛" SCH 80 | 6.9 | 7.6 | 8.4 | 9.1 | 9.9 | 10.7 | 11.4 | 12.2 |
| ¼" SCH 80 | 13.5 | 15.0 | 16.5 | 18.0 | 19.5 | 21.0 | 22.6 | 24.1 |
| ⅜" SCH 80 | 26.5 | 29.5 | 32.4 | 35.4 | 38.3 | 41.3 | 44.2 | 47.2 |
| ½" SCH 80 | 44.2 | 49.1 | 54.1 | 59.0 | 63.9 | 68.8 | 73.7 | 78.6 |
| ¾" SCH 80 | 81.7 | 90.8 | 99.8 | 108.9 | 118.0 | 127.1 | 136.1 | 145.2 |
| 1" SCH 80 | 135.9 | 151.0 | 166.1 | 181.2 | 196.3 | 211.4 | 226.5 | 241.6 |
| 1¼" SCH 80 | 242.3 | 269.2 | 296.2 | 323.1 | 350.0 | 376.9 | 403.9 | 430.8 |
| 1½" SCH 80 | 333.8 | 370.9 | 408.0 | 445.1 | 482.2 | 519.3 | 556.4 | 593.5 |
| ½" SCH 160 | 31.9 | 35.5 | 39.0 | 42.6 | 46.1 | 49.7 | 53.2 | 56.8 |
| ¾" SCH 160 | 55.6 | 61.7 | 67.9 | 74.1 | 80.3 | 86.4 | 92.6 | 98.8 |
| 1" SCH 160 | 98.5 | 109.5 | 120.4 | 131.4 | 142.3 | 153.3 | 164.2 | 175.2 |
| 1¼" SCH 160 | 199.6 | 221.8 | 244.0 | 266.2 | 288.4 | 310.6 | 332.7 | 354.9 |
| 1½" SCH 160 | 265.6 | 295.1 | 324.6 | 354.1 | 383.7 | 413.2 | 442.7 | 472.2 |

TABLE 18

| Drive Delta-P = (psi) 2000 | | | | | | | |
|---|---|---|---|---|---|---|---|
| PIPE SIZE/SCHEDULE | DRIVE VOLUME LOSS @ 500' (in^3) | DRIVE VOLUME LOSS @ 750' (in^3) | DRIVE VOLUME LOSS @ 1000' (in^3) | DRIVE VOLUME LOSS @ 1250' (in^3) | DRIVE VOLUME LOSS @ 1500' (in^3) | DRIVE VOLUME LOSS @ 1750' (in^3) | DRIVE VOLUME LOSS @ 2000' (in^3) |
| ⅛" SCH 40 | 2.7 | 4.1 | 5.5 | 6.8 | 8.2 | 9.5 | 10.9 |
| ¼" SCH 40 | 5.0 | 7.5 | 10.0 | 12.5 | 15.0 | 17.5 | 20.0 |
| ⅜" SCH 40 | 9.2 | 13.7 | 18.3 | 22.9 | 27.5 | 32.1 | 36.6 |
| ½" SCH 40 | 14.6 | 21.9 | 29.2 | 36.4 | 43.7 | 51.0 | 58.3 |
| ¾" SCH 40 | 25.6 | 38.4 | 51.2 | 64.0 | 76.8 | 89.5 | 102.3 |
| 1" SCH 40 | 41.5 | 62.2 | 82.9 | 103.7 | 124.4 | 145.1 | 165.9 |
| 1¼" SCH 40 | 71.8 | 107.6 | 143.5 | 179.4 | 215.3 | 251.2 | 287.0 |
| 1½" SCH 40 | 97.7 | 146.5 | 195.3 | 244.2 | 293.0 | 341.8 | 390.7 |
| ⅛" SCH 80 | 1.7 | 2.6 | 3.5 | 4.4 | 5.2 | 6.1 | 7.0 |
| ¼" SCH 80 | 3.4 | 5.2 | 6.9 | 8.6 | 10.3 | 12.0 | 13.7 |
| ⅜" SCH 80 | 6.7 | 10.1 | 13.5 | 16.9 | 20.2 | 23.6 | 27.0 |
| ½" SCH 80 | 11.2 | 16.8 | 22.5 | 28.1 | 33.7 | 39.3 | 44.9 |
| ¾" SCH 80 | 20.7 | 31.1 | 41.5 | 51.9 | 62.2 | 72.6 | 83.0 |
| 1" SCH 80 | 34.5 | 51.8 | 69.0 | 86.3 | 103.5 | 120.8 | 138.0 |
| 1¼" SCH 80 | 61.5 | 92.3 | 123.1 | 153.9 | 184.6 | 215.4 | 246.2 |
| 1½" SCH 80 | 84.8 | 127.2 | 169.6 | 212.0 | 254.3 | 296.7 | 339.1 |
| ½" SCH 160 | 8.1 | 12.2 | 16.2 | 20.3 | 24.3 | 28.4 | 32.4 |
| ¾" SCH 160 | 14.1 | 21.2 | 28.2 | 35.3 | 42.3 | 49.4 | 56.5 |
| 1" SCH 160 | 25.0 | 37.5 | 50.1 | 62.6 | 75.1 | 87.6 | 100.1 |
| 1¼" SCH 160 | 50.7 | 76.1 | 101.4 | 126.8 | 152.1 | 177.5 | 202.8 |
| 1½" SCH 160 | 67.5 | 101.2 | 134.9 | 168.6 | 202.4 | 236.1 | 269.8 |

TABLE 18-continued

| Drive Delta-P = (psi) 2000 | | | | | | | | |
|---|---|---|---|---|---|---|---|---|
| PIPE SIZE/SCHEDULE | DRIVE VOLUME LOSS @ 2250' (in^3) | DRIVE VOLUME LOSS @ 2500' (in^3) | DRIVE VOLUME LOSS @ 2750' (in^3) | DRIVE VOLUME LOSS @ 3000' (in^3) | DRIVE VOLUME LOSS @ 3250' (in^3) | DRIVE VOLUME LOSS @ 3500' (in^3) | DRIVE VOLUME LOSS @ 3750' (in^3) | DRIVE VOLUME LOSS @ 4000' (in^3) |
| ⅛" SCH 40 | 12.3 | 13.6 | 15.0 | 16.4 | 17.7 | 19.1 | 20.4 | 21.8 |
| ¼" SCH 40 | 22.5 | 25.0 | 27.5 | 30.0 | 32.5 | 34.9 | 37.4 | 39.9 |
| ⅜" SCH 40 | 41.2 | 45.8 | 50.4 | 54.9 | 59.5 | 64.1 | 68.7 | 73.3 |
| ½" SCH 40 | 65.6 | 72.9 | 80.2 | 87.5 | 94.8 | 102.0 | 109.3 | 116.6 |
| ¾" SCH 40 | 115.1 | 127.9 | 140.7 | 153.5 | 166.3 | 179.1 | 191.9 | 204.7 |
| 1" SCH 40 | 186.6 | 207.3 | 228.0 | 248.8 | 269.5 | 290.2 | 311.0 | 331.7 |
| 1¼" SCH 40 | 322.9 | 358.8 | 394.7 | 430.5 | 466.4 | 502.3 | 538.2 | 574.1 |
| 1½" SCH 40 | 439.5 | 488.4 | 537.2 | 586.0 | 634.9 | 683.7 | 732.5 | 781.4 |
| ⅛" SCH 80 | 7.8 | 8.7 | 9.6 | 10.5 | 11.3 | 12.2 | 13.1 | 13.9 |
| ¼" SCH 80 | 15.5 | 17.2 | 18.9 | 20.6 | 22.3 | 24.1 | 25.8 | 27.5 |
| ⅜" SCH 80 | 30.3 | 33.7 | 37.1 | 40.5 | 43.8 | 47.2 | 50.6 | 53.9 |
| ½" SCH 80 | 50.5 | 56.2 | 61.8 | 67.4 | 73.0 | 78.6 | 84.2 | 89.9 |
| ¾" SCH 80 | 93.4 | 103.7 | 114.1 | 124.5 | 134.8 | 145.2 | 155.6 | 166.0 |
| 1" SCH 80 | 155.3 | 172.5 | 189.8 | 207.1 | 224.3 | 241.6 | 258.8 | 276.1 |
| 1¼" SCH 80 | 276.9 | 307.7 | 338.5 | 369.3 | 400.0 | 430.8 | 461.6 | 492.3 |
| 1½" SCH 80 | 381.5 | 423.9 | 466.3 | 508.7 | 551.1 | 593.5 | 635.9 | 678.2 |
| ½" SCH 160 | 36.5 | 40.6 | 44.6 | 48.7 | 52.7 | 56.8 | 60.8 | 64.9 |
| ¾" SCH 160 | 63.5 | 70.6 | 77.6 | 84.7 | 91.7 | 98.8 | 105.8 | 112.9 |
| 1" SCH 160 | 112.6 | 125.1 | 137.7 | 150.2 | 162.7 | 175.2 | 187.7 | 200.2 |
| 1¼" SCH 160 | 228.2 | 253.5 | 278.9 | 304.2 | 329.6 | 354.9 | 380.3 | 405.6 |
| 1½" SCH 160 | 303.6 | 337.3 | 371.0 | 404.7 | 438.5 | 472.2 | 505.9 | 539.7 |

TABLE 19

| Drive Delta-P = (psi) 2250 | | | | | | | |
|---|---|---|---|---|---|---|---|
| PIPE SIZE/SCHEDULE | DRIVE VOLUME LOSS @ 500' (in^3) | DRIVE VOLUME LOSS @ 750' (in^3) | DRIVE VOLUME LOSS @ 1000' (in^3) | DRIVE VOLUME LOSS @ 1250' (in^3) | DRIVE VOLUME LOSS @ 1500' (in^3) | DRIVE VOLUME LOSS @ 1750' (in^3) | DRIVE VOLUME LOSS @ 2000' (in^3) |
| ⅛" SCH 40 | 3.1 | 4.6 | 6.1 | 7.7 | 9.2 | 10.7 | 12.3 |
| ¼" SCH 40 | 5.6 | 8.4 | 11.2 | 14.0 | 16.8 | 19.7 | 22.5 |
| ⅜" SCH 40 | 10.3 | 15.5 | 20.6 | 25.8 | 30.9 | 36.1 | 41.2 |
| ½" SCH 40 | 16.4 | 24.6 | 32.8 | 41.0 | 49.2 | 57.4 | 65.6 |
| ¾" SCH 40 | 28.8 | 43.2 | 57.6 | 72.0 | 86.3 | 100.7 | 115.1 |
| 1" SCH 40 | 46.6 | 70.0 | 93.3 | 116.6 | 139.9 | 163.3 | 186.6 |
| 1¼" SCH 40 | 80.7 | 121.1 | 161.5 | 201.8 | 242.2 | 282.5 | 322.9 |
| 1½" SCH 40 | 109.9 | 164.8 | 219.8 | 274.7 | 329.6 | 384.6 | 439.5 |
| ⅛" SCH 80 | 2.0 | 2.9 | 3.9 | 4.9 | 5.9 | 6.9 | 7.8 |
| ¼" SCH 80 | 3.9 | 5.8 | 7.7 | 9.7 | 11.6 | 13.5 | 15.5 |
| ⅜" SCH 80 | 7.6 | 11.4 | 15.2 | 19.0 | 22.8 | 26.5 | 30.3 |
| ½" SCH 80 | 12.6 | 19.0 | 25.3 | 31.6 | 37.9 | 44.2 | 50.5 |
| ¾" SCH 80 | 23.3 | 35.0 | 46.7 | 58.3 | 70.0 | 81.7 | 93.4 |
| 1" SCH 80 | 38.8 | 58.2 | 77.6 | 97.1 | 116.5 | 135.9 | 155.3 |
| 1¼" SCH 80 | 69.2 | 103.9 | 138.5 | 173.1 | 207.7 | 242.3 | 276.9 |
| 1½" SCH 80 | 95.4 | 143.1 | 190.8 | 238.4 | 286.1 | 333.8 | 381.5 |
| ½" SCH 160 | 9.1 | 13.7 | 18.3 | 22.8 | 27.4 | 31.9 | 36.5 |
| ¾" SCH 160 | 15.9 | 23.8 | 31.8 | 39.7 | 47.6 | 55.6 | 63.5 |
| 1" SCH 160 | 28.2 | 42.2 | 56.3 | 70.4 | 84.5 | 98.5 | 112.6 |
| 1¼" SCH 160 | 57.0 | 85.6 | 114.1 | 142.6 | 171.1 | 199.6 | 228.2 |
| 1½" SCH 160 | 75.9 | 113.8 | 151.8 | 189.7 | 227.7 | 265.6 | 303.6 |

| PIPE SIZE/SCHEDULE | DRIVE VOLUME LOSS @ 2250' (in^3) | DRIVE VOLUME LOSS @ 2500' (in^3) | DRIVE VOLUME LOSS @ 2750' (in^3) | DRIVE VOLUME LOSS @ 3000' (in^3) | DRIVE VOLUME LOSS @ 3250' (in^3) | DRIVE VOLUME LOSS @ 3500' (in^3) | DRIVE VOLUME LOSS @ 3750' (in^3) | DRIVE VOLUME LOSS @ 4000' (in^3) |
|---|---|---|---|---|---|---|---|---|
| ⅛" SCH 40 | 13.8 | 15.3 | 16.9 | 18.4 | 19.9 | 21.5 | 23.0 | 24.5 |
| ¼" SCH 40 | 25.3 | 28.1 | 30.9 | 33.7 | 36.5 | 39.3 | 42.1 | 44.9 |
| ⅜" SCH 40 | 46.4 | 51.5 | 56.7 | 61.8 | 67.0 | 72.1 | 77.3 | 82.4 |
| ½" SCH 40 | 73.8 | 82.0 | 90.2 | 98.4 | 106.6 | 114.8 | 123.0 | 131.2 |
| ¾" SCH 40 | 129.5 | 143.9 | 158.3 | 172.7 | 187.1 | 201.5 | 215.9 | 230.3 |
| 1" SCH 40 | 209.9 | 233.2 | 256.6 | 279.9 | 303.2 | 326.5 | 349.8 | 373.2 |
| 1¼" SCH 40 | 363.3 | 403.6 | 444.0 | 484.4 | 524.7 | 565.1 | 605.5 | 645.8 |
| 1½" SCH 40 | 494.5 | 549.4 | 604.3 | 659.3 | 714.2 | 769.2 | 824.1 | 879.0 |
| ⅛" SCH 80 | 8.8 | 9.8 | 10.8 | 11.8 | 12.7 | 13.7 | 14.7 | 15.7 |

TABLE 19-continued

| Drive Delta-P = (psi) 2250 | | | | | | | | |
|---|---|---|---|---|---|---|---|---|
| ¼" SCH 80 | 17.4 | 19.3 | 21.3 | 23.2 | 25.1 | 27.1 | 29.0 | 30.9 |
| ⅜" SCH 80 | 34.1 | 37.9 | 41.7 | 45.5 | 49.3 | 53.1 | 56.9 | 60.7 |
| ½" SCH 80 | 56.9 | 63.2 | 69.5 | 75.8 | 82.1 | 88.5 | 94.8 | 101.1 |
| ¾" SCH 80 | 105.0 | 116.7 | 128.4 | 140.0 | 151.7 | 163.4 | 175.0 | 186.7 |
| 1" SCH 80 | 174.7 | 194.1 | 213.5 | 232.9 | 252.3 | 271.8 | 291.2 | 310.6 |
| 1¼" SCH 80 | 311.6 | 346.2 | 380.8 | 415.4 | 450.0 | 484.6 | 519.3 | 553.9 |
| 1½" SCH 80 | 429.2 | 476.9 | 524.6 | 572.3 | 620.0 | 667.6 | 715.3 | 763.0 |
| ½" SCH 160 | 41.1 | 45.6 | 50.2 | 54.8 | 59.3 | 63.9 | 68.4 | 73.0 |
| ¾" SCH 160 | 71.4 | 79.4 | 87.3 | 95.3 | 103.2 | 111.1 | 119.1 | 127.0 |
| 1" SCH 160 | 126.7 | 140.8 | 154.9 | 168.9 | 183.0 | 197.1 | 211.2 | 225.3 |
| 1¼" SCH 160 | 256.7 | 285.2 | 313.7 | 342.2 | 370.8 | 399.3 | 427.8 | 456.3 |
| 1½" SCH 160 | 341.5 | 379.4 | 417.4 | 455.3 | 493.3 | 531.2 | 569.2 | 607.1 |

TABLE 20

| Drive Delta-P = (psi) 2500 | | | | | | | |
|---|---|---|---|---|---|---|---|
| PIPE SIZE/SCHEDULE | DRIVE VOLUME LOSS @ 500' (in^3) | DRIVE VOLUME LOSS @ 750' (in^3) | DRIVE VOLUME LOSS @ 1000' (in^3) | DRIVE VOLUME LOSS @ 1250' (in^3) | DRIVE VOLUME LOSS @ 1500' (in^3) | DRIVE VOLUME LOSS @ 1750' (in^3) | DRIVE VOLUME LOSS @ 2000' (in^3) |
| ⅛" SCH 40 | 3.4 | 5.1 | 6.8 | 8.5 | 10.2 | 11.9 | 13.6 |
| ¼" SCH 40 | 6.2 | 9.4 | 12.5 | 15.6 | 18.7 | 21.8 | 25.0 |
| ⅜" SCH 40 | 11.4 | 17.2 | 22.9 | 28.6 | 34.3 | 40.1 | 45.8 |
| ½" SCH 40 | 18.2 | 27.3 | 36.4 | 45.6 | 54.7 | 63.8 | 72.9 |
| ¾" SCH 40 | 32.0 | 48.0 | 64.0 | 79.9 | 95.9 | 111.9 | 127.9 |
| 1" SCH 40 | 51.8 | 77.7 | 103.7 | 129.6 | 155.5 | 181.4 | 207.3 |
| 1¼" SCH 40 | 89.7 | 134.5 | 179.4 | 224.2 | 269.1 | 313.9 | 358.8 |
| 1½" SCH 40 | 122.1 | 183.1 | 244.2 | 305.2 | 366.3 | 427.3 | 488.4 |
| ⅛" SCH 80 | 2.2 | 3.3 | 4.4 | 5.4 | 6.5 | 7.6 | 8.7 |
| ¼" SCH 80 | 4.3 | 6.4 | 8.6 | 10.7 | 12.9 | 15.0 | 17.2 |
| ⅜" SCH 80 | 8.4 | 12.6 | 16.9 | 21.1 | 25.3 | 29.5 | 33.7 |
| ½" SCH 80 | 14.0 | 21.1 | 28.1 | 35.1 | 42.1 | 49.1 | 56.2 |
| ¾" SCH 80 | 25.9 | 38.9 | 51.9 | 64.8 | 77.8 | 90.8 | 103.7 |
| 1" SCH 80 | 43.1 | 64.7 | 86.3 | 107.8 | 129.4 | 151.0 | 172.5 |
| 1¼" SCH 80 | 76.9 | 115.4 | 153.9 | 192.3 | 230.8 | 269.2 | 307.7 |
| 1½" SCH 80 | 106.0 | 159.0 | 212.0 | 264.9 | 317.9 | 370.9 | 423.9 |
| ½" SCH 160 | 10.1 | 15.2 | 20.3 | 25.4 | 30.4 | 35.5 | 40.6 |
| ¾" SCH 160 | 17.6 | 26.5 | 35.3 | 44.1 | 52.9 | 61.7 | 70.6 |
| 1" SCH 160 | 31.3 | 46.9 | 62.6 | 78.2 | 93.9 | 109.5 | 125.1 |
| 1¼" SCH 160 | 63.4 | 95.1 | 126.8 | 158.4 | 190.1 | 221.8 | 253.5 |
| 1½" SCH 160 | 84.3 | 126.5 | 168.6 | 210.8 | 253.0 | 295.1 | 337.3 |

| PIPE SIZE/SCHEDULE | DRIVE VOLUME LOSS @ 2250' (in^3) | DRIVE VOLUME LOSS @ 2500' (in^3) | DRIVE VOLUME LOSS @ 2750' (in^3) | DRIVE VOLUME LOSS @ 3000' (in^3) | DRIVE VOLUME LOSS @ 3250' (in^3) | DRIVE VOLUME LOSS @ 3500' (in^3) | DRIVE VOLUME LOSS @ 3750' (in^3) | DRIVE VOLUME LOSS @ 4000' (in^3) |
|---|---|---|---|---|---|---|---|---|
| ⅛" SCH 40 | 15.3 | 17.0 | 18.7 | 20.4 | 22.2 | 23.9 | 25.6 | 27.3 |
| ¼" SCH 40 | 28.1 | 31.2 | 34.3 | 37.4 | 40.6 | 43.7 | 46.8 | 49.9 |
| ⅜" SCH 40 | 51.5 | 57.2 | 63.0 | 68.7 | 74.4 | 80.1 | 85.9 | 91.6 |
| ½" SCH 40 | 82.0 | 91.1 | 100.2 | 109.3 | 118.4 | 127.6 | 136.7 | 145.8 |
| ¾" SCH 40 | 143.9 | 159.9 | 175.9 | 191.9 | 207.9 | 223.9 | 239.8 | 255.8 |
| 1" SCH 40 | 233.2 | 259.1 | 285.1 | 311.0 | 336.9 | 362.8 | 388.7 | 414.6 |
| 1¼" SCH 40 | 403.6 | 448.5 | 493.3 | 538.2 | 583.0 | 627.9 | 672.7 | 717.6 |
| 1½" SCH 40 | 549.4 | 610.4 | 671.5 | 732.5 | 793.6 | 854.6 | 915.7 | 976.7 |
| ⅛" SCH 80 | 9.8 | 10.9 | 12.0 | 13.1 | 14.2 | 15.2 | 16.3 | 17.4 |
| ¼" SCH 80 | 19.3 | 21.5 | 23.6 | 25.8 | 27.9 | 30.1 | 32.2 | 34.4 |
| ⅜" SCH 80 | 37.9 | 42.1 | 46.4 | 50.6 | 54.8 | 59.0 | 63.2 | 67.4 |
| ½" SCH 80 | 63.2 | 70.2 | 77.2 | 84.2 | 91.3 | 98.3 | 105.3 | 112.3 |
| ¾" SCH 80 | 116.7 | 129.7 | 142.6 | 155.6 | 168.6 | 181.5 | 194.5 | 207.5 |
| 1" SCH 80 | 194.1 | 215.7 | 237.3 | 258.8 | 280.4 | 302.0 | 323.5 | 345.1 |
| 1¼" SCH 80 | 346.2 | 384.6 | 423.1 | 461.6 | 500.0 | 538.5 | 577.0 | 615.4 |
| 1½" SCH 80 | 476.9 | 529.9 | 582.9 | 635.9 | 688.8 | 741.8 | 794.8 | 847.8 |
| ½" SCH 160 | 45.6 | 50.7 | 55.8 | 60.8 | 65.9 | 71.0 | 76.1 | 81.1 |
| ¾" SCH 160 | 79.4 | 88.2 | 97.0 | 105.8 | 114.7 | 123.5 | 132.3 | 141.1 |
| 1" SCH 160 | 140.8 | 156.4 | 172.1 | 187.7 | 203.4 | 219.0 | 234.6 | 250.3 |
| 1¼" SCH 160 | 285.2 | 316.9 | 348.6 | 380.3 | 412.0 | 443.6 | 475.3 | 507.0 |
| 1½" SCH 160 | 379.4 | 421.6 | 463.8 | 505.9 | 548.1 | 590.2 | 632.4 | 674.6 |

The greater length of the conduit 546 for a given flow through conduit 546, the greater the amount of energy loss due to friction of the fluid in the conduit 546. The larger the conduit 546 for a given flow through the conduit 546, the lesser the amount of energy loss due to friction of the fluid in the conduit 546. The data in Table 21 provided below illustrate these concepts. These losses must be considered and balanced with the compression losses discussed previously to determine an optimum drive system configuration for the pumping system.

TABLE 21

DATA for oil
Specific gravity = 0.9
Viscosity (SUS) = 220
Bulk Modulus (psi) = 250000

| PIPE SIZE/ SCHEDULE | PRESSURE DROP/100 FEET OF PIPE FLOW = 10 GAL/MIN (PSI) | PRESSURE DROP/100 FEET OF PIPE FLOW = 15 GAL/MIN (PSI) | PRESSURE DROP/100 FEET OF PIPE FLOW = 20 GAL/MIN (PSI) |
|---|---|---|---|
| ⅜" SCH 40 | 185.0 | | |
| ½" SCH 40 | 73.0 | 109.0 | 146.0 |
| ¾" SCH 40 | 24.0 | 36.0 | 47.0 |
| 1" SCH 40 | 9.0 | 14.0 | 18.0 |
| 1¼" SCH 40 | 3.0 | 4.5 | 6.0 |
| 1½" SCH 40 | | 2.4 | 3.2 |

The pumping apparatus of preferred embodiments is also useful in applications where the fluid being pumped contains significant impurities, which can cause damage to conventional pumps, such as a centrifugal pump. For example, sand grains and particles can cause substantial and catastrophic failure to centrifugal pumps. In contrast, similarly sized particles do not cause substantial damage to the pumps of preferred embodiments. Provided the valves are appropriately chosen, even product fluid which contains suspended rocks and other solid materials can be pumped using the pumps of preferred embodiments. Accordingly, the maintenance costs and costs associated with pump failure are greatly reduced. In addition, such a design enables filtration to occur after the product fluid is removed from its source, rather than requiring the pump inlet contain a filter.

Figure 6A:
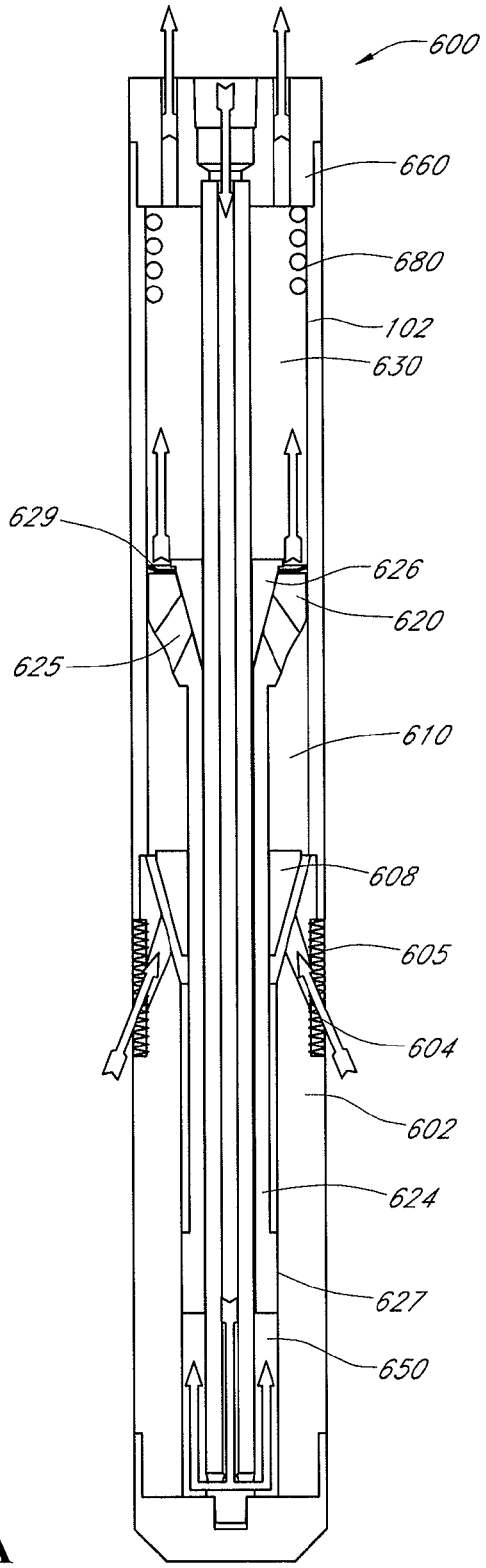
FIG. 6A provides a cross-sectional view of a pump fitted with a filter or screen to reduce the risk of plugging within the pump. The pump is depicted during the power stroke.
Figure 6B:
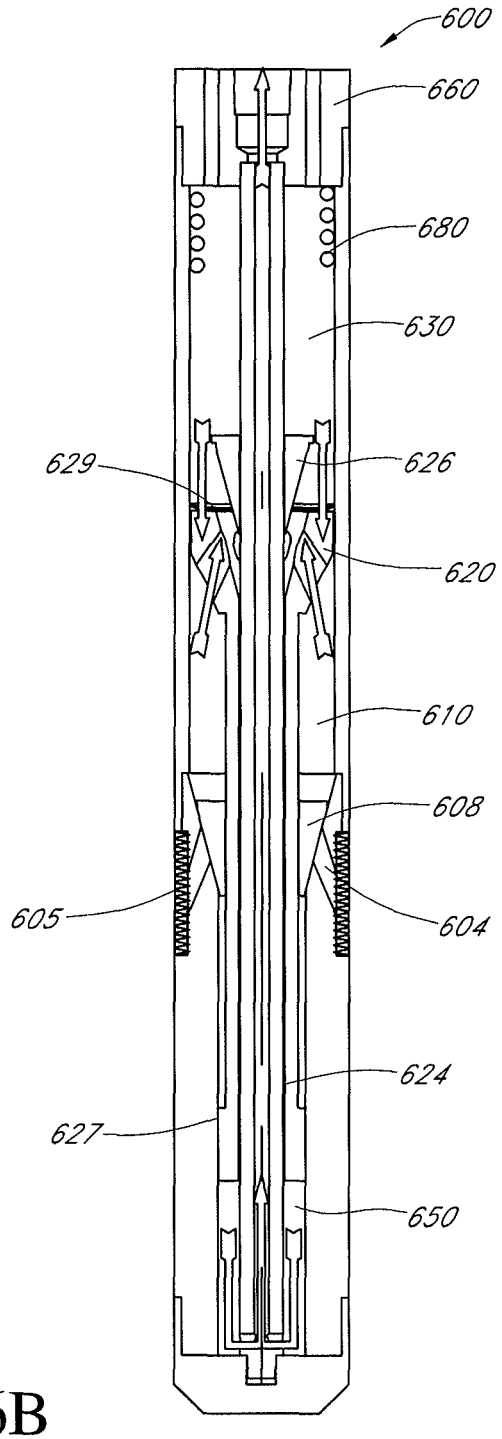
FIG. 6B provides a cross-sectional view of a pump according to preferred embodiment. The pump is depicted during the recovery stroke.
Figure 6C:
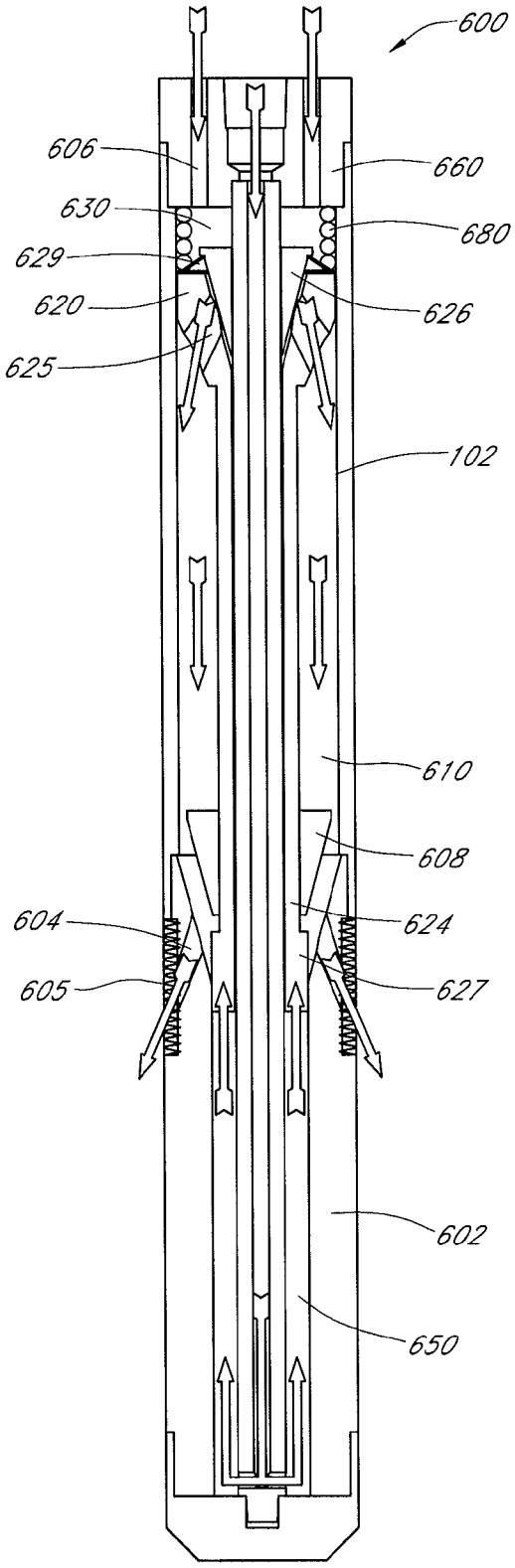
FIG. 6C provides a cross-sectional view of a pump according to a preferred embodiment. The pump is depicted during a cleaning operation wherein the transfer piston is lifted beyond its highest point during normal operation.

Nevertheless, in some embodiments, the pumping apparatus can be fitted with a filter or screen to reduce the risk of plugging within the pump as illustrated in FIGS. 6A-C. The embodiment illustrated in FIGS. 6A-C also employs a pump 600 that can be flushed or cleaned. The pump 600 is similar to the embodiments described above in connection with FIGS. 3-5, and therefore only the differences are discussed in detail.

The pump 600 can comprise a pump inlet filter 605. In the embodiment illustrated in FIGS. 6A-C, the filter 605 is a fluid inlet screen placed in the pump housing 602. Alternatively, the filter or screen can be set off from the exterior surface of the pump housing such that any build up on the filter does not block the pump inlet. However, in some circumstances where the accumulation of particles is less of a concern, the filter can be placed adjacent to or within the pump inlet, as illustrated. The filtering of fluid to the inlet of a pump is well-known in the art, and any suitable filtering or screening mechanism can be utilized. In preferred embodiments, screens that prevent sand particles from entering the pump and also prevent screen clogging are utilized. For example, in some embodiments, well screens with a v-shaped opening, such as Johnson Vee-Wire® screens, can be utilized. Preferred screens have an opening (sometimes referred to as the "slot size") of between about 0.01 inches to about 0.25 inches. These screens prevent the majority of fine sand particles from entering the pump. The openings in the screen are preferably smaller than the smallest channel within the pump. Therefore, any particles that pass through the screen do not plug the pump.

The size of particles permitted to flow through the pump is determined by the size of the perforations or holes in the filter or screen. Preferably, the diameters of the perforations/holes in the filter are at least as small as the smallest channel through which the product fluid passes. Typically, the smallest channel is one of (a) the pump inlet holes, (b) the transfer piston channel, or (c) the diameter of the opening created when either the inlet valve or the transfer piston valve opens. Therefore, any particle small enough to pass through the perforations/holes in the external filter is expected to pass through the pump apparatus without difficulty.

In some embodiments, one way valves are used to prevent the flow of fluid from the reverse direction, e.g., from the product chamber 630 to the transfer chamber 610, and from the transfer chamber 610 through the pump inlet 604. However allowing flow in the reverse direction is desirable in many circumstances, such as when the pump or inlet screen has become plugged or is no longer operating optimally. For example, sensors may detect an increased pressure drop across the inlet screen, or across one of the valves in the pump. Alternatively, the pump can be flushed at regular intervals to prevent the accumulation of particles, such as after it has been in operation for a predetermined period or after it has pumped a predetermined amount of fluid. Accordingly, FIGS. 6A-C illustrate an embodiment of a pump wherein the pump 600 is capable of allowing the reverse flow of product fluid.

In some embodiments, the pump 600 is provided with a mechanism by which the one-way valves, 608 (inlet valve) and 626 (transfer piston valve), are prevented from closing. In one embodiment, the one-way valves are prevented from closing only upon an increase in the power fluid pressure beyond the normal operating pressures. In such an embodiment, the increased pressure lifts the transfer piston 620 higher than it is typically lifted during normal operating conditions. Any mechanism which utilizes the increased lift to prevent the valves from closing can be utilized.

In the embodiments illustrated in FIGS. 6A-C, the rod portion 624 of the transfer piston 620 contains an inlet valve stop 627. During regular operation of the pump 600, as illustrated in FIG. 6A and FIG. 6B, this inlet valve stop 627 does not alter the operation of the pump 600. When it is necessary to prop open the inlet valve 608 and allow reverse flow, such as for flushing, cleaning, or adding chemicals for cleaning or rehabilitating a hydraulic structure, the power fluid pressure is increased beyond the pressure utilized for normal operation of the pump, thereby lifting the transfer piston 620 higher than usual. When raised to this higher level, the inlet valve stop 627 catches the conical check valve member 608, thereby preventing it from closing, as illustrated in FIG. 6C. Thus, fluid is permitted to flow from the transfer chamber 610 through the pump inlet 604. The stop 627 need not be coupled to the transfer piston 620.

A transfer piston valve stop 629 can be coupled to the upper surface of the transfer piston 620. As shown in FIG. 6A and FIG. 6B, the valve stop 629 does not influence the operation of the pump 600 during normal operating conditions. However, when the power fluid pressure is increased beyond its normal operating parameters and the transfer piston rises higher than usual, the transfer piston valve stop 629 is activated and it prevents the transfer piston valve 626 from closing. In the embodiment illustrated, the transfer piston valve stop 629 comprises a v-shaped member, a portion of which is positioned under the transfer piston valve member 626. During normal operation, this v-shaped member does not prevent the transfer piston valve member 626 from lowering and sealing the transfer piston channel 625, as shown in FIG. 6A (power stroke) and FIG. 6B (recovery stroke). However, when the piston 620 rises to a predetermined level, an activator 680 applies force to the v-shaped member, thereby forcing the transfer piston valve 626 open, as illustrated in FIG. 6C. The activator 680 can take the form of a spring as illustrated, a rod extending down from the top cap 660, or it can be a stop mounted on the inside of the pump housing 602 in the product chamber 630. Numerous other mechanisms for activating the piston valve stop 629 as known in the art are also suitable for use. In one embodiment, the activator 680 is a spring, as this prevents damage to the pump components (such as the top cap and piston) if the pressure of the power fluid is accidentally increased during normal operation.

Referring to FIG. 6C, if the pump becomes plugged or it is desirable to clean the pump or work on the well, the pump operator can supply power fluid at an increased pressure. The increased pressure in the power fluid chamber 650 lifts the transfer piston 620 beyond its highest point during normal operation. If the power fluid is supplied at 1000 psi during normal operation to lift the transfer piston, the power fluid might be supplied at 1200 psi for the stop to contact the activator. The inlet valve stop 627 prevents the inlet valve 608 from closing. Similarly, the transfer piston valve stop 629 prevents the transfer piston valve 626 from closing. The product fluid is then permitted to flow from the pump outlet 606 into the product chamber 630, from the product chamber 630 to the transfer chamber 610, and from the transfer chamber 610 through the pump inlet 604 to the fluid source. This allows the pump operators to work on the pump and the well without having to remove the pump from a borehole such as a water, oil, gas or coal bed methane dewatering well.

In some embodiments described herein, the valves are self-actuating one-way valves. However, the valves can optionally be electronically controlled. Using standard computer process control techniques, such as those known in the art, the opening and closing of each valve can be automated. In such embodiments, two-way valves can be utilized. Two-way valves allow the pump operators to open the valves and permit flow in the reverse direction when necessary, such as to flush an inlet or channel that has become plugged or to clean the pump, without employing the valve stops 627, 629 previously discussed. Accordingly, a pump with electronically controlled valves can be flushed or cleaned without increasing the power fluid pressure as described in connection with the embodiments illustrated in FIGS. 6A-C.

Figure 7A:
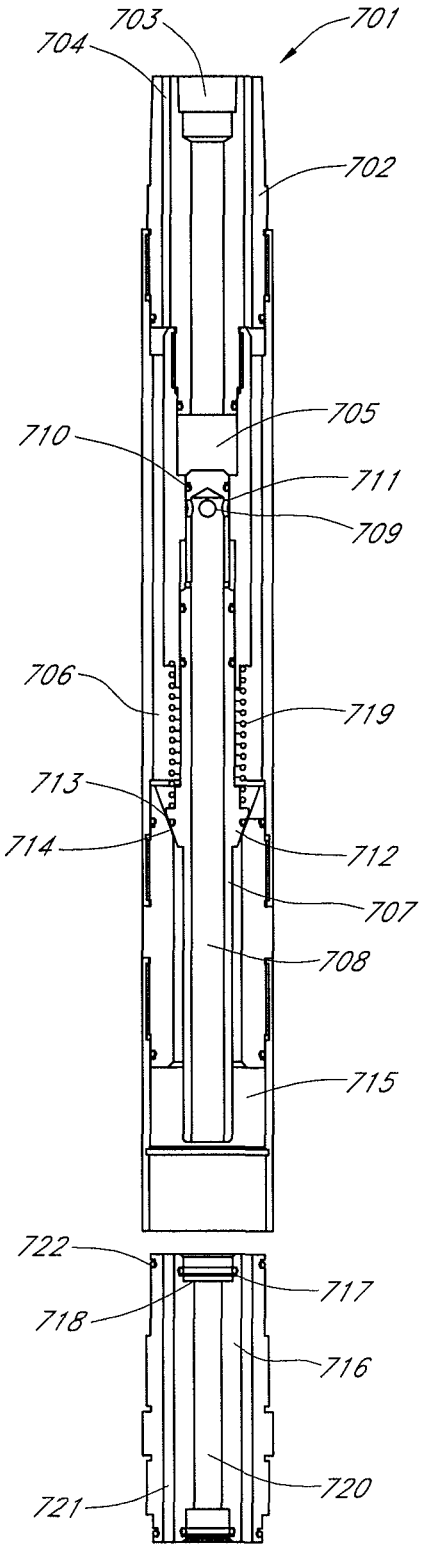
FIG. 7A provides a cross-sectional view of a pump coaxial disconnect in a closed position.
Figure 7B:
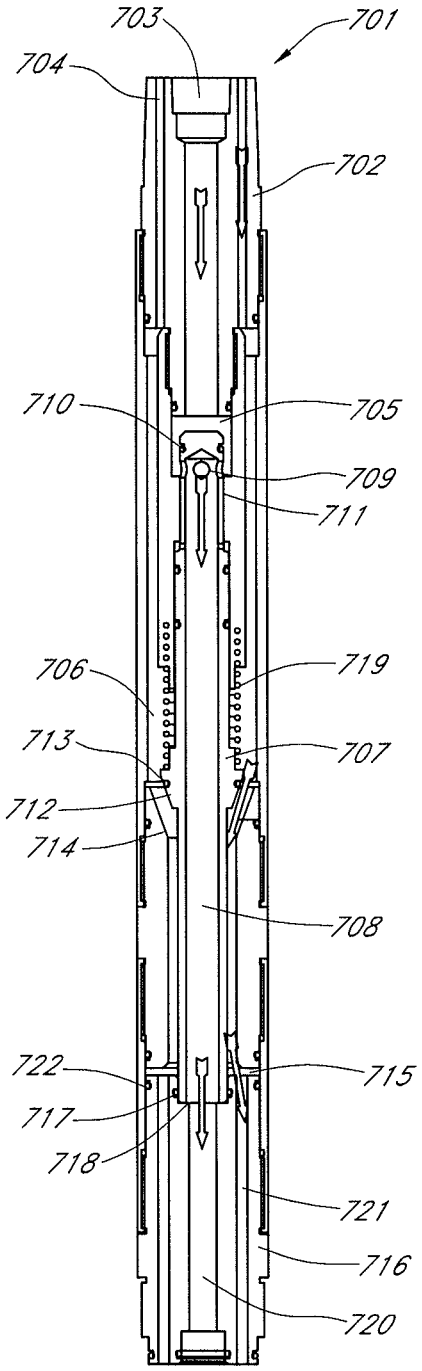
FIG. 7B provides a cross-sectional view of a pump coaxial disconnect in an open position.

FIG. 7A and FIG. 7B illustrate a coaxial disconnect (HCDC) configured to allow removal of any coaxial hydraulic equipment from a coaxial pipe or tube connection without losing either of the two prime fluids. In pumps and downhole well applications, the HCDC is connected between the coaxial tubing installed down the well casing and the coaxial pump located at the bottom of the well. To replace the pump, the coaxial tubing is rolled up onto a waiting tube reel, and the pump is disconnected from the HCDC. The HCDC allows the pump to be removed without losing the two fluids located within the coaxial tubing.

Referring now to FIG. 7A, the illustrated embodiment of an HCDC 701 includes a top cap 702, which provides connection interfaces to both a power fluid port 703 and a product fluid port 704 of the coaxial tube. A valve stem 707 is configured to control both the power and product fluid flows through the HCDC. A power fluid seat 711 is configured to control flow of the power fluid. A product fluid seat 714 is configured to control flow of the product fluid. A pump top cap 716 is configured to control the position of the valve stem 707.

FIG. 7A illustrates the HCDC 701 in a closed position. When connected to the coaxial tube, a power fluid chamber 705 maintains a fluid connection with the inner coaxial tube and a product fluid chamber 706 maintains a fluid connection with the outer coaxial tube. The HCDC valve stem 707 isolates the power fluid chamber 705 from a power fluid outlet 708 when a power fluid seal 710 is seated within the power fluid seat 711. This prevents the power fluid from flowing from the power fluid chamber 705 to the power fluid outlet 708 through a power fluid valve port 709.

The HCDC valve stem 707 isolates the product fluid chamber 706 from a product fluid outlet 715 when a product fluid seal 713 is seated against the product fluid seat 714. This prevents the product fluid from flowing from the product fluid chamber 706 to the power fluid outlet 715 past a product fluid valve stem 712. An HCDC return spring 719 maintains a closing force on the valve stem 707 to isolate both the power and product fluid flows.

Figure FIG. 7B illustrates the HCDC 701 in an open position. When connected to the coaxial tube, the power fluid chamber 705 maintains a fluid connection with the inner coaxial tube and the product fluid chamber 706 maintains a fluid connection with the outer coaxial tube. When the pump top cap 716 is connected into the bottom of the HCDC 701, the valve stem 707 is pushed up into the HCDC by the pump top cap valve stem pocket 718. The valve stem 707 is sealed to the top cap by a top cap power fluid seal 717. The HCDC power fluid outlet 708 now maintains a fluid connection with the pump top cap power fluid chamber 720. The HCDC product fluid outlet 715 now maintains a fluid connection with a pump top cap product fluid chamber 721.

As the pump top cap 716 is inserted farther into the HCDC, a top cap product fluid seal 722 forms a seal with the inside of the HCDC power fluid outlet 715. As the pump top cap 716 is inserted farther into the HCDC, the valve stem 707 is pushed upwards against the return spring 719 and lifts the product fluid seal 713 away from the product fluid seat 714. This allows product fluid to flow between the product fluid chamber 706 and the product fluid outlet 715.

As the pump top cap 716 is inserted further into the HCDC, the valve stem 707 is pushed upwards against the return spring 719 and lifts the power fluid seal 710 out of the power fluid seat 711. This causes the top of the valve stem 707 to enter the power fluid chamber and allow power fluid to flow through the power fluid valve port 709 into the power fluid outlet 708. This allows power fluid to flow between the power fluid chamber 705 and the power fluid outlet 708.

Figure 8A:
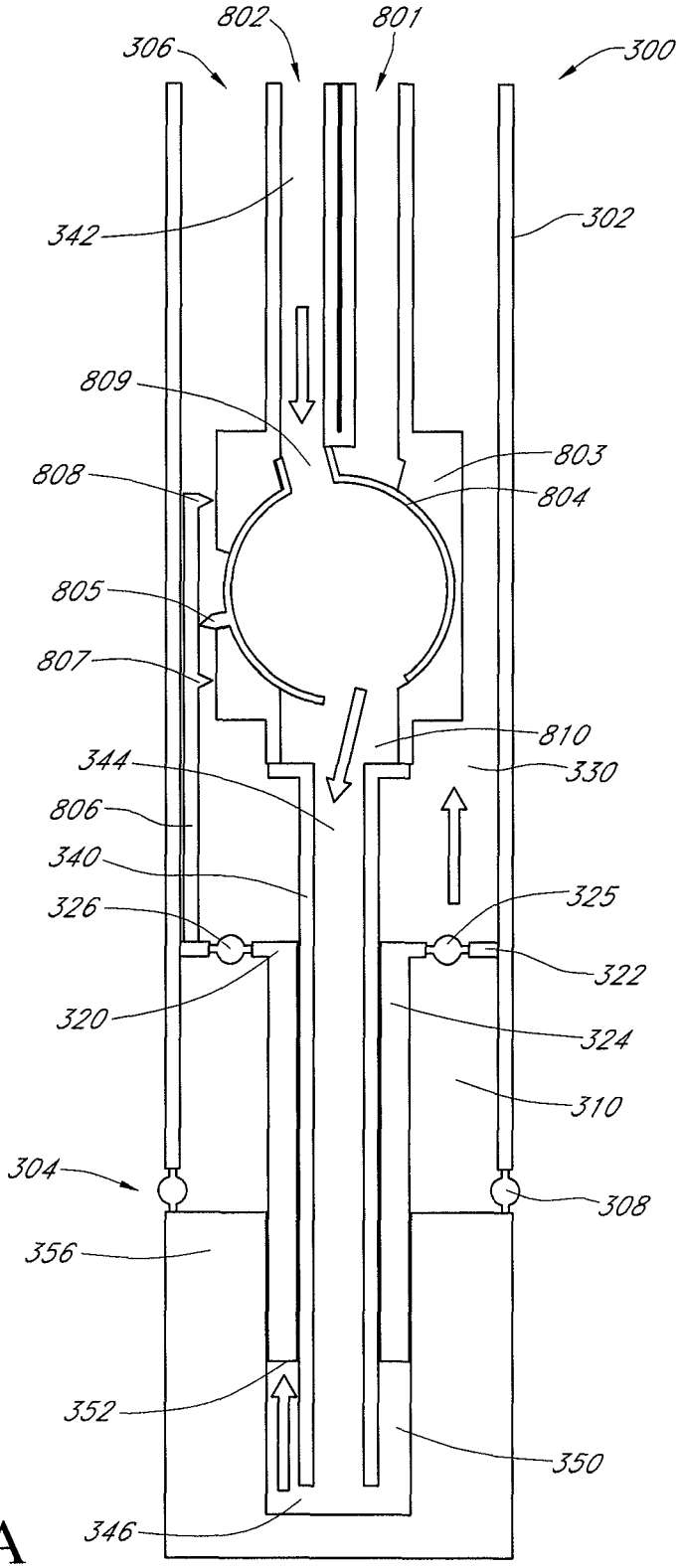
FIG. 8A provides a cross-sectional view of a subterranean switch pump during a power stroke.
Figure 8B:
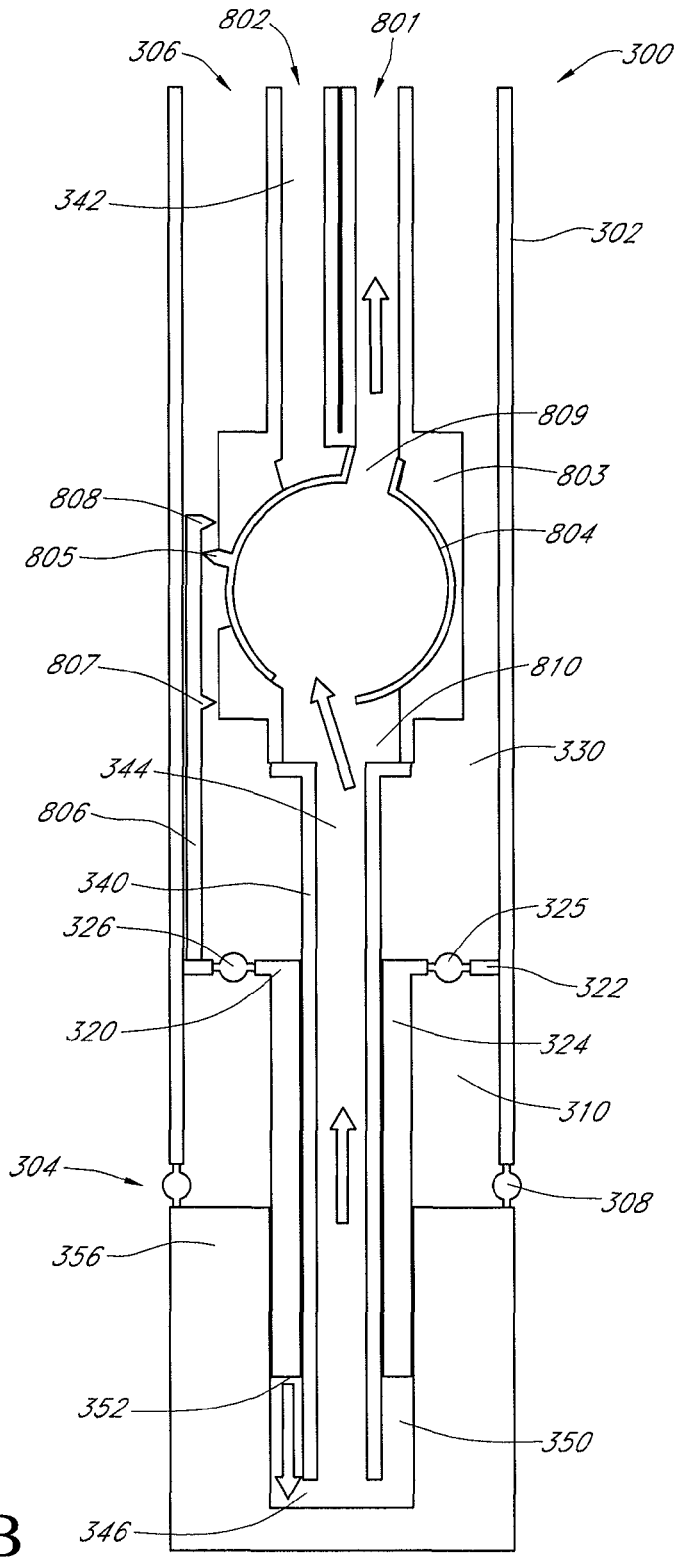
FIG. 8B provides a cross-sectional view of a subterranean switch pump during a pump recovery stroke.

FIG. 8A and FIG. 8B illustrate a subterranean switch pump. In general, a hydraulic subterranean switch (HSS) is configured to reduce the effects of hydraulic fluid compression acting on the pumps of the present disclosure (such as those described above) at well depths. In downhole well applications, the HSS is connected between coaxial tubing, which is installed down the well casing, and the coaxial pump, located at the bottom of the well.

In one illustrated form of the system as discussed below, the HSS is connected to a coaxial downhole tubing set which includes an outer product water tube within which are located two hydraulic power tubes. One of these tubes is pressurized to the required hydraulic pressure necessary to drive a piston on its power stroke (as described above). The other hydraulic tube is pressurized to the required hydraulic pressure necessary to drive the piston on its recovery stroke (as described above).

FIG. 8A illustrates one embodiment of an HSS 803. The HSS 803 includes a power hydraulic line 802, which provides fluid pressure required to drive the piston on its power stroke. A recovery hydraulic line 801 provides fluid pressure required to drive the piston on its recovery stroke. A diverter valve stem 804 is configured to control a fluid connection of the pump power fluid column 344 to either the power or recovery pressure fluid flows through the HSS 803. In some embodiments a HSS valve stem cam 805 is actuated by a pump piston follower 806 to switch between either power or recovery strokes.

Near the end of the power stroke, a pump piston follower 806 is raised by a pump piston 320, which causes a recovery stroke cam lobe 807 to raise an HSS valve stem cam 805. This causes the valve stem 804 to switch the position of a valve stem inlet 809 to complete the hydraulic connection of a pump power fluid column 344 from the power hydraulic line 802 to the recovery hydraulic line 801 via the HSS valve stem outlet 810. This initiates the recovery stroke of the pump.

FIG. 8B illustrates the pump recovery stroke. Near the end of the pump recovery stroke, the pump piston follower 806 is lowered by the pump piston 320, which causes the power stroke cam lobe 808 to lower the HSS valve stem cam 805. This causes the valve stem 804 to switch the position of the valve stem inlet 809 to complete the hydraulic connection of the pump power fluid column 344 from the recovery hydraulic line 801 to the power hydraulic line 802 via the HSS valve stem outlet 810. This initiates the power stroke of the pump.

Figure 9:
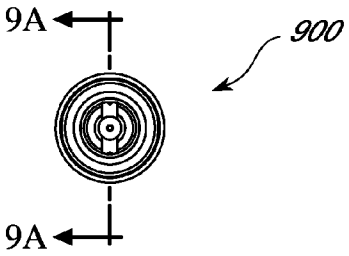
FIG. 9 provides a cross-section view of one embodiment of a downhole pump.
Figure 9A:
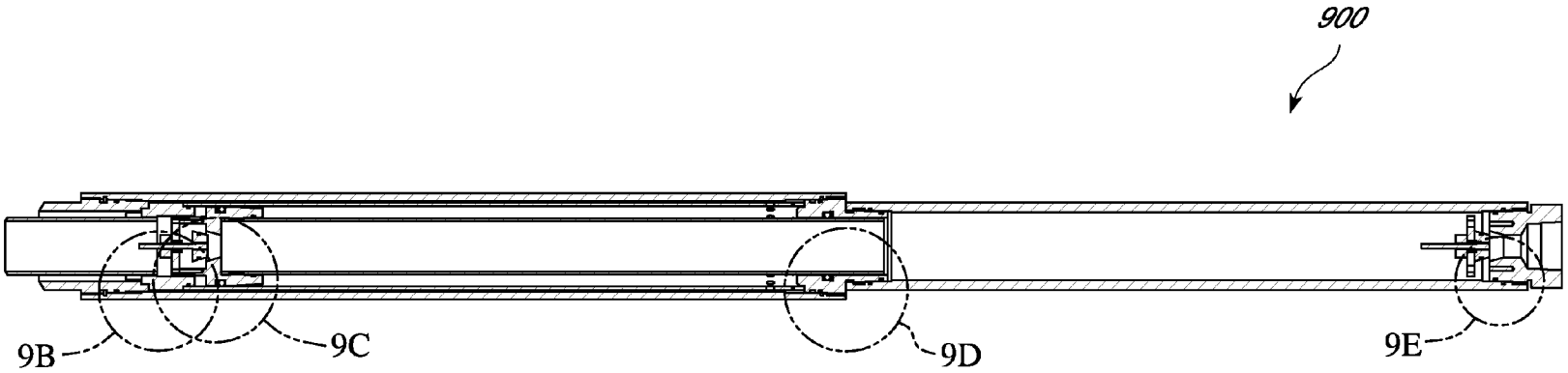
FIG. 9A provides a cross-section view of one embodiment of a 3.5" downhole pump.
Figure 9D:
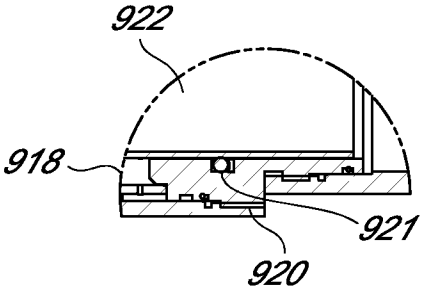
FIG. 9D provides a cross-section view of the embodiment of FIG. 9A including the seal between a power fluid chamber and a transfer chamber.
Figure 9E:
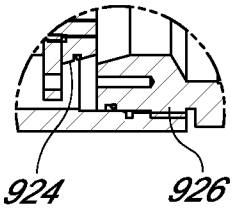
FIG. 9E provides a cross-section view of the embodiment of FIG. 9A including the intake valve located within the bottom of the pump.
Figure 9B:
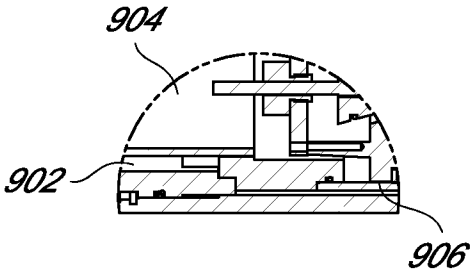
FIG. 9B provides a cross-section view of a connection location for the power fluid tube and the product fluid coaxial tube.
Figure 9C:
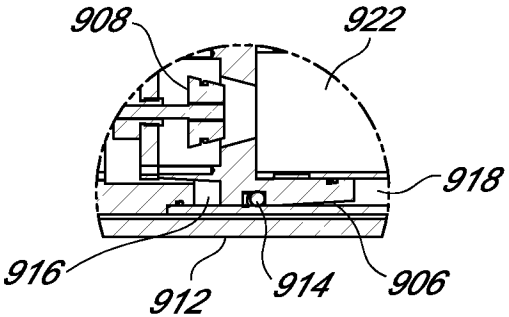
FIG. 9C provides a cross-section view of the embodiment of FIG. 9A including the main piston seal.

FIG. 9 illustrates one embodiment of a downhole pump 900. FIG. 9A shows a cross section of an embodiment of a 3.5" version of the pump 900. FIG. 9B illustrates a detail of the connection locations for both the power fluid 902 and product fluid 904 coaxial tubes. FIG. 9C illustrates a detail of the transfer piston 906 and the transfer valve 908 within the piston tube and pump casing 912. FIG. 9C also illustrates the main piston seal 914 which separates the product fluid chamber 916 and the power fluid chamber 918. FIG. 9D illustrates the main block 920, which locates the main seal 921 between the power fluid chamber 918 and the transfer chamber 922. FIG. 9E illustrates the arrangement of the intake valve 924 located within the bottom cap 926 of the pump assembly.

Figure 10:
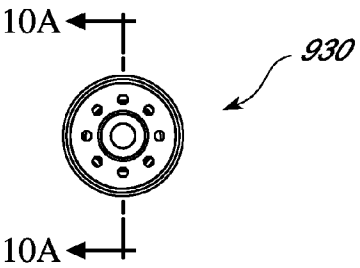
FIG. 10 provides another embodiment of a downhole pump.
Figure 10A:
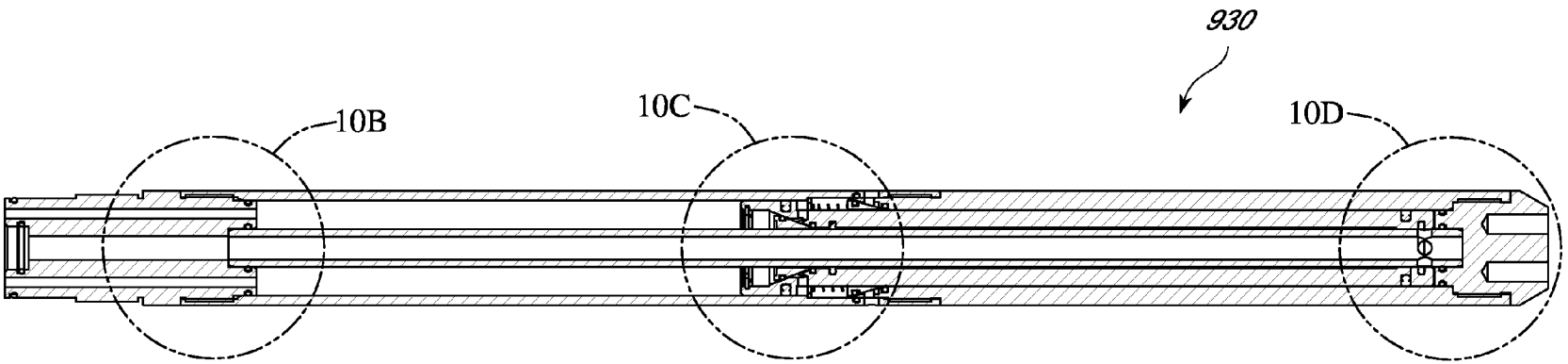
FIG. 10A provides a cross-sectional view of a 1.5" stacked downhole pump.
Figure 10D:
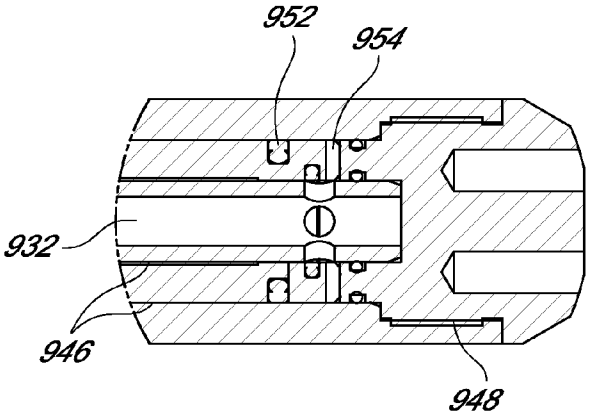
FIG. 10D provides a cross-sectional view of the embodiment of FIG. 10A including a bottom piston seal.
Figure 10B:
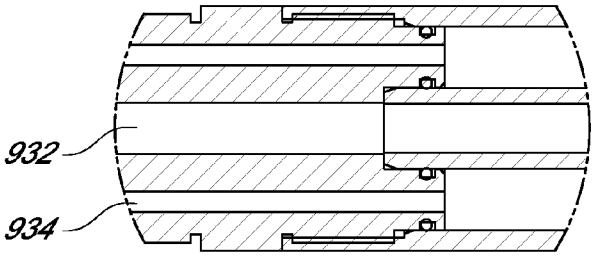
FIG. 10B provides a cross-sectional view of the embodiment of FIG. 10A including the power fluid and product fluid coaxial tubes.
Figure 10C:
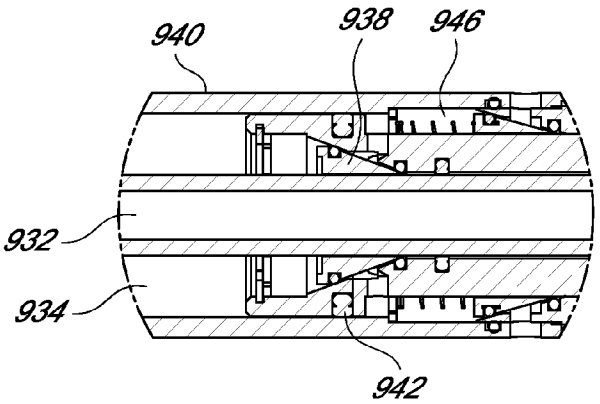
FIG. 10C provides a cross-sectional view of the embodiment of FIG. 10A including a main piston seal.

FIG. 10 illustrates another embodiment of a downhole pump 930. The downhole pump 930 has a configuration different than that of the embodiment of FIG. 9. The location of the power fluid and the product fluid (and related chambers for such power fluid and product fluid) are switched from outside to inside and from inside to outside for the coaxial pumps illustrated in FIG. 9 and FIG. 10. FIG. 10A shows a cross section of an embodiment of a 1.5" stacked version of the pump 930 similar to the embodiment illustrated in FIG. 3. FIG. 10B illustrates a detail of the connection and static seal locations for both the power fluid (internal) 932 and product fluid (external) 934 coaxial tubes. FIG. 10C illustrates a detail of the upper portion of the transfer piston 936 and the transfer valve 938 within the pump casing 940. FIG. 10C also illustrates the main piston seal 942, which separates the product fluid chamber 944 and the transfer fluid chamber 946. FIG. 10D illustrates the bottom cap 948, which locates the power fluid tube 932 within the pump. FIG. 10D also illustrates the bottom piston seal 952, which separates the power fluid chamber 954 from the transfer fluid chamber 946.

Figure 11:
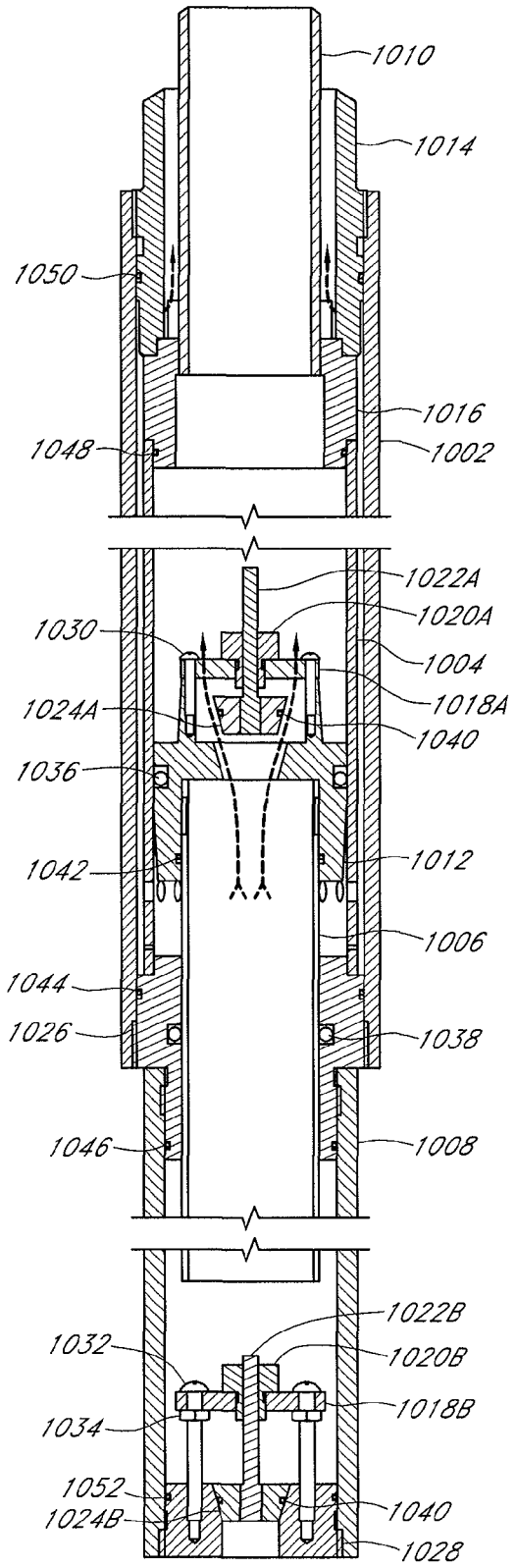
FIG. 11 provides another embodiment of a downhole pump.

FIG. 11 illustrates an embodiment of a downhole pump. The illustrated pump comprises an outer cylinder 1002 and a main cylinder 1004, which surrounds a piston rod 1006. A lower cylinder 1008 is present below the main cylinder 1004. A discharge stub 1010 is present extending from the outer cylinder 1002. A piston 1012 is present within the main cylinder 1004. An outer top cap 1014 is attached to the outer cylinder 1002 and surrounding the discharge stub 1010. An inner top cap 1016 is located below the outer top cap 1014 and entirely within the outer cylinder 1002.

A piston check valve guide bar 1018A and a lower check valve guide bar 1018B are attached to check valve guides 1020A and 1020B and check valve pins 1022A and 1022B respectively. The check valve pins 1022A and 1022B attach to check valves 1024A and 1024B respectively. When in an open position, check valve 1024A allows liquid to flow around it. When in a closed position, check valve 1024B prevents liquid flow.

In some embodiments the downhole pump includes a main block 1026 surrounding the lower portion of the piston rod 1006. The downhole pump also includes a lower plate 1028, which contacts the check valve 1024B when it is in a closed position and no fluid may pass therethrough. The downhole pump includes a piston check valve screw 1030 a lower plate check valve screw 1032, a lower plate check valve nut 1034 as illustrated in FIG. 11. In addition, the downhole pump can include a piston reciprocating o-ring 1036 as part of the piston 1012, a main seal ring 1038 as part of the main block 1026, a check valve o-ring 1040 as part of the check valves 1024A and 1024B, a piston rod o-ring 1042 as part of the piston rod 1006, a main block upper o-ring 1044 as part of the main block 1026, a main block lower o-ring 1046 as part of a lower portion of the main block 1026, an inner top seal o-ring 1048 as part of the inner top cap 1016, an outer top seal o-ring 1050 as part of the outer top cap 1014 and a bottom seal o-ring 1052 as part of the lower plate 1028.

Figure 12:
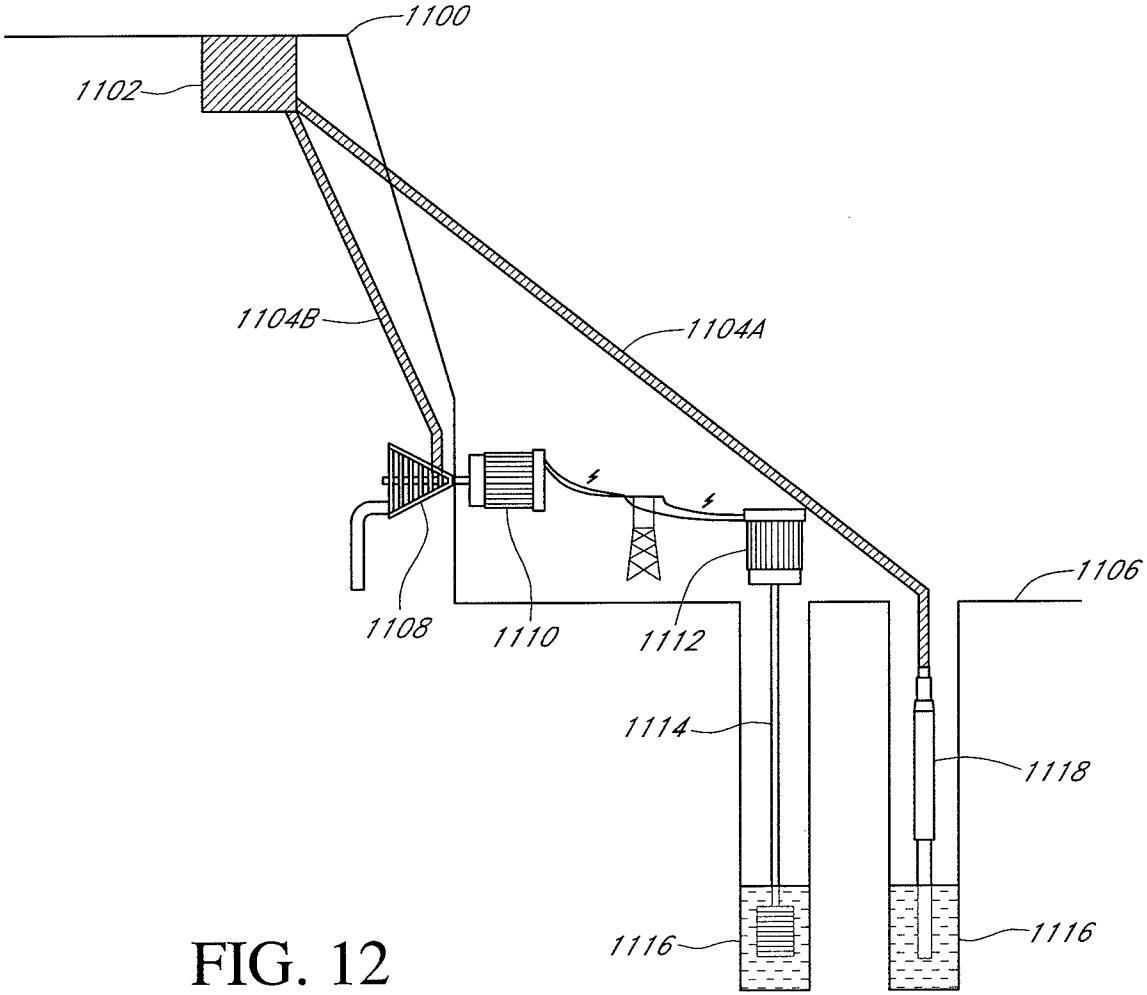
FIG. 12 provides a figure illustrating an efficiency comparison between a conventional electric pump and a pump of a preferred embodiment.

FIG. 12 illustrates energy conversion for a conventional pump system and a pump system of the present disclosure. Both systems utilize the potential energy of a fluid 1102 at an elevation 1100 greater than ground level 1106. The fluid 1102 flows through pipes 1104A and 1104B. In the illustrated electrically-driven pump system, the fluid in pipe 1104B flows through a typical conventional system comprising a water turbine 1108 which drives an electrical generator 1110. The generated electricity is routed through a typical electrical transmission system to an electrically-driven fluid pump 1112 to extract fluid 1116 from a deep well through a pipe 1114. Due to energy conversion and transmission losses throughout this system, the conventional pump system with a high head thus achieves an efficiency of not greater than about 60%. In the illustrated direct fluid-driven pump system, the fluid 1102 flows from a pipe 1104A to the pump of the present disclosure 1118 used to extract water 1116 from a deep well. This process uses a high-head water source and a pump of the present disclosure to achieve a measured efficiency of up to about 96%. The high-head direct fluid-driven pump system increases efficiency by reducing the conversion and transmission losses inherent in the electrically-driven pump system.

Figure 13:
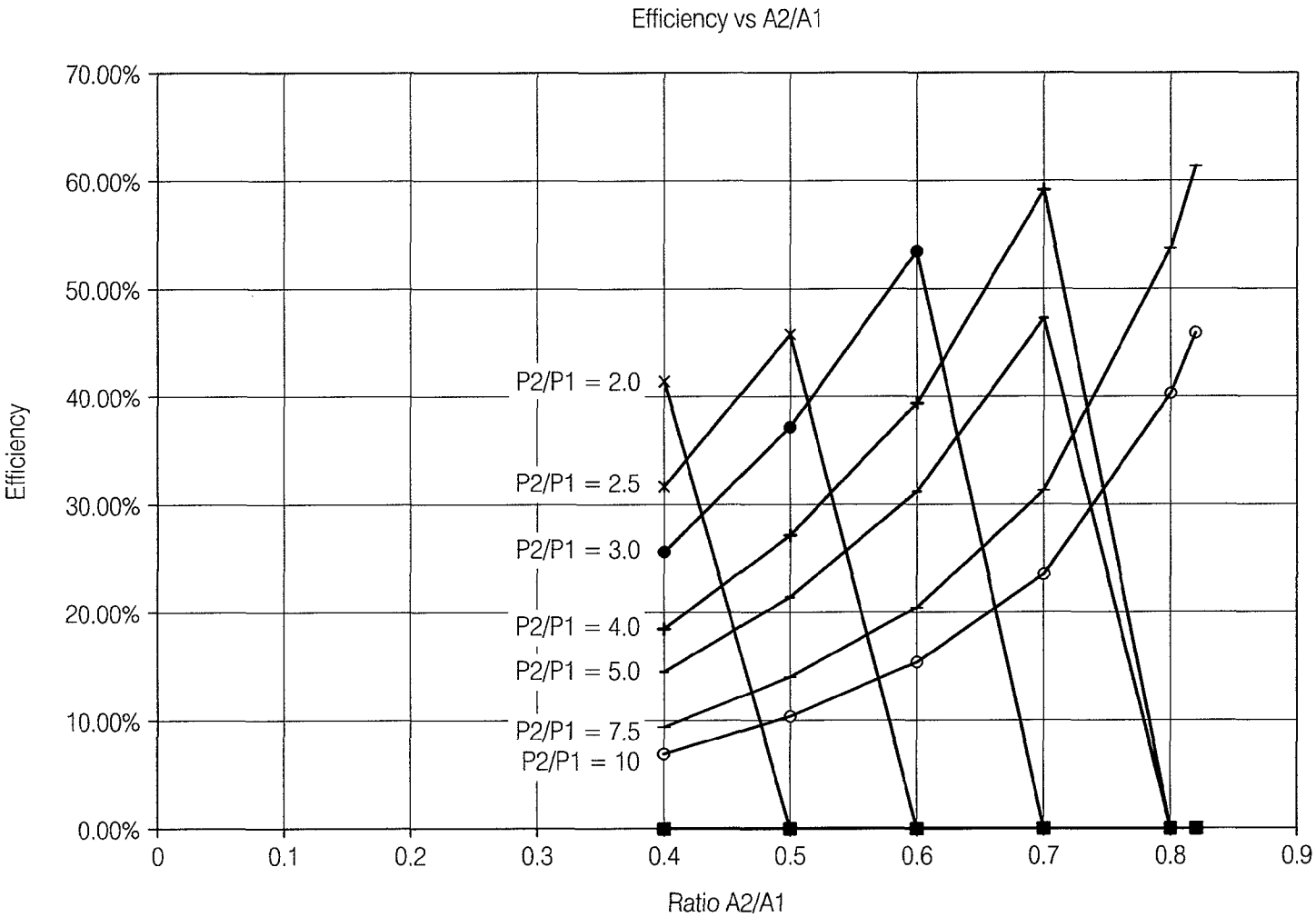
FIG. 13 provides a graph illustrating efficiency of various pumps based upon a ratio of two areas on a piston.

FIG. 13 is a graph illustrating dynamic performance of a piston pump, such as the piston pump described in U.S. Pat. No. 6,193,476 to Sweeney, which is hereby incorporated by reference in its entirety. The analysis has various applications including the need to accelerate the power column fluid and the standing column fluid.

The piston pump includes a transfer piston sliding in the bore of a pipe. The transfer piston, and a standing column of water, are raised by pressurizing an annular space ($A_1$-$A_2$) using either a source of water at a higher elevation (pressure-head concept) or a power piston in a power cylinder (power cylinder concept). Some embodiments are hybrid types of pumps.

To reset the transfer piston at the end of the power stroke the pressure in the annular space must be reduced by:

releasing the water in the pressurehead concept or reversing the power cylinder.

During the power stroke, the pressure created by the power column ($P_2$) must be greater than the pressure at the bottom of the standing column ($P_1$); the area that the standing column acts on ($A_1$) is larger than the area that the power column acts on ($A_1$-$A_2$). This means that for the pressurehead concept the height of the power column ($H_2$) must be greater than the height of the standing column ($H_1$). For both the pressurehead concept and the power cylinder concept, as the power column pressure decreases, the annular space must increase relative to $A_1$. As the annular space increases the transfer area ($A_2$) decreases, decreasing the water lifted per stroke.

During the recovery stroke the pressure in the annular space ($P_5$) must be less than $P_1$: in a pressurehead concept pump the point of release for the power water ($H_5$) must be below the top of the standing column; in the power cylinder concept pump the negative pressure created in the power cylinder is limited to −14.7 psig, this becomes very significant if the power cylinder is located at or above the top of the standing column. The standing column follows the transfer piston down the standing column pipe during the recovery stroke and must be lifted again before any water can be discharged. The distance that the standing column retreats is less than the stroke of the transfer piston because some water comes up through the transfer piston during the recovery stroke. If the transfer area ($A_2$) is large compared to $A_1$, the standing column retreats only a short distance.

For the following discussion, term definitions are provided: RotR is Run-of-the-River Hydro, a pump used to boost water into a reservoir to support a small hydro power development; $H_1$ is height of the standing column; $P_1$ is pressure at the bottom of the standing column; $H_2$ is height of the primary power column; $P_2$ is pressure created by the primary power column; $P_3$ is pressure in the intake chamber; $P_4$ is pressure during power stroke; $P_1$ is pressure during the recovery stroke; $P_4$ is pressure in the pool of working fluid; $H_5$ is height of the power column discharge; $P_5$ is pressure created by the power column while discharging; $P_c$ is pressure in the power cylinder; $A_1$ is area of the transfer piston; $A_2$ is area of the transfer space of the transfer piston; $A_2$−$A_1$ is area of the annular space that the power fluid pressure acts on; $A_2/A_1$ is ratio of the transfer space area to the total transfer piston area ($A_2/A_1$=r<1); r is $A_2/A_1$<1; a is acceleration as a multiple of 'g'; g is acceleration of gravity=32.2 ft/sec$^2$; d is density of the working fluid: 0.036 lbs/in$^3$ for water; $F_d$ is force down or resisting upward motion; $F_u$ is force up or resisting downward motion; $F_d$ is net force in the direction of intended travel; R is total seal resistance to motion; W is weight of the Transfer Piston; M is mass; S is stroke length; Eff is efficiency (work out/work in expressed as a percentage); $W_o$ is work output; and $W_i$ is work input.

Power water from a source at an elevation $H_2$ well above the top of the standing column $H_1$ is used to pressurize the annular space and raise the transfer piston and the standing column of water. The power water must be released at an elevation $H_5$ below $H_1$.

The force attempting to move the transfer piston up is:

$$F_u=P_2(A_1-A_2)+P_3(A_2)$$

For most applications $P_3$=$P_4$ and can be taken to 0 (W is much less than the other forces and is ignored for this analysis).

The force resisting the attempted upward motion is:

$$F_d=P_1A_1+R+W$$

The net force acting on the transfer piston is:

$$F_n=P_2(A_1-A_2)-(P_1A_1+R)$$

The mass to be accelerated is:

$$M=H_1A_1d+H_2(A_1-A_2)d+W$$

wherein the mass of the standing column is $H_1A_1d$; the mass of the power column is $H_2(A_1-A_2)d$; and the mass of the piston is W (the piston mass is usually small enough relative to the water columns to be ignored). Because P is HAd/A, therefore PA is HAd and P is Hd.

The masses of the water columns can be rewritten:

$$M=P_1A_1+P_2(A_1-A_2)$$

The net force is equal to the mass times the acceleration expressed as a fraction of g.

$$F_n = Ma$$

$$P_2(A_1 - A_2) - (P_1A_1 + R) = a\{P_1A_1 + P_2(A_1 - A_2)\}$$

$$P_2A_1 - P_2A_2 - P_1A_1 - R = aP_1A_1 + aP_2A_1 - aP_2A_2$$

Separate $P_2$ $$P_2A_1 - P_2A_2 - aP_2A_1 + aP_2A_2 = aP_1A_1 + P_1A_1 + R$$

$$P_2(A_1 - A_2 - aA_1 + aA_2) = P_1A_1(a + 1) + R$$

$r = A_2/A_1$, then $A_2 = rA_1$, $$P_2(A_1 - rA_1 - aA_1 + arA_1) = P_1A_1(a + 1) + R$$

$$P_2 = \frac{P_1A_1(a+1)}{(A_1 - rA_1 - aA_1 + arA_1)} + \frac{R}{(A_1 - rA_1 - aA_1 + arA_1)},$$

$$P_2 = \frac{P_1A_1(a+1)}{A_1(1 - r - a + ar)} + \frac{R}{A_1(1 - r - a + ar)},$$

$$P_2 = \frac{P_1(1+a)}{\{1 - r + a(r-1)\}} + \frac{R}{A_1\{1 - r + a(r-1)\}},$$

However: $\{1 - r + a(r-1)\} = \{(1-r) - a(1-r)\} = (1-a)(1-r)$ $$P_2 = \frac{P_1(1+a)}{(1-a)(1-r)} + \frac{R}{A_1(1-a)(1-r)},$$

Neglecting $R$.

$$\frac{P_2}{P_1} = \frac{(1+a)}{(1-a)(1-r)}$$

or $$P_2 = \frac{P_1(1+a)}{(1-a)(1-r)}$$

Setting $A_2/A_1 = r = 0.8$: $1 - r = 0.2$ $$\frac{P_2}{P_1} = \frac{(1+a)}{(1-a)0.2},$$

for $H_1$=100', the following relationships hold:

| a | $P_2/P_1$ | $H_2$ |
|---|---|---|
| 0.1 | 6.11 | 611' |
| 0.25 | 8.33 | 833' |
| 0.5 | 15 | 1500' |
| 1.0 | infinite | |

Making the transfer area ($A_2$) smaller makes the annular area ($A_1$−$A_2$) bigger:

Setting $A_2/A_1 = r = 0.5$: $1 - r = 0.5$

-continued $$\frac{P_2}{P_1} = \frac{(1+a)}{(1-a)0.5}$$

for $H_1$=100', the following relationships hold:

| a | $P_2/P_1$ | $H_2$ |
|---|---|---|
| 0.1 | 2.44 | 244' |
| 0.25 | 3.33 | 333' |
| 0.5 | 6.00 | 600' |
| 1.0 | infinite | |

The force trying to push the transfer piston down as part of a recovery stroke is:

$$F_d=P_1A_1+W$$

wherein W<<less than other forces and is ignored.

The force resisting the attempted downward motion is:

$$F_u=P_5(A_1-A_2)+P_3A_2+R$$

In this case $P_3=P_1$ and the valve in the transfer piston is open.

$$F_n=F_d-F_u=P_1A_1-(P_5(A_1-A_2)+P_1A_2+R)$$

The mass to be accelerated is:

$$M = H_1A_1d + H_5(A_1 - A_2)d = P_1A_1 + P_5(A_1 - A_2)$$

$$F_n = Ma$$

$$P_1A_1 - P_5(A_1 - A_2) - P_1A_2 - R = a\{P_1A_1 + P_5(A_1 - A_2)\}$$

$$P_1A_1 - P_1A_2 - P_5A_1 + P_5A_2 - R = aP_1A_1 + aP_5A_1 - aP_5A_2$$

Separate $P_5$:

$$P_5A_2 - P_5A_1 + aP_5A_2 - aP_5A_1 = aP_1A_1 - P_1A_1 + P_1A_2 + R$$

$A_2/A_1 = r$: therefore $A_2 = rA_1$, $$P_5(rA_1 - A_1 + arA_1 - aA_1) = P_1(aA_1 - A_1 + rA_1) + R$$

$$P_5 = \frac{P_1A_1(a-1+r)}{A_1(r-1+ar-a)} + \frac{R}{A_1(r-1+ar-a)},$$

$$P_5 = \frac{P_1(a-1+r)}{(r-1+ar-a)} + \frac{R}{A_1(r-1+ar-a)},$$

However: $(r-1+ar-a) = r-1+a(r-1) = (1+a)(r-1)$ and $a-1+r = a-(1-r)$ $$P_5 = \frac{P_1(a-(1-r))}{(1+a)(r-1)} + \frac{R}{A_1(1+a)(r-1)},$$

Neglecting $R$.

$$P_5 = \frac{P_1(a-(1-r))}{(1+a)(r-1)}$$

Setting $A_2/A_1 = r = 0.8$: $(1-r) = 0.2$: $(r-1) = -0.2$ $$\frac{P_5}{P_1} = \frac{(a-0.2)}{-0.2(1+a)}$$

For $H_1$=100', the following relationships hold:

| a | $P_5/P_1$ | $H_5$ |
|---|---|---|
| 0.1 | 0.455 | 45.5' |
| 0.15 | 0.217 | 21.7' |
| 0.2 | 0 | 0' |
| 0.25 | −0.2 | −20'* |

*i.e. the discharge must be below the level of the pump and create a suction

Decreasing the Transfer Area relative to the Standing Column Area:

Setting $A_2/A_1 = r = 0.5$: $(1-r) = 0.5$: $(r-1) = -0.5$ $$\frac{P_2}{P_1} = \frac{(a-0.5)}{-0.5(1+a)}$$

For $H_1$=100', the following relationships hold:

| a | $P_5/P_1$ | $H_5$ |
|---|---|---|
| 0.1 | 0.73 | 73' |
| 0.15 | 0.61 | 61' |
| 0.2 | 0.40 | 40' |
| 0.5 | 0.00 | 0' |

Work out=weight moved per stroke×$H_1$ $$W_o=A_2SdH_1$$

Work in=the weight of water used per stroke×total height lost $$W_i = (A_1 - A_2)Sd(H_2 - H_5)$$

$$Eff = 100W_o/W_i = \frac{A_2SdH_1}{(A_1 - A_2)Sd(H_2 - H_5)},$$

$$A_2/A_1 = r\text{: } A_2 = rA_1,$$

$$Eff = \frac{100rA_1H_1}{A_1(1-r)(H_2 - H_5)},$$

$$Eff = \frac{100rH_1}{(1-r)(H_2 - H_5)},$$

As an example $A_2/A_1 = r = 0.8$: $1-r = 0.2$: and $a = 0.1$ g: $H_1 = 100$ ft, $H_2 = 611'$: $H_5 = 45.5'$ $$Eff = \frac{100(0.8)100}{0.2(611-45.5)} = 70.7\%$$

In order to de-water a mine the equations discussed above can be used, but the power water can be released at $H_5$=0. However, the pressure required to operate the power stroke is not reduced and the water is released at the bottom of the standing column reducing the efficiency (to 65.5% in one situation above). The released power water then has to be re-lifted resulting in a further efficiency loss (to 52.4% in one situation investigated above).

The placement of the pump does not change the basic formulas, but does affect how the formulas may be simplified.

The force attempting to move the transfer piston up is $F_u$:

$$F_u=P_2(A_1-A_2)+P_3(A_2)$$

$P_3=P_4$ is nearly 0 in most cases and is ignored.

The force resisting the attempted upward motion is $F_d$ (W is much less than the other forces and is ignored for this analysis):

$$F_d=P_1A_1+R+W$$

$$F_n=F_u-F_d=P_2(A_1-A_2)-(P_1A_1+R)$$

Where the mass of the Standing Column $H_1A_1d$, the mass of the power column $H_2(A_1-A_2)d$; and the mass of the piston W, the mass to be accelerated is (the piston mass is usually small enough relative to the water columns to be ignored):

$$H_2 = H_1:\ HAd = Pd$$

$$\begin{aligned}\text{Mass} &= H_1A_1d + H_1(A_1 - A_2)d + W\\ &= 2H_1A_1d - H_1A_2d\\ &= 2P_1A_1 - P_1A_2\end{aligned}$$

$$F_n = Ma$$

$$P_2(A_1 - A_2) - (P_1A_1 + R) = (2P_1A_1 - P_1A_2)a$$

$$P_2 = P_1 + P_c:\ \text{and}\ A_2 = rA_1:$$

$$(P_1 + P_c)(A_1 - rA_1) - P_1A_1 - R = (2P_1A_1 - P_1rA_1)a$$

$$P_1A_1 + P_cA_1 - P_1rA_1 - P_crA_1 - P_1A_1 - R = aP_1A_1(2 - r)$$

Separate $P_c$, $$P_cA_1 - P_crA_1 = aP_1A_1(2 - r) + P_1rA_1 + R$$

$$P_cA_1(1 - r) = P_1A_1(a(2 - r) + r) + R$$

$$P_c = \frac{P_1A_1(a(2 - r) + r)}{A_1(1 - r)} + \frac{R}{A_1(1 - r)},$$

$$P_c = \frac{P_1(a(2 - r) + r)}{(1 - r)} + \frac{R}{A_1(1 - r)},$$

Neglecting $R$.

$$P_c = \frac{P_1(a(2 - r) + r)}{(1 - r)};$$

Set $r = 0.8$: $(1 - r) = 0.2$: $(2 - r) = 1.2$ $$P_c = \frac{P_1(1.2a + 0.8)}{0.2}$$

Where $H_1$=100 ft and $P_1$=43.3 psig, the following relationships apply:

| a | $P_c/P_1$ | $P_c$ | $P_2$ |
|---|---|---|---|
| 0.0 | 4.0 | | |
| 0.1 | 4.6 | 199' | 242' |
| 0.25 | 5.5 | | |
| 0.5 | 7.0 | | |
| 1.0 | 10.0 | | |

Decrease the transfer area so that:

$$A_2/A_1 = r = 0.5;$$

$$1 - r = 0.5:\ 2 - r = 1.5$$

$$P_c = \frac{P_1(1.5a + 0.5)}{0.5}$$

Where $H_1$=100 ft and $P_1$=43.3 psig, the following relationships apply:

| a | $P_c/P_1$ | $P_c$ | $P_2$ |
|---|---|---|---|
| 0.0 | 1.0 | | |
| 0.1 | 1.3 | 56.3' | 100' |
| 0.25 | 1.75 | | |
| 0.5 | 2.5 | | |

The force attempting to push the transfer piston down is (W is much less than other forces and is ignored):

$$F_d=P_1A_1+W$$

The force resisting the attempted downward motion is:

$$F_u=P_5(A_1-A_2)+P_3A_2+R$$

In this case $P_3=P_1$: the transfer valve is open, $$F_n=F_d-F_u=P_1A_1-(P_5(A_1-A_2)+P_1A_2+R)$$

The mass to be accelerated is:

$$M = H_1A_1d + H_2(A_1 - A_2)d;$$

$$H_2 = H_1:\ H_1d = P_1:$$

$$M = P_1A_1 + P_1(A_1 - A_2)$$

$$F_n = Ma$$

$$P_1A_1 - P_5(A_1 - A_2) - P_1A_2 - R = a(P_1A_1 + P_1(A_1 - A_2))$$

$$A_2 = rA_1:\ P_5 = P_1 + P_c\ (P_c\ \text{is negative})$$

$$P_1A_1 - (P_1 + P_c)(A_1 - rA_1) - P_1rA_1 - R = aP_1A_1 + aP_1A_1 - aP_1rA_1$$

$$P_1A_1 - (P_1A_1 + P_cA_1 - P_1rA_1 - P_crA_1) - rP_1A_1 = aP_1A_1(2 - r) + R$$

$$P_1A_1 - P_1A_1 - P_cA_1 + rP_1A_1 + P_crA_1 - rP_1A_1 = aP_1A_1(2 - r) + R$$

$$P_crA_1 - P_cA_1 = aP_1A_1(2 - r) + R$$

$$P_cA_1(r - 1) = aP_1A_1(2 - r) + R$$

$$P_c = \frac{aP_1A_1(2 - r)}{A_1(r - 1)} + \frac{R}{A_1(r - 1)},$$

$$P_c = \frac{aP_1(2 - r)}{(r - 1)} + \frac{R}{A_1(r - 1)},$$

Neglecting $R$.

$$P_c = \frac{aP_1(2 - r)}{(r - 1)}$$

Setting $A_2/A_1 = r = 0.8$;

$$(2 - r) = 1.2;$$

$$(r - 1) = -0.2;$$

$$(2 - r)/(r - 1) = -6$$

$$P_c = -6aP_1$$

If $H_1$=100 ft and $P_1$=43.3 psig, the following relationships apply:

| a | $P_c = -6aP_1$ |
|---|---|
| 0.1 | −26 psig (not possible) |
| 0.05 | −13 psig (limiting case) |

To have $P_c$=−14.7, for a=0.1, $P_1$=(−14.7)/(−0.6)=24.5 psig: $H_1$=56.6 ft.

Making the transfer area smaller:

Setting $A_2/A_1=r=0.5;(2-r)=1.5;(r-1)=-0.5;(2-r)/(r-1)=-3$ $P_c=-3aP_1$:

For $P_1$=43.3 psig (100 ft of water), $a$ is 0.1 and $P_c$ is −13 psig.

Work out=weight moved per stroke×$H_1$ $W_o=A_2SdH_1$

Work in=$W_i=P_c(A_1-A_2)S$:

$P_c=P_c$(power)−$P_c$(recovery)

The volume moved by the power cylinder must equal the volume received by the power side of the transfer cylinder; $(A_1-A_2)S$.

$$Eff = 100W_o/W_i = \frac{100A_2SdH_1}{P_c(A_1-A_2)S}$$

$A_2/A_1 = r$: $A_2 = rA_1$: and $HAd = PA$: $Hd = P$ $$Eff = \frac{100rA_1P_1}{P_cA_1(1-r)}$$

$$Eff = \frac{100rP_1}{P_c(1-r)}$$

$A_2/A_1 = r = 0.8$: $(1-r) = 0.2$:

and $H_1 = 100$ ft′: $P_1 = 43.3$ $psig$

Power stroke acceleration of 0.1 g and accepting a recovery acceleration of 0.05 g, Power stroke $P_c = 199$ Recovery Stroke $P_c = -13$ $P_c = 212$ $psig$ $$Eff = \frac{100(0.8)43.3}{212(0.2)} = 81.7\%$$

In a pump placed at the bottom of a standing column $H_2$=0 (RotR Hydro Style 1), (for mine dewatering and booster applications), the force attempting to move the transfer piston up is $F_u$:

$F_u=P_2(A_1-A_2)+P_4(A_2)$ $P_4=P_3$ is nearly 0 in most cases and is ignored.

The force resisting the attempted upward motion is $F_d$ (wherein W is much smaller than the other forces and is ignored for this analysis):

$F_d=P_1A_1+R+W$ $F_n=F_u-F_d=P_2(A_1-A_2)-(P_1A_1+R)$

Where the mass of the Standing Column is $H_1A_1d$; the mass of the power column is $H_2(A_1-A_2)d$=0; and the mass of the piston W (the piston mass is usually small enough relative to the water columns to be ignored), the mass to be accelerated is:

: $HAd = PA$ $$\text{Mass} = H_1A_1d + W = P_1A_1$$

$F_n = Ma$ $P_2(A_1 - A_2) - (P_1A_1 + R) = P_1A_1a$

-continued $P_2 = P_c$: $A_2 = rA_1$ $P_c(A_1 - rA_1) - P_1A_1 - R = P_1A_1a$ $P_cA_1(1-r) = P_1A_1a + P_1A_1 + R$ $$P_c = \frac{P_1A_1(a+1)}{A_1(1-r)} + \frac{R}{A_1(1-r)},$$

$$P_c = \frac{P_1(a+1)}{(1-r)} + \frac{R}{A_1(1-r)},$$

Neglecting $R$.

$$P_c = \frac{P_1(a+1)}{(1-r)}$$

Set $r = 0.8$: $(1-r) = 0.2$

For $H_1$=100' ($P_1$=43.3 psig), the following relationships apply:

| a | $P_c/P_1$ | $P_c$ |
|---|---|---|
| 0.1 | 5.5 | 238 psig |
| 0.25 | 6.25 | 271 psig |

$F_d=P_1A_1+W$ (wherein W is much less than other forces and is ignored) The force resisting the attempted downward motion is $F_u$:

$F_u=P_5(A_1-A_2)+P_3A_2+R$

In this case $P_3=P_1$: the Transfer Valve is open.

$F_n=F_d-F_u=P_1A_1-(P_5(A_1-A_2)+P_1A_2+R)$

The mass to be accelerated is:

$M = H_1A_1d + H_5(A_1 - A_2)d$;

$H_5 = 0$: $H_1d = P_1$:

$M = P_1A_1$ $F_n = Ma$ $P_1A_1 - P_5(A_1 - A_2) - P_1A_2 - R = aP_1A_1$ $A_2 = rA_1$: $P_5 = P_c$($P_c$ is negative)

$P_1A_1 - P_c(A_1 - rA_1) - P_1rA_1 = aP_1A_1 + R$ $-P_cA_1(1-r) = aP_1A_1 - P_1A_1 + P_1rA_1 + R$ $P_cA_1(r-1) = aP_1A_1 - P_1A_1 + P_1rA_1 + R$ $$P_c = \frac{P_1A_1(a-1+r)}{A_1(r-1)} + \frac{R}{A_1(r-1)},$$

$$P_c = \frac{P_1(a-1+r)}{(r-1)} + \frac{R}{A_1(r-1)},$$

Neglecting $R$.

$$P_c = \frac{P_1(a-1+r)}{(r-1)} = \frac{P_1(a+(r-1))}{(r-1)}$$

Set $A_2/A_1 = r = 0.8$: $r - 1 = -0.2$ $$P_c = \frac{P_1(a-0.2)}{-0.2}$$

For $H_1$=100' (P1=43.3 psig), the following relationships apply:

| a | $P_c/P_1$ | $P_c$ |
|---|---|---|
| 0.1 | 0.5 | 21.65 psig |
| 0.2 | 0 | 0 psig |
| 0.25 | −0.25 | −10.8 psig |

If the Recovery Stroke work can be recovered $$W_o = A_2SdH_1$$

Work in=$W_i = P_c(A_1 - A_2)S$:

$$P_c = P_c(\text{power}) - P_c(\text{recovery})$$

The volume moved by the power cylinder must equal the volume received by the annular space of the transfer cylinder; $(A_1-A_2)S$.

$$Eff = 100W_o/W_i = \frac{100A_2SdH_1}{P_c(A_1 - A_2)S}$$

$$A_2/A_1 = r\text{: } A_2 = rA_1\text{: and } HAd = PA\text{: } Hd = P$$

$$Eff = \frac{100rA_1P_1}{P_cA_1(1-r)}$$

$$Eff = \frac{100rP_1}{P_c(1-r)}$$

$$A_2/A_1 = r = 0.8\text{: } 1 - r = 0.2\text{:}$$

$$\text{and } H_1 = 100 \text{ ft}'\text{: } P_1 = 43.3\ psig$$

Power and Recovery Stroke acceleration of 0.1 g

Power Stroke $P_c = 238$

Recovery Stroke $P_c = 22$ $$P_c = 216\ psig$$

$$Eff = \frac{100(0.8)43.3}{216(0.2)} = 81.7\%$$

If the recovery stroke work cannot be salvaged:

$$Eff = \frac{100rP_1}{P_c(1-r)}$$

Power Stroke $P_c = 238$

Recovery Stroke $P_c = 0$ $$P_c = 238\ psig$$

$$Eff = \frac{100(0.8)43.3}{238(0.2)} = 72.7\%$$

Although the above analysis works in the general case, several principles put forth above can have a more nuanced analysis. Repeating below a portion of the equations mentioned above:

Work out = weight moved per stroke × $H_1$ $$W_o = A_2SdH_1$$

Work in = the weight of water used per stroke × total height lost $$W_i = (A_1 - A_2)Sd(H_2 - H_5)$$

-continued $$Eff = 100W_o/W_i = \frac{100A_2SdH_1}{(A_1 - A_2)Sd(H_2 - H_5)},$$

Bold terms cancel $$A_2/A_1 = r\text{: } A_2 = rA_1,$$

$$Eff = \frac{100rA_1H_1}{A_1(1-r)(H_2 - H_5)},$$

$$Eff = \frac{100rH_1}{(1-r)(H_2 - H_5)},$$

In the first analysis, efficiency increases with increasing "r" because the upper term increases with "r" and the first factor in the lower term decreases with increasing "r": both trends act to increase the efficiency with increasing "r". However, the second factor in the lower term decreases with increasing "r", i.e. the pump is easier to drive with smaller "r"; and therefore $H_2$ (the height of the required power fluid column) decreases and $H_5$ (the allowable height of the power fluid release) increases. Other work supported the trend of increasing efficiency with increasing "r".

Nevertheless, certain formulae are reproduced below to clarify the general case.

From Power Stroke Considerations:

$$P_2 = \frac{P_1(1+a)}{(1-a)(1-r)} + \frac{R}{A_1(1-a)(1-r)},$$

Neglecting $R$.

$$P_2 = \frac{P_1(1+a)}{(1-a)(1-r)}$$

From Recovery Stroke Considerations:

$$P_5 = \frac{P_1(a-(1-r))}{(1+a)(r-1)} + \frac{R}{A_1(1+a)(r-1)},$$

Neglecting $R$.

$$P_5 = \frac{P_1(a-(1-r))}{(1+a)(r-1)}$$

For pressurehead style pumps $P_1$, $P_2$ and $P_5$ can be used in place of $H_1$, $H_2$ and $H_5$.

The efficiency equation can be rewritten as:

$$Eff = \frac{100rA_1P_1}{A_1(1-r)(P_2 - P_5)}, = \frac{100rP_1}{(1-r)P_2 - (1-r)P_5},$$

$$Eff = \frac{100rP_1}{\frac{(1-r)(P_1(1+a)}{(1-a)(1-r)} - \frac{(1-r)P_1(a-(1-r))}{(1+a)(r-1)}},$$

$-(1-r)$ can be rewritten as $+(r-1)$ $$Eff = \frac{100r}{\frac{(1-r)(1+a)}{(1-a)(1-r)} + \frac{(r-1)(a-(1-r))}{(1+a)(r-1)}},$$

$$Eff = \frac{100r}{\frac{(1+a)}{(1-a)} + \frac{(a-(1-r))}{(1+a)}},$$

Note: as "r" increases, the top term increases. The first term in the bottom is independent of "r": the second term on the bottom increases as "r" increases, reducing the efficiency with increasing "r"; however the bottom doesn't increase as quickly as the top so that over all the efficiency increases with increasing "r".

The equation is solved for four examples to demonstrate that the efficiency increases with increasing "r" for accelerations of 0.1 g and 0.01 g.

Example 1: for a=0.1; and r=0.8

$$Eff = \frac{100r}{\frac{(1+a)}{(1-a)} + \frac{(a-(1-r))}{(1+a)}}, = \frac{80}{\frac{1.1}{0.9} + \frac{(0.1-0.2)}{1.1}}, = \frac{80}{1.22 - \frac{0.1}{1.1}}, = \frac{80}{1.22 - 0.091},$$

$$Eff = 70.9\%$$

Example 2: for a=0.1; and r=0.5

$$Eff = \frac{100r}{\frac{(1+a)}{(1-a)} + \frac{(a-(1-r))}{(1+a)}} = \frac{50}{\frac{1.1}{0.9} + \frac{(0.1-0.5)}{1.1}} = \frac{50}{1.22 - \frac{0.4}{1.1}} = \frac{50}{1.22 - 0.364}$$

$$Eff = 58.4\%$$

Example 3: for a=0.01; and r=0.8

$$Eff = \frac{100r}{\frac{(1+a)}{(1-a)} + \frac{(a-(1-r))}{(1+a)}} = \frac{80}{\frac{1.01}{0.99} + \frac{(0.01-0.2)}{1.01}} = \frac{80}{1.22 - \frac{0.19}{1.01}} = \frac{80}{1.22 - 0.188}$$

$$Eff = 71.4\%$$

Example 4: for a=0.01; and r=0.5

$$Eff = \frac{100r}{\frac{(1+a)}{(1-a)} + \frac{(a-(1-r))}{(1+a)}}, = \frac{50}{\frac{1.01}{0.99} + \frac{(0.01-0.5)}{1.01}}, = \frac{50}{1.22 - \frac{0.49}{1.01}} = \frac{50}{1.22 - 0.485},$$

$$Eff = 68.0\%$$

TABLE 22a

| Output | | |
|---|---|---|
| Cycle time | 11.99 | sec |
| Cycles/min | 5.00 | |
| per cycle | 1.78 | lbs |
| per min | 8.92 | lbs |
| | 4.05 | liters |
| | 1.07 | Gal(US) |
| | 0.89 | Gal(Imp) |
| Work Rate | 297.39 | ft-lbs/sec |
| | 0.541 | hp |
| Eff | 96.71% | |

To calculate efficiency for the Power Cylinder Option, wherein the calculation includes the mass of the power column in the calculation of the acceleration, H is height of standard column, which is 2000 ft; P1 is 864 psi; A1 is the area of standing column, which is 5.45 square inches, A2/A1=0.505; A2 is 2.75225 square inches; A1−A2 is the area that the pressure differential operates on, which is 2.69775 square inches; R=k*H1*(A1)^0.5; k=0.0054; R=Sum of Seal Resistance which is 25.21 lbs; Stroke is 1.5 ft; 1 ft of water (f)=0.432 psi; Density of water 0.036 lbs/in3.

TABLE 22b

| Recovery Stroke ($P_c$ = −12 psig) Ratio of Hp/H1 | Power column height Hp | P5 psi | Net force lbs | Accel ft/sec2 | Recovery stroke sec | Ei1 Work in lbs |
|---|---|---|---|---|---|---|
| 1 | 2000 | 852 | 7 | 0.049 | 7.788 | 582.71 |
| 0.99 | 1980 | 843.36 | 30 | 0.212 | 3.766 | 582.71 |
| 0.975 | 1950 | 830.4 | 65 | 0.458 | 2.560 | 582.71 |
| 0.95 | 1900 | 808.8 | 124 | 0.876 | 1.850 | 582.71 |
| 0.925 | 1850 | 787.2 | 182 | 1.306 | 1.516 | 582.71 |
| 0.9 | 1800 | 765.6 | 240 | 1.747 | 1.311 | 582.71 |
| 0.85 | 1700 | 722.4 | 357 | 2.664 | 1.061 | 582.71 |
| 0.8 | 1600 | 679.2 | 473 | 3.633 | 0.909 | 582.71 |
| 0.75 | 1500 | 636 | 590 | 4.657 | 0.803 | 582.71 |
| 0.7 | 1400 | 592.8 | 706 | 5.741 | 0.723 | 582.71 |
| 0.5 | 1000 | 420 | 1173 | 10.799 | 0.527 | 582.71 |
| 0.998 | 1996 | 850.272 | 12 | 0.082 | 6.058 | 582.71 |

Power Stroke Water Energy Gained Per Stroke=Eo=12SA2dH1

Eo=42803 in lbs

Recovery Work=583 in lbs

Hp=0.998×H1=1996 ft: Ph=862.272 psi

TABLE 22c

| Ratio of P2/P1 required psi | Height of working column | P2 psi | Net force lbs | Accel ft/sec2 | Power stroke sec | Pc required psi | Ei2 Work in lbs | Eo/Ei |
|---|---|---|---|---|---|---|---|---|
| 1 | 1996 | 864.0 | −2403 | zero | — | 1.73 | 84 | — |
| 1.5 | 1996 | 1296.0 | −1238 | zero | — | 433.73 | 21062 | 197.76% |
| 2 | 1996 | 1728.0 | −72 | zero | — | 865.73 | 42039 | 100.42% |
| 2.1 | 1996 | 1814.4 | 161 | 0.74 | 2.019 | 952.13 | 46235 | 91.43% |

TABLE 22c-continued

| Ratio of P2/P1 required psi | Height of working column | P2 psi | Net force lbs | Accel ft/sec2 | Power stroke sec | Pc required psi | Ei2 Work in lbs | Eo/Ei |
|---|---|---|---|---|---|---|---|---|
| 2.25 | 1996 | 1944.0 | 510 | 2.34 | 1.133 | 1081.73 | 52528 | 80.59% |
| 2.5 | 1996 | 2160.0 | 1093 | 5.00 | 0.774 | 1297.73 | 63017 | 67.30% |
| 2.75 | 1996 | 2376.0 | 1676 | 7.67 | 0.625 | 1513.73 | 73506 | 57.77% |
| 3 | 1996 | 2592.0 | 2259 | 10.34 | 0.539 | 1729.73 | 83995 | 50.61% |
| 2.039 | 1996 | 1761.7 | 19 | 0.09 | 5.936 | 899.42 | 43676 | 96.71% |

As illustrated above in Tables 22, the A2/A1 ratio is 0.505, the recovery stroke show −12 psi as Pc, which shows a 12 psi vacuum is created under the transfer piston as the upper cylinder is drawn back. Further, only 582.71 lbs. of energy is needed to draw the transfer piston down in the cylinder because the area on the upper side of the transfer piston with the force on it from the weight of the discharge column easily overcomes the energy resisting the transfer piston from the lower area of the transfer piston in the transfer chamber.

Examining the power stroke, at 96.71% efficiency at an acceleration of 0.09 ft/sec$^2$ 43,676 lbs. of force is needed to make the transfer piston move back up. The acceleration is 0.09/32=0.0028 g (gravity) as opposed to the 1.0 g used in some of the equations reproduced above and that described how the particular pump was to operate. Pipelines are designed at a nominal 2 ft/sec velocity with a maximum design velocity of 5 ft/sec, which are standard numbers. Such numbers may be changed, but are those often used. At 1 g (32 ft/sec$^2$) the acceleration creates a velocity, which is too fast too quickly for optimal use.

Tables 22 above shows the efficiency of one 3.5" pump at just over 35 Barrels per day. The data indicate that the 3.5" pump functions just as well if it were 3.5°. The above 3.5" pump has useful application in stripper oil wells in the United States. Of the more than 400,000 stripper oil wells in the United States, many average approximately 2.2 Barrels per day of oil and simultaneously produce 9 Barrels of water. Thus, the average production of a stripper oil well is approximately 20 Barrels per day. Smaller stripper oil wells use 10 HP or larger pump jacks. As illustrated in the data of Table 22, a pump of the present disclosure can perform the same work as one of the commonly used stripper oil well pumps for less than 1 HP.

TABLE 23

| Efficiency vs A2/A1 | | | | | | |
|---|---|---|---|---|---|---|
| A2/A1 = P2/P1 | 0.4 | 0.5 | 0.6 | 0.7 | 0.8 | 0.82 |
| 1.5 | 0.0% | 0.0% | 0.0% | 0.0% | 0.0% | 0.0% |
| 1.8 | 0.0% | 0.0% | 0.0% | 0.0% | 0.0% | 0.0% |
| 2.0 | 41.4% | 0.0% | 0.0% | 0.0% | 0.0% | 0.0% |
| 2.5 | 31.6% | 45.7% | 0.0% | 0.0% | 0.0% | 0.0% |
| 3.0 | 25.5% | 37.2% | 53.3% | 0.0% | 0.0% | 0.0% |
| 4.0 | 18.5% | 27.1% | 39.3% | 59.1% | 0.0% | 0.0% |
| 5.0 | 14.5% | 21.3% | 31.2% | 47.1% | 0.0% | 0.0% |
| 7.5 | 9.4% | 13.9% | 20.5% | 31.3% | 53.7% | 61.1% |
| 10.0 | 6.9% | 10.3% | 15.3% | 23.5% | 40.2% | 45.8% |
| optimum | 26.6% | 31.5% | 36.0% | 40.7% | 46.3% | 47.5% |
| P5/P1, req | 0.39 | 0.31 | 0.185 | 0.05 | 0.05 | 0.05 |
| Rec Acc ft/sec2 | 8.04 | 8.01 | 8.04 | 7.21 | 4.21 | 3.61 |
| P2/P1 opt | 2.9 | 3.48 | 4.35 | 5.79 | 8.69 | 9.65 |

The data from Table 23 above are reproduced in the graph of FIG. 13. As illustrated, the efficiency of the pump is graphed as a function of the ratio of A2/A1 for several different values of P2/P1. Lines have been added connecting the points on the graph of each value of P2/P1 as the ratio of A2/A1 changed. Generally, for each P2/P1 the efficiency increased as the ratio of A2/A1 increased up until a point when efficiency fell to zero and remained there for further increases in the ratio of A2/A1.

More accurately, the piston pump illustrated in Table 23 and FIG. 13 is more efficient as the ratio of A2/A1 increases. There are two opposing trends in operation: (1) as the transfer area A2 increase for a fixed overall area A1, more fluid is lifted per stroke and less working fluid is used per stroke; and (2) the opposing trend is that the driving pressure must increase as the transfer area increases for a fixed over-all area. As illustrated in the equations above, the increase in lifted fluid and the reduction in power fluid are more important that the increase in the driving pressure. The fluid lifted per stroke is the transfer area times the stroke length (A2S). The power fluid used per stroke is the power fluid area times the stroke length. The power fluid area is the annular area equal to the over-all area minus the transfer area (A1−A2), as A2 increases for a fixed A1, the power fluid area decreases.

Figure 14:
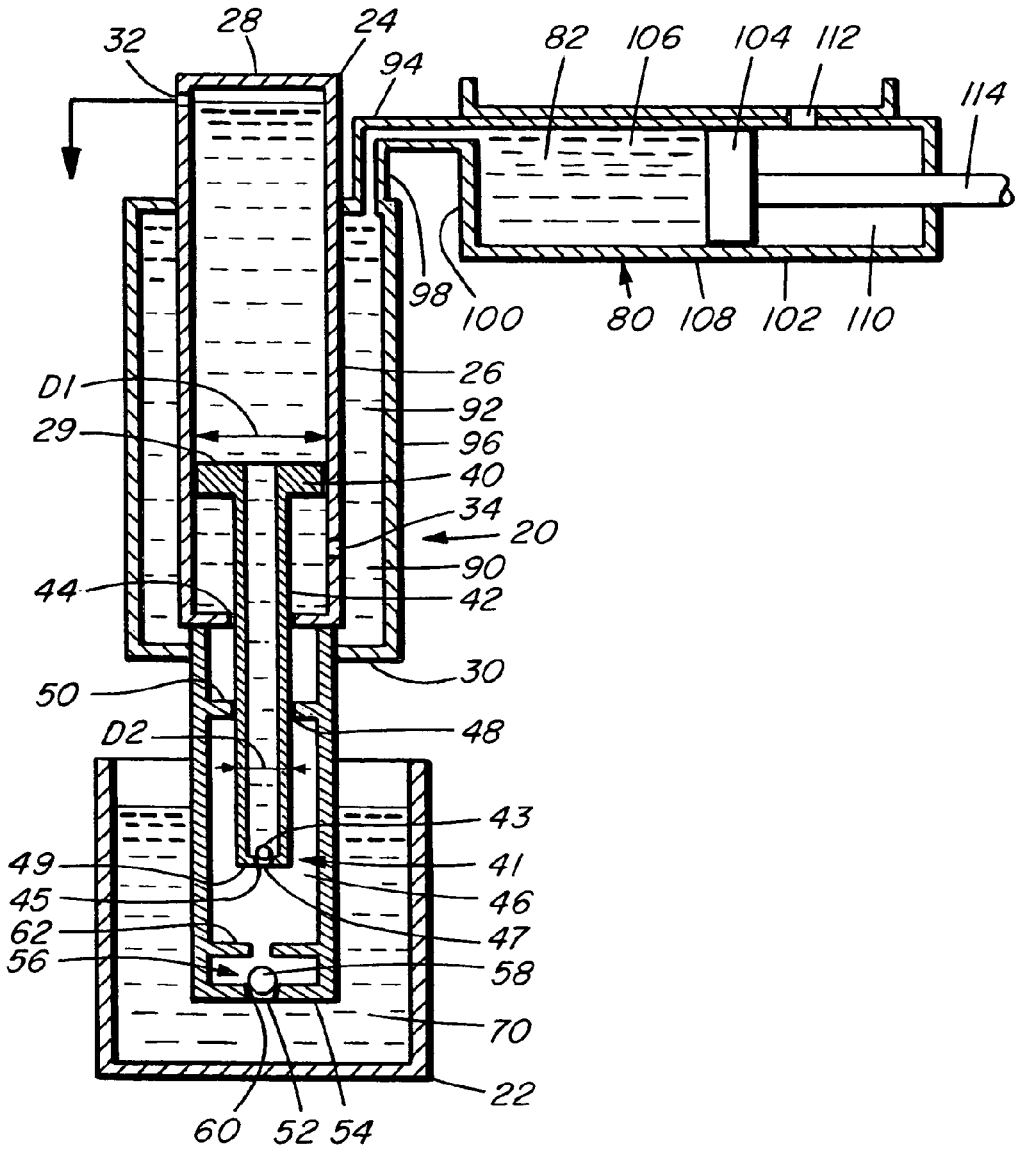
FIG. 14 is a simplified elevational view, partly in section, of a pumping apparatus according to an embodiment of the invention.

Referring to the drawings, and first to FIG. 14, this shows a piston type pumping apparatus 20 according to an embodiment of the invention. The apparatus is intended to pump liquids, typically water, up relatively great vertical distances, such as from the bottom 30 of a mine to the surface as exemplified by the distance between points 22 and 24. The system includes a vertically oriented first transfer cylinder 26 having a top 28, adjacent point 24, and a bottom 30. There is a first passageway 32 for liquid adjacent the top where liquid is discharged from the cylinder. There is a second passageway 34 near the bottom of the cylinder which allows liquid to enter or exit the cylinder.

A transfer piston 40 is reciprocatingly mounted within the cylinder and is connected to a vertically oriented, hollow piston rod 42 which extends slidably and sealingly through aperture 44 in the bottom of the cylinder. The piston 40 has an area 29 at the top thereof against which pressurized fluid in the cylinder acts. The passageway 32 is above or adjacent to the uppermost position of the piston and the passageway 34 is below its lowermost position. It should be understood that FIG. 14 is a simplified drawing of the invention and seals and other conventional elements which would be apparent to someone skilled in the art are omitted. These components would be similar to those disclosed in U.S. Pat. No. 6,913,476, which is incorporated herein by reference in its entirety.

There is a first one-way valve 41 at the bottom of the piston rod 42 which includes a valve member 43 and a valve seat 45 which extends about a third passageway 47 in bottom 49 of the piston rod. This one-way valve allows liquid to flow into the piston rod, but prevents a reverse flow out the bottom of the piston rod.

There is a reload chamber 46 below the cylinder 26 which is sealed, apart from aperture 48 at top 50 thereof, which slidably and sealingly receives piston rod 42, and fourth passageway 52 at bottom 54 thereof. The piston rod acts as a piston within the reload chamber. There could be a piston member on the end of the rod within the reload chamber and the term "piston rod" includes this possibility. A second one-way valve 56 is located at the passageway 52 and includes a valve member in the form of ball 58 and a valve seat 60 adjacent to the bottom of the reload chamber. An annular stop 62 limits upward movement of the ball. This one-way valve allows liquid to flow from a source chamber 70 into the reload chamber 46, but prevents liquid from flowing from the reload chamber towards the chamber 70. Chamber 70 contains liquid to be pumped out of passageway 32 at top of the cylinder.

The piston 40 has a diameter D1 substantially greater than diameter D2 of the piston rod and, accordingly, the piston rod, acting as a piston in the reload chamber, has a significantly smaller area upon which pressurized liquid acts, in the direction of movement of the piston rod and piston 40, within the reload chamber 46 compared to the cross-sectional area of the piston 40 and the interior of cylinder 26. For example, in one embodiment the piston is 3" in diameter, while the piston rod 42 is 1" in diameter. Therefore liquid in the cylinder at a given pressure exerts a much greater force on the piston and piston rod compared to the force exerted upwardly on the piston rod and piston by a similar pressure of liquid in reload chamber 70.

There is means 80 for storing pressurized liquid 82 connected to the second passageway 34. This means 80 stores pressurized liquid recovered from chamber 90 in the cylinder 26 below the piston 40. In this embodiment the means includes a column of liquid 92 extending from passageway 34 to a point 94 at the top of the column. The column in this example is formed by an annular jacket 96 extending about the cylinder 26 and a conduit 98 extending to discharge end 100 of a second, power cylinder 102. The column can be pressurized by a remotely located power cylinder or by using a body of liquid (water), located at a higher elevation, as a pressure head.

The cylinder 102 has a piston 104 reciprocatingly mounted therein. The liquid 82 occupies chamber 106 on side 108 of the piston which faces discharge end 100 of the cylinder. Chamber 110 on the opposite side of the piston is vented to atmosphere through passageway 112. There is a piston rod 114 connected to the piston 104 to drive the piston towards the discharge end and thereby discharge liquid 82 from the cylinder.

In operation, the cylinder 26 is filled with liquid, typically water, above the piston 40. Likewise chamber 90 is filled with water along with the jacket 96 and chamber 106 of the second cylinder 102. Similarly piston rod 42 is filled with water or other liquid along with the reload chamber 46 and the source chamber 70. The piston is in the lowermost position as shown in FIG. 14. This is used to prime the pump.

The piston rod 114 is then moved to the left, from the point of view of FIG. 14, typically by a motor or engine with a crank mechanism or a pneumatic or hydraulic device, although this could be done in other ways. This displaces liquid 82 from the cylinder 102 downwardly through the column 92, through the second passageway 34 into the chamber 90 where it acts upwardly against the bottom of piston 40 and pushes the piston upwards in the cylinder 26.

The piston rod 42 is pushed upwardly with the piston and thereby reduces pressure in reload chamber 46, since the volume occupied by the piston rod in the reload chamber is reduced as the piston rod moves upwardly. One-way valve 41 prevents liquid from flowing from the piston rod into the reload chamber, but the reduced pressure within the reload chamber causes ball 58 to raise off of its seat 60, such that liquid flows from chamber 70 into the reload chamber.

When piston 104 of the cylinder 102 approaches the end of its travel adjacent discharge end 100, and piston 40 approaches its uppermost position towards top 28 of the cylinder 26, liquid is discharged from the passageway 32. When the piston 104 has reached its limit adjacent discharge end 100, pressure against piston rod 114 is released. The weight of liquid occupying cylinder 26 above the piston 40 acts downwardly on the piston and forces the piston towards its lowermost position shown in FIG. 14. This forces liquid out of chamber 90 and into the chamber 106 of cylinder 102, moving the piston 104 to the right, from the point of view of FIG. 14, so it returns to the original position shown.

At the same time, the piston rod 42 is forced downwardly into the reload chamber 46. This increases pressure in the reload chamber and keeps the ball 58 against valve seat 60 to prevent liquid from flowing back into the source chamber 70 through the passageway 52. The liquid in the reload chamber is thus forced upwardly into the piston rod 42 by raising valve member 43 off of valve seat 45. In this way, a portion of the liquid in reload chamber 46, which had flowed into the reload chamber from the source chamber as the piston was previously raised, moves from the reload chamber into the piston rod and refills the cylinder 26 above the piston 40 as the piston moves downwardly towards its lowermost position shown in FIG. 14.

The piston 104 in the cylinder 102 is then pushed again to the left, from the point of view of FIG. 14, and again raises the piston 40. A volume of liquid equal to the volume of liquid which moved into the piston rod 42 from the reload chamber 46, as the piston 40 previously moved downwards, is then discharged from passageway 32 as the piston 40 approaches its uppermost position and piston 102 approaches its position closest to the discharge end 100 of cylinder 102.

The cycles are then continued and, as may be readily understood, each time the piston 40 moves down and back up, it pumps a volume of liquid from the reload chamber 46, and ultimately from source chamber 70, equal to the difference in volume occupied by the piston rod 44 within the reload chamber 46, when the piston 40 is in the lowermost position as shown in FIG. 14, less the volume it occupies within the reload chamber (if any) when the piston 40 has reached its uppermost position. The travel of the piston 40 is adjusted so the piston rod remains within the aperture 48 at the uppermost limit of travel of the piston 40 and piston rod.

The pump apparatus described above can pump liquid from point 22 to point 32 as described above. The apparatus can pump liquid against a significant hydraulic head, such as experienced in pumping water from the bottom of a mine, without requiring a pump with a high hydraulic head output. This is because liquid in column 92 acts upwardly against the bottom of the piston 40 and assists the movement of the piston 104 towards the left, from the point of view of FIG. 14. When the piston 40 is moved downwardly by the weight of liquid in cylinder 26 above the piston, it moves the liquid in chamber 90 upwardly, increasing its hydraulic head and building up its potential energy. Thus a large portion of the energy lost as the piston 40 moved downwardly is recovered in potential energy represented by the liquid in column 92 extending to cylinder 102.

Thus it may be seen that the cylinder 102 should be placed as high as possible for the maximum recovery of the energy. It should be understood that the position of cylinder 102 could be different than shown in FIG. 14. It could be, for example, oriented vertically. The terms "left" and "right" used above in relation to the cylinder, piston and piston rod assist in understanding the invention and are not intended to cover all possible orientations of the invention. In some embodiments, the components may be oriented vertically, horizontally, or any angled position therebetween. For example, the components may be angled about 5, 10, 15, 20, 25, 30, 35, 40, 45, 50, 55, 60, 65, 70, 75, 80, 85 degrees or any number therebetween.

Figure 15:
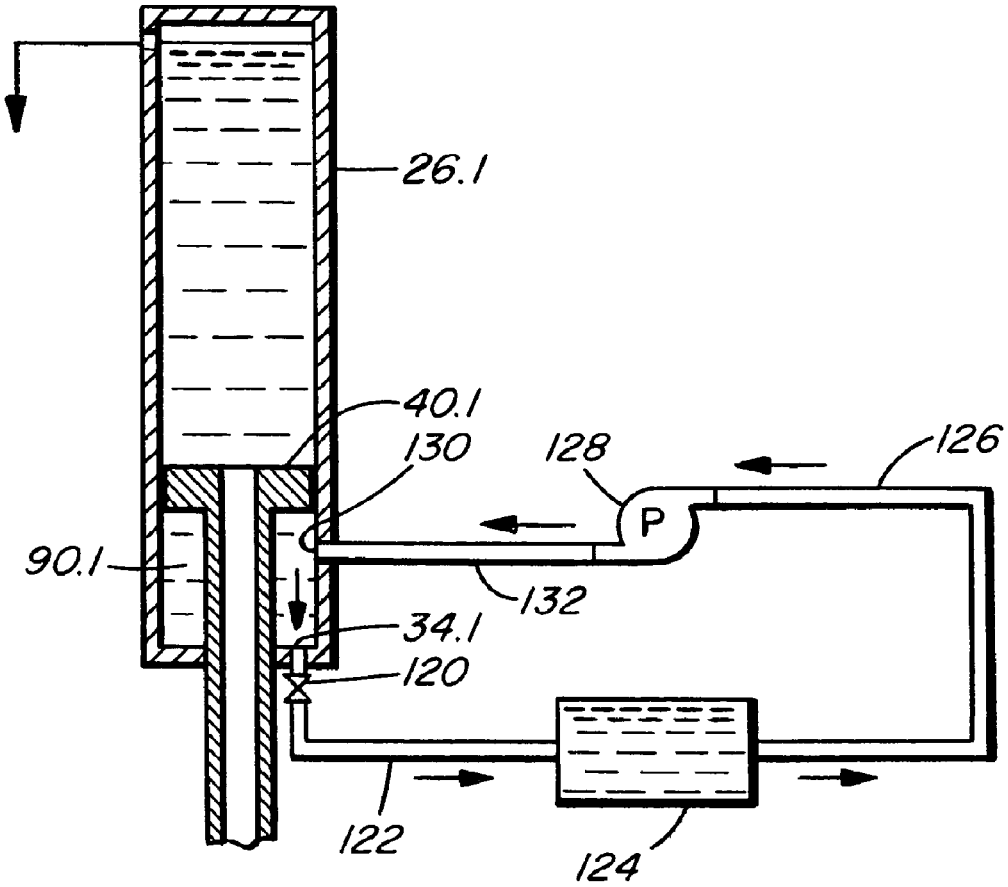
FIG. 15 is a simplified elevational view, partly in section, of the upper fragment of an alternative embodiment employing a centrifugal pump.

FIG. 15 shows a pumping apparatus 20.1 generally similar to the apparatus shown in FIG. 14 with like parts having like numbers with the addition of "0.1". It is herein described only regarding the differences between the two embodiments. Only the upper portion of the apparatus is shown, the reload chamber and source chamber being omitted because they are identical to the first embodiment. In this example passageway 34.1 is fitted with a one-way valve 120 which permits liquid to flow from chamber 90.1 into conduit 122, but prevents liquid from flowing in the opposite direction. The conduit 122 is connected to a receiver 124 which may be similar in structure to a hydraulic accumulator, for example, and can store pressurized hydraulic fluid. When the piston 40.1 is moved downwardly by the liquid in cylinder 26.1, it is forced into the receiver 124.

A hydraulic conduit 126 connects the receiver to a centrifugal pump 128, which is connected to passageway 130 in the cylinder 26.1 below the piston 40.1 via a conduit 132. After the piston reaches its bottommost position, as shown in FIG. 15, pump 128 starts to pump liquid from the receiver 124 into the chamber 90.1 to lift the piston 40.1. The fact that the liquid in the receiver 124 was pressurized during the previous downward movement of piston 40.1 reduces the work required from pump 128 to assist in raising the piston. This apparatus operates in a manner analogous to the embodiment of FIG. 14, but uses the receiver to store pressurized hydraulic fluid instead of utilizing a physical, vertical hydraulic head as in the previous embodiment. Furthermore a centrifugal pump 128 is employed instead of the piston pump comprising cylinder 102 and piston 104 of the previous embodiment. Otherwise this apparatus operates in a similar manner.

Analysis of Pressures and Force Balance

Referring to FIGS. 14-19:

$A_1$ is the area of the top 29 of the transfer piston 40 which is the area of the transfer cylinder 26

$A_2$ is the area of the bottom of the piston rod 42

$A_1-A_2$ is the area of the transfer piston in contact with the power fluid

S is the stroke length $P_1$ is the pressure of the standing column $P_2$ is the pressure of the working fluid during the power stroke $P_3$ is the available head of the fluid to be pumped $P_4$ is the pressure in the transfer chamber $P_5$ is the pressure of the power fluid during the recovery stroke $P_c$ is the pressure created in the power cylinder 102 located at the same level as the standing column discharge 32

W is the weight of the piston

R is the resistance created by the seals d is the density of water (0.036 lbs/in$^3$)

$A_c$ is the area of the Power Cylinder $S_c$ is the stroke of the Power Cylinder H is the height of the standing column of water d is the density of water During the recovery stroke the transfer piston moves down, with valve member 43 open and valve 56 closed.

Downward Forces $F_d=P_1A_1+W$

Upward Forces $F_u=P_2(A_1-A_2)+R_4A_2+R$

Net force $F=F_d-F_u=P_1A_1+W-P_2(A_1-A_2)-P_4A_2-R$

If we assume:

$P_1$=45 psig, approximately 100 feet of water, and $A_1$=8 in$^2$, $P_1A_1$=45×8=360 lbs a piston weight of 2 lbs (approximately 8 in$^3$ of steel)

a seal resistance 20 lbs $P_4=P_1$ and therefore $P_4A_2=P_1A_2$ $$F=P_1A_1-P_1A_2-P_5(A_1-A_2)-R$$

$$F=P_1(A_1-A_2)-P_5(A_1-A_2)-R=(P_1-P.su-b.5)(A_1-A_2)-R$$

For this to be a net downward force, $P_5$ must be less than $P_1$. The area that $P_1$ operates on is $(A_1-A_2)$.

During the power stroke the transfer piston moves up and valve member 43 closed.

Downward forces $F_d=P_1A_1+W+R$

Upward forces $F_u=P_2(A_1-A_2)+P_4A_2$

Net force$=F=F_u-F_d=P_2(A_1-A_2)+P_4A_2-P_1A_1-W-R$ $P_4=P_3$. If we assume $P_3<<P$ or $P_2$, we can ignore $P_4A_2$. As for the recovery stroke we can ignore W.

$$F=P_2(A_1-A_2)-P_1A_1-R$$

Efficiency

Work in During the Recovery Stroke $P_5=P_1-P_c$ where $P_c$ is the pressure created in the power cylinder located at the same level as the standing column discharge.

Work Done at the Power Cylinder $$W_i=P_cA_cS_c,$$

$A_cS_c$ is the volume of power fluid moved per stroke$=(A_1-A_2)S$ $W_i=P_c(A_1-A_2)S$, For an example, $P_c$=14 psig, $A_1$=8 in$^2$ $_1A_2$=4 in$^2$, and S=12 in $W_1$=14(8−4)12=672 in lbs (56 ft lbs) plus R×S 20×12=240 in lbs. $A_2/A_1$=0.5

Work in During the Power Stroke $P_2=P_1+P_c$. To create an acceleration of "a" times g (32.2 ft/sec$^2$) in the standing column, the net force must be "a" times the weight of the standing column.

$$F=P_2(A_1-A_2)-P_1A_1-R=aHA_1d=aP_1A_1$$

$$(P_1+P_c)(A_1-A_2)-P_1A_1-R=aP_1A_1$$

$P_1A_1-P_1A_2+P_cA_1-P_1A_2-P.su-b.1A_1-R=aP_1A_1$. The bold terms cancel.

$$P_c(A_1-A_2)=aP_1A_1+P_1A_2+R$$

$$P_c=\frac{P_1(aA_1+A_2)}{(A_1-A_2)}+\frac{R}{(A_1-A_2)}$$

For a head of 100 feet, $P_1$=43.3 psig, and a=1 g, R=20 lbs.

$$P_c=\frac{43.3(1\times 8+4)}{4}+\frac{20}{4}$$

$$=130+5$$

$$=135\ psig$$

Work in at the Power Cylinder $$W_i=P_c(A_1-A_2)S=135\times 4\times 12=6480 \text{ in lbs}$$

Work Output

The water lifted is $SA_2d=12\times4\times0.036=1.73$ lbs and it is raised 1200 inches.

$$W_0=1/73\times1200=2070 \text{ in lbs}=173 \text{ ft lbs}$$

Efficiency based on $A_2/A_1$ ratio of 0.5

$$E=W_0/W_1=2070/(6480+672+240)=28.0\%$$

By examining the above formula for $P_c$ one can see how changing the acceleration and the ratio of $A_2/A_1$ affects the pressure necessary to drive the pump. For example:

$A_2/A_1=0.8$ or in the example $A_2$ would now=6.4 sq. in. and a=0.25 g $$P_c = \frac{P_1(aA_1 + A_2)}{(A_1 - A_2)} + \frac{R}{(A_1 - A_2)}$$

$$P_c = \frac{43.3(.25\times8+6.4)}{1.6} + \frac{20}{1.6}$$

$$= 227 + 12.5$$

$$= 239.5 \ psig$$

or using a lower $A_2/A_1$ ratio—say 0.25, now $A_2=2$ and leaving acceleration at 0.25 g $$P_c = \frac{P_1(aA_1 + A_2)}{(A_1 - A_2)} + \frac{R}{(A_1 - A_2)}$$

$$P_c = \frac{43.3(.25\times8+2)}{6.6} + 20$$

$$= 28 + 3.33$$

$$= 31.33 \ psig$$

We are now moving a volume of water up 100 feet in our example by adding 31.33 psi (72.37 ft.) of head to the power column.

Dynamic Analysis of the Original Concept

Recovery Stroke

Continuing with the same example the net force on the Standing Column 26 is: $F=P_c(A_1-A_2)-R=14(8-4)-20=36$ lbs The mass of the Standing Column is $$1200\times8\times0.036=346 \text{ lbs.}$$

The acceleration is $$36/346=0.10 \text{ g}=3.22 \text{ ft/sec}^2$$

The time required to complete the stroke $$D = \frac{at^2}{2}: \ D = S \text{ in feet} = 1 \text{ foot;}$$

$$t = (2S/a)^{0.5} = (2/3.22)^{0.5} = 0.79 \text{ seconds}$$

Power Stroke

The acceleration was defined as 1 g or 32.2 ft/sec$^2$.

$$t=(2/32.2)^{0.5}=0.25 \text{ seconds.}$$

The complete stroke will take 0.79+0.25=1.03 seconds

The above analysis of pressures and force can be manipulated using different ratios of $A_2/A_1$, $P_2/P_1$ and acceleration "a".

Figure 16:
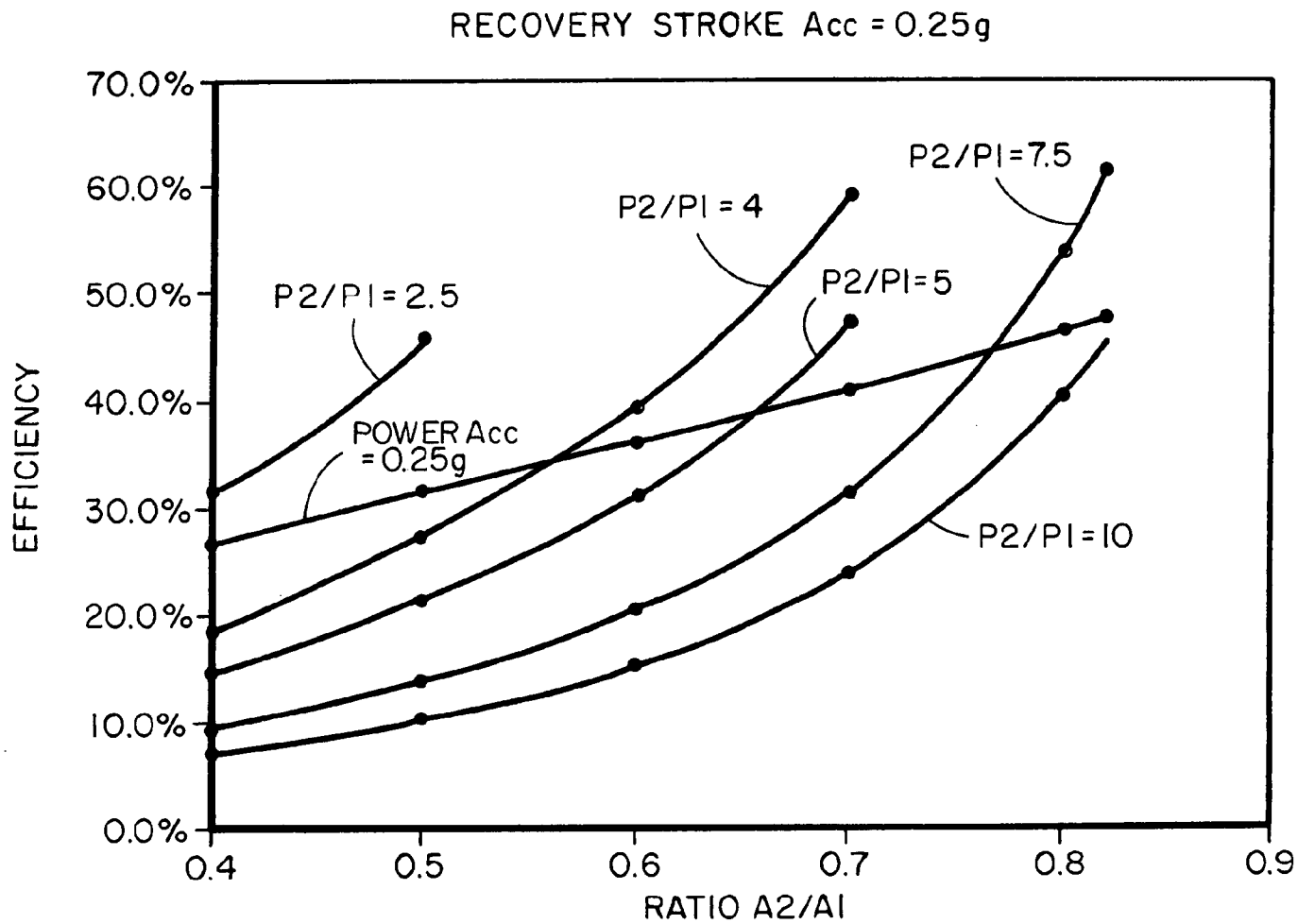
FIG. 16 is a graph of the efficiency of the pressure head concept of the pump.

Attached as FIG. 16 is a performance curve for the pressure head concept showing the efficiency against the ratio $A_2/A_1$.

Also included as Table 24 are the calculations from which FIG. 16 is drawn showing the absolute numeric variations as parameters are changed.

TABLE 24

Efficiency vs. A2/A1

| | A2/A1 = | | | | | |
|---|---|---|---|---|---|---|
| P2/P1 | 0.4 | 0.5 | 0.6 | 0.7 | 0.8 | 0.82 |
| 1.5 | 0.0% | 0.0% | 0.0% | 0.0% | 0.0% | 0.0% |
| 1.8 | 0.0% | 0.0% | 0.0% | 0.0% | 0.0% | 0.0% |
| 2.0 | 41.4% | 0.0% | 0.0% | 0.0% | 0.0% | 0.0% |
| 2.5 | 31.6% | 45.7% | 0.0% | 0.0% | 0.0% | 0.0% |
| 3.0 | 25.5% | 37.2% | 53.3% | 0.0% | 0.0% | 0.0% |
| 4.0 | 18.5% | 27.1% | 39.3% | 59.1% | 0.0% | 0.0% |
| 5.0 | 14.5% | 21.3% | 31.2% | 47.1% | 0.0% | 0.0% |
| 7.5 | 9.4% | 13.9% | 20.5% | 31.3% | 53.7% | 61.1% |
| 10 | 6.9% | 10.3% | 15.3% | 23.5% | 40.2% | 45.8% |
| Optimum | 26.6% | 315.% | 36.0% | 40.7% | 46.3% | 47.5% |
| P5/P1, req | 0.39 | 0.31 | 0.185 | 0.05 | 0.05 | 0.05 |
| Rec Acc ft/sec$^2$ | 8.04 | 8.01 | 8.04 | 7.21 | 4.21 | 3.61 |
| P2/P1 opt | 2.9 | 3.48 | 4.35 | 5.79 | 8.69 | 9.65 |

For the pressure head concept, the curves demonstrate that a pump could approach an efficiency of up to 61% if used in applications where a high pressure head is available and the power water can be discharged at a low level, both compared to the height of the standing column. Efficient pump designs have a high $A_2/A_1$ ratio indicating the volume of water discharged from the standing column is greater than the volume of water used on the power side of the transfer piston. This feature indicates that the pump may be attractive in lifting water from a well or de-watering a mine if there is a convenient source of suitable power water; i.e. compatible with the water to be lifted and having a high head. As previously discussed, a pressure head pump could be attractive in some run-of-the-river hydro applications if a suitable source of power water is convenient.

For the power cylinder concept, the curves indicate that the higher the $A_2/A_1$ ratio the more efficient the pump, and the lower the accelerations the more efficient the pump.

Efficient pressure head concept pumps move a greater volume of process water per stroke than the volume of power water required. This again results directly from the high ratios of $A_2/A_1$. This means that the power water could be released to join the process water and still allow effective pumping to occur. Conversely, pumps with low ratios of $A_2/A_1$ but with a large amount of power water and a lower head can move smaller amounts of process water up greater heights. They will expend more power water than the process water they move. This process is similar to the classic hydraulic ram principle where a large amount of fluid at a low pressure head is used to transfer a small amount of fluid up a higher elevation.

A different embodiment of the pump utilizes a bladder similar to a pressure tank in a water system or a packer similar to a drill hole packer that houses the water in the power cylinder pressurized by air or hydraulic pressure and then the pressure lowered and again re-pressurized. This allows the use of the pump without expending the power fluid.

Analysis

Figure 17:
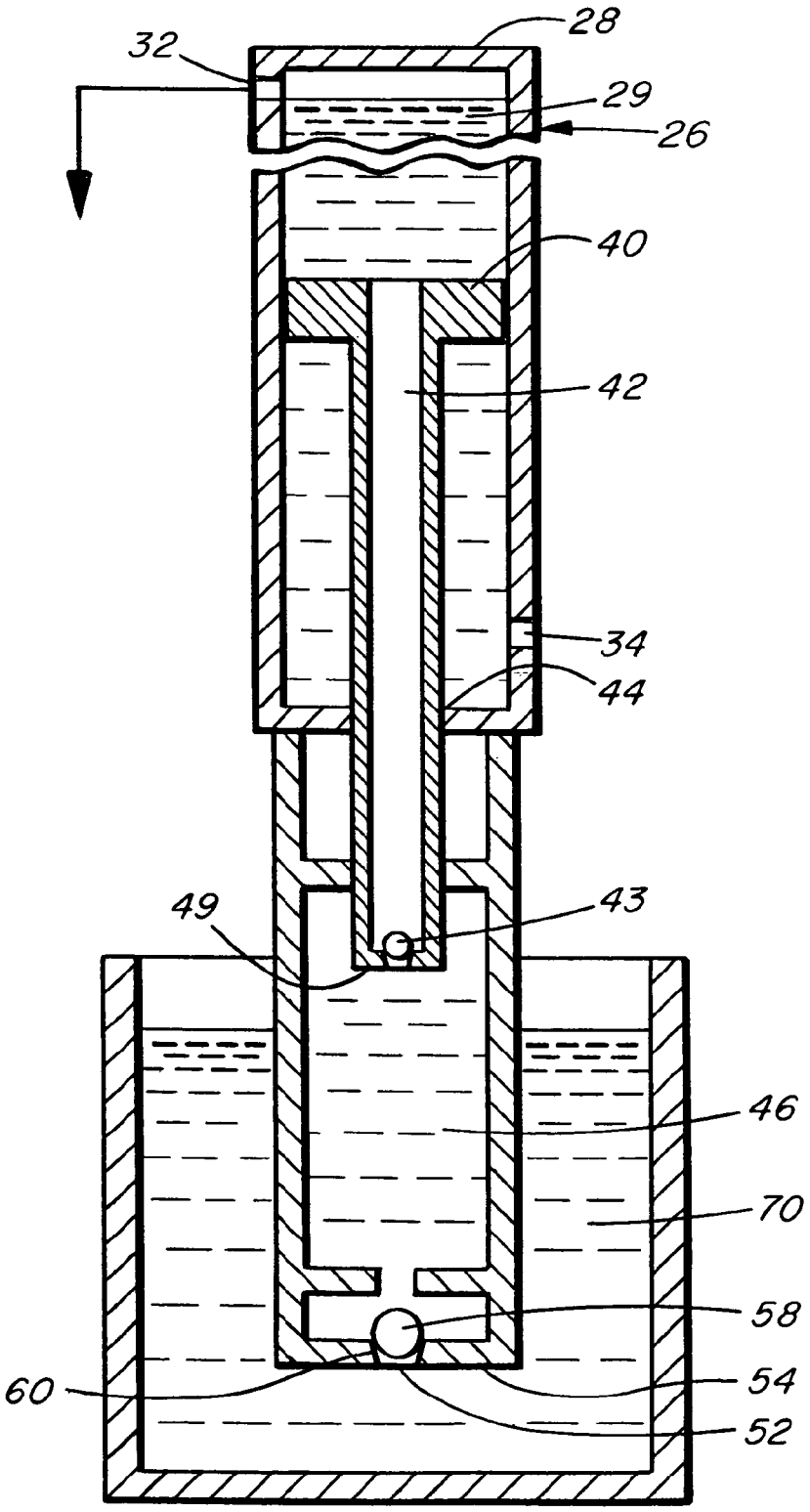
FIG. 17 is a sectional view of the embodiment of FIG. 14 showing the Force Balance in the pump.
Figure 18A:
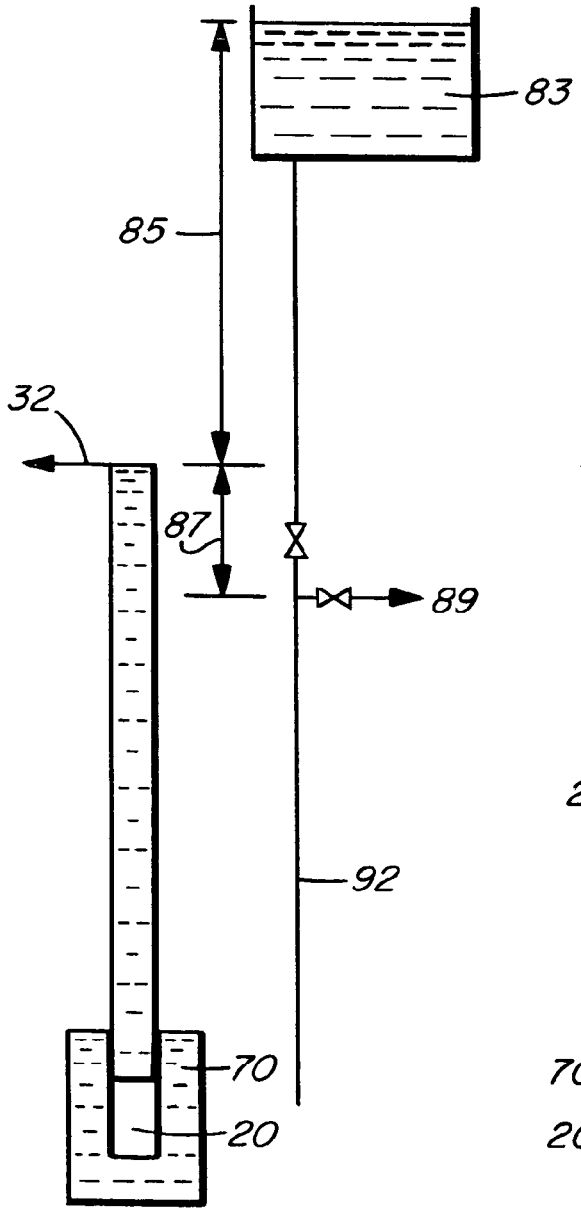
FIGS. 18A and 18B are simplified sectional views showing Pressure Head Concept of a pump and the Power Cylinder Concept of the pump.
Figure 18B:
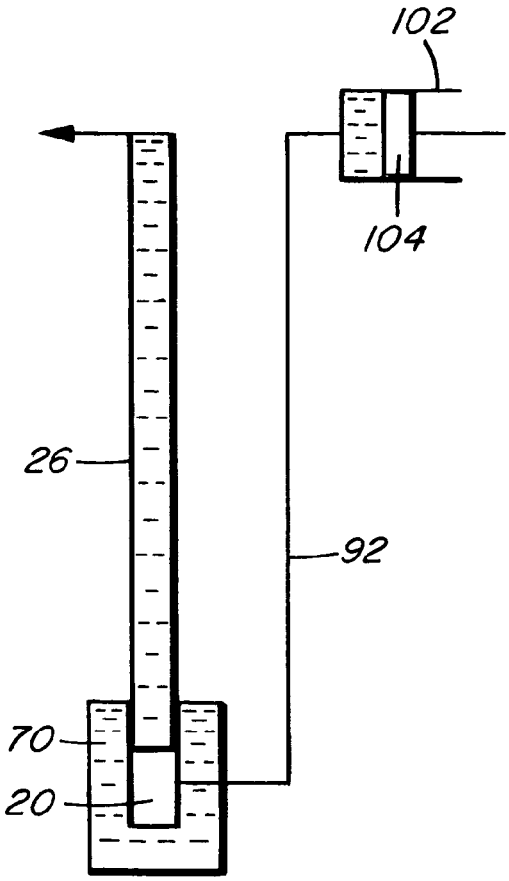

FIG. 17 shows the two main embodiments of the pump. FIG. 18A describes the pressure head concept showing how the liquid, generally water, stored at a higher elevation 83 supplies excess pressure for the power stroke 85 and reduced pressure 87 when point 89 is used for the power fluid release. FIG. 18B shows the power cylinder concept where the excess pressure is generated by the power cylinder 102 and the recovery stroke is augmented by the creation of a vacuum when piston 104 is withdrawn from the column of power fluid.

Performance Curves

Pressure Head Concept

Referring to Table 24, the valves were manipulated to calculate the efficiency of various pressure head arrangements. The manipulation required:

setting various ratios of $A_2/A_1$ from 0.4 to 0.82 then, for each of the ratios, calculating the recovery stroke performance for various ratios of $P_5/P_1$ (the height of the power water release compared to the standing column height), "optimising" $P_5/P_1$ to obtain a recovery stroke acceleration of 8 ft/sec$^2$, if possible, using the "optimised" results from the recovery stroke calculations as input for the power stroke calculations, calculating the power stroke performance for various ratios of $P_2/P_1$ (the height of the power water source compared to the standing column height), "optimising" $P_2/P_1$ was to obtain a power stroke acceleration of 8 ft/sec$^2$, transferring the calculated efficiencies to another spreadsheet along with the "optimised" $P_5/P_1$ and $P_2/P_1$ ratios and the recovery stroke acceleration, using the calculated efficiencies to plot a graph of efficiency vs. $A_2/A_1$ for the most significant ratios of $P_2/P_1$.

The results indicated that high ratios of $A_2/A_1$ result in higher efficiency and low acceleration. The results also indicate that a low ratio of $P_5/P_1$ is required to create reasonable recovery stroke acceleration.

Referring to Table 24, performance data for the ratio $A_2/A_1$=0.82 is shown which indicates that an efficiency of 61% could be achieved if a power stroke acceleration of 8 ft.sec 2 (0.25 g) is considered acceptable. The recovery stroke acceleration will be around 4 ft/sec2 with this design.

What is not immediately apparent is that when the $A_2/A_1$ ratio is high, the power water released per stroke is much less than the process water lifted per stroke. The process water lifted per stroke is $A_2$ S and the power water released per stroke is $(A_2-A_1)S$.

When $A_2/A_1$=0.8:

$$(A_2-A_1)=A_1-0.8A_1=0.2A_1$$

and the amount of power water released per stroke is $$(A_2-A_1)S=0.2\,A_1S$$

and $A_2$=0.8$A_1$:

therefore the amount of process water lifted is $$A_2S=0.8\,A_1S$$

or four times the amount of power water released.

This means that the power water could be released into the process water and the pump will still pump a net of (0.8−0.2) $A_1S$=0.6$A_1S$ per stroke.

Power Cylinder Concept

Values were manipulated to calculate the efficiency for various power cylinder arrangements. The manipulation required is:

setting various ratios of $A_2/A_1$; from 0.4 to 0.82, then, for each of the ratios, setting the pressure in the power cylinder ($P_c$) during the recovery stroke, calculating the recovery stroke performance for various ratios of $H_p/H_1$ (the height of the pump compared to the height of the standing column), "optimising" $H_p/H_1$ to obtain a recovery stroke acceleration of 8 ft/sec$^2$, if possible, using the "optimised" results from the recovery stroke calculations as input for the power stroke calculations, calculating the power stroke performance for various ratios of $P_2/P_1$, "optimising" $P_2/P_1$ to obtain a power stroke acceleration of 8 ft/sec$^2$, transferring the calculated efficiencies to another spreadsheet along with the "optimised" $H_p/H_1$ and $P_2/P_1$ ratios and the recovery stroke acceleration, using the calculated efficiencies to plot a graph of efficiency vs. $A_2/A_1$ for the most significant ratios of $P_2/P_1$.

The results indicate that high ratios of $A_2/A_1$ result in higher efficiency and lower ratios allow moving fluid to higher heads but using more process water or a larger power column if contained in a bladder or packer.

Applications

For the concept pump to be reasonably efficient, the ratio $A_2/A_1$ must be high. For this sort of pump to have a reasonable recovery stroke acceleration the power water in a pressure head style pump must be released low relative to the height of the standing column. For this sort of pump to have a reasonable power stroke acceleration the power column must be tall relative to the standing column. These features indicate that the pump would be attractive in applications where there is a source of power water at an elevation much higher than the standing column height. It must also be possible to release the power water at a low elevation relative to the height of the power column in a pressure head style pump.

Figure 19A:
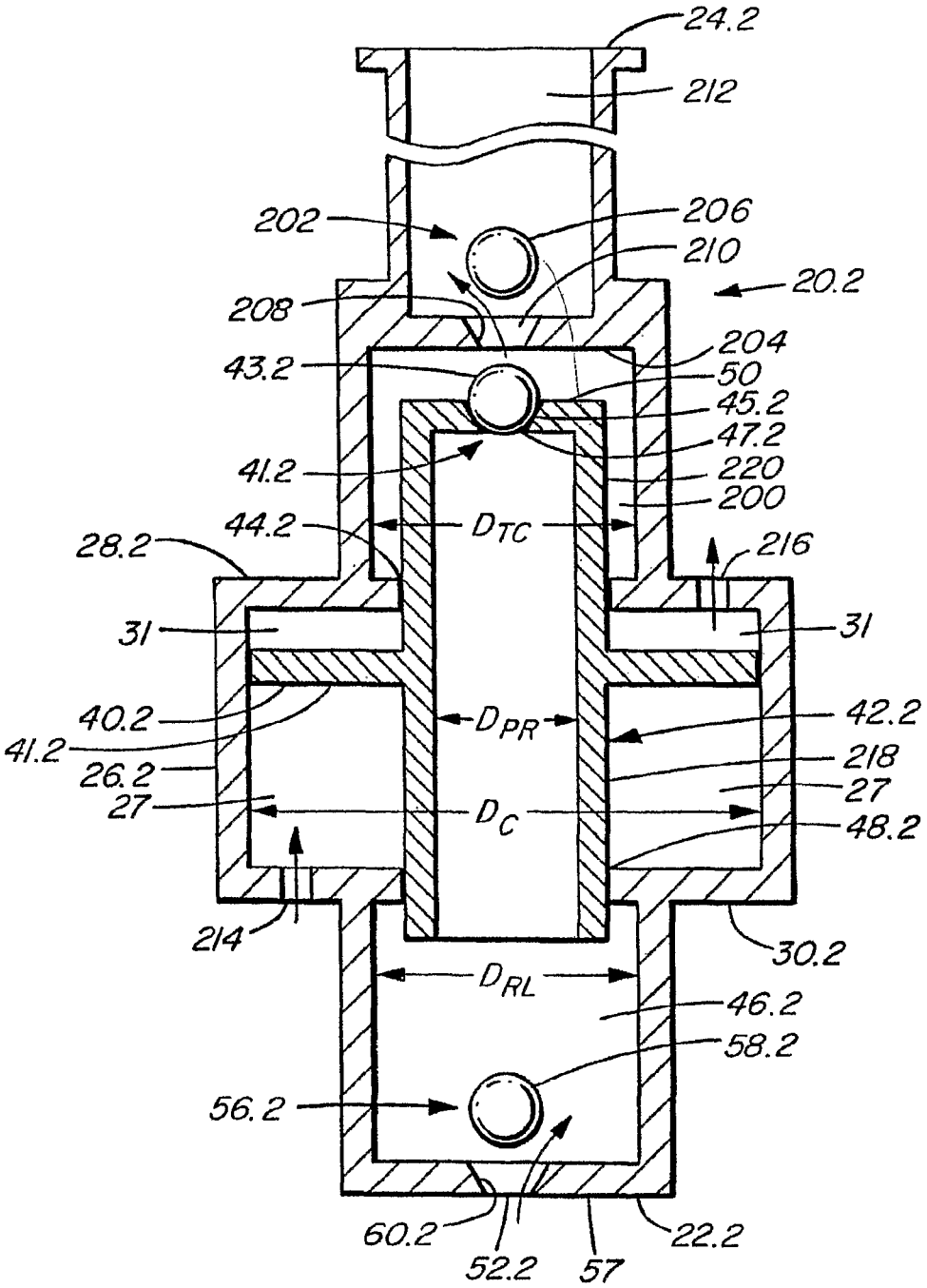
FIGS. 19A and 19B are simplified elevational views, partly in section, of a pumping apparatus in a power stroke and a recovery stroke respectively according to another embodiment of the invention.
Figure 19B:
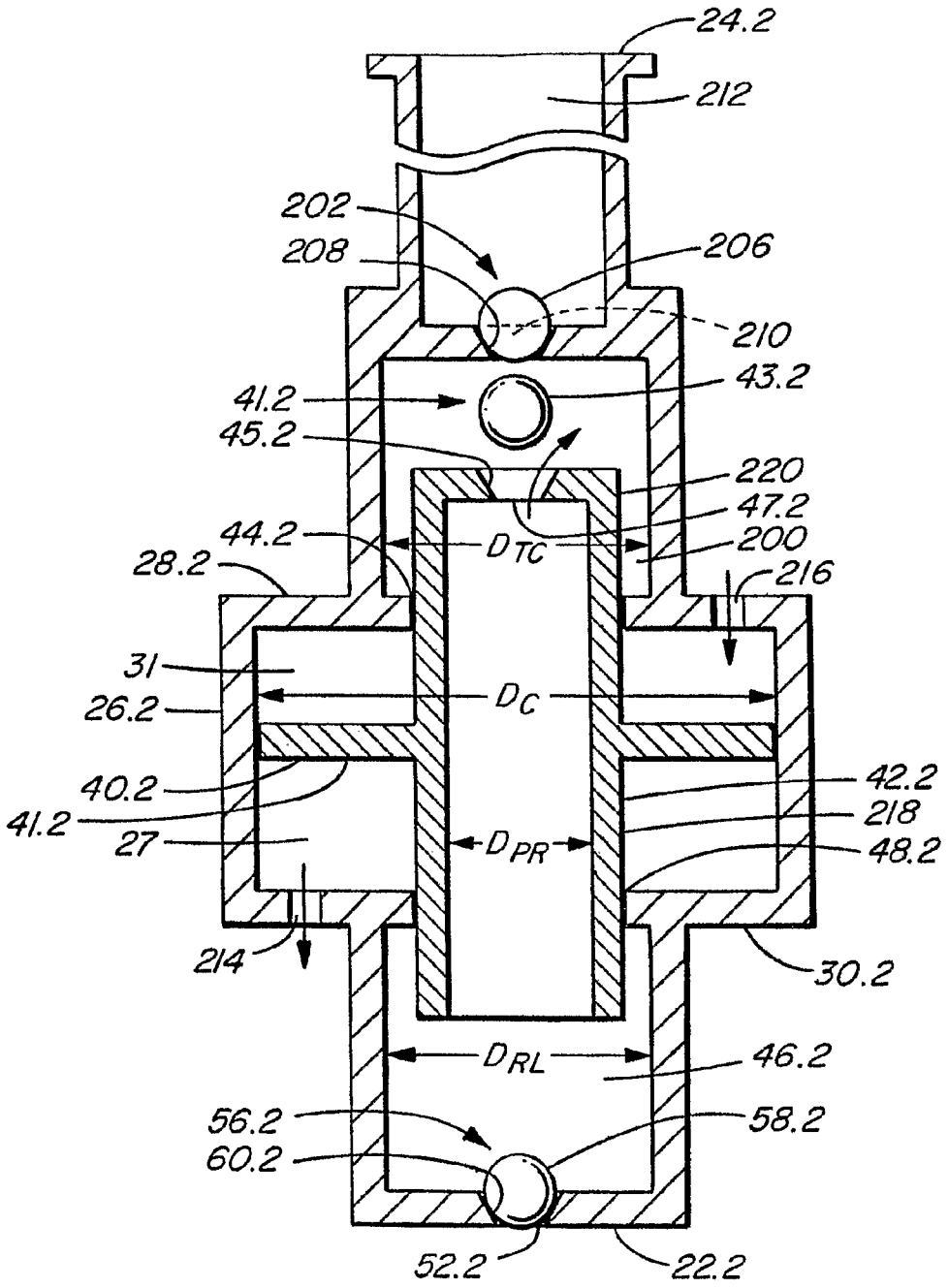

The previously discussed run-of-the-river hydro booster application could fit these requirements, Analysis shows this application allows the recovery of more than 55% of the energy of a high elevation tributary if it is channeled to a pressure head style pump placed at the bottom. The pump lifts almost five times as much water as is used to power the pump if the water is lifted $1/10^{th}$ of the height of the power head. The water is then recycled through the turbine at the bottom. Using the pump to de-water a mine could also be attractive. Raising water from a well could be attractive. Raising water to a reservoir or to a higher elevation (pressure) could also be attractive Another embodiment of the present invention is illustrated in FIG. 19A and FIG. 19B, wherein like parts have like reference numerals with the additional suffix "0.2". Referring first to FIG. 19A, a piston type pumping apparatus is shown indicated by reference numeral 20.2. The apparatus is intended to pump liquids, typically water, up relatively great vertical distances as exemplified by the distance between points 22.2 and 24.2.

There is a vertically oriented cylinder 26.2 having a top 28.2 and a bottom 30.2. A piston 40.2 is reciprocatingly mounted within the cylinder 26.2 and is connected to a vertically oriented, hollow piston rod 42.2 which extends slidably and sealingly through aperture 44.2 in the top 28.2 of the cylinder and aperture 48.2 in the bottom 30.2 of the cylinder. The piston 40.2 is annular in shape, in this example, has a surface area 41.2 and divides the cylinder into two sections exemplified by cylinder space 27 below the piston and cylinder space 31 above the piston. The cylinder 26.2 has a diameter $D_C$ and the hollow piston rod 42.2 has a diameter $D_{PR}$.

The piston rod 42.2 has a first portion 218 below the piston 40.2 and a second portion 220 above the piston. The first portion 218 extends slidably and sealingly through the aperture 48.2 and the second portion 220 extends slidably and sealingly through the aperture 44.2. It should be understood that FIG. 19A and FIG. 19B are simplified drawings of the invention and seals and other conventional elements which would be apparent to someone skilled in the art are omitted.

There is a first one-way valve, indicated by reference numeral 41.2, at top 50 of the piston rod 42.2. Valve 41.2 has a valve member 43.2 and a valve seat 45.2 which extends about a first passageway 47.2 in the top 50 of the piston rod 42.2.

There is a reload chamber 46.2 adjacent bottom 30.2 of the cylinder 26.2 and is sealed with the cylinder apart from the aperture 48.2. The reload chamber 46.2 is in the form of a cylinder, in this example, and has a diameter $D_{RL}$. A second one-way valve indicated by reference numeral 56.2 is located at a bottom 57 of the reload chamber 46.2 and includes a valve member 58.2 and a valve seat 60.2 which extends about a second passageway 52.2 in the bottom of the reload chamber.

The second one-way valve allows liquid to flow from a source of liquid to be pumped below the apparatus 20.2 into the reload chamber 46.2 and into hollow piston rod 42.2, but prevents liquid from flowing from the reload chamber towards the source below.

There is a transfer chamber 200 adjacent the top 28.2 of the cylinder 26.2 and is sealed with the cylinder apart from the aperture 44.2. The transfer chamber 200 is in the form of a cylinder, in this example, and has a diameter $D_{TC}$. The second portion 220 of the piston rod 42.2 acts as a piston within the transfer chamber 200. There could be a piston member on the end of the piston rod 42.2 within the transfer chamber 200 and the term "piston rod" includes this possibility.

The first one-way valve 41.2 allows liquid to flow into the transfer chamber 200 from the hollow piston rod 42.2 and from the reload chamber 46.2, but prevents a reverse flow into the hollow piston rod and reload chamber.

Since the transfer chamber 200 and the reload chamber 46.2 are above and below the cylinder 26.2 respectively, in this embodiment, the cylinder diameter $D_C$ can be sized such that the piston rod diameter $D_{PR}$ can be equal to or less than the diameters $D_{TR}$ and $D_{RL}$ of the transfer chamber 200 and reload chamber 46.2 respectively, and can also be sized such that the surface area 41.2 of the piston 40.2 is large enough for optimal pumping. The larger the diameter $D_{PR}$ of the piston rod 42.2, the greater the volume of fluid that can be pumped by the apparatus 20.2. The greater the surface area 41.2 of the piston 40.2 the greater the pumping force.

A third one-way valve indicated by reference numeral 202 is located at the top 204 of the transfer chamber 200 and includes a valve member 206 and a valve seat 208 which extends about a third passageway 210 in the top of the transfer chamber. There is a discharge chamber 212 above and adjacent to the transfer chamber 200 and is sealed with the transfer chamber apart from the third one-way valve 202. The third one-way valve 202 allows liquid to flow from the transfer chamber 200 into the discharge chamber 212, but prevents a reverse flow of liquid from the discharge chamber into the transfer chamber.

A fourth passageway 214 is located in the bottom 30.2 of the cylinder 26.2 and a fifth passageway 216 is located in the top 28.2 of the cylinder. The fourth and fifth passageways 214 and 216 allow a flow of pressurized liquid into and out of the cylinder spaces 31 and 27 respectively as explained below. Typically, the fourth and fifth passageways 214 and 216 respectively would be connected to a source of pressurized liquid via respective conduits and respective valves.

In operation, the apparatus 20.2 is primed by filling the reload chamber 46.2, the hollow piston rod 42.2 and the discharge chamber 200 with fluid, typically water, and the piston is placed in its lowermost position next to bottom 30.2 of cylinder 26.2. The first, second and third one-way valves 41.2, 56.2 and 202 are closed.

During the power stroke, shown in FIG. FIG. 19A, pressurized fluid is let into the cylinder space 27 through passageway 214. The pressurized fluid acts on the piston 40.2, causing it to rise from the bottom 30.2 towards the top 28.2.

The second portion 220 of the piston rod 42.2 rises upwardly through the aperture 44.2 and thereby creates an increased pressure in the transfer chamber 200 since the volume of space occupied by the second portion in the transfer chamber is increased.

The increased pressure in the transfer chamber 200 causes the valve member 43.2 of the first one-way valve 41.2 to remain firmly seated in its valve seat 45.2, such that liquid is prevented from flowing through passageway 47.2. The increased pressure also causes the valve member 206 of the third one-way valve 202 to rise off its seat 208, such that liquid may flow from the transfer chamber 200 into the discharge chamber 212.

The volume of liquid flowing from the transfer chamber 200 into the discharge chamber 212 is substantially equal to the increased volume occupied by the second portion 220 of the piston rod 42.2 in the transfer chamber.

Correspondingly, the first portion 218 of the piston rod 42.2 rises upwardly through the aperture 48.2, increasing the volume of space occupied by the reload chamber 46.2 and the hollow piston rod 42.2 combined. Since the first one-way valve 43.2 is closed, as discussed above, the pressure in the reload chamber 46.2 and in the hollow piston rod 42.2 is reduced.

The reduced pressure in the reload chamber 46.2 causes the valve member 58.2 of the second one-way valve 56.2 to rise off its seat 60.2, such that liquid flows from the source below into the reload chamber through passageway 52.2. The volume of liquid flowing from the source into the reload chamber 46.2 is substantially equal to the increase in total volume occupied by the hollow piston rod 42.2 and the reload chamber 46.2 combined, such that the pressure is equalized between the source, the reload chamber and the hollow piston rod.

During the power stroke the piston 40.2 continues to travel until it reaches the top 28.2 of the cylinder 26.2. The increase in the total volume of space occupied by the hollow piston rod 42.2 and the reload chamber 46.2 is equal to the decrease of volume occupied by fluid in the transfer chamber 200. The decrease in volume of fluid in transfer chamber 200 is equal to increase in the volume of space occupied by the second portion 220 of the piston rod in the transfer chamber 200.

Referring now to FIG. 19B, during the recovery stroke pressurized fluid is let into the cylinder space 31 through passageway 216. The pressurized fluid acts on the piston 40.2 such that it is deflected downwards from the top 28.2 of cylinder 26.2 towards the bottom 30.2. Simultaneously, pressurized fluid from space 27 is released through passageway 214.

Initially during the recovery stroke, with the first one-way valve 41.2 closed and the third one-way valve 202 open, the pressure in the transfer chamber 200 is decreased since the volume of space occupied by the second portion 220 of the piston rod 42.2 is decreased. This decrease in pressure causes the valve member 206 of the third one-way valve 202 to seat itself on seat 208 which thereby prevents any fluid from the discharge chamber 212 from flowing through passageway 210 into the transfer chamber 200.

Similarly, during the initial period of the recovery stroke with the first one-way valve 41.2 closed and the second one-way valve 56.2 open, the pressure in the reload chamber 46.2 is increased since the total volume of space occupied by the piston rod 42.2 and the reload chamber is decreased while the volume of fluid therein remains at first constant. This increased pressure causes the valve member 58.2 of the second one-way valve 56.2 to seat itself on seat 60.2 which thereby prevents any fluid from the reload chamber 46.2 and the hollow piston rod 42.2 from flowing through passageway 52.2 into the source.

Once the second one-way valve 56.2 closes, the total volume of fluid in the space defined by the reload chamber 46.2, the hollow piston rod 42.2 and the transfer chamber 200 remains constant. During this period of the recovery stroke, with the first one-way valve 41.2, the second one-way valve 56.2 and the third one-way valve 202 closed, the volume of space occupied by the second portion 220 of the piston rod 42.2 in the transfer chamber 200 is reduced as the piston 40.2 travels towards the bottom 30.2 of cylinder 26.2 which causes a reduced pressure in the transfer chamber. A simultaneous increase in pressure occurs in the volume of space contained within the reload chamber 46.2 and the hollow piston rod 42.2.

The decrease in pressure in the transfer chamber 200 and increase in pressure in the hollow piston rod 42.2 and the reload chamber 46.2 causes the valve member 43.2 to rise off its seat 45.2, allowing the fluid to flow from the reload chamber and hollow piston rod into the transfer chamber to equalize the pressure.

The recovery stroke ends with the piston 40.2 next to bottom 30.2 of cylinder 26.2 and with the transfer chamber 200, the hollow piston rod 42.2 and the reload chamber 46.2 filled with liquid. The apparatus 20.2 is then ready for another power stroke. This cycle of a power stroke followed by a recovery stroke is alternately repeated during the operation of the apparatus 20.2.

An advantage of the present embodiment is obtained by the novel use of the third one-way valve 202 which prevents liquid in the discharge chamber 212 from reentering the transfer chamber 200 during the recovery stroke. This improves the efficiency of the pump significantly since energy is not wasted re-pumping the same liquid.

Another advantage is due to the configuration of the reload chamber 46.2, the cylinder 26.2 and the transfer chamber 200. This configuration allows the piston rod diameter $D_{PR}$ to be equal to or less than the diameters $D_{RL}$ and $D_{TC}$ of the reload chamber and transfer chamber respectively. The greater the piston rod diameter $D_{PR}$, the greater the volume of fluid that can be pumped by the apparatus 20.2. Furthermore, since the diameter $D_C$ of the cylinder 26.2 is not bound by either the reload chamber 46.2 or the transfer chamber 200, the surface area 41.2 of the piston 40.2 can be made as large as necessary for an optimal pumping force. The greater the surface area 41.2 of the piston 40.2, the greater the force of the piston rod 42.2 acting on the water in the transfer chamber 200 for a given pressurized fluid on the piston through passageway 214.

Accumulator

Figure 25:
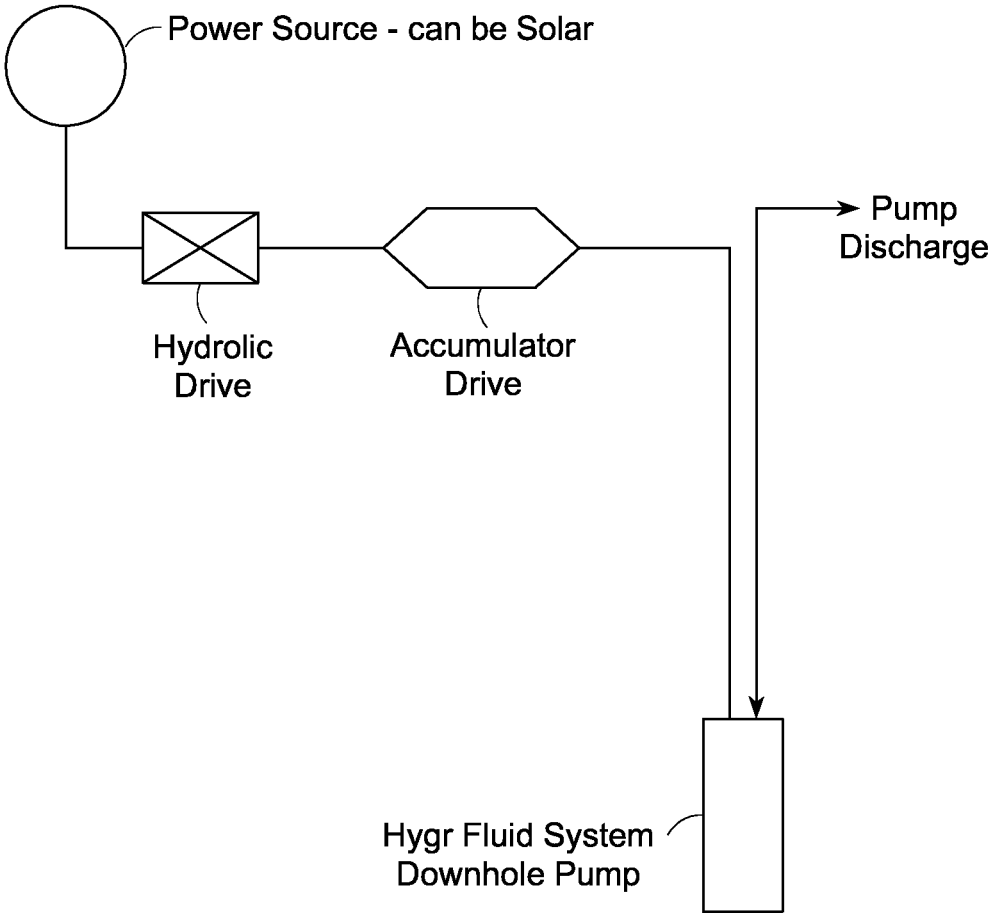
FIG. 25 depicts a system utilizing an accumulator with a Hygr Fluid System pump.
Figure 26:
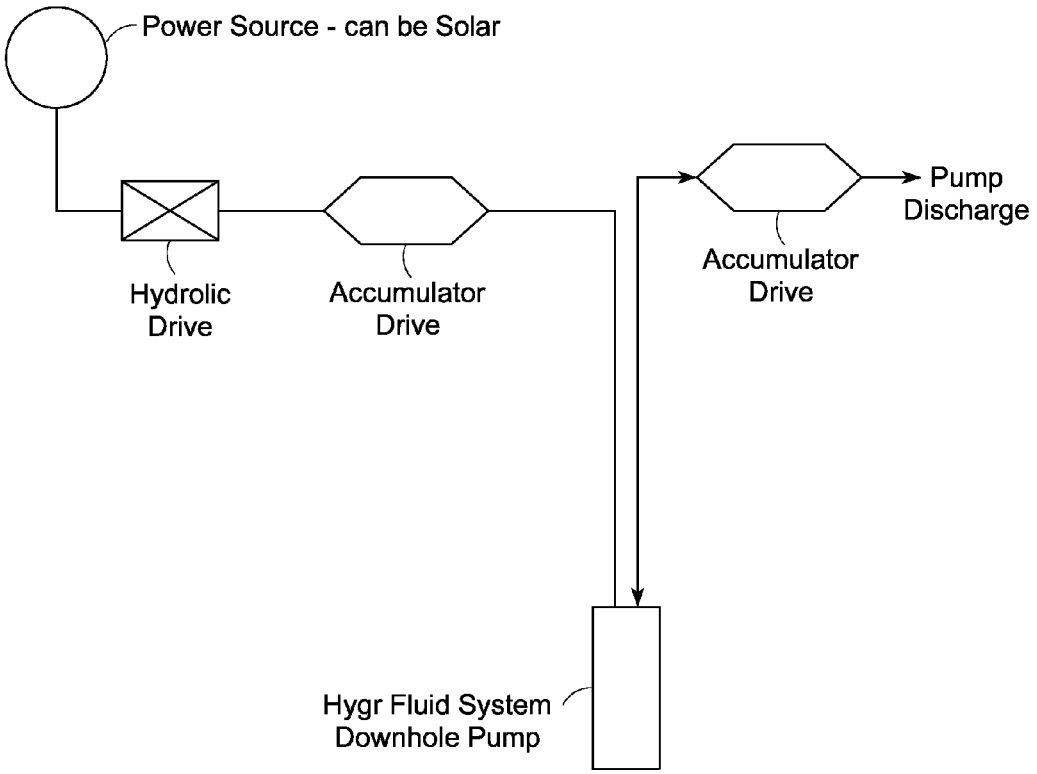
FIG. 26 depicts a system utilizing an accumulator drive and recycle system with a Hygr Fluid System pump.

Performance of a downhole pump with a given A1/A2 ratio can be improved through the use of an accumulator and a pressure-maintaining valve in the produced fluid conduit at the surface. An accumulator is a pressure storage reservoir in which a non-compressible fluid is held under pressure by an external source. The external source can be a spring, a raised weight, or a compressed gas. An accumulator enables the system to cope with extremes of demand using a less powerful pump, to respond more quickly to a temporary demand, and to smooth out pulsations. It is a type of energy storage device. FIG. 25 depicts a system utilizing an accumulator with a Hygr Fluid System pump. The system includes a power source, e.g., solar power, a hydraulic drive, an accumulator drive, a Hygr Fluid System downhole pump, and a pump discharge. FIG. 26 depicts a system utilizing an accumulator drive and recycle system with a Hygr Fluid System pump. depicts a system utilizing an accumulator with a Hygr Fluid System pump. The accumulator includes a power source, e.g., solar power, a hydraulic drive, an accumulator drive, a Hygr Fluid System downhole pump, an accumulator recycle, and a pump discharge.

Various types of accumulators are suitable for use in the preferred embodiments. One of the simplest types of accumulators is the tower accumulator, wherein water is pumped to a tank and the hydrostatic head of the water's height above that of the pump provides pressure. A raised weight accumulator includes a vertical cylinder containing fluid connected to the fluid conduit. The cylinder is closed by a piston on which a series of weights are placed that exert a downward force on the piston and thereby energizes the fluid in the cylinder. In contrast to compressed gas and spring accumulators, this type delivers a nearly constant pressure, regardless of the volume of fluid in the cylinder, until it is empty.

A compressed gas accumulator includes a cylinder with two chambers separated by an elastic diaphragm, a totally enclosed bladder, or a floating piston. One chamber contains fluid and is connected to the fluid line. The other chamber contains an inert gas under pressure (typically air, nitrogen or other gas) that provides the compressive force on the fluid. Inert gas is typically preferred to avoid combustion of oxygen and oil mixtures in the system under high pressure. As the volume of the compressed gas changes, the pressure of the gas (and the pressure on the fluid) changes inversely. The open loop accumulator works by drawing air in from the atmosphere and expelling air into the atmosphere. A separate pump maintains the pressure balance of the air by increasing the fluid in the system. This results in a steady pressure of air and up to 24 times the energy density of a standard hydraulic accumulator.

A spring type accumulator is similar in operation to the gas-charged accumulator, except that a heavy spring (or springs) is used to provide the compressive force. According to Hooke's law the magnitude of the force exerted by a spring is linearly proportional to its extension. Therefore as the spring compresses, the force it exerts on the fluid is increased linearly. The metal bellows accumulators function similarly to the compressed gas type, except the elastic diaphragm or floating piston is replaced by a hermetically sealed welded metal bellows. Fluid may be internal or external to the bellows. The advantages to the metal bellows type include exceptionally low spring rate, allowing the gas charge to do all the work with little change in pressure from full to empty, and a long stroke relative to solid (empty) height, which gives maximum storage volume for a container size. The welded metal bellows accumulator provides an exceptionally high level of accumulator performance, and can be produced with a broad spectrum of alloys resulting in a broad range of fluid compatibility. Another advantage to this type is that it does not face issues with high pressure operation, thus allowing more energy storage capacity. There may be more than one accumulator, or type of accumulator, employed in the systems of preferred embodiments.

In operation, an accumulator is placed close to the pump with a non-return valve preventing flow back to the pump. In the case of piston-type pumps this accumulator is placed in a location to absorb pulsations of energy from a multi-piston pump. It also helps protect the system from fluid hammer.

This protects system components, particularly pipework, from both potentially destructive forces. An additional benefit is the additional energy that can be stored while the pump is subject to low demand, enabling use of a smaller-capacity pump. Accumulators are often placed close to the demand to help overcome restrictions and drag from long pipework runs. The outflow of energy from a discharging accumulator is much greater, for a short time, than even large pumps could generate. An accumulator can maintain the pressure in a system for periods when there are slight leaks without the pump being cycled on and off constantly. When temperature changes cause pressure excursions the accumulator helps absorb them. Its size helps absorb fluid that might otherwise be locked in a small fixed system with no room for expansion due to valve arrangement. The gas precharge in certain accumulator designs is typically set so that the separating bladder, diaphragm or piston does not reach or strike either end of the operating cylinder. The design precharge normally ensures that the moving parts do not foul the ends or block fluid passages.

The use of an accumulator may increase the rate at which the downhole piston is reset, thereby increasing the productivity of the downhole pump. Use of an accumulator may also ensure sufficient force over and above that created by the fluid head is available to reset the downhole piston if/when the fluid head alone is insufficient.

An alternate pump drive method may involve using a transfer barrier accumulator and control valve in the produced fluid conduit at the surface. Using the hydraulic drive pump to alternate pressure on the power column and produced fluid column (via the transfer barrier accumulator) may increase the rate at which the downhole pump may be stroked by enabling the controlled timing of both alternating pressures, thereby increasing the productivity of the downhole pump. By allowing for the introduction of additional force over and above that created by the fluid head, and/or what may be practically achieved with an accumulator and pressure-maintaining valve, the A1/A2 ratio may be decreased, thereby enabling the downhole pump to operate at deeper depths without increasing the power fluid pressure at the surface.

In one embodiment, an accumulator drive system is provided wherein a surface hydraulic accumulator is powered up by a pump on the surface. The pump can any type and can be powered by electricity, solar, or wind, or through the hydraulic ram principle as described herein, or by hand. Once the desired pressure is reached, the downhole pump strokes pumping liquid to the surface. The downhole pump can be situated in any desired configuration, e.g., vertical, horizontal, or at any angle therebetween. In one embodiment, a hydraulic impulse is used to power the downhole pump ("the Hygr Fluid System"). In this embodiment, the drive pipe hydraulic line can be any length or angle, as the flow of hydraulic fluid (e.g., water, oil or other liquid) is not impeded by angles, curves or changes in depth or altitude.

An accumulator reset can be employed in systems of certain embodiments. Such accumulator reset systems are desirable for use in connection with downhole systems, e.g., water wells where a standard water pressure tank is used. Hydraulic accumulators are typically preferred for their higher pressure and deeper pump settings. In operation, an accumulator on the surface has its pressure raised by the downhole pump as it delivers fluid from the well. This extra pressure helps push the transfer piston in the pump down on the reload cycle. In a preferred embodiment, the pump utilizes a larger piston area at the top of the transfer piston exert sufficient force to push the piston back down to reload; however, sometimes gas in the fluid and/or gas and oil wells keeps the fluid in the lines lighter than the drive fluid in the other hydraulic line. Extra force may then be necessary to push the piston down. Besides providing downward force on the transfer piston, use of a hydraulic accumulator also helps to regulate the pumping cycles. A timer can be employed to in connection with the accumulator to assist in improving pump function.

In certain embodiments, using the Accumulator Drive and Reset eliminates the need to drive the downhole pump with a Continuous Hydraulic Drive Unit (CHDU) on the Drive side. Instead, an Accumulator can be placed on the Drive side and pressurized by using a pump or an Acccumulator plus a pump on the Delivery side of the system. The Delivery side can be overpressurized from the Hydraulic Drive side and run through an Accumulator on the Delivery side with extra pressure to help reset the Transfer Piston in the downhole pump. By putting a pump on the Delivery side, one can degas the liquid from a well and then add whatever pressure is necessary to reset the Transfer Piston and pressurize the Accumulator on the Drive Side. That Accumulator will have a present pressure that is great enough to stroke the downhole pump and produce fluid out the Delivery line. With the Hygr Fluid System, there is constant transfer of the energy from one state to another to drive the pumping system, with a small amount added when necessary to replace the energy transferred to friction losses.

The systems are particularly suited for water pumping applications, but are also applicable to oil and gas applications. Gas wells all lose production due to liquid buildup in the well as the formation pressure decreases. When the wells are deliquified (dewatered) the resulting fluid has some entrained gas. By resetting the downhole Transfer Piston from the Delivery side, one can run the produced fluid through a degassing system and then run it to an Accumulator and have a pump that is powered by electricity, solar or gas as with the Blair system or gas powered systems that will pressurize a very large Accumulator or a Surface Drive pump can be put on the Delivery side to pressurize the system.

In one embodiment of a multi-pump system, the Hygr Fluid System can be adapted so one central drive unit powers multiple downhole pumps. The hydraulic pump system can operate with the hydraulic line in a horizontal, vertical, or angled position, such that the drive unit can be placed in the middle, or side of several pumps. This lends itself well to the pumping of oil or gas wells in close proximity. Instead of having a pump and drive unit on each well, the central drive unit can be timed to turn individual pump(s) on or off as desired. This allows one pump to be working permanently while other pumps are turned on or off on a selected basis, or all pumps can be sequentially or intermittently operated for continuous or discontinuous operation. For the gas and oil market this offers improved costing, safety and environmental reliability. The Hygr Fluid System is particularly well-suited to mine, excavation, and open pit dewatering.

In one embodiment, a driver using wellhead gas ("Blair Driver") can be adapted to the Hygr fluid system and supply power to the system from existing gas production. This design is desirable for remote locations. The Blair Driver and Blair Drive System are described in U.S. Pat. No. 6,065,387, U.S. Pat. No. 6,499,384, and Canada Pat. No. 2,276,868, the disclosures of which are incorporated by reference herein in their entireties.

Figure 20:
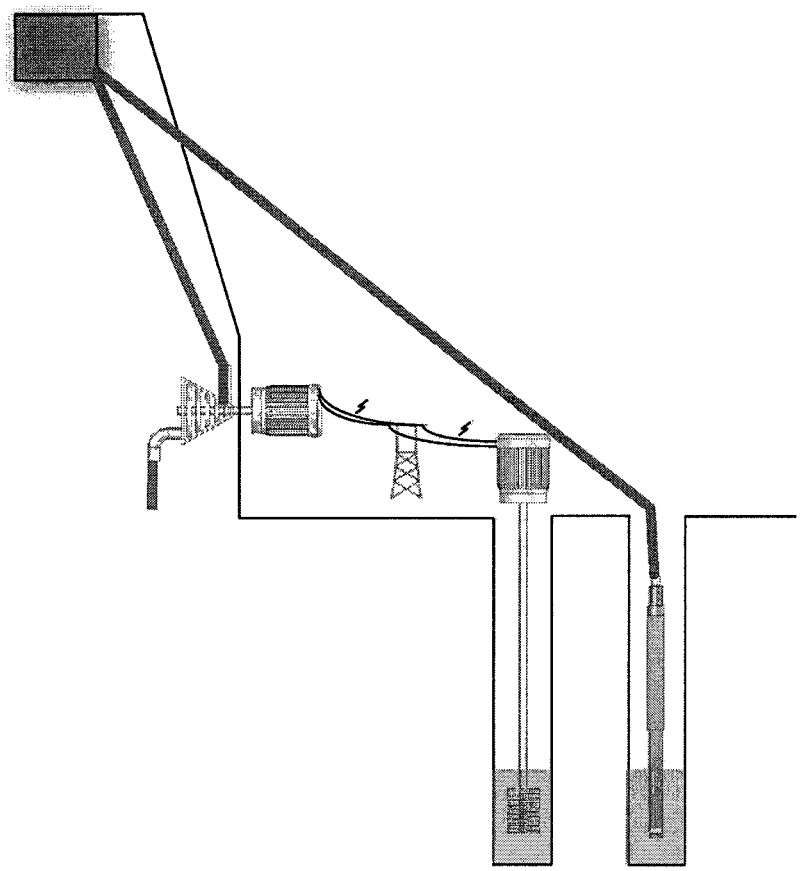
FIG. 20 shows a schematic of a system wherein water at a higher level is directed straight to the pump to power the pump stroke.

For mine, excavation, and open pit dewatering, a pump can be employed in the bottom of the pit that pumps water up about 50% of the way out of the pit, then transfers it to a second pump that lifts the water the rest of the way out of the pit (FIG. 20). With the Hygr Fluid system, the bottom pump is powered with the hydraulic force (energy) of the water column from the top of the excavation. The Hydraulic Ram principle powers the bottom Hygr fluid system unit and pumps the water 50% or more out of the pit and then a regular pump using standard electric power then pumps the fluid the rest of the way out of the pit. This system then uses at least 50% less purchased electric power to pump the liquid out of the pit than would be used by a conventional system, thereby reducing the cost of energy for operating the system by 50% or more.

Figure 21:
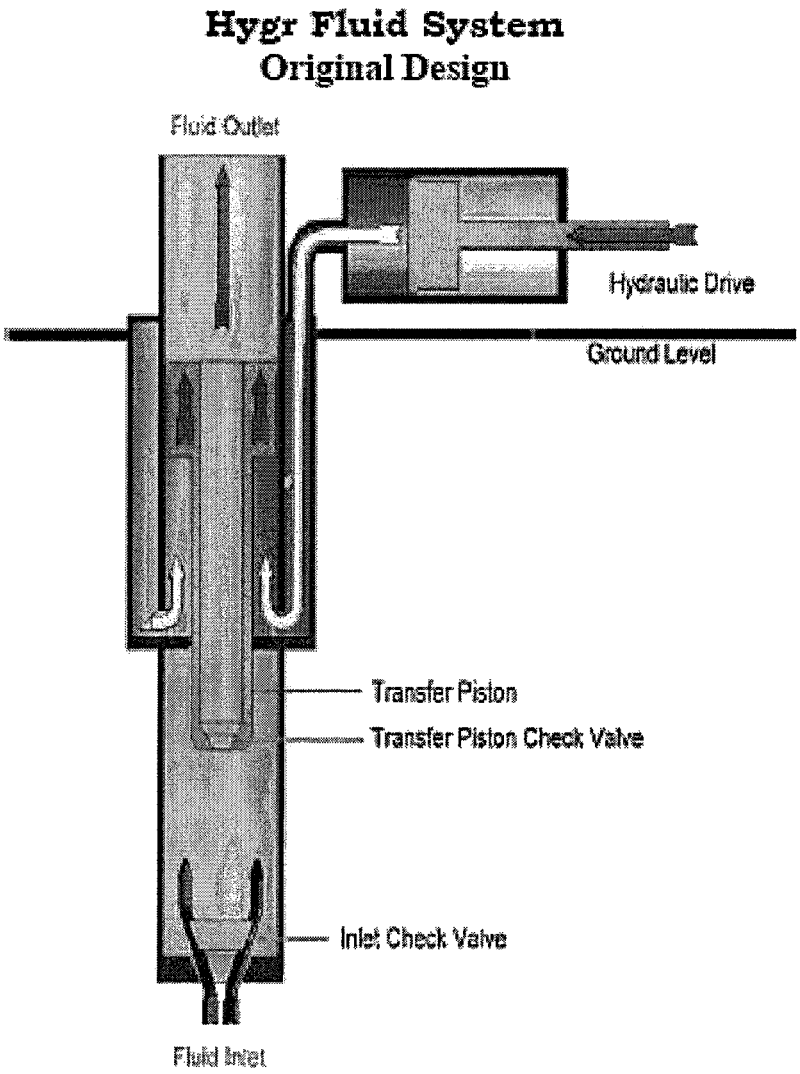
FIG. 21 depicts an embodiment of the Hygr Fluid System wherein the hydraulic cylinder on the surface moves forward and produces a hydraulic impulse transmitted through the delivery pipe to the pump.

Energy conversion is depicted in FIG. 21. Water at a higher level is directed straight to the pump and powers the pump stroke. This avoids running the water through a generator to generate electricity, which is transported via power lines to the surface and then back down to the pump, resulting in substantial energy savings.

In one embodiment, the hydraulic cylinder on the surface moves forward and produces a hydraulic impulse transmitted through the delivery pipe to the pump. The delivery pipe (Drive Line) operates on hydraulic impulse, and can be in any desired configuration, e.g., horizontal, vertical, on an angle or a corkscrew.

It has been observed that use of water as a hydraulic fluid to power the downhole pump exhibits some compression at 1000 ft., with this compression effect becoming more pronounced at 1500, 2000, 3000, 4000, 6000, or 10,000 ft. A Continuous Hydraulic Drive System has been developed to address this issue. In this system, as much fluid is pumped on the surface as needed to account for the hydraulic compression of the Drive Fluid plus what is necessary to drive the pump. As an example of this compression effect in operation, if 1 gallon is pumped with a drive unit on the surface, 1 gallon is obtained from the pump. When the pump was set to operate at a depth of 1600 ft., if 1 gallon is pumped with the drive unit on the surface, only ½ gallon is obtained from the pump.

The use of an accumulator can mitigate compression observed with a surface drive unit powering the downhole pump. An accumulator on the surface can be powered by any low energy pumping system and once it gains enough pressure it can send a hydraulic impulse down the Drive String to the downhole pump and it makes a stroke. The power to drive the low horsepower (e.g., ¼ HP) pump to pressurize the surface accumulator can be solar, wind, hand, or any other desired energy source. The pump may only stroke once or twice an hour, as it may take a long time to pressure up the surface accumulator—but the well only needs 1 or 2 strokes an hour to keep the water pumped off and the gas flowing.

Figure 22:
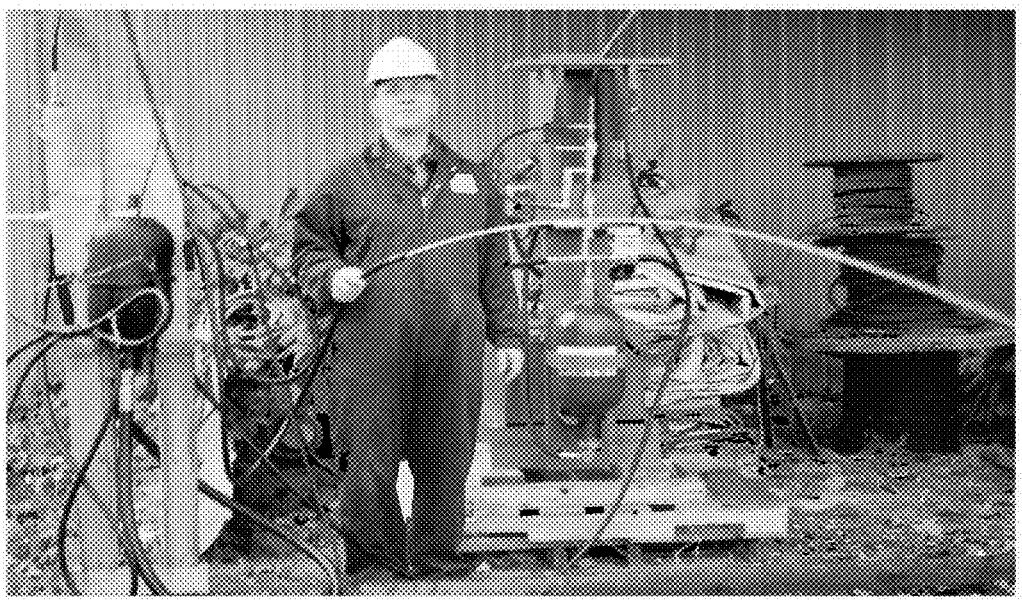
FIG. 22 is a photograph showing two hydraulic accumulators and water pumped from downhole.

In FIG. 22 are shown two Hydraulic Accumulators, the one on the right of the Drive Unit is used to overpressurize the system to add energy to the Recovery (return) stroke. The one on the left is the Accumulator Drive System powered by electricity. The Accumulator gains in pressure, then sends and impulse down the line to power the pump. The system of FIG. 22 is employed with a pump positioned down 200 ft., and the water coming from the hose is from 200 ft.

Figure 23:
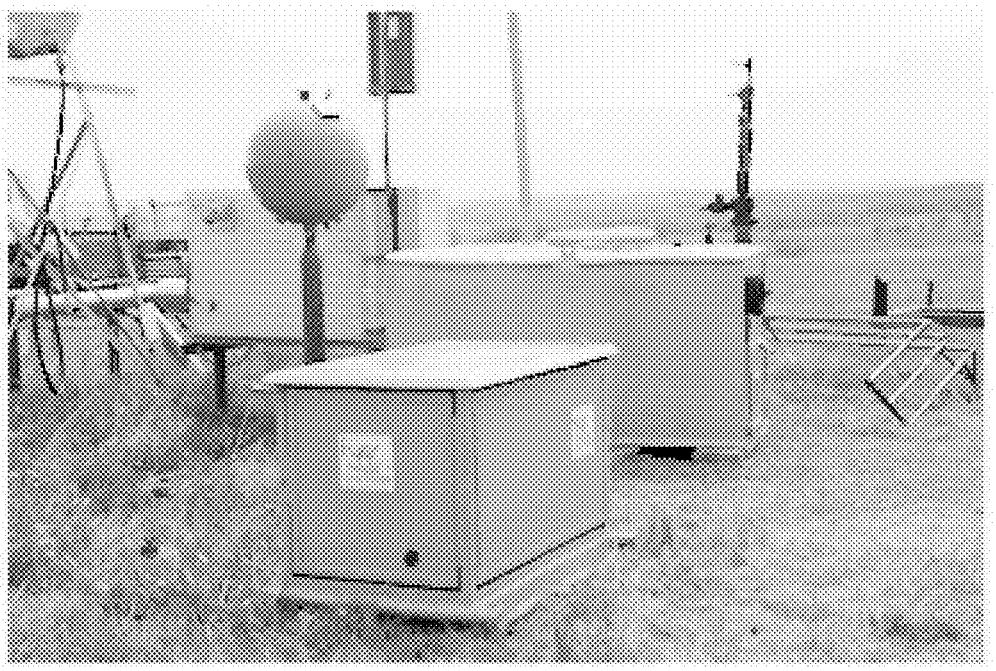
FIG. 23 is a photograph showing a drive unit (forward box) and control unit (rear box).
Figure 24A:
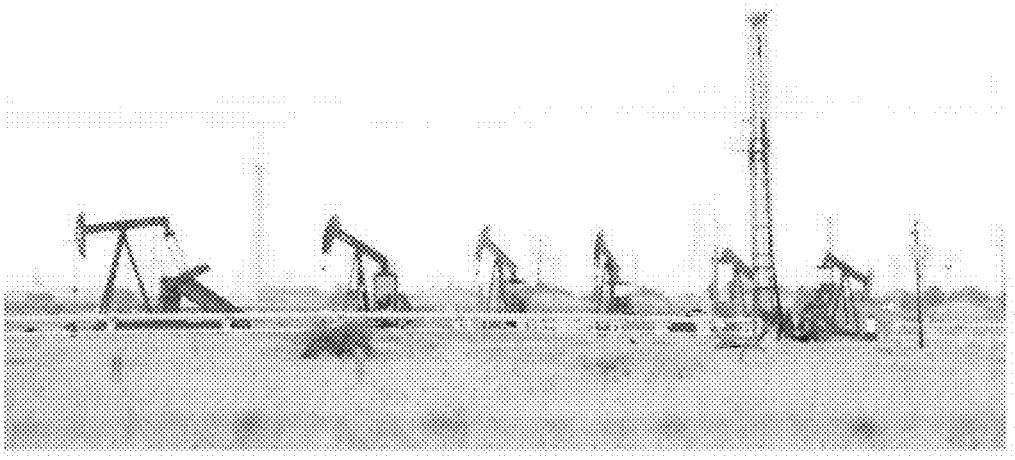
FIG. 24A depicts wells in close proximity controlled by one drive unit.
Figure 24B:
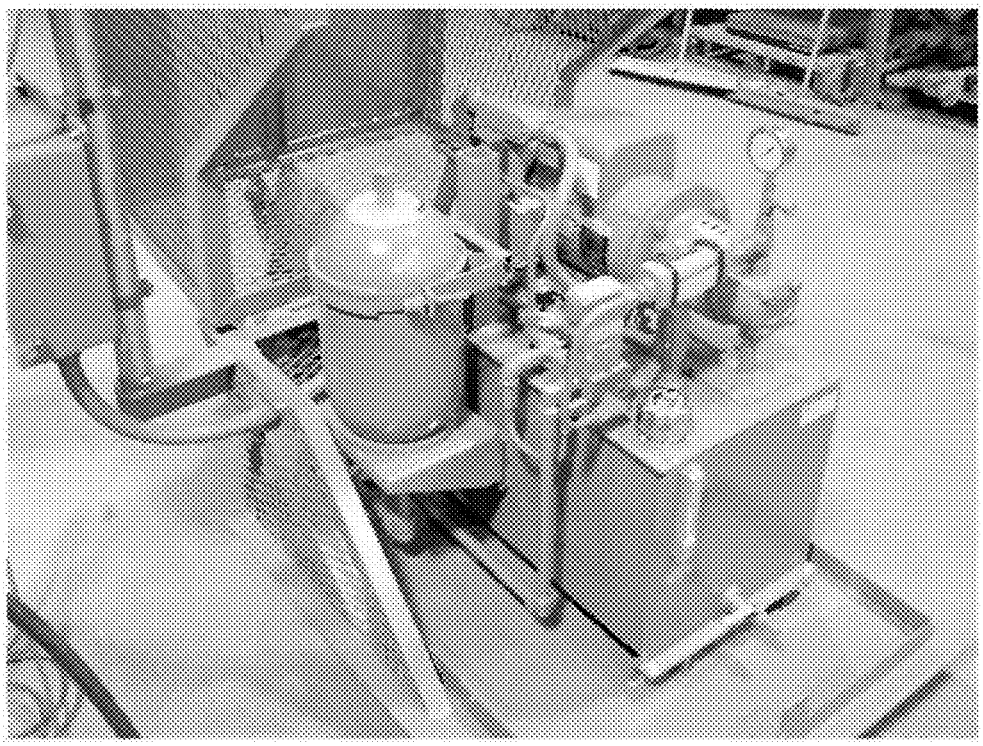
FIG. 24B depicts a drive unit for controlling wells as in FIG. 23.

FIG. 23 shows a Drive Unit and a Control Unit. The Drive (Power) and Control units can easily and economically drive and control the systems of preferred embodiments at any distance (even thousands of miles away). Electronic controls can power and monitor everything that is happening. FIG. 24A shows wells close together. One Drive Unit (FIG. 24B) can be placed in the middle of the wells and drive all of them, instead of having one drive unit on each well.

Figure 27:
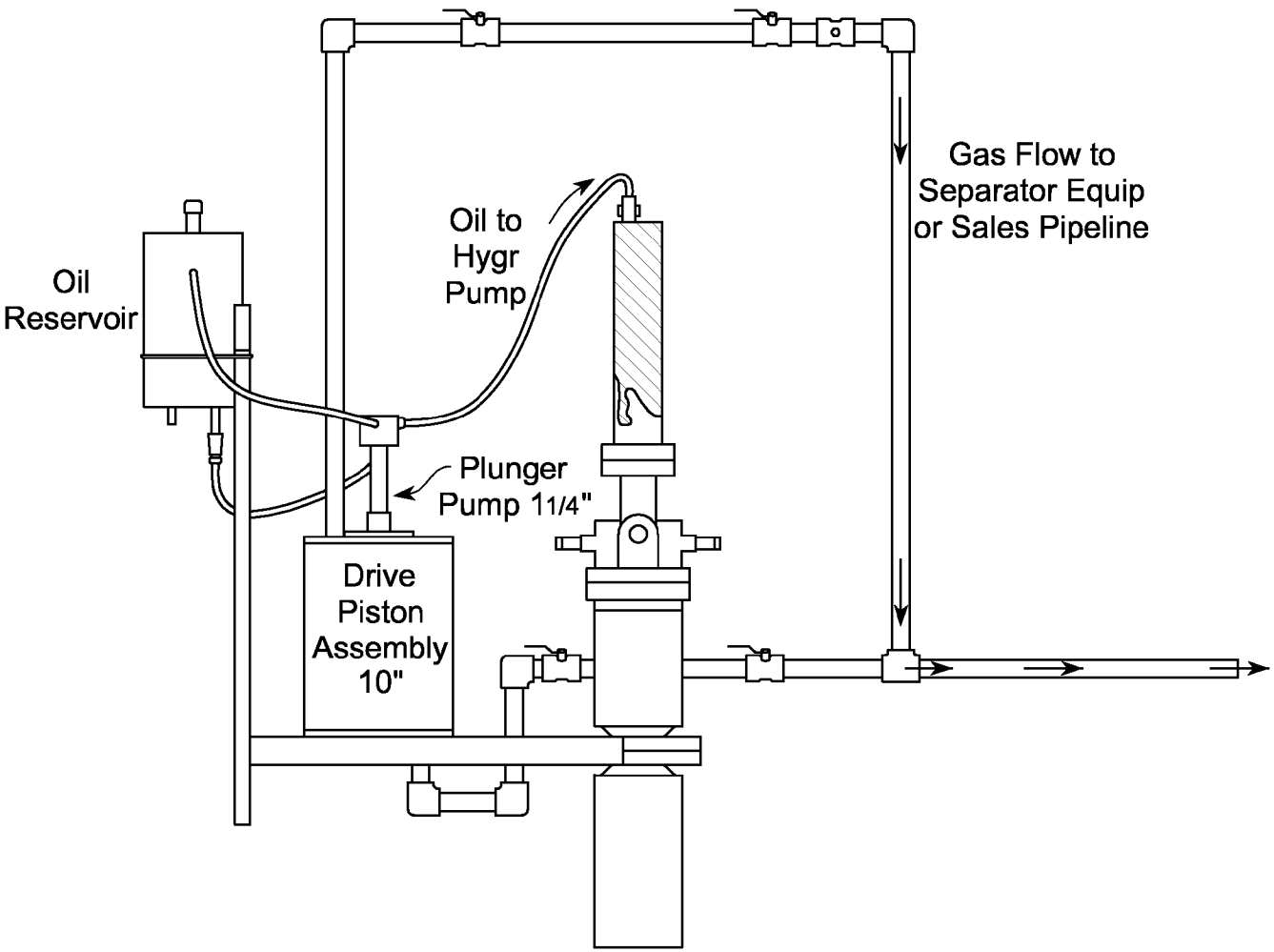
FIG. 27 depicts a Blair Drive system providing oil to a Hygr Fluid System.
Figure 28:
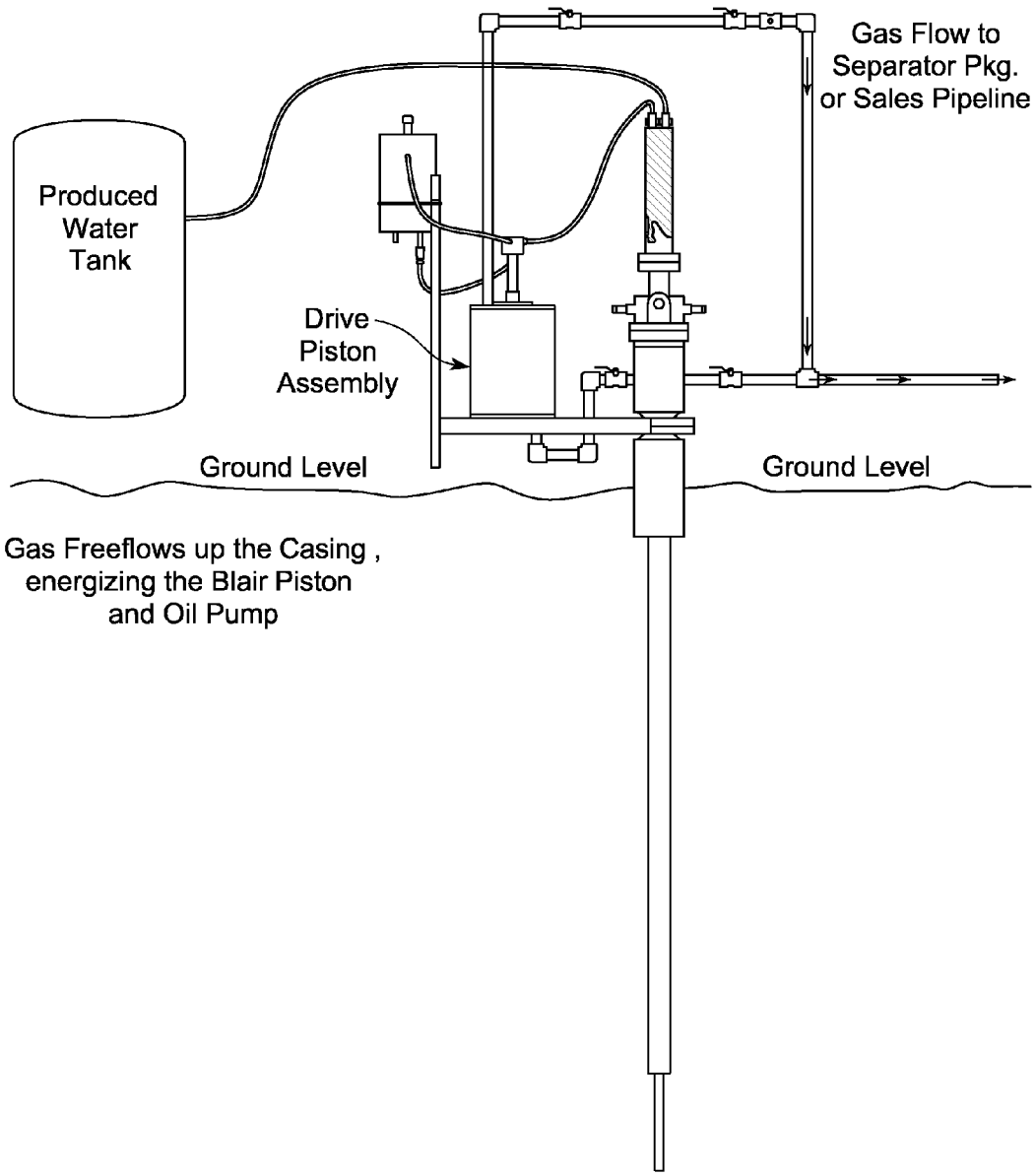
FIG. 28 depicts a Blair Drive system wherein gas freeflows up the casing, energizing the Blair Piston and oil pump.

FIG. 27 shows the Blair Air System driving the Hygr Fluid System downhole pump. The system was developed to use the pressure in a natural gas line to run an air compressor and then re-inject the gas into the gas line. This supplies compressed air to a gas well to run instrumentation and small pneumatic pumps and to achieve an emissions free well site. The system can be configured to provide power to the downhole pump of preferred embodiments with reciprocating pumping action. The reciprocating action used to power the air system can be modified to power a surface hydraulic pump as in certain embodiments. FIG. 27 depicts providing the oil to the Hygr pump. This is the Hydraulic Fluid used to drive the downhole pump. FIG. 28 shows the Produced Water Tank. This is the water taken from the gas well to deliquify it. The system is particularly well-suited for dewatering (or deliquification) of gas wells. Every gas well loses pressure over time and the fluid (poor quality water) builds up and holds the gas in the formation. Gas producers initially finish wells with a 4½" or larger casing. As the well loses pressure, a small tubing string—usually 2⅜' or 2⅞" is installed as a "Velocity String". The same amount of gas that was going up the 4½" or larger casing then goes up the tubing string of smaller cross-sectional area. This increases the velocity and carries the water out of the formation. Once the pressure drops further, a Plunger Lift is installed. This is a unit that falls to the bottom of the string when the pressure is low and holds the well shut until enough pressure is built up to push it to the top of the well and to carry all the fluid out. Once the pressure reduces further, the well is "swabbed", which involves pushing a plunger down the well and drawing it back out to get the water out of the well bore. Often a Plunger Lift is not employed—instead, swabbing is used.

With the Hygr Fluid System, a low cost pumping system can be installed at the beginning of the liquification cycle when the pressure drops below the level necessary to keep the velocity high enough in the well bore to carry the liquid out. Engines powered by natural gas are well suited to provide energy in certain embodiments, such as high producing gas wells. The systems can economically bring back into production low producing gas wells. Once the well is liquified and the well does not produce gas it must be properly decommissioned and abandoned. Using the Hygr Fluid System with the reconfigured Blair System (Hygr Blair Drive) enables such wells will continue to produce gas for a much longer time with no emissions, offering substantial environmental benefits.

Figure 29:
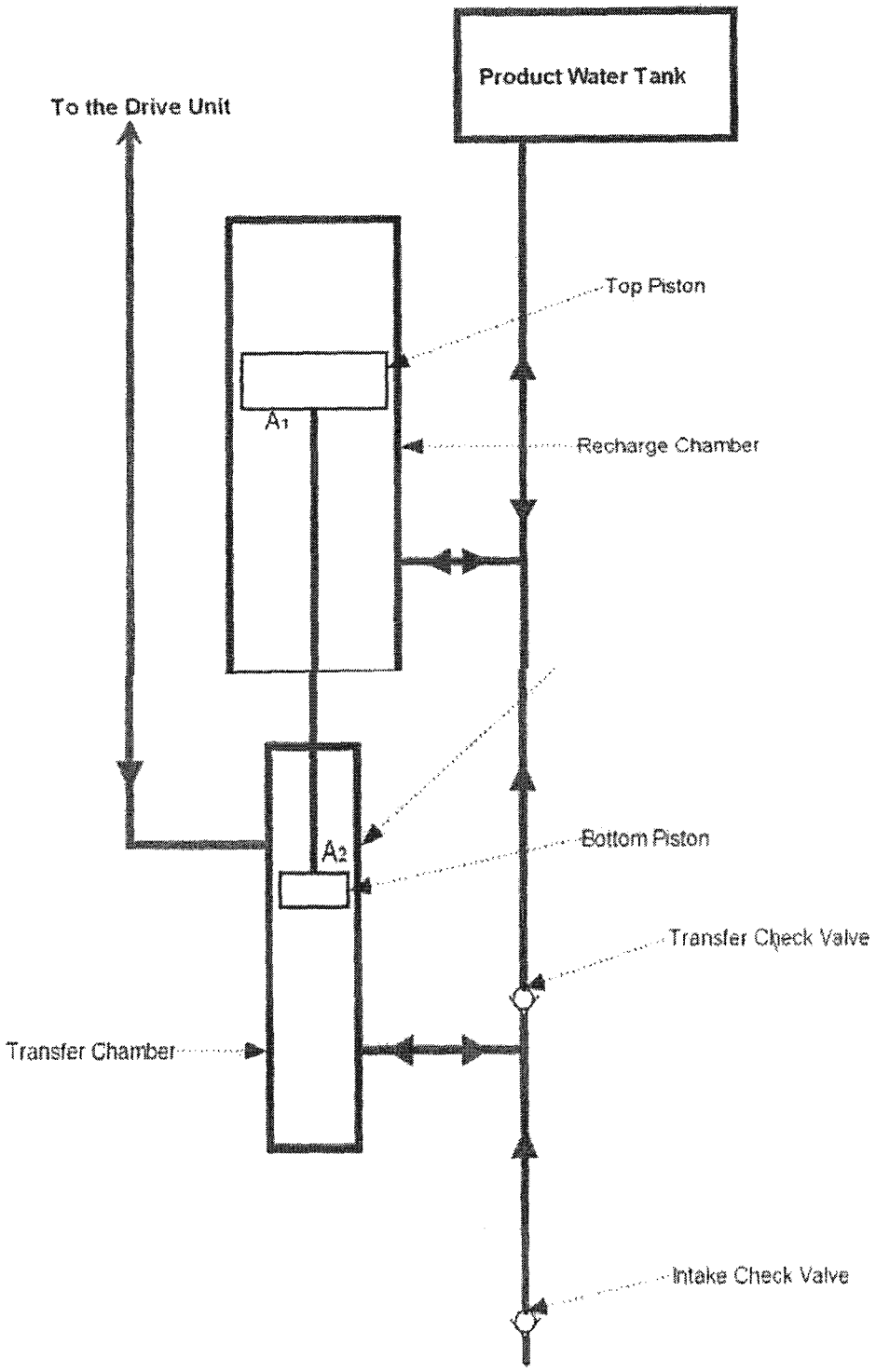
FIG. 29 is a block diagram depicting the 4G system.
Figure 30:
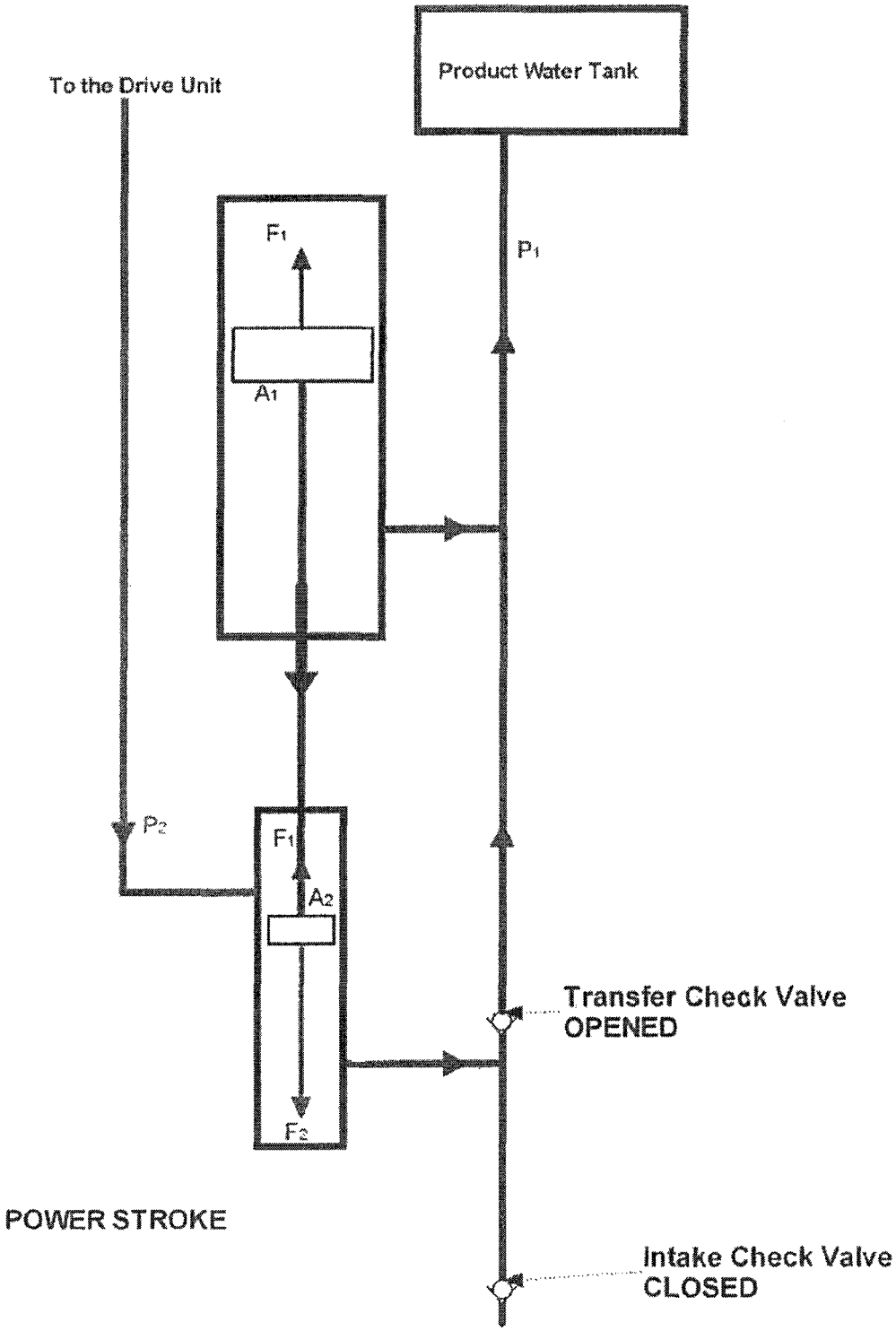
FIG. 30 is a block diagram depicting the power stroke of the 4G system.
Figure 31:
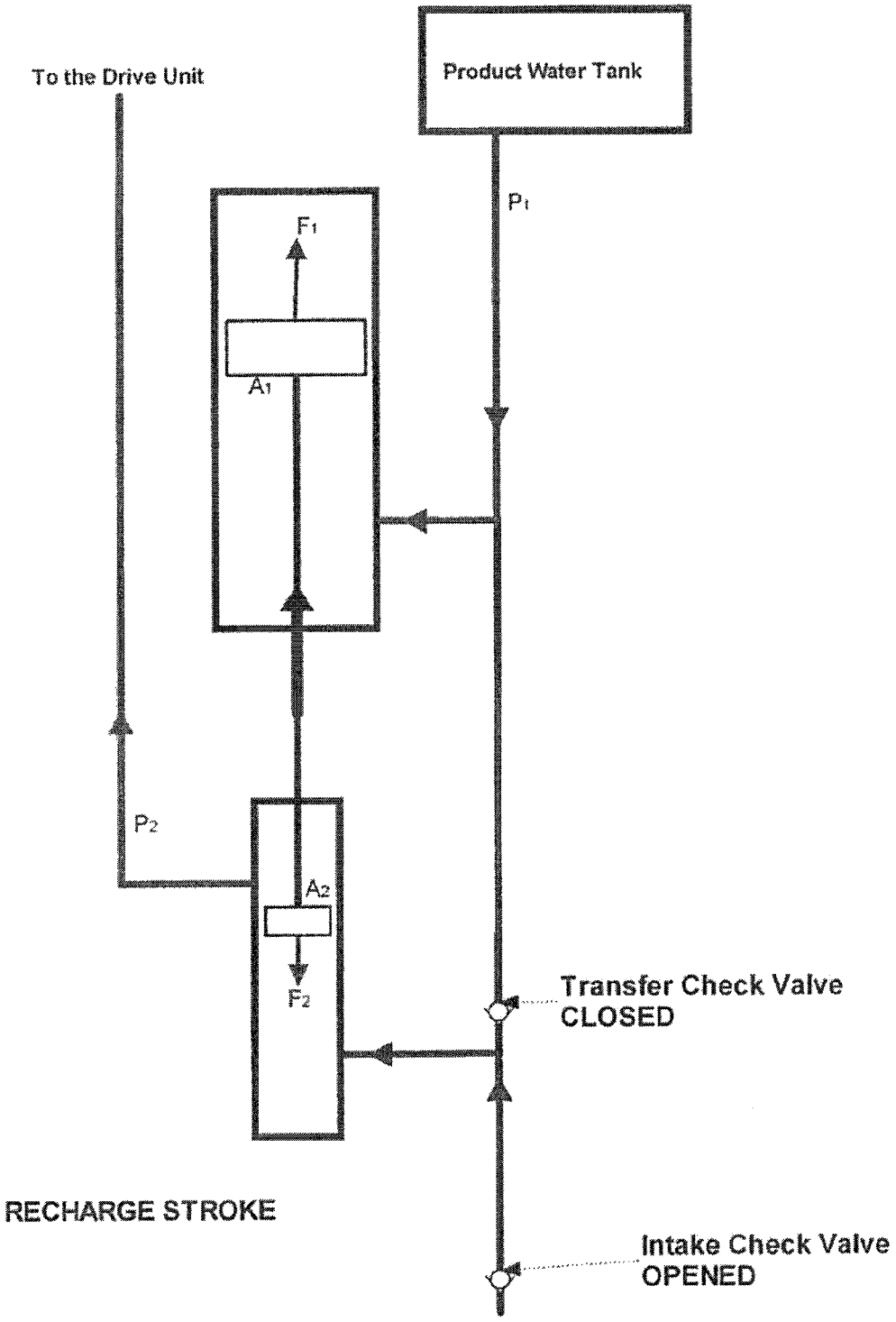
FIG. 31 is a block diagram depicting the recharge stroke 4G system.
Figure 32:
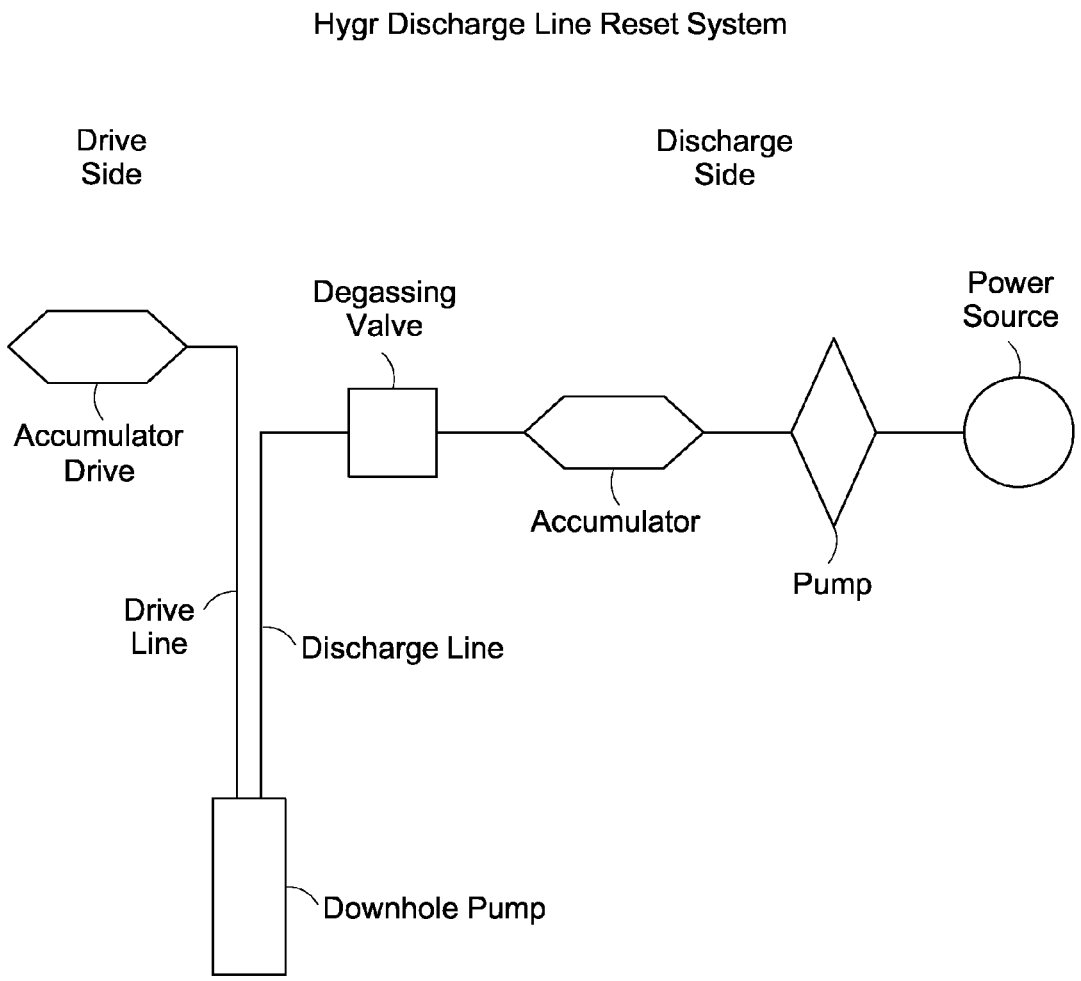
FIG. 32 depicts a system utilizing an accumulator drive with a discharge reset.

FIG. 29 is a block diagram depicting one embodiment of a Hygr Fluid System. The system includes a recharge chamber with top piston $A_1$, a transfer chamber with bottom piston $A_2$, a transfer check valve, an intake check valve, a product water tank, and a fluid transfer line to the drive unit. FIG. 30 is a block diagram depicting the power stroke of the depicted embodiment of the Hygr Fluid System of FIG. 29. The transfer check valve is opened, the intake check valve is closed, and the drive unit exerts pressure $P_2$ on the system, which forces the bottom piston $A_2$ down with force $F_2$. Top piston $A_1$ moves up exerting force $F_1$, and pressure $P_1$ is exerted upwards on the product water tank. FIG. 31 is a block diagram depicting the recharge stroke Hygr Fluid System. The transfer check valve is closed, the intake check valve is opened, and pressure $P_2$ is exerted from the bottom piston $A_2$ to the drive unit and the top piston $A_1$. Top piston $A_1$ moves up exerting force $F_1$, and pressure $P_1$ is exerted downwards from the product water tank. The power and recharge strokes alternate, providing pumping action.

The present application discloses a pump having increased energy efficiency. The pumps disclosed reduce maintenance costs by reducing the number of moving parts and/or reducing the damage caused by suspended particles. In many pumping applications, a motor must be placed downhole to pump the fluid to the surface and such motors often require a downhole cooling system. One advantage of some embodiments disclosed herein is the elimination of the requirement of a downhole cooling system.

Methods and devices suitable for use in conjunction with aspects of the preferred embodiments are disclosed in U.S. Pat. No. 6,193,476 and U.S. Pat. No. 7,967,578, both of which are hereby incorporated by reference in their entireties.

Methods and devices suitable for use in conjunction with aspects of the preferred embodiments are disclosed in U.S. Patent Publication No. 2008-0219869-A1; U.S. Patent Publication No. 2005-0169776-A1; and U.S. Patent Publication No. 2011-0255997-A1, which are also hereby incorporated by reference in their entireties.

The above description presents the best mode contemplated for carrying out the present invention, and of the manner and process of making and using it, in such full, clear, concise, and exact terms as to enable any person skilled in the art to which it pertains to make and use this invention. This invention is, however, susceptible to modifications and alternate constructions from that discussed above that are fully equivalent. Consequently, this invention is not limited to the particular embodiments disclosed. On the contrary, this invention covers all modifications and alternate constructions coming within the spirit and scope of the invention as generally expressed by the following claims, which particularly point out and distinctly claim the subject matter of the invention. While the disclosure has been illustrated and described in detail in the drawings and foregoing description, such illustration and description are to be considered illustrative or exemplary and not restrictive.

All references cited herein are incorporated herein by reference in their entireties. To the extent publications and patents or patent applications incorporated by reference contradict the disclosure contained in the specification, the specification is intended to supersede and/or take precedence over any such contradictory material.

Unless otherwise defined, all terms (including technical and scientific terms) are to be given their ordinary and customary meaning to a person of ordinary skill in the art, and are not to be limited to a special or customized meaning unless expressly so defined herein. It should be noted that the use of particular terminology when describing certain features or aspects of the disclosure should not be taken to imply that the terminology is being re-defined herein to be restricted to include any specific characteristics of the features or aspects of the disclosure with which that terminology is associated. Terms and phrases used in this application, and variations thereof, especially in the appended claims, unless otherwise expressly stated, should be construed as open ended as opposed to limiting. As examples of the foregoing, the term 'including' should be read to mean 'including, without limitation,' 'including but not limited to,' or the like; the term 'comprising' as used herein is synonymous with 'including,' 'containing,' or 'characterized by,' and is inclusive or open-ended and does not exclude additional, unrecited elements or method steps; the term 'having' should be interpreted as 'having at least;' the term 'includes' should be interpreted as 'includes but is not limited to;' the term 'example' is used to provide exemplary instances of the item in discussion, not an exhaustive or limiting list thereof; adjectives such as 'known', 'normal', 'standard', and terms of similar meaning should not be construed as limiting the item described to a given time period or to an item available as of a given time, but instead should be read to encompass known, normal, or standard technologies that may be available or known now or at any time in the future; and use of terms like 'preferably,' 'preferred,' 'desired,' or 'desirable,' and words of similar meaning should not be understood as implying that certain features are critical, essential, or even important to the structure or function of the invention, but instead as merely intended to highlight alternative or additional features that may or may not be utilized in a particular embodiment of the invention. Likewise, a group of items linked with the conjunction 'and' should not be read as requiring that each and every one of those items be present in the grouping, but rather should be read as 'and/or' unless expressly stated otherwise. Similarly, a group of items linked with the conjunction 'or' should not be read as requiring mutual exclusivity among that group, but rather should be read as 'and/or' unless expressly stated otherwise.

Where a range of values is provided, it is understood that the upper and lower limit, and each intervening value between the upper and lower limit of the range is encompassed within the embodiments.

With respect to the use of substantially any plural and/or singular terms herein, those having skill in the art can translate from the plural to the singular and/or from the singular to the plural as is appropriate to the context and/or application. The various singular/plural permutations may be expressly set forth herein for sake of clarity. The indefinite article 'a' or 'an' does not exclude a plurality. A single processor or other unit may fulfill the functions of several items recited in the claims. The mere fact that certain measures are recited in mutually different dependent claims does not indicate that a combination of these measures cannot be used to advantage. Any reference signs in the claims should not be construed as limiting the scope.

It will be further understood by those within the art that if a specific number of an introduced claim recitation is intended, such an intent will be explicitly recited in the claim, and in the absence of such recitation no such intent is present. For example, as an aid to understanding, the following appended claims may contain usage of the introductory phrases 'at least one' and 'one or more' to introduce claim recitations. However, the use of such phrases should not be construed to imply that the introduction of a claim recitation by the indefinite articles 'a' or 'an' limits any particular claim containing such introduced claim recitation to embodiments containing only one such recitation, even when the same claim includes the introductory phrases 'one or more' or 'at least one' and indefinite articles such as 'a' or 'an' (e.g., 'a' and/or 'an' should typically be interpreted to mean 'at least one' or 'one or more'); the same holds true for the use of definite articles used to introduce claim recitations. In addition, even if a specific number of an introduced claim recitation is explicitly recited, those skilled in the art will recognize that such recitation should typically be interpreted to mean at least the recited number (e.g., the bare recitation of 'two recitations,' without other modifiers, typically means at least two recitations, or two or more recitations). Furthermore, in those instances where a convention analogous to 'at least one of A, B, and C, etc.' is used, in general such a construction is intended in the sense one having skill in the art would understand the convention (e.g., 'a system having at least one of A, B, and C' would include but not be limited to systems that have A alone, B alone, C alone, A and B together, A and C together, B and C together, and/or A, B, and C together, etc.). In those instances where a convention analogous to 'at least one of A, B, or C, etc.' is used, in general such a construction is intended in the sense one having skill in the art would understand the convention (e.g., 'a system having at least one of A, B, or C' would include but not be limited to systems that have A alone, B alone, C alone, A and B together, A and C together, B and C together, and/or A, B, and C together, etc.).

It will be further understood by those within the art that virtually any disjunctive word and/or phrase presenting two or more alternative terms, whether in the description, claims, or drawings, should be understood to contemplate the possibilities of including one of the terms, either of the terms, or both terms. For example, the phrase 'A or B' will be understood to include the possibilities of 'A' or 'B' or 'A and B.'

All numbers expressing quantities of ingredients, reaction conditions, and so forth used in the specification are to be understood as being modified in all instances by the term 'about.' Accordingly, unless indicated to the contrary, the numerical parameters set forth herein are approximations that may vary depending upon the desired properties sought to be obtained. At the very least, and not as an attempt to limit the application of the doctrine of equivalents to the scope of any claims in any application claiming priority to the present application, each numerical parameter should be construed in light of the number of significant digits and ordinary rounding approaches.

Furthermore, although the foregoing has been described in some detail by way of illustrations and examples for purposes of clarity and understanding, it is apparent to those skilled in the art that certain changes and modifications may be practiced. Therefore, the description and examples should not be construed as limiting the scope of the invention to the specific embodiments and examples described herein, but rather to also cover all modification and alternatives coming with the true scope and spirit of the invention.

What is claimed is:

1. A pumping apparatus, comprising:
- a first inlet having an inlet valve;
- an outlet for product fluid, the outlet having a pressure maintaining valve;
- an accumulator in fluid communication with the pressure maintaining valve;
- an internal power fluid column, the internal power fluid column having a second inlet;
- a transfer piston reciprocatingly mounted about the power fluid column;
- a product fluid chamber positioned above the transfer piston;
- a transfer chamber positioned below the transfer piston;
- a sealable channel in the transfer piston fluidly connecting the product fluid chamber and the transfer chamber, the sealable channel having a transfer piston valve;
- at least one passageway fluidly connecting the power fluid column with a power fluid chamber; and
- a first valve stop configured to prevent closing of the inlet valve and a second valve stop configured to prevent closing of the transfer piston valve.

2. The pumping apparatus of claim 1, wherein the apparatus is configured to pressurize a fluid inside the power fluid column and the power fluid chamber.

3. The pumping apparatus of claim 2, wherein the transfer piston is configured such that the fluid inside the power fluid column acts against a first area comprising at least a portion of the transfer piston in a direction of transfer piston movement.

4. The pumping apparatus of claim 3, wherein the first area is greater than a second area comprising at least a portion of the transfer piston in the power fluid chamber, and wherein the transfer piston is configured such that the fluid in the power fluid chamber acts against the second area in a direction of movement of the transfer piston.

5. The pumping apparatus of claim 1, wherein at least one of the first valve stop and the second valve stop comprises an extended portion on the rod portion of the transfer piston or a v-shaped member configured to prevent the transfer piston valve from closing when the v-shaped member contacts an activator.

6. The pumping apparatus of claim 1, wherein the power fluid column is internal and the power fluid chamber, the transfer chamber and the product chamber are situated coaxially about the power fluid column.

7. The pumping apparatus of claim 1, configured for use in a deep well, wherein the system is configured to operate using a power fluid comprising water or a hydraulic fluid.

8. The pumping apparatus of claim 7, wherein at least one of the power fluid chamber and the power fluid column comprises stainless steel or titanium.

9. The pumping apparatus of claim 1, further comprising a fluid inlet screen configured to filter fluid entering the first inlet.

10. The pumping apparatus of claim 1, further comprising a coaxial disconnect.

11. The pumping apparatus of claim 1, further comprising a power fluid within the power fluid column and power fluid chamber.

12. A pumping apparatus, comprising:
- a first inlet having an inlet valve;
- an outlet for product fluid, the outlet having a pressure maintaining valve;
- an accumulator in fluid communication with the pressure maintaining valve;
- an internal power fluid column, the internal power fluid column having a second inlet;
- a transfer piston reciprocatingly mounted about the power fluid column;
- a product fluid chamber positioned above the transfer piston;
- a transfer chamber positioned below the transfer piston;
- a sealable channel in the transfer piston fluidly connecting the product fluid chamber and the transfer chamber, the sealable channel having a transfer piston valve;
- at least one passageway fluidly connecting the power fluid column with a power fluid chamber; and
- a housing, wherein the first inlet, the outlet, and the internal power fluid column are disposed within the housing, wherein the transfer piston slidably and sealingly extends between the power fluid column and an interior wall of the housing, and wherein the product fluid chamber and the transfer chamber are at least partially defined by the interior wall of the housing.

13. The system of claim 12, further comprising a coaxial disconnecting device, wherein the coaxial disconnecting device is separately sealed to the power fluid column and the product fluid chamber, whereby fluid communication between the power fluid column and the coaxial disconnecting device is provided, and whereby fluid communication between the product fluid chamber and the coaxial disconnecting device is provided.

14. A method for pumping a fluid, the method comprising:
- introducing a power fluid into the power fluid chamber of a pumping apparatus of claim 1 via the internal power fluid column, whereby the transfer piston is lifted so as to close the transfer piston valve, whereby fluid to be pumped is drawn into the transfer chamber via the inlet valve;
- decreasing a pressure of the power fluid in the power fluid column and the power fluid chamber, whereby the transfer piston falls, the transfer piston valve is opened, and the inlet valve is closed, whereby the fluid to be pumped passes from the transfer chamber via the transfer piston valve into the product fluid chamber; and increasing the pressure of the power fluid in the power fluid column and the power fluid chamber, whereby the transfer piston is raised, and the transfer piston valve closes, such that fluid to be pumped in the product chamber is forced out of the product chamber, such that the power fluid is pumped, wherein the accumulator provides force over that created by a head of the internal power fluid column.

15. The method of claim 14, wherein the pressure of the power fluid is increased and decreased through application of an oscillating pressure to the power fluid by moving a piston back and forth in a cylinder containing the power fluid, and wherein motion of the piston is induced by operation of at least one device selected from the group consisting of a motor, an engine with a crank mechanism, a pneumatic device, and a hydraulic device.

16. The method of claim 15, wherein providing oscillating pressure to the power fluid comprises providing a column of power fluid extending to an elevation higher than an elevation at which product fluid is recovered, wherein introducing a power fluid into a power fluid chamber of a pumping apparatus via an internal power fluid column comprises closing a valve to a power fluid source and opening a power fluid release valve at an elevation lower than an elevation at which the pumped fluid is recovered, whereby the power fluid is introduced into the power fluid chamber.

* * * * *